United States Patent [19]

Abellana et al.

[11] Patent Number: 4,523,523

[45] Date of Patent: Jun. 18, 1985

[54] MAILING MACHINE WITH ENVELOPE INSERTION SENSING APPARATUS

[75] Inventors: Jovito N. Abellana, Trumbull, Conn.; Easwaran C. N. Nambudiri, Hicksville, N.Y.

[73] Assignee: Pitney Bowes Inc., Stamford, Conn.

[21] Appl. No.: 447,917

[22] Filed: Dec. 8, 1982

[51] Int. Cl.[3] ..... B41F 13/24; B41F 33/08

[52] U.S. Cl. ..... 101/235; 101/93; 101/78; 101/287; 400/708; 250/223 R

[58] Field of Search ..... 101/91, 93, 78, 233–235, 101/287, 242, 246; 400/708; 250/222.2, 223 R

[56] References Cited

U.S. PATENT DOCUMENTS

| | | | |
|---|---|---|---|
| 1,484,375 | 2/1924 | Jarve | 101/233 |
| 2,639,665 | 5/1953 | Lambert | 101/235 |
| 3,072,052 | 1/1963 | Bach | 101/235 |
| 3,778,618 | 11/1973 | Laskowski | 250/223 R |
| 4,019,050 | 4/1977 | Axelrod | 250/223 R |
| 4,023,489 | 5/1977 | Beery | 101/245 |
| 4,114,750 | 9/1978 | Baeck | 400/618 |
| 4,220,085 | 9/1980 | Schottle et al. | 101/287 |
| 4,421,023 | 12/1983 | Kittredge | 101/91 |
| 4,442,769 | 4/1984 | Kallin | 101/242 |

FOREIGN PATENT DOCUMENTS

| | | | |
|---|---|---|---|
| 2026392 | 2/1980 | United Kingdom | 400/708 |
| 2093244 | 8/1982 | United Kingdom | 400/707.5 |

OTHER PUBLICATIONS

Estabrooks et al., "Transparency Sensor", IBM Technical Disclosure Bulletin, vol. 23, No. 4, p. 1355, 9/80.

Champion et al., "Dynamic Voltage . . . Detector", IBM Technical Disclosure Bulletin, vol. 23, No. 7B, pp. 3147–3148, 12/80.

*Primary Examiner*—William Pieprz

*Attorney, Agent, or Firm*—Donald P. Walker; William D. Soltow, Jr.; Albert W. Scribner

[57] ABSTRACT

An electronically controlled mailing machine is provided which includes a housing having a slot into which an envelope may be inserted, a platen movably connected to said housing, a print head overhanging said platen, and structure for moving the platen into engagement with an envelope inserted into the slot for urging the envelope into imprinting engagement with the print head. In addition there is provided a computer, for controlling the platen moving means, and switching apparatus including a member movably connected to the housing and extending into said slot for movement by an envelope inserted into the slot. The switching apparatus includes an optical sensing device mounted within the housing and electrically connected to the computer. The sensing device is responsive to movement of the member for signalling the computer. And the computer is responsive to the signalling for causing the platen moving structure to move the platen. It is a feature of the invention that the computer include a microprocessor, a strobe and a program for controlling the microprocessor. The strobe is electrically connected to the microprocessor and to the optical sensing means to permit the microprocessor, under the control of the program, to intermittently energize the optical sensing device, whereby the life of the optical sensing device is extended.

6 Claims, 31 Drawing Figures

Fig. 1.
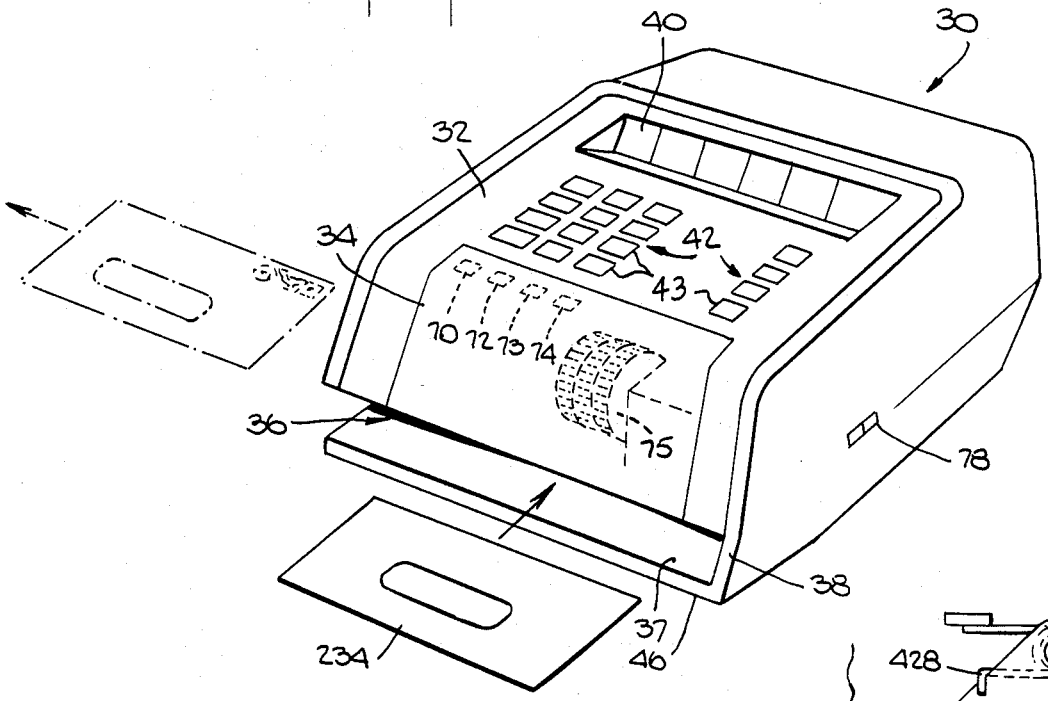
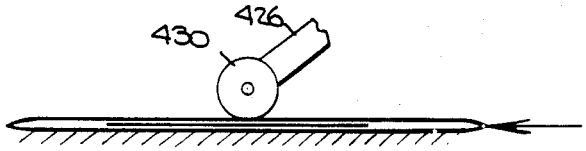
Fig. 24.
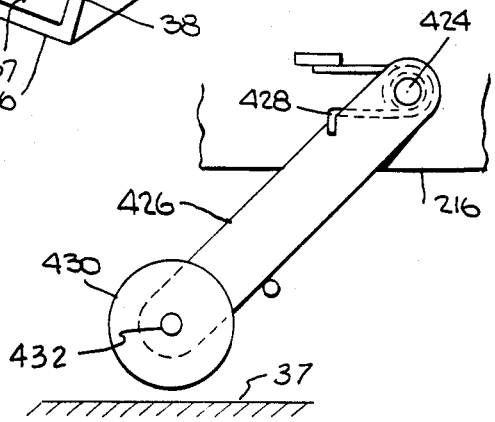
Fig. 23.
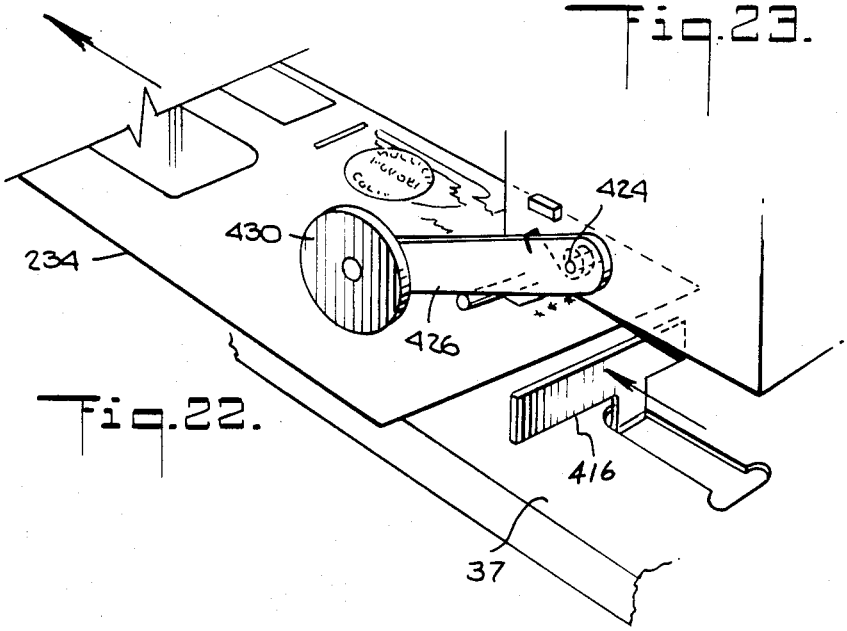
Fig. 22.

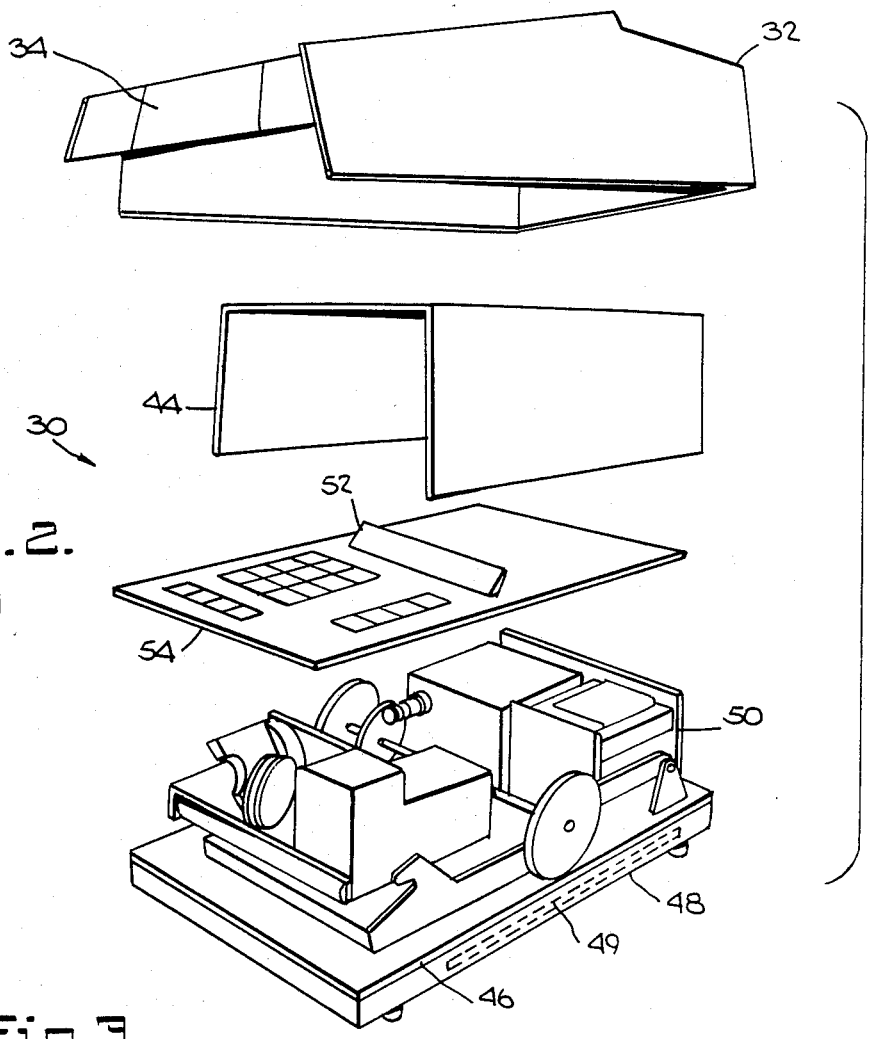
Fig. 2.
Fig. 3.
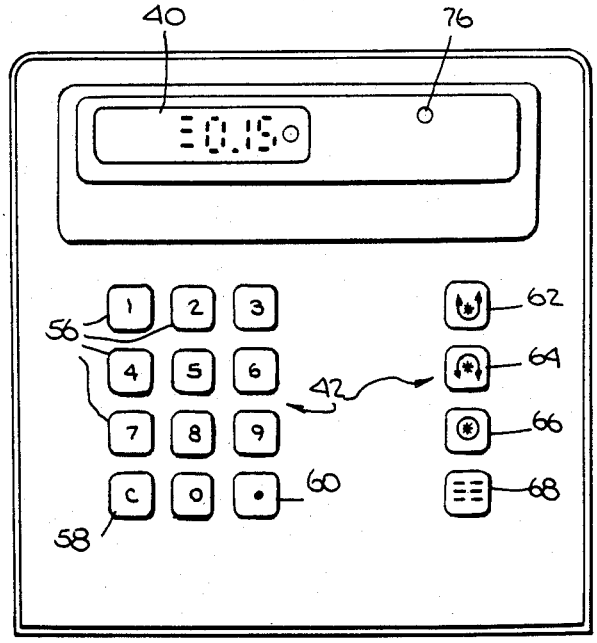

46
190
81
194
198
156
212
210
208
7
154
102
106
93
248
250
98
96
94
90
88
82
92
84
86
104
100
312
338
318
314
298
8
320
336
306
225
340
304
332
334
330
328
326
324
322
200
206
204
188
192
80
162
358
196
108
110
297
305
300
348
344
296
122
111
112
11

362
306
304
310
292
248
360
114
346
374
184
354
356
350
352
348
122
390
358
430
418
37
400

Fig. 13.
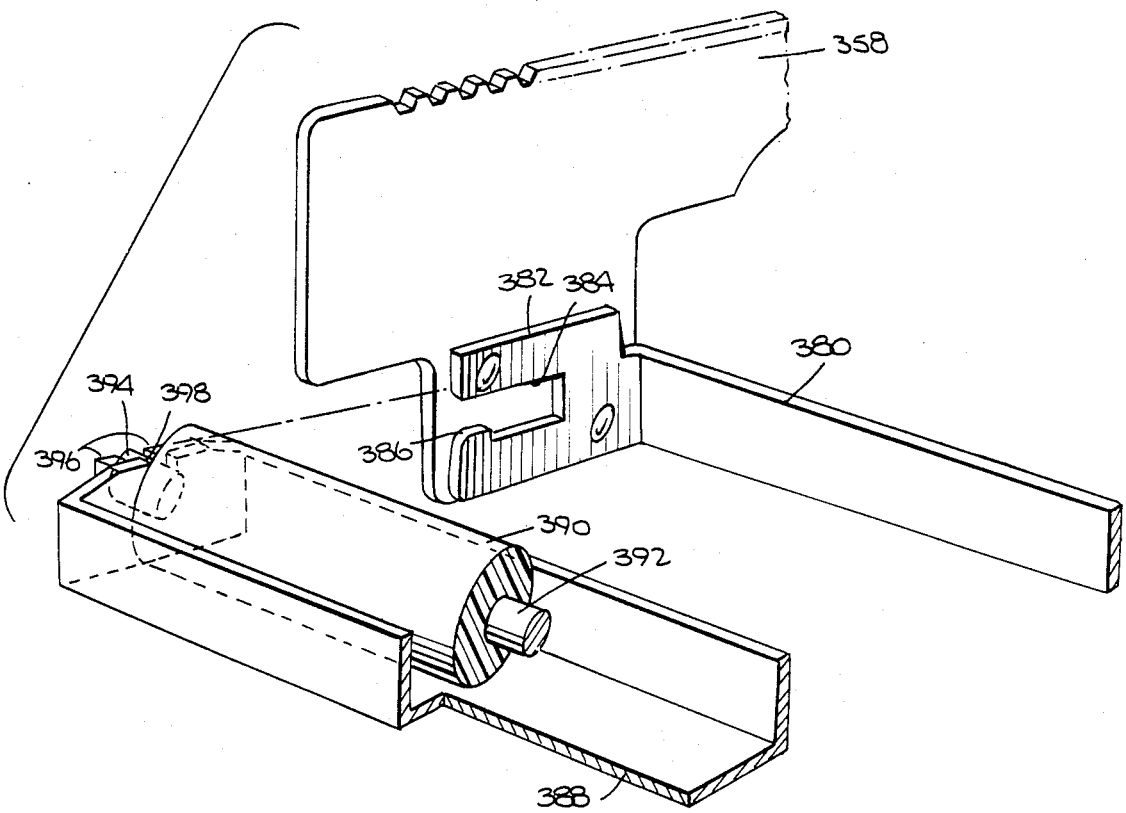
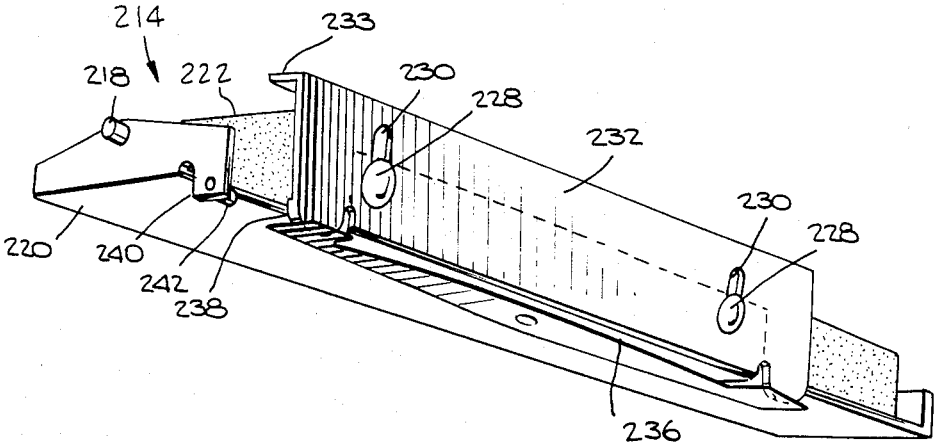
Fig. 14.

MAILING MACHINE WITH ENVELOPE INSERTION SENSING APPARATUS

BACKGROUND OF THE INVENTION

Since the first postage meter was invented by Mr. Arthur H. Pitney at the turn of the century, the postage meter has had a rather steady evolution until the late 1970's. During this long period, the postage meter was basically a mechanical device involving a printing means with ascending and descending registers. The meter could be charged with a fixed amount of postage and there could be accounting of the amount of postage that had been used as well as a record of the amount of postage remaining. What is commonly referred to as a postage meter is actually two separate units, the postage meter and drive means therefor which is referred to as the base. Although the base is also referred to as the mailing machine, as used in this specification the term mailing machine, includes the postage meter and drive means therefor. The postage meter is that portion of the device that has printing dies as well as the ascending and descending registers. The base is that portion of the device that supplies drive to the postage meter portion. The reason for having made this device in two separable units was because the postage meter portion had to be brought to a post office periodically in order to have more postage charged to such meter. It obviously would be less of a task to carry the postage meter portion of the machine without having to bring the drive portion as well. For this reason, the heavier parts of the machine were located in the base.

With the advent of the dynamic growth of the field of electronics, the postage meter has experienced radical changes. The first change to take place was that of the ability to reset the meter postage remotely. This was accomplished through the use of telephone lines providing connection between the postage meters and a central station wherein an amount of postage would be charged to the account of a user and his postage meter would be reset accordingly by such central station through use of a code. The second change that has taken place is the advent of the electronic postage meter. Whereas previous postage meters had relied almost exclusively on mechanical systems, the recently developed electronic postage meters perform tasks such as setting, accounting and printing through electromechanical and electronic means. In order to accomplish such tasks, electronic postage meters have utilized central processing units, memories, counters and the like for the purpose of performing tasks that had previously been performed mechanically. The first electronic postage meters paralleled the prior mechanical meters in that they were designed to fit upon a base. In fact, the first electronic postage meters were designed so that they could be placed upon bases that had been designed for mechanical meters and which were readily avialable. With the companion advancement of the remote meter resetting systems, it is no longer necessary that the mailing machine be separated into two distinct units since the necessity of taking the meter to the post office for recharging has been eliminated. As a consequence, it would be desirable to have a self-contained electronic mailing machine that includes the metering function as well as all drive mechanisms that are controlled by electronic means. Obviously, such a device would be lighter, more compact, and more economical to produce.

SUMMARY OF THE INVENTION

An electronically controlled mailing machine is provided which includes a housing having a slot into which an envelope may be inserted, a platen movably connected to the housing, a print head overhanging the platen, means for moving the platen into engagement with an envelope inserted into said slot for urging the envelope into imprinting engagement with said print head, computer means for controlling the platen moving means, switch means including a member movably connected to the housing and extending into the slot for movement by an envelope inserted thereinto, said switch means including optical sensing means mounted within said housing and electrically connected to the computer means, said sensing means responsive to movement of said member by an envelope inserted into said slot for signalling said computer means, and said computer means responsive to said signalling for causing said platen moving means to move said platen. Preferably, the switch means includes a spring connected to the housing and to the member for urging the member into a first position wherein the member extends into said slot for engagement by an envelope, the member having a second position wherein the member is sensed by the optical sensing means, and the member is adapted for movement from the first position to the second position against the urging of the spring by an envelope inserted into the slot. Further, it is a feature of the invention that the computer means include a microprocessor and include a program stored in the computer means for controlling the microprocessor, that the computer means include strobe means electrically connected to the microprocessor and to the optical sensing means, and that the microprocessor, under the control of the program, operate the strobe means to intermittently energize the optical sensing means thereby extending the life of the LED of the optical sensing means.

BRIEF DESCRIPTION OF THE DRAWING

FIG. 1 shows a front perspective view of a mailing machine that incorporates the features of the instant invention;

FIG. 2 is an exploded view of the mailing machine shown in FIG. 1;

FIG. 3 is a plan view of the keyboard of the mailing machine shown in FIG. 1;

FIG. 13 is a perspective view of a portion of the ink roller drive;

FIG. 14 is a perspective view of a stripper that is included in the mailing machine print station;

FIG. 22 is a perspective view of the envelope hold-down device used in the mailing machine;

FIG. 23 is a side elevational view of the hold-down device shown in FIG. 18;

FIG. 24 shows the hold-down device of FIG. 20 cooperating with an envelope;

Program Appendix

Figure 4:
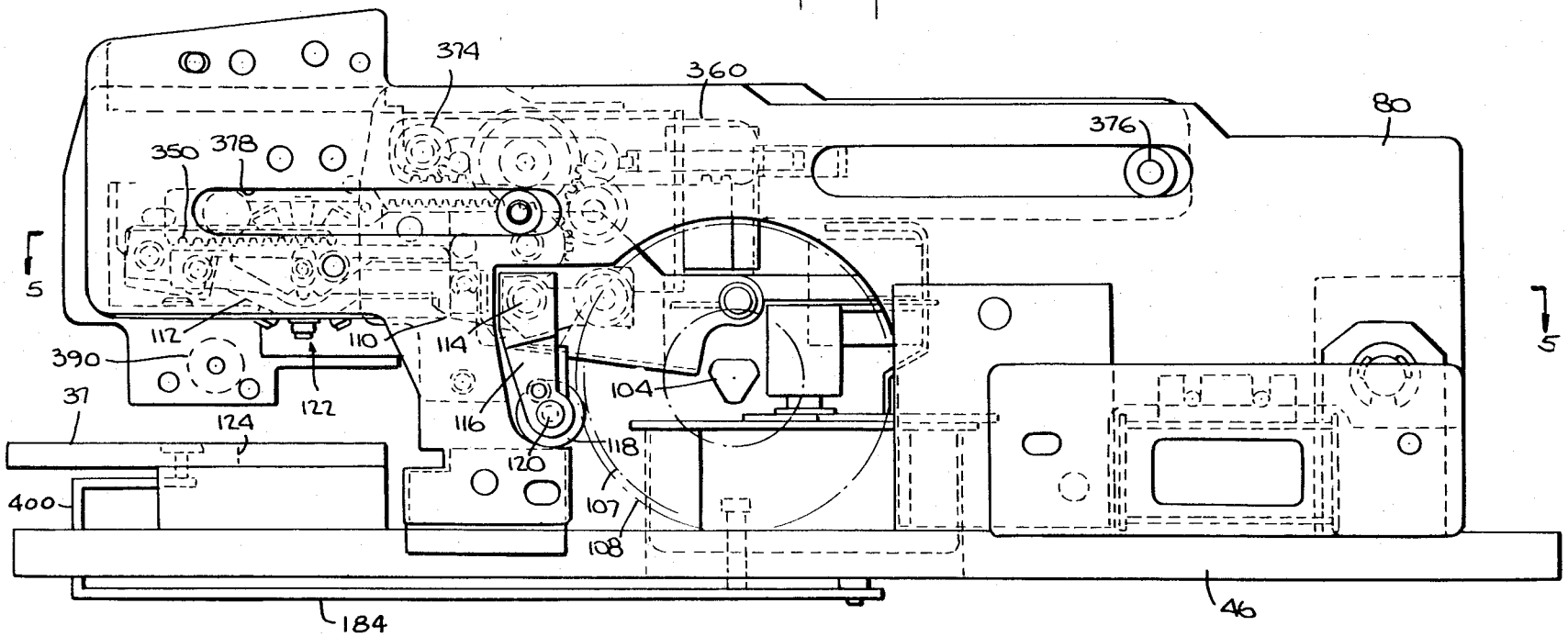
FIG. 4 is a longitudinal cross-sectional view of the mailing machine shown in FIG. 1.

A program listing for an electronic postage meter such as disclosed in this patent application is set forth as part of the specification at the end of the detailed description and before the claims.

DETAILED DESCRIPTION OF THE PREFERRED EMBODIMENT

Referring now to the drawing, and more particularly to FIGS. 1–4, there is illustrated therein an electronic mailing machine generally shown at 30. The mailing machine 30 includes a cover 32 having a pivotal lid 34, a slot 36 therein with a closed end 38 at the right hand side thereof as seen in FIG. 1. A portion of the slot 36 forms a deck 37. At the top of the cover 32 is a display panel 40 and control panel 42 having openings 43 therein. The cover 32 and an electromagnetic insulating shield 44 are attached to a base 46, the cover and base together forming a housing. Depending from the base 46 is a pan 48 that contains a logic board 49. A power supply board 50, a display board 52 and a keyboard 54 are supported within the cover 32, the display board 52 being aligned with an opening in the display panel 40 and the keyboard 54 being aligned with the control panel 42. The keyboard 54 serves as an information inputting and information retrieval device and has a number of keys which extend into the openings 43 of the control panel 42 and become part of the control panel. Numeric setting keys 56, a clear key 58 and a decimal key 60 are located on the left hand side of the control panel 42. On the right hand side of the control panel 42 are a postage used key 62, a postage unused key 64, a postage sum or piece count key 66 and a select postage key 68. In the front of the mailing machine 30 and located under the lid 34 are selection keys for remote meter resetting operation including an authorization key 70, an enter amount key 72, and an enter combination key 73. Also located under the lid 34 is a date key 74 and a plurality of thumb wheels 75 which are connected to the date printing mechanism that will be described hereinafter. Preferably the keys on the control panel 42 are membrane switches. Shown on the display panel 40 is a check date indicator 76 that is electrically connected to the date key 74. An on/off power switch 78 is located on the side of he cover 32 for the control of power to be supplied to the electrical components of the mailing machine 30.

Referring now to FIGS. 4–9, the mailing machine 30 includes a pair of opposite side frames 80 and 81 supported by the base 46. A drive motor 82 is located between the side frames 80, 81 and mounted on the base 46. The output shaft 84 of the drive motor 82 has a gear 86 secured thereto. A shaft 88 is supported within ball bearings 90 (only one being shown) supported by a opposed walls 92 and 93. A gear 94 is mounted on the shaft 88 and meshes with the gear 86 on the drive shaft 84 to be driven thereby. A worm screw 96 is formed on the shaft 88 and meshes with a disc gear 98 of a single revolution spring clutch 100. A wall 102 extends between the walls 92, 93 and receives a shaft 104 therein, the other end of the shaft being supported by an opposite wall 103. Print cams 106, 108 are secured to opposite ends of the shaft 104 and another print cam 107 is secured to the shaft intermediate the two print cams. A die shelf extension bracket 110, a print bracket 111 and a rectifier bracket 112 receive a shaft 114, the print bracket being secured to the shaft 114 by set screws 115 for rotation therewith. A lever 116 is attached to the shaft 114 and has a cam follower 118 rotatably connected thereto by a pin 120. The cam follower 118 engages the cam 107 to be pivoted thereby and causes rotation of the shaft 114 which carries the rectifier bracket 112 therewith. A print head shown generally at 122 is supported within the rectifier bracket 112 and includes the print bracket 111 and the deck 37 has an opening 124 that is spaced relative to the print head.

Figure 7:
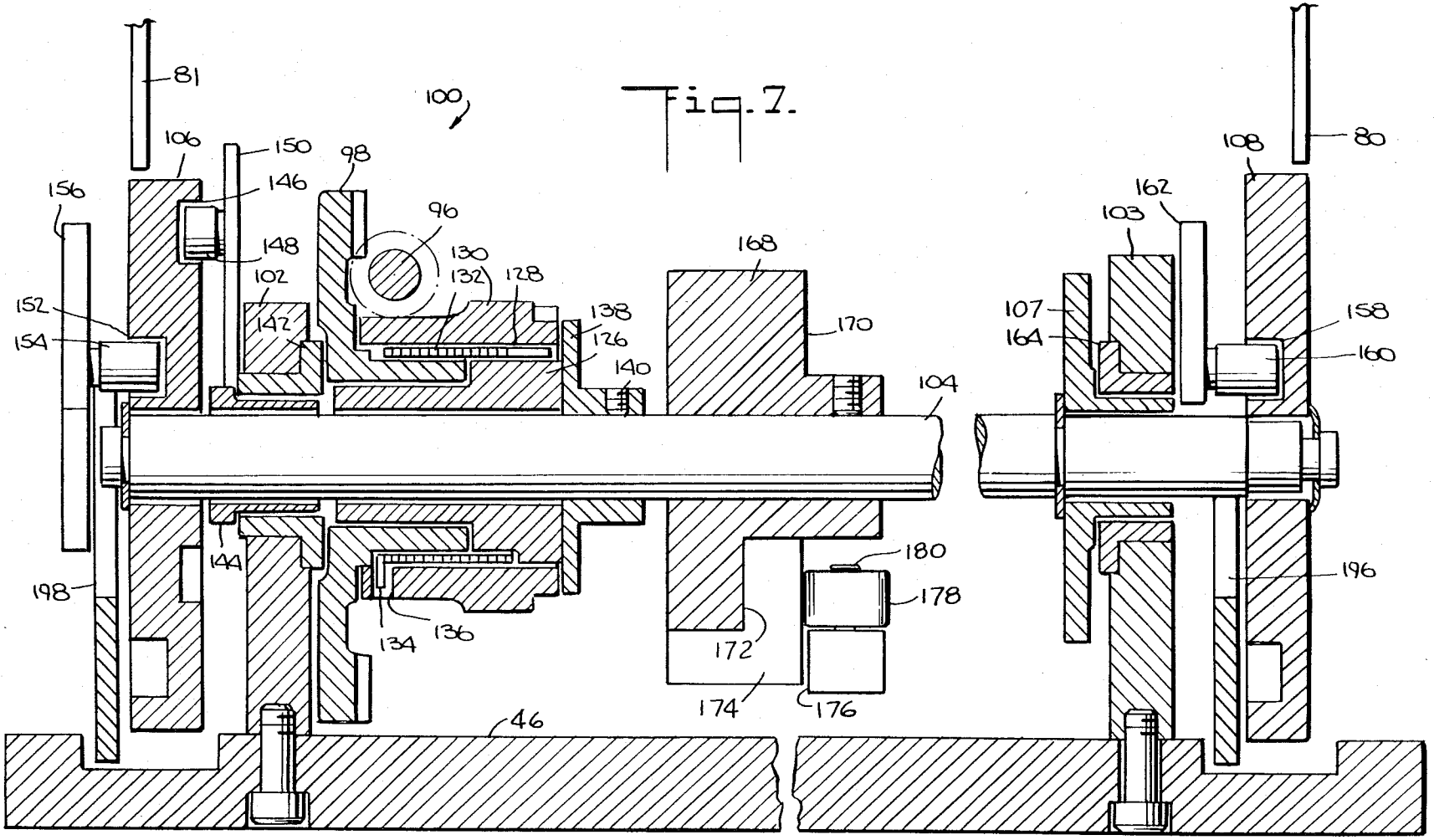
FIG. 7 is a cross-sectional view of the single revolution clutch utilized in the mailing machine shown in FIG. 1 and taken along the lines 7—7 of FIG. 5.

Referring to FIG. 7, the spring clutch shown generally at 100 includes the disc gear 98 and the shaft 104. A slidable member 126 is splined to the shaft 104 for rotation therewith and has an opening 128 therein. A confiner 130 is disposed about the slidable member 126 and a coil spring 132 is located between the slidable member and the confiner. One end of the spring 132 is received within the opening 128 of the slidable member 126 and the other end of the spring has a tab 134 that is received within an opening 136 of the confiner 130. A collar 138 is secured to the shaft 104 by a set screw 140 to limit the movement of the slidable member 126 and the confiner 130.

At one end of the slidable member 126 opposite to the collar 138 is a bushing 142 that is received within the wall 102 for the purpose of supporting the shaft 104. A bearing 144 is located within the bushing 142 and receives the shaft 104 to allow the shaft to rotate within the wall 102. The cam 106 is secured to the portion of the shaft 104 that extends beyond the bearing member 144. The cam 106 has a cam track 146 therein. The cam track 146 receives a cam follower 148 that is rotatably connected to an inking arm 150. The cam 106 has a second cam track 152 that receives a cam follower 154 that is rotatably secured to a printing arm 156. The cam 108 is secured to the opposite end of the shaft 104 and has a cam track 158 that receives a cam follower 160 that is rotatably attached to another printing arm 162.

A bearing 164 is located within the support wall 103 and receives the cam 107 therein, the cam being secured to the shaft 104 for rotation therewith. Also rotatably secured to the shaft 104 is another cam 168 having a pair of cam surfaces 170 and 172 with a step 174 formed therein (also see FIGS. 19 and 20). The radius of the step 174 is greater than the radius of the cam surfaces 170, 172. A substantially square bearing member 176 is engageable with the step 174 and a rotatable cam follower 178 is engageable with the cam surfaces 170, 172. The cam follower 178 is mounted by a pin 180 attached to the bearing member 176 which is formed as one end of an arm 182 that is attached at its other end to a lever 184 by a stub shaft 186 for movement therewith. The stub shaft 186 is rotatably received within an opening (not shown) of the base 46 and is connected to the lever 184 which is located below the base.

A pair of stanchions 188 and 190 (FIGS. 5 and 9) are laterally spaced opposite one another and are supported by the base 46. Received within the stanchions 188, 190 are a pair of stub shafts 192 and 194, respectively. A pair of platen arms 196 and 198 are supported by the stub shafts 192, 194 respectively, so as to rotate relative to the stanchions 188, 190. A grooved pin 200 is supported by the printing arm 162 and a companion pin 202 is supported by the platen arm 196. A tension spring 204 is mounted upon a hub 206 and engages the pins 200 and 202 so that the arms 162 and 196 are resiliently connected to one another. The hub 206 is riveted to the printing arm 162. Corresponding pins 208 (only one shown), spring 210 and hub 212 are associated with the printing arm 156 and platen arm 198.

Figure 9:
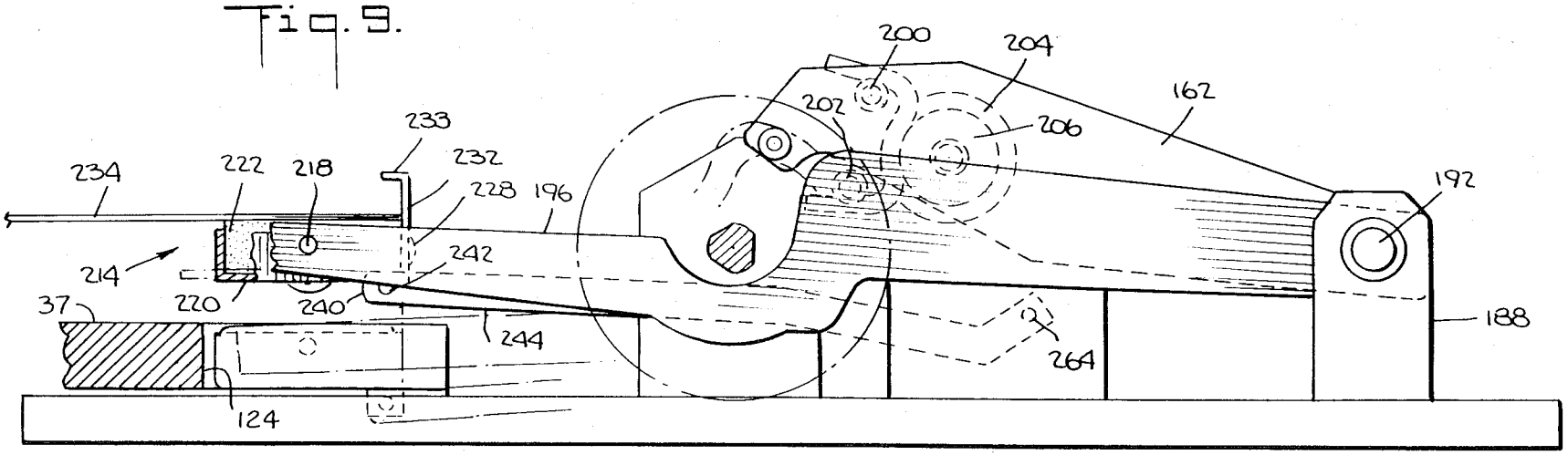
FIG. 9 is a detailed view of a portion of the print drive mechanism of the mailing machine shown in FIG. 1.
Figure 11:
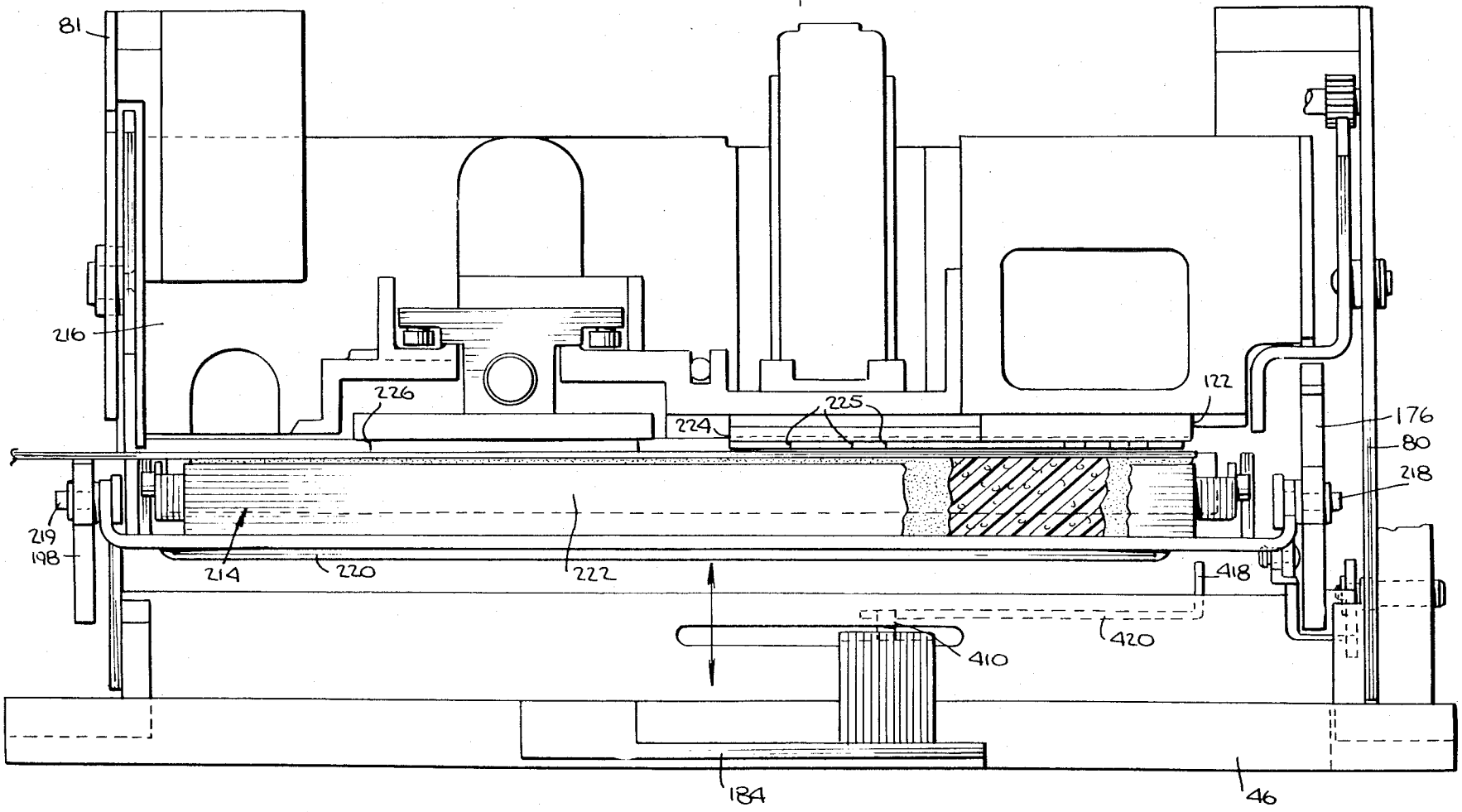
FIG. 11 is a cross-sectional view of the printing platen assembly taken along the lines 11—11 of FIG. 5.

Referring now to FIGS. 9, 11 and 14, a platen assembly is shown generally at 214 spaced relative to a casting 216 that is attached to the side frames 80, 81. The platen assembly 214 includes a pair of opposed pins 218 and 219 that are received within the platen arms 196, 198, respectively. A platen bracket 220 is secured to the pins 218, 219 and extends therebetween at the location of the opening 124 in the deck 37, the platen bracket receiving a foam rubber platen 222. The platen 222 is vulcanized to the platen bracket 220 to be secured thereto and extends parallel to the print head 122, a date printer 224 and a slogan die 226 all of which are housed within the casting 216. The date printer 224 has plurality of wheels 225 (only partially shown in FIG. 11) that are rotatably engaged by the thumb wheels 75 (FIG. 1) to be set thereby. A pair of stubs 228 are attached to one side of the platen bracket 220 and are received within elongated openings 230 of a stripper bracket 232. The stripper bracket 232 has an upper lip 233 that projects from the stripper bracket intermediate the platen 222 and the print head 122. As seen in FIG. 9, an envelope 234 can be placed upon the deck 37 to be located intermediate the lip 233 of the stripper bracket 232 and the platen 222. A leaf spring 236 is riveted to the bottom of the platen bracket 220 and engages legs 238 that depend from the stripper bracket 232 to thereby bias the stripper bracket away from the platen 222. It will be noted that the stripper bracket 232 is slidable relative to the platen bracket 220 and is engageable with the casting 216. Depending from the platen bracket 220 is a tab 240 that receives a pin 242 to which a leveler link 244 is rotatably attached. The other end of the leveler link 244 is rotatably secured to the base 46 by a pin 246.

Figure 8:
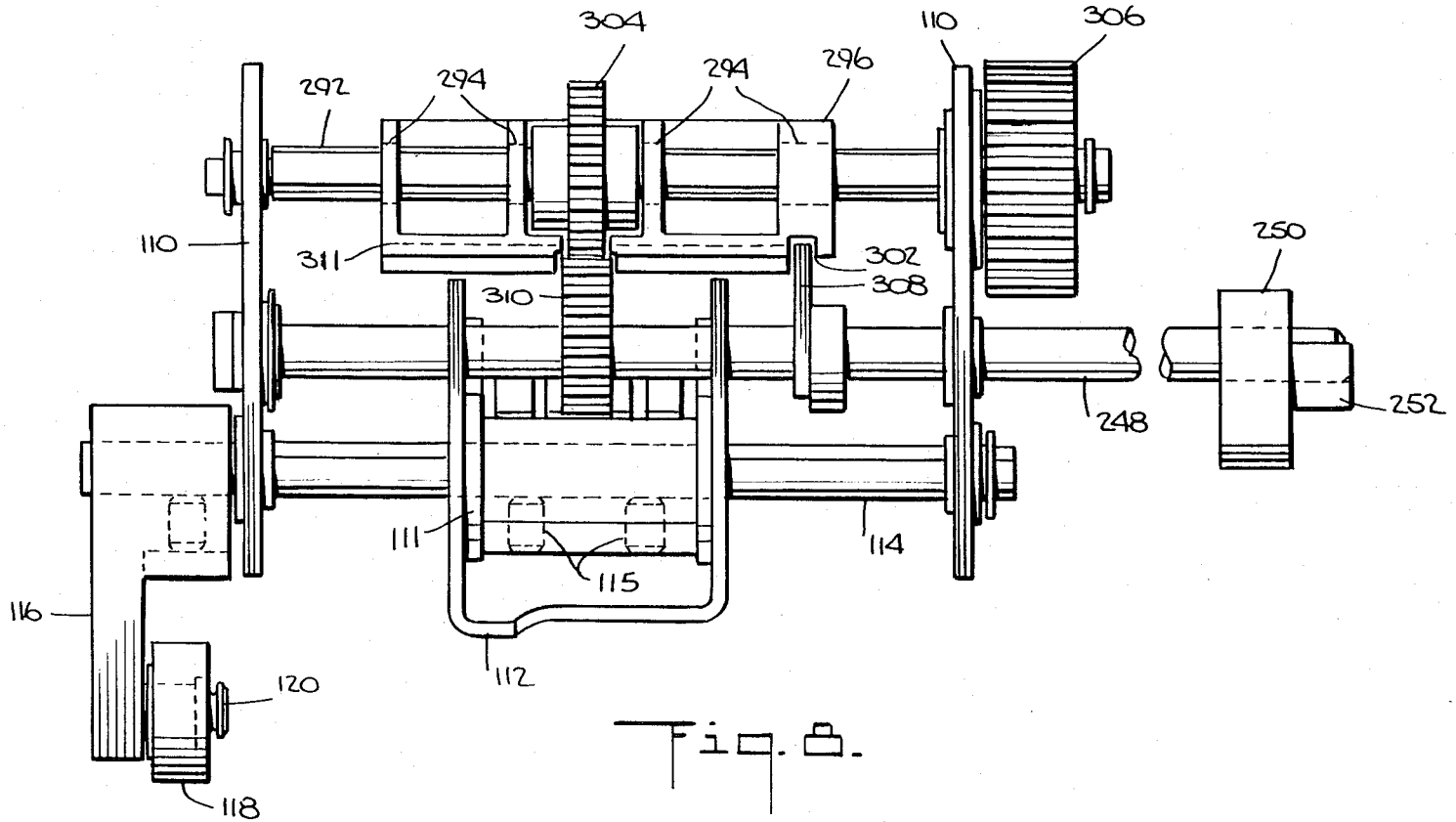
FIG. 8 is a detailed view of the locking mechanism for the print head of the mailing machine taken along the lines 8—8 of FIG. 5.

As seen in FIG. 8, the die shelf extension bracket 110 receives a trip shaft 248 that has a trip lever 250 secured thereto for rotation therewith. Referring more specifically to FIGS. 15–18, the trip lever 250 has a bar 252 attached thereto and the bar engages the inside surface of a pivot member 256. The pivot member 256 has a post 258 thereon and is rotatably supported by a shaft 260. At one end of the pivot member 256 is a bearing surface 262 which is positioned to be engageable with an abutment surface 264 of the confiner 130. At the other end of the pivot member 256 is another bearing surface 266. The pivot member 256 also has a shoulder 268 thereon which is adapted to mate with one end 270 of another pivot member 272, the pivot member 272 having a post 274 thereon and being rotatable about a shaft 276. A spring 278 is secured to the posts 258, 274 so as to urge the surface 268 of the pivot member 256 and the pivot member 256 toward one another through rotation of the pivot member 256 in the clockwise direction and the pivot member 272 in a counterclockwise direction as seen in FIGS. 15–18. The pivot member 272 has a bearing surface 280 on the other end thereof which is engageable with a shoulder 282 of the confiner 130. The confiner 130 has a projecting portion 284 forming another shoulder 286 that is engageable by a depending member 288 of the pivot member 272. Attached to a support bracket 290 that is mounted on the base 46 is a switch 291 having an actuator 293 that is engaged by a bearing surface 279 of the pivot member 272.

Figure 5:
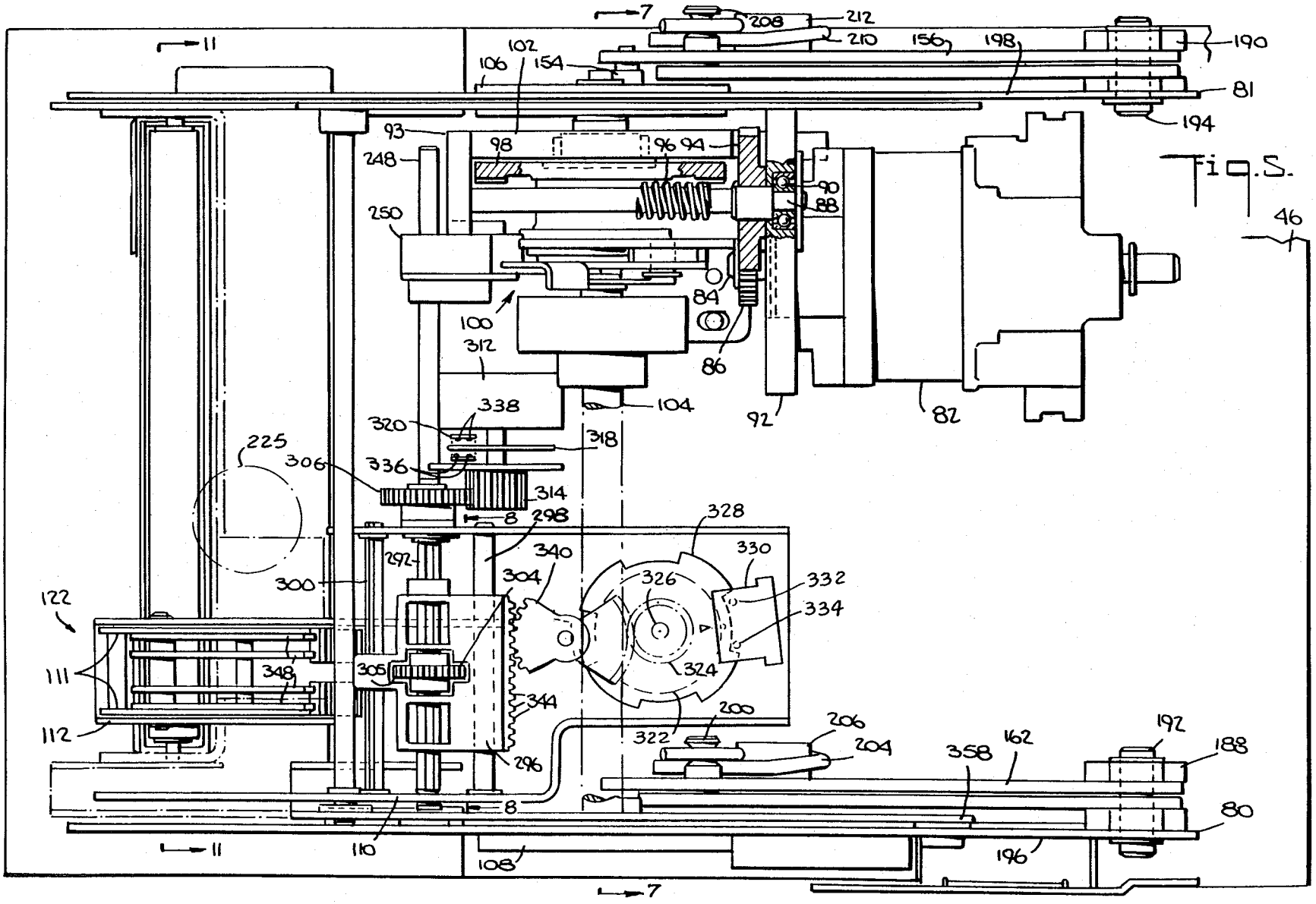
FIG. 5 is a plan view of mailing machine taken along the lines 5—5 of FIG. 4.
Figure 6:
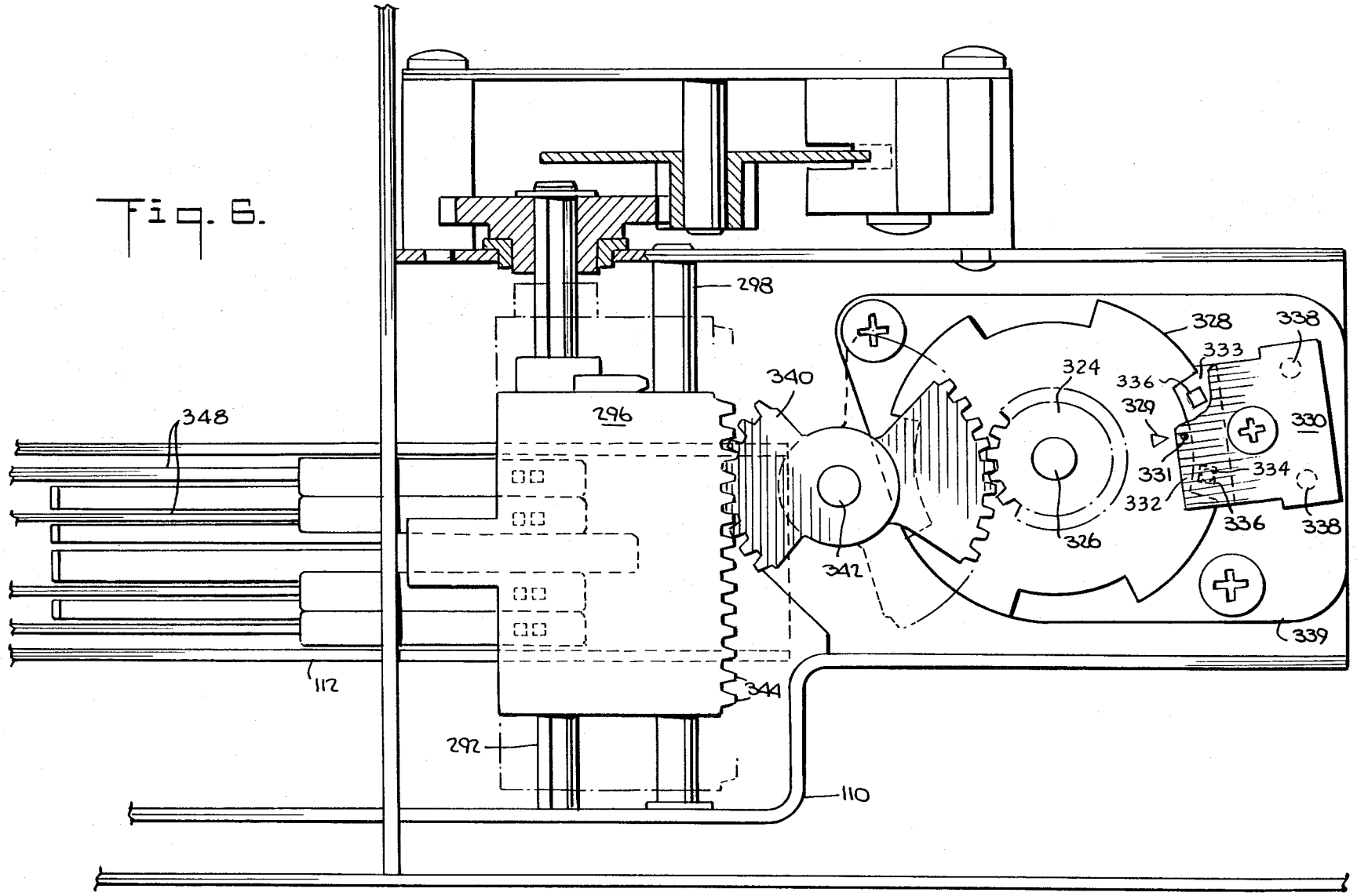
FIG. 6 is an enlarged view of a portion of the mailing machine shown in FIG. 5.

Referring now to FIGS. 5, 6 and 8, the die shelf extension bracket 110 rotatably supports a tri-lobe shaft 292 which is received within opposed openings 294 of a carriage 296 so that it may rotate therein without interference. The carriage 296 is slideably retained and guided by a pair of shafts 298 and 300 and has a slot 302 therein. A selector gear 304 is mounted on the tri-lobe shaft 292 and disposed within an opening 305 of the carriage 296. A gear 306 is secured to the trilobe shaft 292 outside of the die shelf extension bracket 110. The trip shaft 248 has a locking lever 308 that is receivable within the slot 302 of the carriage 296 and a gear segment 310 is mounted on the trip shaft 248 to be rotated thereby. The trip shaft 248 passes through clearance openings in the rectifier bracket 112. The carriage 296 has tooth forms 311 at the bottom thereof as seen in FIG. 8. These tooth forms 311 extend parallel to the shaft 292.

Referring now to FIGS. 5 and 6, mounted on the base 46 is a first electrical setting means in the form of a stepper motor 312 which has a gear 314 mounted on the output shaft 316 thereof. The gear 314 is in mesh with the gear 306 that is mounted on the tri-lobed shaft 292. Also mounted on the output shaft 316 of the stepper motor 312 is an optical encoder disk 318 that is received within a sensor 320 whereby the instantaneous position of the stepper motor shaft 316 can be determined.

A second electrical setting means in the form of a stepper motor 322 is mounted on the base 46 and has a gear 324 mounted on the output shaft 326 thereof. An optical encoder disk 328 is also mounted on the output shaft 326 for determining the angular position of the gear 324 and an alignment mark 329 thereon. Such determination is accomplished with an optical sensor 330 that has a pair of opposed plates or walls 332 and 333 that defined a space therebetween one wall 332 having an alignment mark 331 thereon. The optical encoder disk 328 is partially received within such opening. One wall 332 has a pair of light sources 334, (for example, light emitting diodes) and the other wall 333 has a pair of light responsive devices, such as photocells 336, aligned with the light sources. The housing of the optical sensor 330 has a pair of guide pins 338 extending therefrom that are received within measured openings of a mounting bracket 339.

A gear 340 is mounted on a shaft 342 and meshingly engages the stepper motor gear 324. The carriage 296 has teeth 344 thereon that are engaged by the gear 340 whereby the carriage may be laterally moved along the shafts 298 and 300 upon rotation of the gear 340. It will be appreciated that the optical encoder disk 318 and the sensor 320 are of the same construction as the optical encoder disk 328 and the sensor 330, respectively.

Figure 10:
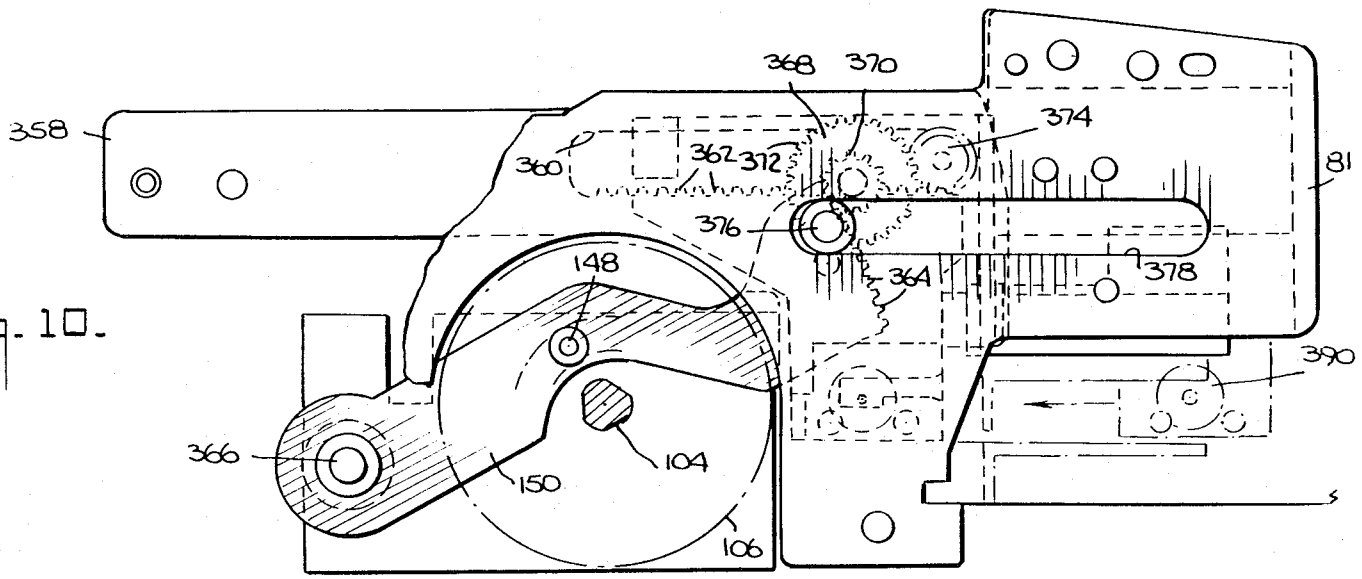
FIG. 10 is a cross-sectional view of a portion of the inking drive mechanism of the mailing machine shown in FIG. 1.
Figure 12:
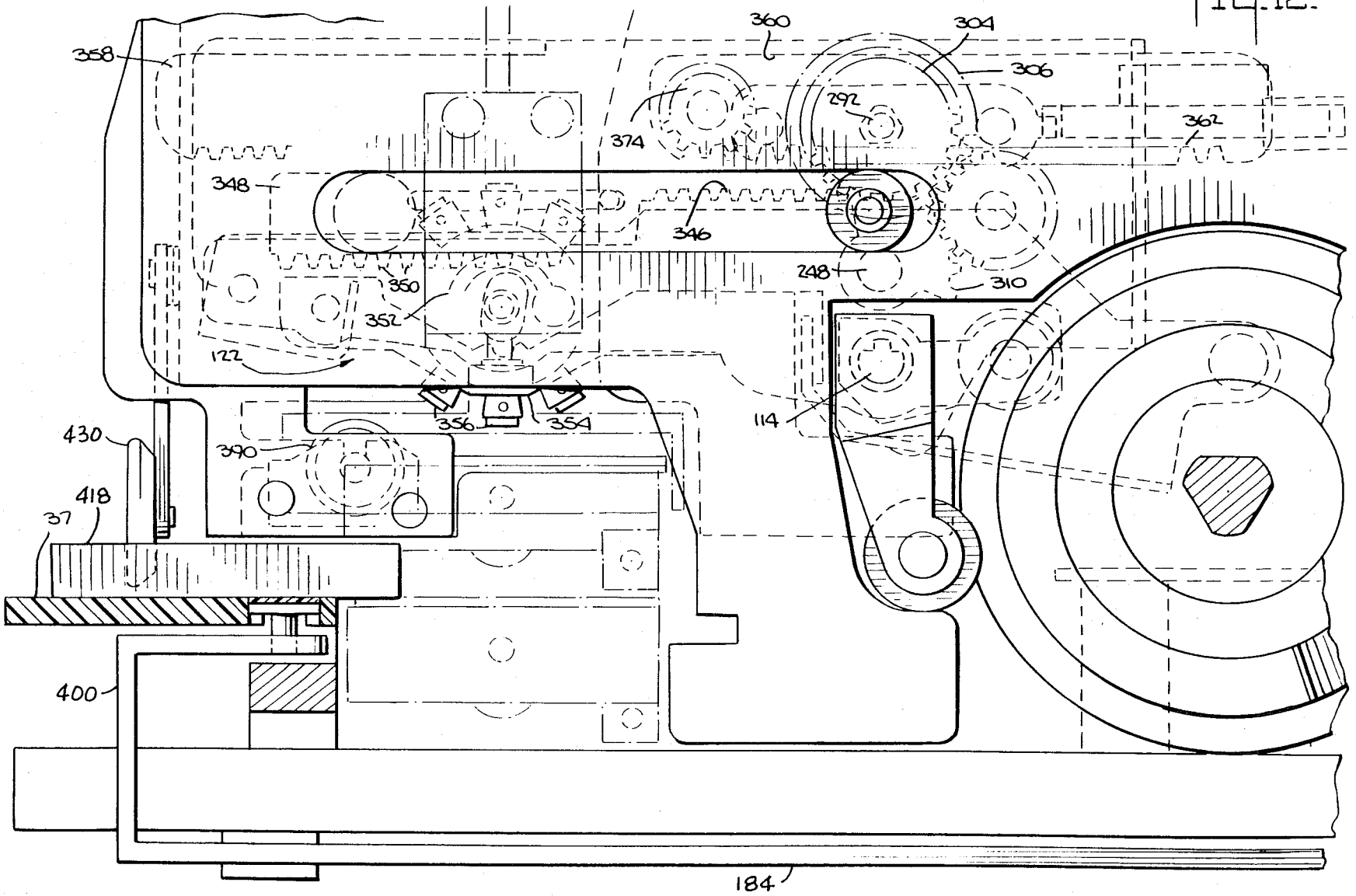
FIG. 12 is a detailed cross sectional view of the printing station of the mailing machine.

Referring now to FIGS. 8, 10 and 12, the shaft 292 is supported by the die shelf extension bracket 110 and has mounted thereon the gears 304 and 306. The gear 304 is engageable with the upper teeth 346 of four racks 348, which racks have lower teeth 350 at the other longitudinal end thereof. The lower teeth 350 of each rack 348 engage gears 352 that are integral with print wheels 354, there being a corresponding print wheel for each rack. The print wheels 354 have fonts 356 distributed about their perimeters, each font of each wheel being of a different number from 0 to 9.

An inker rack 358 has an elongated opening 360 therein the teeth 362 projecting into the opening. The inking arm 150 has teeth 364 at one end thereof and is mounted upon a shaft 366 at its other end for pivoting thereabout. With this structure, as the cam 106 is rotated by the shaft 104, the cam follower 148 on the inking arm 150 will cause the inking arm to pivot about the shaft 366 thereby arcately driving the teeth 364 with a reciprocating motion. A compounded gear 368 has a small diameter gear portion 370 and a large diameter gear portion 372, the small diameter portion 370 being engaged by the teeth 364 of the inking arm 150. The large diameter gear portion 372 engages a gear 374, which gear is in engagement with the teeth 362 of the inker rack 358. With such construction, as the inking arm 150 is pivoted the compound gear 368 will be rotated to rotate the gear 374 and the inker rack 358 will thereby be driven longitudinally in a reciprocal manner. The inker rack 358 also has a pin 376 thereon which is received within an opening 378 of the side frame 81 thereby providing support to the inker rack.

Referring now to FIGS. 13 and 14, a tie bar 380 (only one end thereof being shown) is integrally secured to the inker rack 358 and has end brackets 382 (only one shown) on opposite ends thereof. The end brackets 382 have slots 384 with a ridge 386 located at the open end of the slots. A roller housing 388 rotatably receives an ink roller 390 which has a shaft 392 extending therethrough. The ends 394 of the shaft 392 are received within lugs 396 located at opposite sides of the roller housing 388 and which are adapted to be received within the slots 384 to support the housing 388 within the tie bar 380. A slit 398 is located within each lug 396 to allow the shaft ends 394 to be received therein thereby rotatably supporting the ink roller 390 within the roller housing 388. It will be appreciated that any ink roller support structure may be used and the one described does not form part of the instant invention. It is included only for the purpose of illustrating the type of structure that may be used.

Referring now to FIGS. 11 and 19–24, a generally "L" shaped member 400 is integral with one end of the lever 184 and has an opening 402 that receives one end of an extension spring 404. The member 400 also has a leg 405 that extends parallel to the lever 184. The other end of the spring 404 is received within an opening 406 of a frame member 408. A post 410 is integral with a slid member 412 and received within an elongated opening 414 of the leg 405. The spring 404 exerts a force upon the lever 184 causing the lever to force the cam follower 178 against the cam surface 172 or the bearing member 176 against the cam surface 170 depending upon the angular posture of the cam 168. The slid member 412 has a T-shaped pusher 416 at its end opposite the post 410, which pusher has a wall portion 418 and a connector 420 that is received within a channel 422 of the base 46. A stub shaft 424 is secured to an arm 426 and is rotatably supported by the casting 216. A spring 428 is wrapped around the stub shaft 424 and has one end attached to the casting 216 and the other end engages the arm 426 to bias the arm in a downward direction so that a roller 430 which is rotatably attached to the arm by a pin 432 is urged downwardly onto the deck 37.

Figure 19:
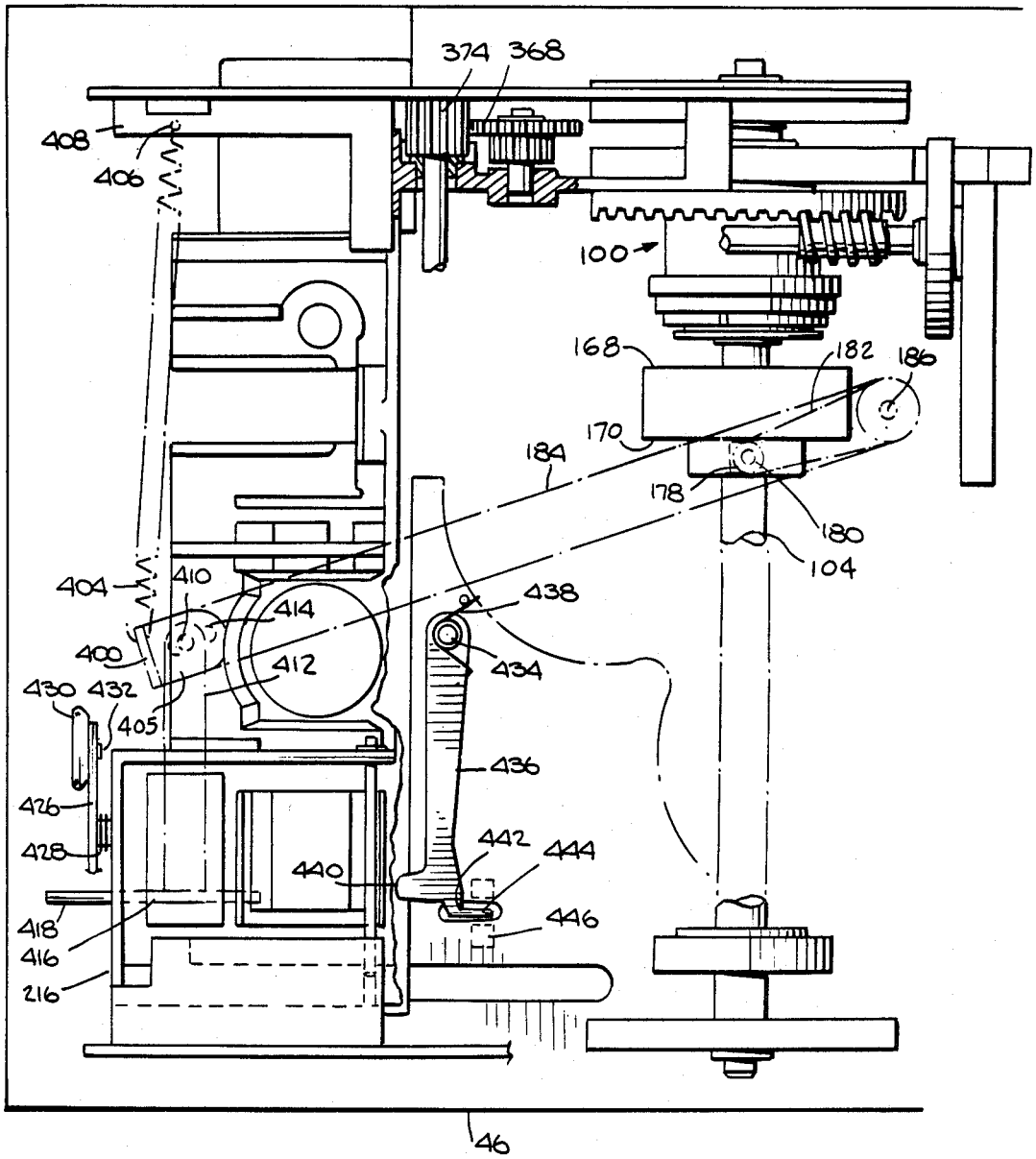
FIG. 19 is a cross-sectional view of a portion of the mailing machine showing the ejection mechanism.
Figure 20:
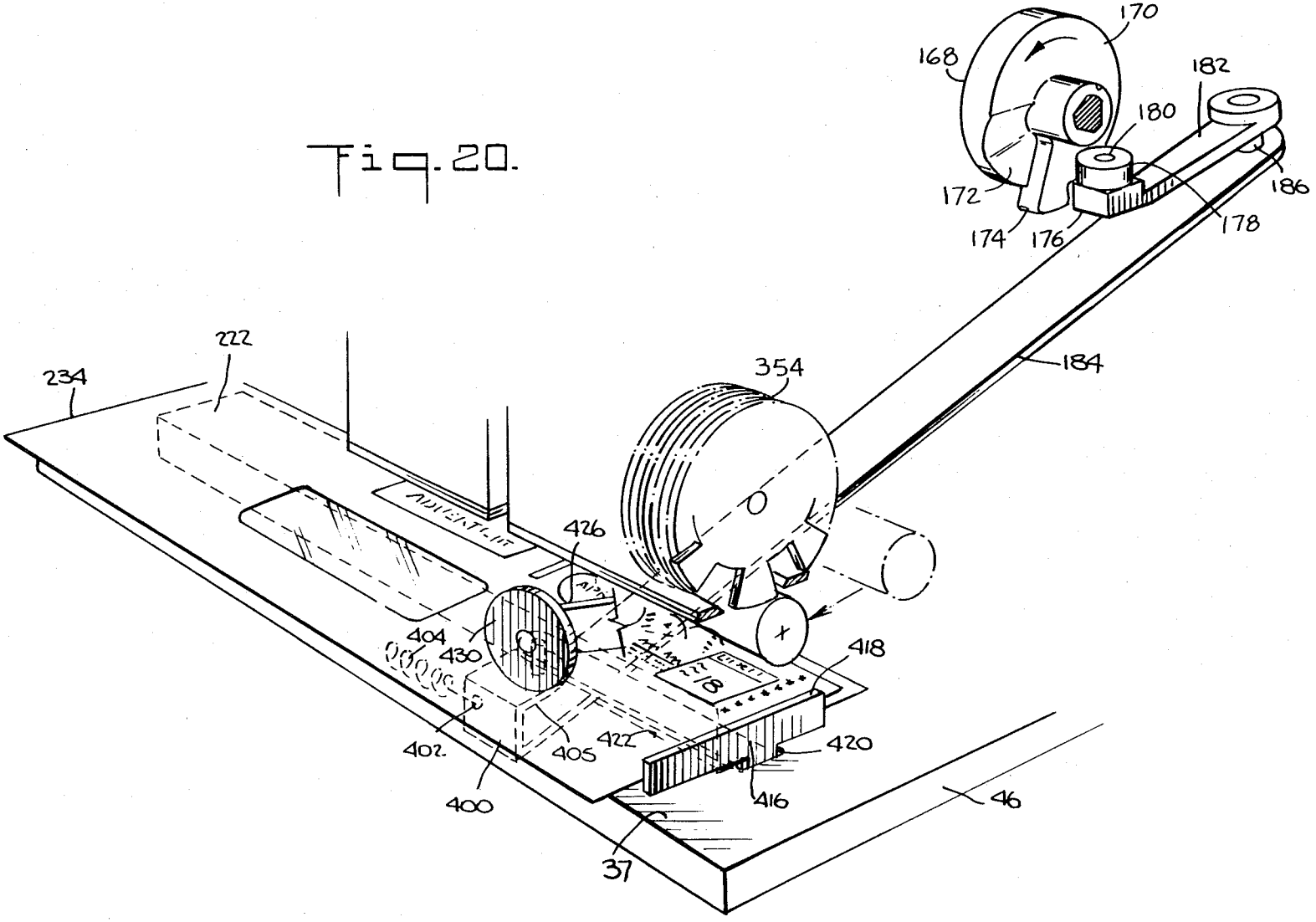
FIG. 20 is a perspective view of the envelope receiving slot of the mailing machine along with certain components associated therewith.
Figure 21:
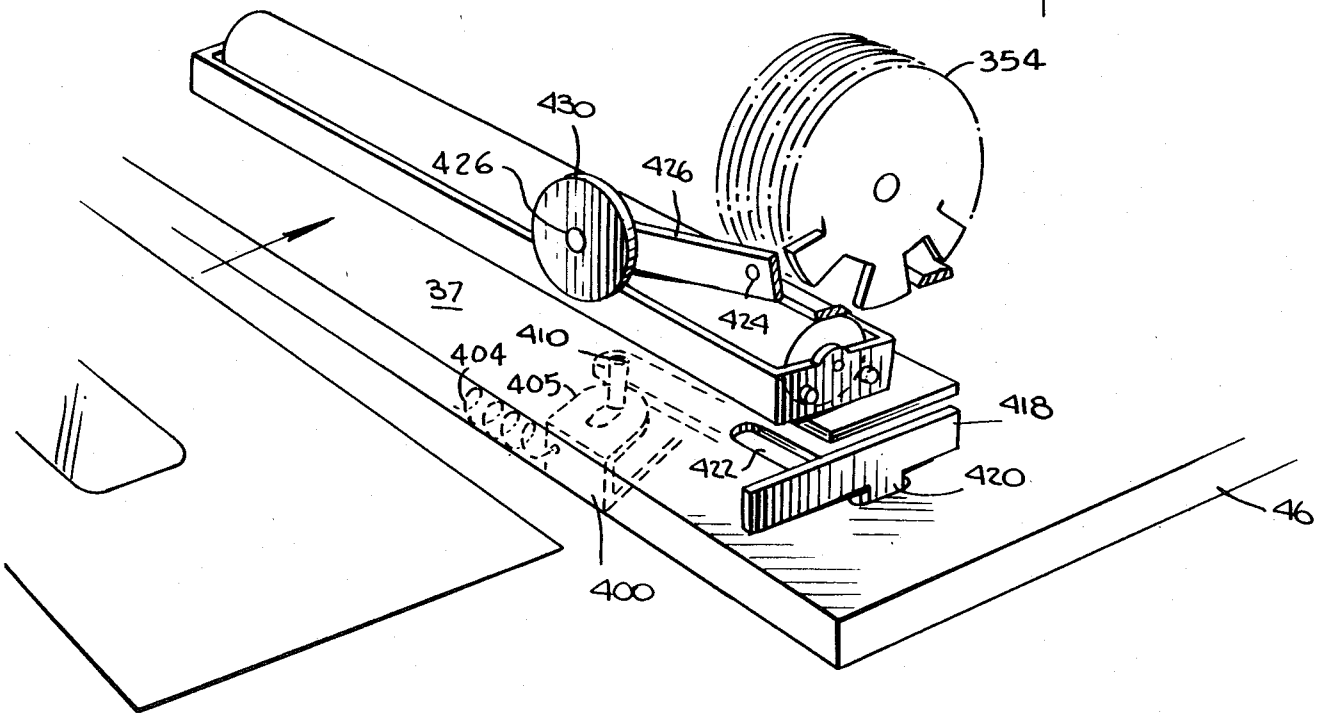
FIG. 21 is a perspective view of part of the ejector mechanism utilized with the mailing machine.

A pivot pin 434 mounted on the base 46 and pivotally supports a lever 436. A torsion spring 438 is secured at one end to the base 46 and engages the lever 436 at its other end for normally urging the lever 436 toward the slot 36, thereby urging the lever in a clockwise direction as seen in FIG. 19. The lever 436 extends into the slot 36 for engagement by an envelope inserted thereinto and has a forwardly protruding portion including a letter contacting tip 440 at one end thereof and a rearwardly protruding portion including a depending finger 442 that extends through an opening 444 in the base 46. An optical sensing device or switch 446 having an LED in one leg thereof and a light responsive photosensor in the other leg thereof is mounted on the logic bracket 49 and is in a position to receive the finger 442 between the legs when the lever 436 is moved, by an envelope inserted into the slot 36, in the counter-clockwise direction, against the urging of the spring 438. The end of the member 436 thus moves from a first position wherein it is dispersed in the slot 36 for engagement by an envelope inserted thereinto, to a second position wherein it is dispersed for sensing by said optical sensing means.

Figure 26:
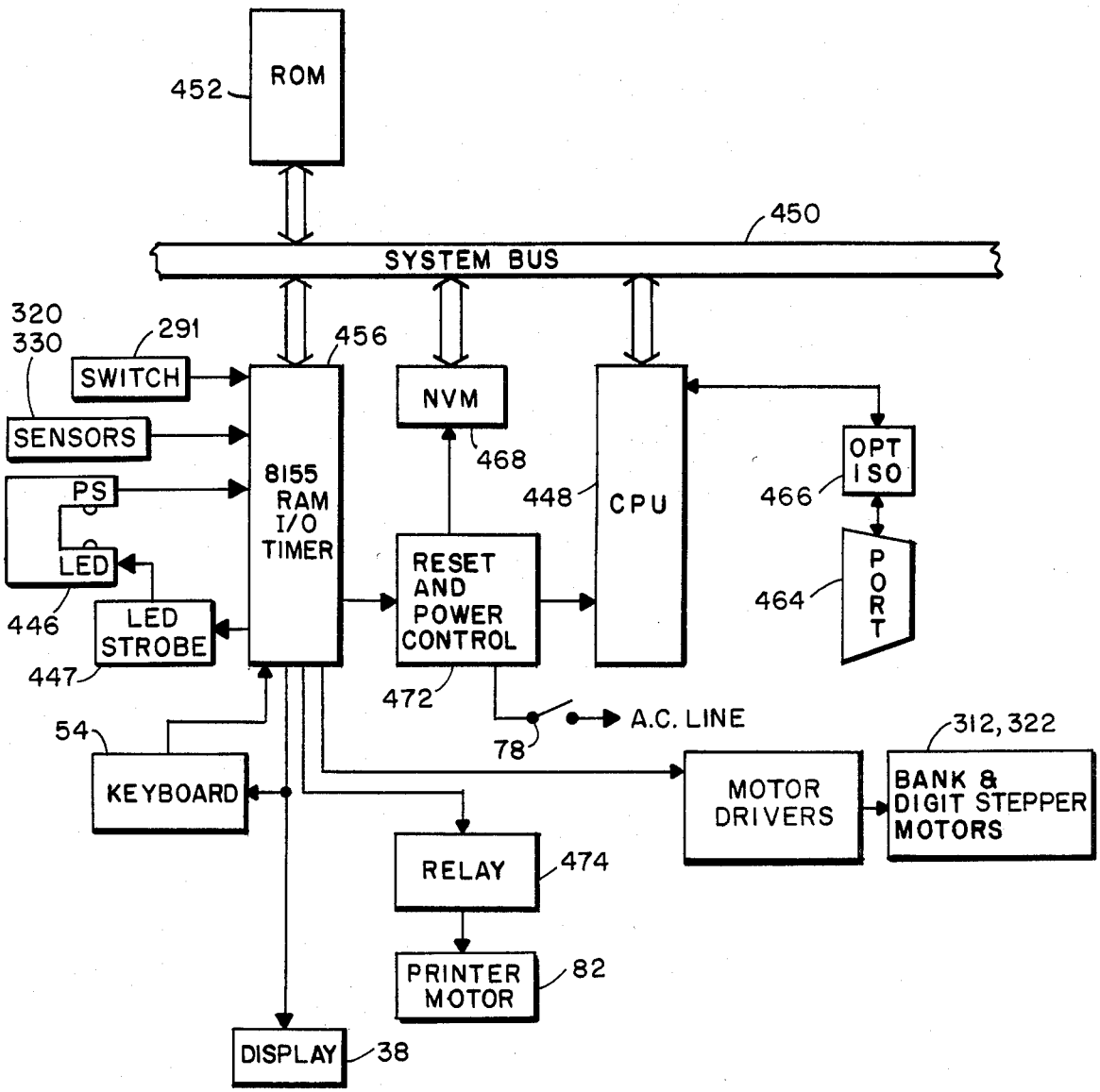
FIG. 26 is a block diagram of the electronic circuit of the mailing machine.

Referring now to FIG. 26, a block diagram is shown of the electrical circuit of the mailing machine and in FIGS. 27, 27*a*, 27*b*, 28 and 29 a flow chart is shown that describes operation of the mailing machine 30. The electrical circuit includes an 8-bit microprocessor 448 (CPU), such as an Intel Model 8085 microprocessor, which controls the functions of the mailing machine 30 and is connected to various components of the electrical circuit through a system bus 450. The microprocessor 448 is in electrical connection with a ROM 452 through the system bus 450. The ROM 452 serves as an address latch that formats address signals and stores a series of programs for controlling the mailing machine 30. An integrated circuit 456, which may be an Intel Model 8155, is also connected to the system bus 450 and includes a RAM with input lines and output lines and a timer. The RAM 456 has memory space allocated for ascending register and descending register data for transcient storage. External communication data ports 464 are connected to the microprocessor 448 through optical isolators 466. These external communication ports allow connection with devices such as an electronic scale, a remote meter resetting system, servicing equipment and the like. Also in connection with the microprocessor 448 through the system bus 450 is the keyboard 54 and a non-volatile memory (NVM) 468. The stepper motors 312, 322 are also in electrical connection with the microprocessor 448 via the RAM 456 and bus 450 or reset controls 472. A reset and power control unit 472 is electrically connected between the RAM 456 and the microprocessor 448 and a relay 474 connects the motor 82 to the RAM 456.

Figures 27, 27B:
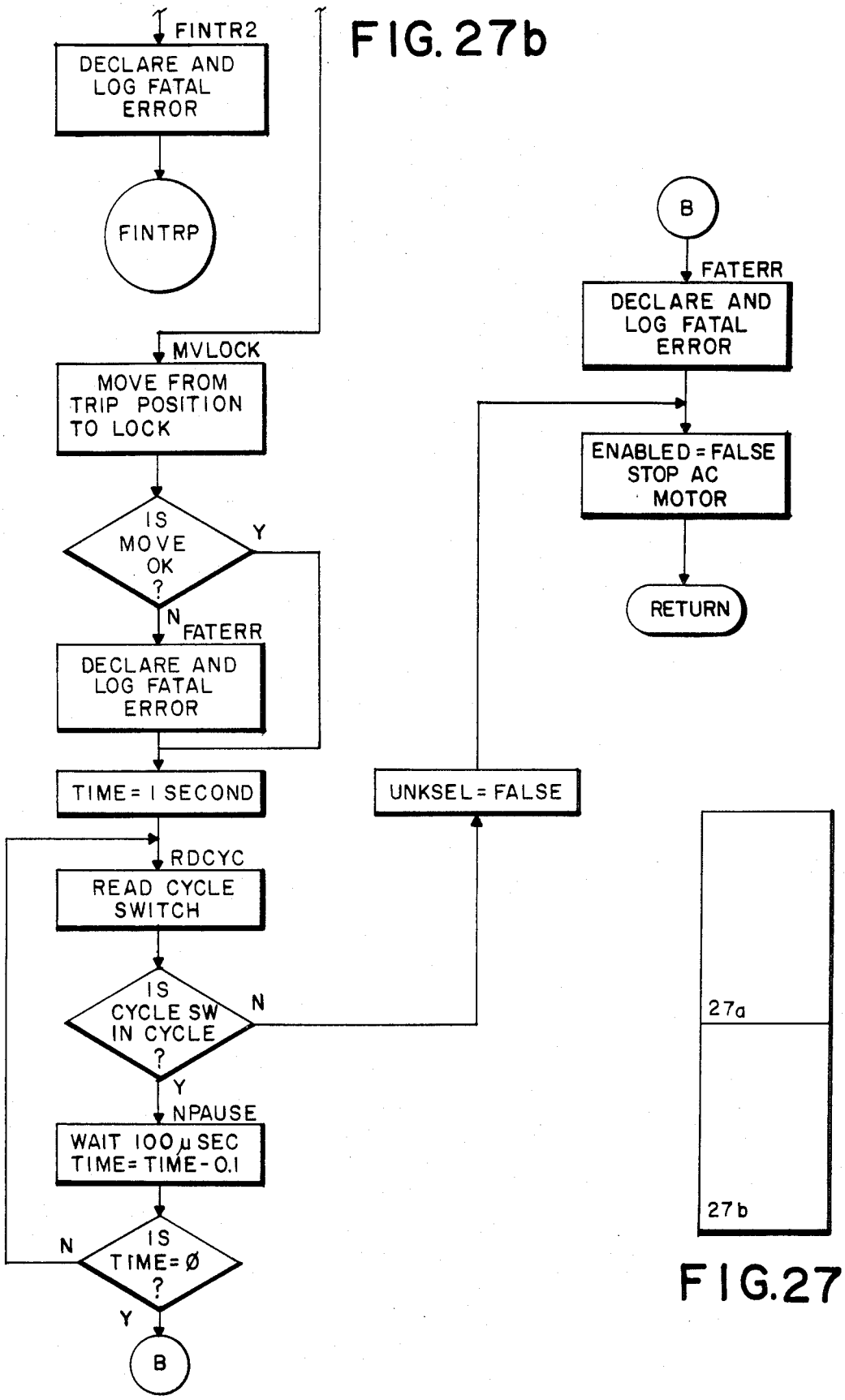
FIGS. 27, 27*a*, 27*b*, 28 and 29 are flow charts describing the operation of the mailing machine.
Figure 27A:
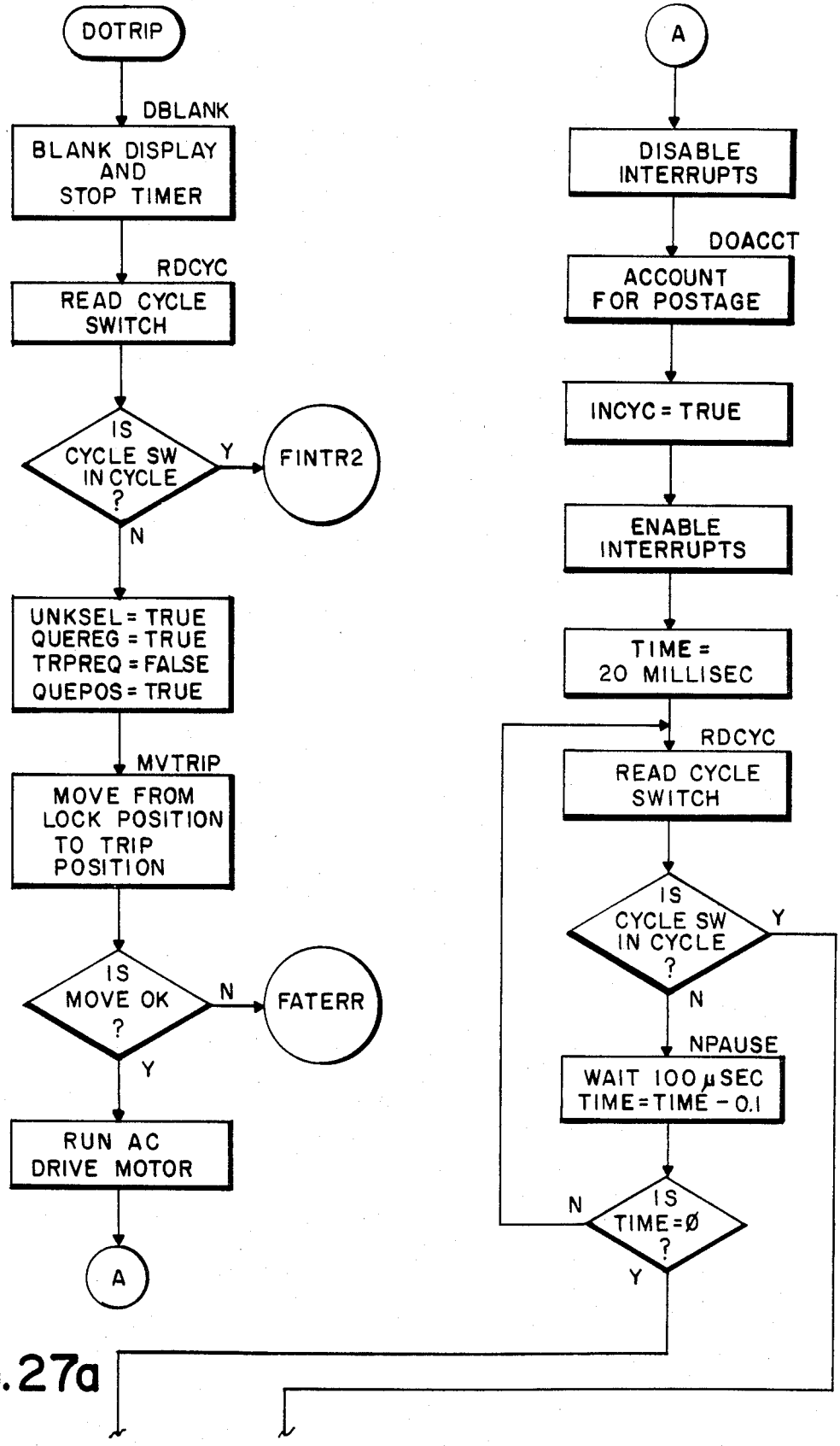
Figure 28:
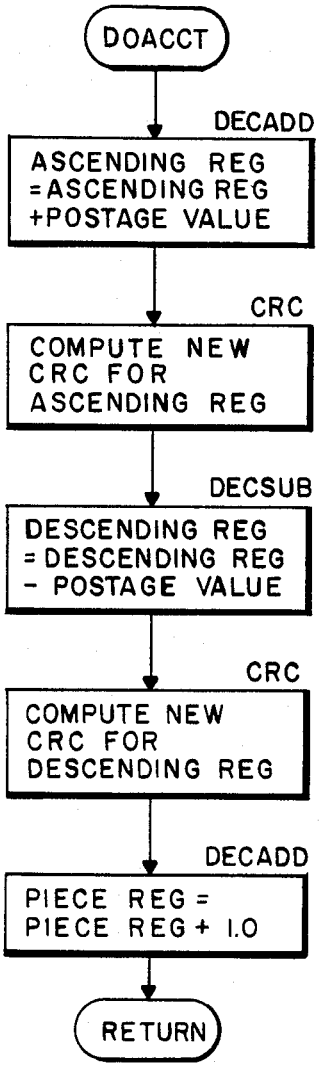
Figure 29:
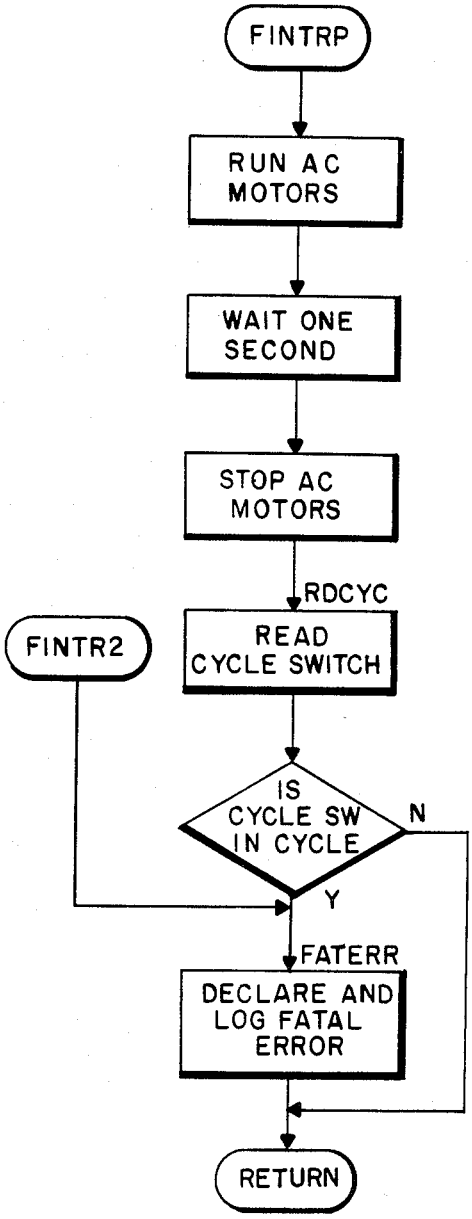

Operation of the mailing machine 30 is shown basically in the flow chart shown in FIGS. 27, *27a*, *27b*, 28 and 29 which taken together with the description which follows describes in detail such operation.

The mailing machine 30 is first prepared for operation by turning on the power switch 78. Upon initial start-up, the check date indicator 76, an LED, on the display panel 40 will start flashing for the purpose of warning the operator to check the date for which the date printer 224 is set. This indicator 76 will flash a signal to indicate that the microprocessor 448 has disabled the mailing machine 30. The lid 34 would then be lifted by the operator to expose the date key 74 and the thumb wheels 75. The operator would then operate the thumb wheels 75 to change the date print wheels 225, if necessary, and would then depress the date switch key 74. Upon depressing the date key 74, the check data indicator 76 will be turned off and the display panel 40 will change to ≡0.00≡, the triple bars indicating that the mailing machine is ready for the input of postage information. At this time, the print head 122 is in the home position as indicated in FIG. 4 and the printing cams 106, 108 will be positioned to place the cam followers 154, 160 in locations so as to cause the print bracket 111 to raise the print head within the cover 32 away from the deck 37 so that it cannot be contacted or wiped to obtain an unauthorized impression. The carriage 296 and selector gear 304 will be located in the home position and the locking lever 308 will be located outside of the carriage slot 302 as seen in FIG. 8. In such position, the selector gear 304 is out of engagement with all the racks 348 (FIG. 5) which are locked in position by engagement between the upper rack teeth 346 and the tooth forms 311.

Postage values are selected by first entering the value through the numeric setting keys 56 of the keyboard 42. Such value selections are indicated at the display panel 40. The display panel board 52 may be set to zero by depression of the clear key 58 and then a new value may be entered. With the initial selection of the postage value completed, the select postage key 68 is depressed and the microprocessor 448 will cause the print wheels 354 to be set for the selected postage by controlling the stepper motors 312, 322. As a result of the select postage key 68 being depressed at the keyboard 54, a signal is sent to the microprocessor 448. The microprocessor 448 operates in accordance with a control program stored in the ROM 452 which is accessed over address lines. In accordance with the control program stored in the ROM 452, the microprocessor 448 accesses data stored in the RAM 456 over the system bus 450. The data in the RAM 456 represents positions for which the stepper motors 312, 322 had been set. Upon the microprocessor 448 accessing the RAM 456, the stepper motors 312, 322 are set relatively by the microprocessor 448 based on their present dispositions and the new positions to be assumed. Upon being so set data representations of the new positions of the stepper motors 312, 322 are supplied to and stored in the RAM 456.

Figure 15:
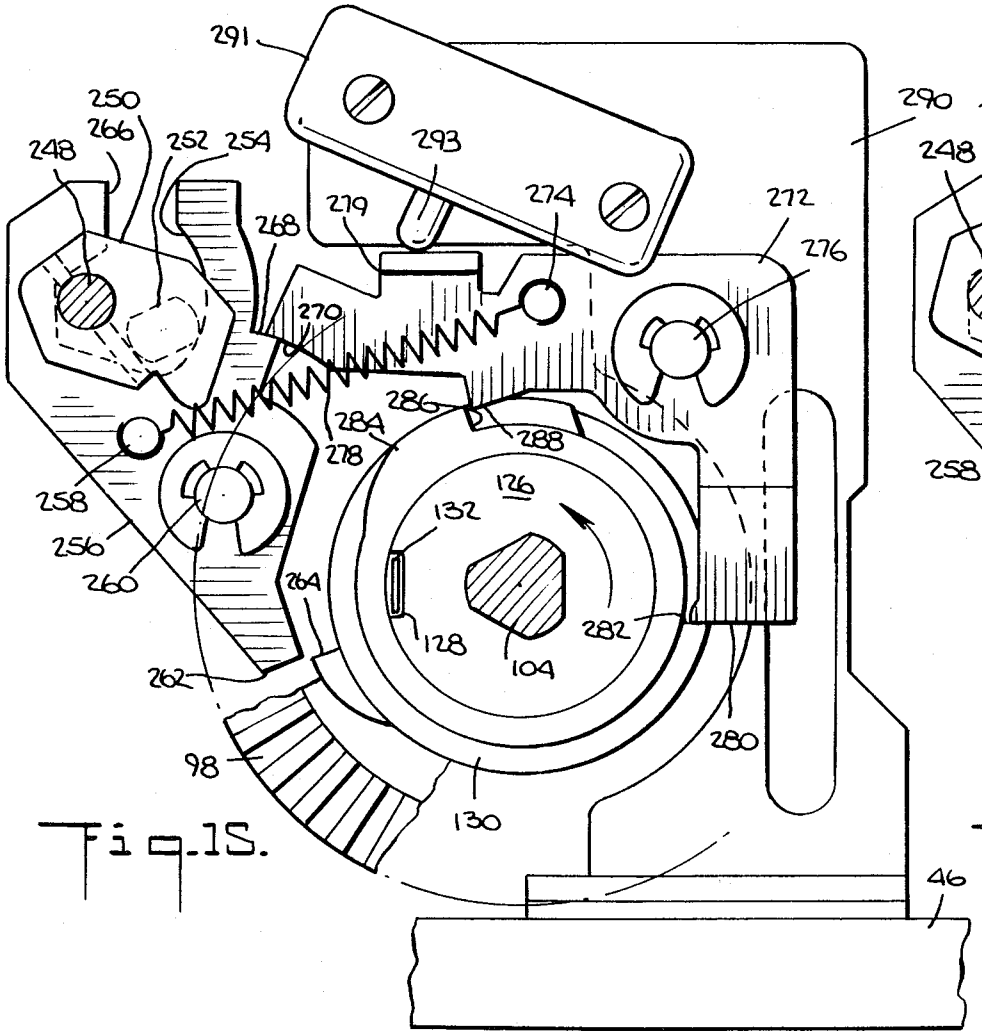

Prior to depression of the select postage key 68, the spring clutch 100 will be in the home position as shown in FIG. 15. At this time, the trip shaft 248 will be in a position such that the locking lever 308 is removed from the carriage slot 302 thereby forming the carriage 296 for movement along the shaft 292.

As stated previously, selection of postage values is accomplished by the stepper motors 312, 322 through control of the microprocessor 448. The stepper motor 312 causes a selected print wheel 354 to be rotated while the other stepper motor 322 determines the bank to be acted upon by the stepper motor 312, the term bank including the rack 348, gear 352, print wheel 354 and other components associated with the rotation of a given print wheel. The microprocessor 448 will control the movement of the stepper motor 322 through the RAM 456 so that the selector gear 304 carried by the carriage 296 will address each bank in sequence. Movement of the carriage 296 is accomplished by incremented rotation of the gear 324 which in turn will rotate the carriage gear 340 thereby causing the carriage 296 to slide along the tri-lobe shaft 292. The position of the carriage 296 is determined by the optical sensor 330 that senses the angular displacement of the optical encoder 328 mounted on the output shaft 326 of the stepper motor 322. As each bank is addressed by the selector gear 304 through the stepper motor 322, the stepper motor 312 will be enabled through control of the microprocessor 448 to rotate the addressed print wheel 354 and place it into the position selected by the numeric setting keys 56. This rotation is caused by the rotation of the selector gear 304, by the stepper motor 312 via gear 306 and shaft 292, whose teeth engage the upper teeth 346 of the particular rack 348 being acted upon to move it longitudinally to the selected position. As the rack 348 is being moved, the lower teeth 350 will cause rotation of the print wheel 354 through interaction with the gear 352. After a print wheel 354 is set into its selected position, selector gear 304 is moved by the carriage 296 onto the next bank until the entire print head 122 has been set.

Each stepper motor 312, 322 is provided with a two channel optical encoder 318, 328, respectively, to permit the microprocessor 448 to determine the setting of the print wheels 354 and position of the carriage 296, respectively, and to detect unauthorized wheel movements. With the two channel encoder 318, 328 a determination can be made of the direction of rotation of the stepper motor by the sequence in which the lights 334 are exposed. It will be noted that the sensor 330 has a pair of pins 338 thereon that are adapted to fit with openings of the mounting bracket 339. In this way, proper alignment of the optical sensor 330 is assured. The upper wall 332 of the sensor 330 has a mark 331 thereon that is used for the purpose of setting the optical encoder disk 328. This is accomplished by aligning the mark 329 on the optical encoder disk 328 when the encoder disk 328 is loosely mounted upon the shaft 326. The respective stepper motor 322 would be operated so that the shaft 326 is in an incremental position. With this setting of the shaft 326 the loosely fitting encoder disk 328 would be rotated on the shaft 326 so that the mark 329 is aligned with the mark 331 on the wall 332 of the sensor 330. With this alignment completed, the encoder disk 328 would be secured to the shaft 326 so as to be rotated therewith. Of course, with such alignment of the mark 329, the stepper motor is in the home position. The encoder disk 318 and sensor 320 associated with the stepper motor 312 would be assembled in the same manner.

Figure 16:
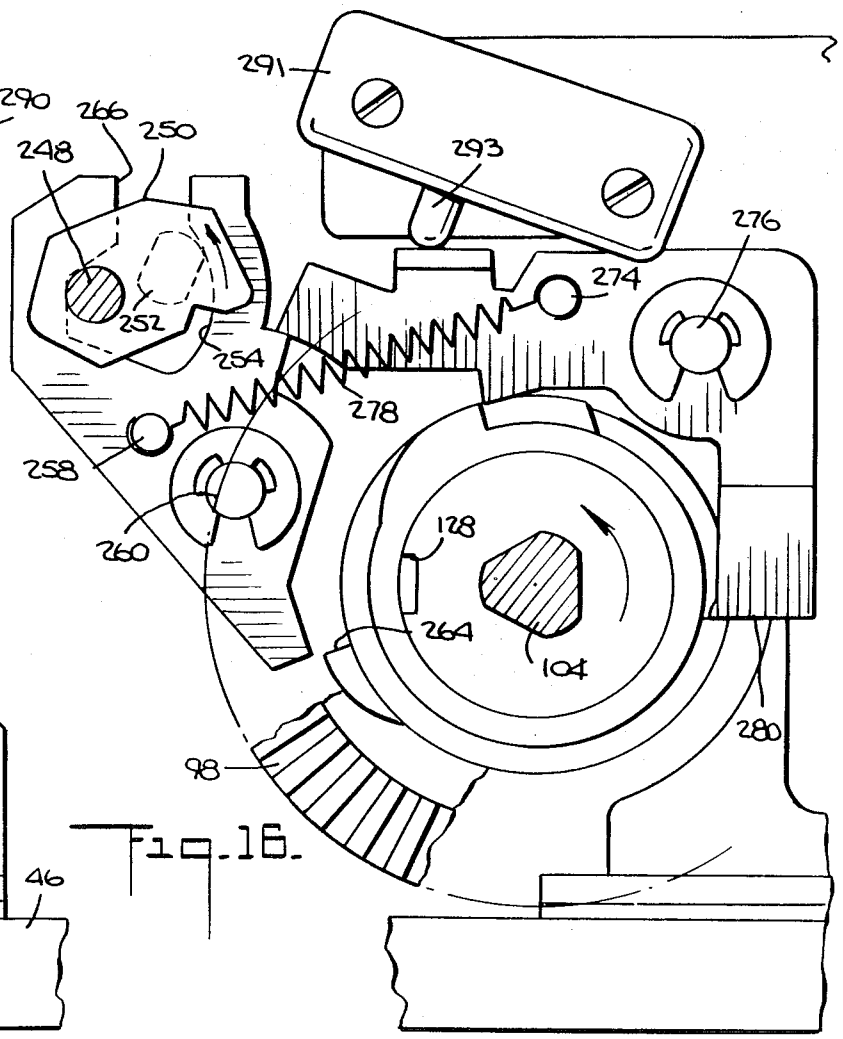
FIGS. 15–18 are cross-sectional views of the single revolution clutch incorporated in the mailing machine, shown in different stages of operation.

After the print wheels 354 are placed in their appropriate position as described, the carriage 296 will be placed in its home position as seen in FIG. 8. The microprocessor 448 would cause the stepper motor 312 to rotate the trip shaft 248 slightly and place the spring clutch 100 in the locked position as shown in FIG. 16. In such locked position, the locking lever 308 would enter the slot 302 to lock the carriage 296. Simultaneously, the tooth forms 311 would engage the upper teeth 346 of the racks 344 thereby locking the print wheels 354 at the selected values. An envelope 234 to be stamped would be placed into the slot 36 thereby urging the lever 436 from its first position where it is engaged by the envelope, against the force exerted thereon by the spring 438, to its second position in which the lever it blocks the light emitted by the LED and its presence sensed by the photosensor of the optical sensing means 446. This is associated by an envelope 234 being pushed against the top 440 of the lever 436 with sufficient force to overcome the spring 438 and position the switch finger 442 within the legs of the optical photosensor 446. In order to expand the life of the LED this optical photosensor is connected in series with a strobe therefor, shown in the drawing as the LED strobe 447. The LED strobe is operated by the microprocessor, under the control of the program stored in the ROM, to intermittently energize the LED, thereby extending the life of the same. Immediately thereafter, the drive motor 82 will be started and the stepper motor 312 will be enabled to rotate the optical encoder 318 and the trip shaft 248.

Referring now to FIGS. 7, 8 and 15–18, in FIG. 15 the trip shaft 248 is shown in its home position, i.e. in this position the pivot member 256 is in a position such that the shoulder 268 is contacted by the end 270 of the pivot member 272 and the bearing surface 280 is in engagement with the shoulder 282. In such position, the spring 132 would be held loosely about the slidable member 126. No movement can be imparted from the disc gear 98 to the slidable member 126 because of the posture of the spring 132. Consequently, the shaft 104 can have no drive imparted thereto. When the clutch 100 is in such position, the print wheels 354 may be rotated so as to adjust the settings on the print head 122. As the trip shaft 248 begins to rotate, the bar 252 begins to slide upon the curved surface 254 and will first assume the locked position as shown in FIG. 16. In this locked position, the components of the single revolution clutch 100 still occupy the same status as in the home position with the exception that the trip shaft 248 is in a position whereby the locking lever 308 is received with the carriage slot 302 to lock the carriage 296 and the racks 348 as previously described.

Figure 18:
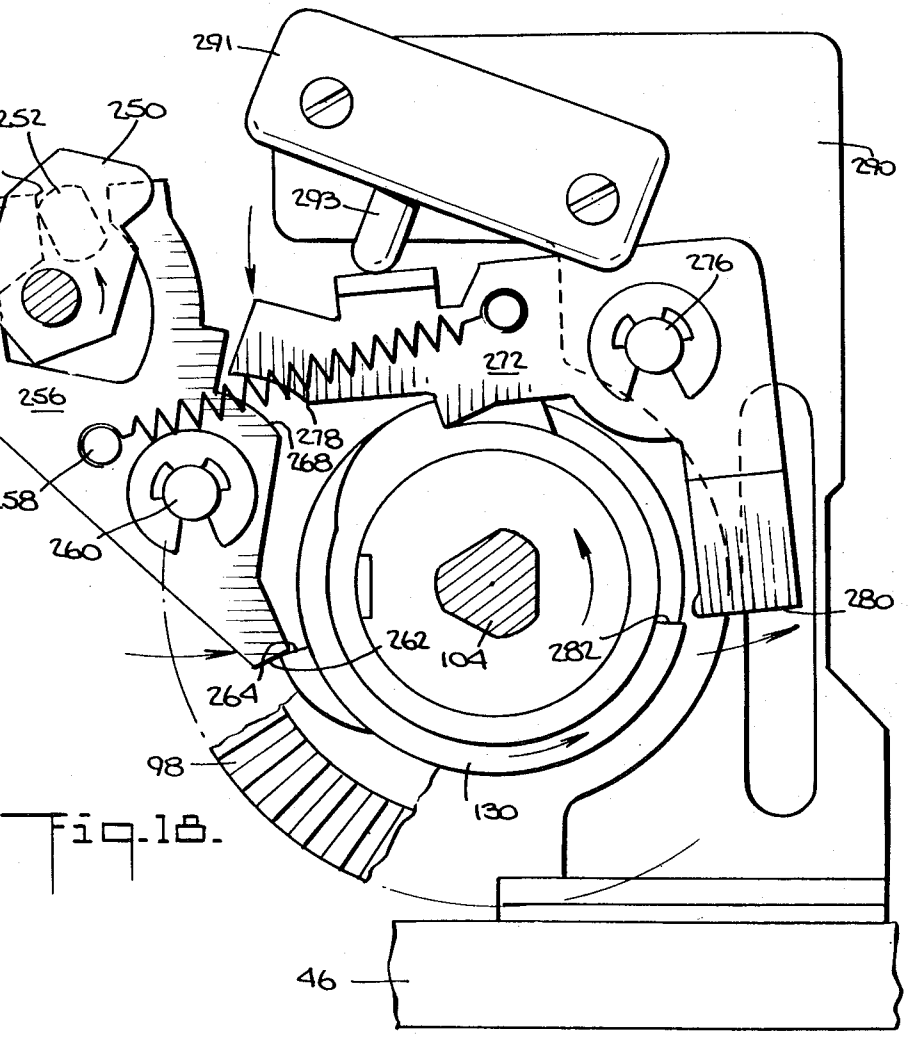
Figure 17:
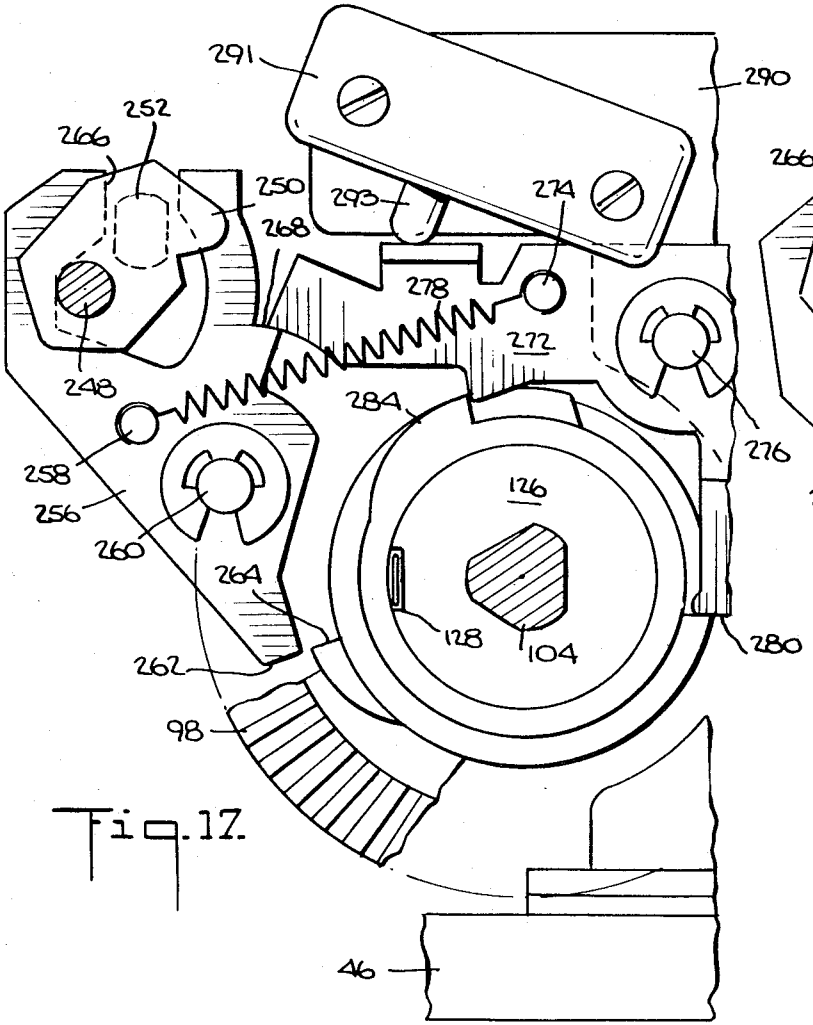

Following the locking of the carriage 296, upon a slightly greater rotation of the trip shaft 248, the bar 252 will then become disengaged from the surface 254 and the pivot member 256 is free to be rotated. Upon further rotation of the trip shaft 248, the bar 252 will contact the bearing surface 266 thereby causing the pivot member 256 to rotate about the shaft 260 in a counterclockwise direction as seen in FIG.18. The contact between the bar 252 and the pivot member is instantaneous, i.e., only sufficiently long to allow rotation of the pivot member. With this occurrence, the pivot member 272 is rotated about the shaft 276 in a counterclockwise direction by the action of the extension spring 278 so that the bearing surface 280 is driven out of engagement with the shoulder 282 and the pivot member 256 engages the abutment surface 264 to prevent movement of the driven member in the clockwise direction. This will free the confiner 130 for rotation in the counterclockwise direction and the spring 132 will wrap about the gear 98 and slidable member 126 thereby providing drive connection therebetween so that the drive from the gear 98 is imparted to the slidable member 126 and confiner 130. As the slidable member 126 begins to rotate, the pivot members 256 and 272 follow various cam surfaces of the confiner 130. This will continue until the shaft 104 has made a full revolution at which time the bearing surface 280 of the pivot member 272 will be engaged by the shoulder 282 as a result of the trip shaft 248 being rotated to disengage the bar 252 from the surface 266 and the spring 278 thereafter rotating the lever 256, 272 in a counterclockwise direction. Thereafter, the spring 132 will be acted upon to allow free wheeling between the slidable member 126 and the gear 98. With such actuation of the clutch 100, a postage printing operation will have been completed as will be described in greater detail hereinafter.

The completion of a printing cycle is indicated by the switch 291. Near the end of the printing cycle, the depending member 288 would ride upon the projection portion 284 thereby rotating the pivot member 272 in a clockwise direction. This will drive the bearing surface 279 into engagement with the actuator 293 to actuate the switch 291. Upon actuation, the switch 291 would send a signal to the microprocessor 448 to indicate the completion of the cycle and the microprocessor will send a signal to charge the postage used in the printing by reducing the amount of postage stored in the RAM 416. The microprocessor 448 will also clear the mailing machine 30 so that it is ready for another operation.

Referring to FIGS. 5, 6, 8 and 15–18, an alternative way of determining that a printing cycle has taken place for purposes of accounting would be through the optical sensor 320 associated with the encoder disk 318 secured to the output shaft 316 of the stepper motor 312. When the carriage 296 in the neutral position, the gear 304 will be out of engagement with all the racks 348 and will engage the gear segement 310. Such position of the carriage 296 will be sensed by the sensor 330 in cooperation with the encoder disks 329 and this will communicated by the microprocessor 448. The trip shaft 248 will be rotated in a first direction by the stepper motor 312 through the segment gear 310 to trip the single revolution clutch 100 so that the clutch will bring about the postage printing operation. Upon completion of the printing cycle, the trip shaft 248 would be returned to the home position and the output shaft 316 would be rotated in the opposite direction. Such return movement of the trip shaft 248 would be observed by the sensor 320 which would send a signal to the microprocessor 448 to indicate the end of a print cycle. Confirmation that rotation has taken place is transmitted by the two photodetectors 325 which, in cooperation with the two lights 323, can not only determine that the disk encoder 328 is being rotated by the output shaft 326 of the bank stepper motor 312 but also in which direction. In the mode of operation herein described when the rotation of the output shaft 316 is in a first direction, the microprocessor 448 controls the printing operation and will charge the appropriate postage amount. Upon rotation of the output shaft in the opposite direction, the microprocessor 448 will clear the system for additional operations.

Referring now to FIGS. 4, 5 and 7, during a single revolution of the shaft 104, a number of activities occur. The cams 106, 108, 107 and 168 will be rotated by the shaft 104. With the rotation of the cams 106 and 108, the cam followers 154 and 160 will be driven within the cam tracks 152, 158 respectively. The bearing member 176 and cam follower 178 will be driven along the cam surface 170.

Focusing initially on the print head 122, as was stated previously, when the clutch 100 is in the static condition, the print head is in a raised position so it cannot be contacted to obtain an unauthorized stamp or impression. As the single revolution clutch 100 is actuated, the shaft 104 will rotate and the cams 106, 107 and 108 will be rotated therewith. The cam follower 118 will cause the lever 116 to be slightly rotated in a counterclockwise direction. With this occurrence, the print wheel bracket 111 will be lowered to expose the print head 122 and place it in a position whereby the print head may be contacted by the ink roller 390. Upon further rotation of the cam 107 the print bracket 111 will be lifted and then lowered again to be in a position to contact an envelope 234 on the platen 222 when lifted thereby.

As the print bracket 111 is being lowered a second time, the platen assembly 214 is being lifted. This is accomplished by the cam followers 154, 160 following the cam tracks 152, 158, respectively, of the print cams 106 and 108. With such movement, the print arms 156, 162, will be moved upwardly thereby moving the platen arms 196, 198 through the interaction of the tension springs 204, 210. As the printing cams 106, 108 rotate, the platen arms 196, 198 will be lifted thereby carrying the platen bracket 220 upwardly with the foam rubber platen 222 therein. As the platen bracket 220 is lifted, the stripper bracket 232 contacts the casting 216 to be driven downwardly as the leaf spring 236 is overcome. Assuming an envelope 234 is located on the platen 222, it will be driven into engagement with the now lowered print head 122 for the printing of postage thereon. The presence of the torsion springs 204, 210 provides compensation for variation in thickness. If a thin envelope is to be stamped, the normal biasing forces of the springs 204, 210 are sufficient to allow printing to occur. On the other hand, if a thick envelope 234 is to be stamped, the springs 204, 210 will yield to accommodate the same. The tension of the springs 204, 210 should be approximately 20 to 40 lb.-in., the tension of the springs of the illustrated machine 30 being 27 lb.-in. As the print bracket 220 is lowered, the stripper bracket 232 will fall and the lip 233 will engage the envelope 234 thereby stripping the same from the print head 122, in case the envelope should stick thereto.

In addition to the printing operation, the inking operation also occurs during the operation cycle as the single revolution clutch is accuated. This is accomplished by the cam follower 148 following the channel 146 within the cam 106. As the cam 106 rotates, the inking arm 150 will be pivoted about the pin 366 thereby causing the teeth 364 to engage the gear small portion 370 and rotate the compound gear 368. The large diameter portion 372 of the compound gear 368 is in engagement with the gear 374 which in turn engages the teeth 362 of the inker rack 358. With such movement of the arm 150, the the inker rack 358 will be moved longitudinally by interaction of the components herein described. As the inker rack 358 is longitudinally moved, the ink roller 390 will be rolled across the lowered print head 122, which lowering was previously described, prior to the platen bracket 220 being moved upwardly. The ink roller 390 will be rolled across the print head 122 and will come to rest while the print head moves upwardly and then downwardly again to engage the platen as described previously. As the platen bracket 220 is lowered after printing, the inking arm 150 will begin to move in the other, or clockwise, direction thereby causing the inker rack 358 to move in the opposite longitudinal direction and cause the ink roller 390 to approach its rest or home position.

Still another activity that takes place as the spring clutch 100 is rotated a single revolution, is that the cam follower 178 will ride upon the cam surface 172 thereby overcoming the spring 404 and causing rotation of the lever 184 about the stub shaft 186. The cam surface 172 has an irregular configuration that rises to meet the cam surface 170 whose dimension is constant. The cam follower 178 will ride on such cam surface 170 but as the cam 168 continues to rotate the step 174 will engage the bearing member 176. Because the step 174 has a greater radius than the cam surface 170, the bearing member 176, whose linear dimensions are substantially equal to the diameter of the cam follower 178, will contact the step 174. In this way, as the cam 168 rotates, the cam follower 178 will lose contact with the surface 170 immediately after the upstream end of the bearing member 176 meets the downstream end of the step 174. The T-shaped pusher 416 is returned to its home position as the cam 168 begins to rotate and the cam follower 178 moves along the cam surface 172. The T-shaped member 416 will be at and remain in its home position while the cam follower 178 moves along the cam surface 170 at which time as the printing operation is occurring. Upon completion of printing, the bearing member 176 will engage and fall from the step 174 thereby causing the spring 404 to instantaneously exert a force upon the upright member 400 and pivot the lever 184 about the stub shaft 186. The wall portion 418 will accelerate to eject a envelope 234 from the mailing machine 40. While the T-shaped pusher 416 is in its home position, the roller 430 will be resting upon the envelope 234 and the spring 428 will cause a biasing force to be imposed by the roller 430 onto the envelope 234. As a consequence, when the T-member 416 begins to drive the envelope 234 across the slot 36, the roller 430, will impose sufficient force upon the envelope 234 and its contents so that they will move in unison. This has the advantage in that the initial impact of the T-shaped pusher 416 is not absorbed as a result of the envelope contents remaining static and the envelope 234 moving relative thereto. By moving the envelope 234 in unison with its contents, it has been found that an envelope 234 will derive the full force of impact upon ejection but if the contents remain static, i.e., they move within the envelope, the T-shaped pusher 416 will have lost much of its force by the time it engages the static contents and will not have sufficient force remaining to eject the envelope 234 from the slot 36. By having a bearing member 176 engaging the step 174 instead of the cam follower 178, it has been found that the full force of the spring 404 is utilized. The rectangularly shaped member 176 drops more quickly at the step 174 then a circular cam follower which would tend to roll over the step.

Figure 25:
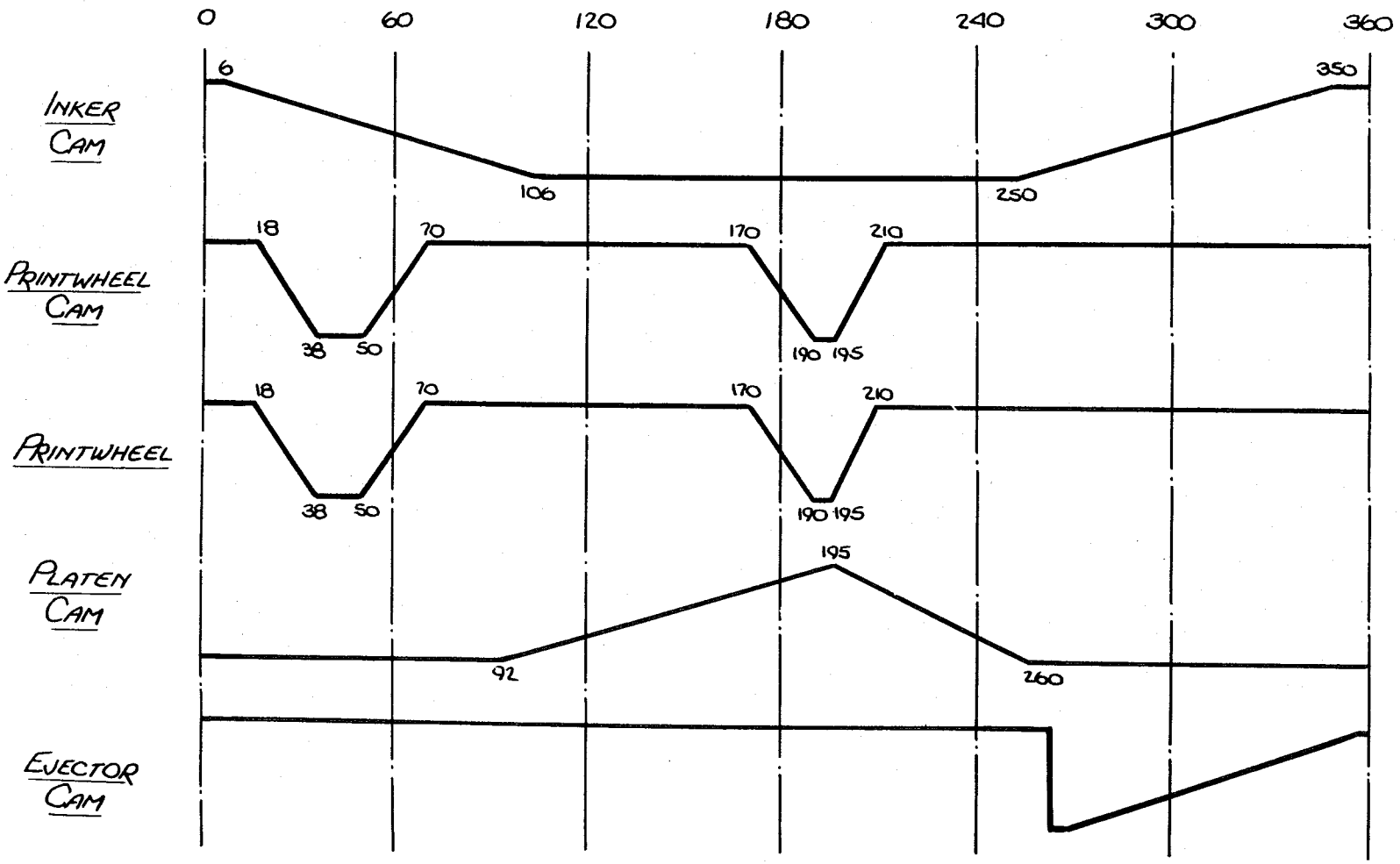
FIG. 25 is a timing chart indicating the sequential operations of certain units of the mailing machine.

The various activities and their relationship to one another are shown graphically in FIG. 25. The abscissa represents the angle of the spring clutch 100 relative to its home position and the ordinate indicates the component whose function is being represented. No activity takes place during the first six degrees of rotation. At 6° the ink roller 390 begins to move toward the print head 122. At 18° the print head 122 starts to move downwardly and between 34° and 50° the ink roller 390 rolls across the print head 122 to ink the same. Between 50° and 70° the print head 122 will move upwardly as the ink roller 390 continues to move in the same direction so as to clear the print head and avoid interference therewith. At 106° the ink roller 390 will be at a rest position, the position it will assume during printing of an envelope 234. The ink roller 390 will stay in such rest position between 106° and 250°. When the spring clutch 100 has rotated to the point where it is 92° from its starting position, the platen 222 will begin to rise. Between 170° and 190° the print head 122 will start descending once more and will remain lowered between 190° and 195°. At 195° the platen 222 will engage the print head 122 to perform the printing operation. Thereafter, the print head 122 will be lifted until it has returned to its home position at 210° and the platen 222 will be lowered until it reaches its home position at 260°. Meanwhile, the ink roller 370 at 250° will start to move in the opposite longitudinal direction to return to its home position and will reach that status by 350°. At 262° the bearing surface 176 will fall down the step 174 to actuate the ejection mechanism to discharge the stamped envelope 234 from the slot 36. Thus a full print cycle will have taken place.

Referring to FIG. 26, one arrangement of the major electronic components of an electronic mailing machine 30 embodying the present invention is shown. The electronic mailing machine 30 is controlled by the microprocessor 448 operated under control of a series of programs stored in the ROM 452. The microprocessor 448 accepts information entered via the keyboard 54 or via the external communication ports 464 from external message generators. Critical accounting and other information is stored in the non-volatile memory 468. The non-volatile memory 468 may be an MOS semiconductor type memory, a battery augmented CMOS memory, or other suitable non-volatile memory component. The function of the non-volatile memory 468 is to store critical postage meter data during those times when power is not applied to the mailing machine 30. This data may include, in addition to the serial number of the mailing machine 30, information as to the amount of the descending register (the amount of postage available for printing), the value of the ascending register (the total amount of postage printed by the meter), and the value of the piece count register (the total number of cycles the meter has performed), as well as other types of data, such as service information, which are desired to be retained in the memory even though no power is applied to the meter.

When the on/off power switch 78 is turned on causing the power supply internal to the mailing machine 30 (such as +5 V) to energize the microprocessor 448 and the balance of the electronic components of the mailing machine. The information stored in the non-volatile memory 468 is transferred via the microprocessor 448 to the RAM 456. The RAM 456 after power up contains an image or copy of the information stored in the non-volatile memory 468 prior to energization. During operation of the mailing machine 30, the data in the RAM 456 is modified. Accordingly, when postage is printed, the descending register will be decremented, the ascending register incremented and the piece counter register incremented. When the power switch 78 is turned off, the updated data in the RAM 456 is transferred via the microprocessor 448 back into the non-volatile memory 468. The data is transferred into a suitably prepared area of the non-volatile memory 468. Thus, the non-volatile memory 468 is updated during the power down cycle when the power switch 78 is turned off. A like transducer of information between the non-volatile memory and the RAM 456 takes place during uncontrollable power failure.

The remote resetting function is performed by first lifting the lid 34 and entering the remote resetting authorization number upon pressing the appropriate key 70. When calling an RMRS Status Center, this information, plus the postage amount desired, is entered through a telephone whereupon a coded combination is received. The operator enters the postage desired, then presses the RMRS enter amount key 72. The operator then enters the combination received from the Status Center and presses the RMRS enter combination key 73. Thereafter, the new postage unused value will be displayed, and the mailing machine 30 is ready for normal operation.

PROGRAM APPENDIX

PATENT APPLICATION

OF: Jovito N. Abellana and Easwaran C. N. Nambudiri

FOR: MAILING MACHINE WITH ENVELOPE INSERTION SENSING APPARATUS

```
<<< ASSEMBLY COMMAND STRING >>>

/LIST=_DRA1:[OPT1.DEBUG]PATENT.LIS
/OBJECT=_DRA1:[OPT1.DEBUG]PATENT.OBJ
+       LINES 60
+       LIST    A,E,G,O,S,X
+       NLIST   M
_DRA1:[OPT1.DEBUG]SYMBOL.SRC
;       I N T E R R U P T   V E C T O R   T A B L E
_DRA1:[OPT1.DEBUG]VECTBL.SRC
;       I N T E R R U P T   P R O C E S S I N G
+       ORG     40H
_DRA1:[OPT1.NEWINT]CLKDEC
_DRA1:[OPT1.NEWINT]DBOUNC
_DRA1:[OPT1.NEWINT]DISPLY
_DRA1:[OPT1.NEWINT]INT75
_DRA1:[OPT1.NEWINT]KDIO
_DRA1:[OPT1.NEWINT]MVDDAT
_DRA1:[OPT1.NEWINT]RDROW
_DRA1:[OPT1.NEWINT]STPTMR
_DRA1:[OPT1.NEWINT]STRTMR
_DRA1:[OPT1.NEWINT]TIMINT
;       P O W E R   U P   &   D O W N
;_DRA1:[OPT1.DEBUG]PWRUP
_DRA1:[OPT1.NEWCTL]PWRABN
_DRA1:[OPT1.NEWCTL]PWRDN
_DRA1:[OPT1.NEWCTL]PWRNOR
_DRA1:[OPT1.NEWCTL]PWRUNG
_DRA1:[OPT1.NEWCTL]PWRUOK
```

<<< ASSEMBLY COMMAND STRING - continued >>>

```
;       K E Y B O A R D   &   D I S P L A Y
_DRA1:[OPT1.NEWKEY]CDBUF
_DRA1:[OPT1.NEWKEY]FILDIM
_DRA1:[OPT1.NEWKEY]KEYBRD
_DRA1:[OPT1.NEWKEY]MODDSP
_DRA1:[OPT1.NEWKEY]PAUTHK
_DRA1:[OPT1.NEWKEY]PCLRK
_DRA1:[OPT1.NEWKEY]PDCMK
_DRA1:[OPT1.NEWKEY]PERDSP
_DRA1:[OPT1.NEWKEY]PNUMK
_DRA1:[OPT1.NEWKEY]PROKEY
_DRA1:[OPT1.NEWKEY]PSETK
_DRA1:[OPT1.NEWKEY]SEGCOD
_DRA1:[OPT1.NEWKEY]VALDSP


;       C O N T R O L   &   P R O C E S S I N G
;+      ORG     400H
_DRA1:[OPT1.NEWCTL]CMDDSB
_DRA1:[OPT1.NEWCTL]CMDENB
_DRA1:[OPT1.NEWCTL]CONFIG
_DRA1:[OPT1.NEWCTL]CONSUM
_DRA1:[OPT1.NEWCTL]CTLSUM
_DRA1:[OPT1.NEWCTL]DBLHDR
_DRA1:[OPT1.NEWCTL]DECADD
_DRA1:[OPT1.NEWCTL]DECCOM
_DRA1:[OPT1.NEWCTL]DECERR
_DRA1:[OPT1.NEWCTL]DECSUB
_DRA1:[OPT1.NEWCTL]DOACCT
_DRA1:[OPT1.NEWCTL]DOSTAT
_DRA1:[OPT1.NEWCTL]DOTRIP
_DRA1:[OPT1.NEWCTL]ENDENT
_DRA1:[OPT1.NEWCTL]ENTAMT
_DRA1:[OPT1.NEWCTL]ENTSER
_DRA1:[OPT1.NEWCTL]EXTSER
_DRA1:[OPT1.NEWCTL]EXTTRP
_DRA1:[OPT1.NEWCTL]FATERR
_DRA1:[OPT1.NEWCTL]FINTRP
_DRA1:[OPT1.NEWCTL]HDRONY
_DRA1:[OPT1.NEWCTL]HDRPLS
_DRA1:[OPT1.NEWCTL]IDLE
_DRA1:[OPT1.NEWCTL]MANRST
_DRA1:[OPT1.NEWCTL]MESAGE
_DRA1:[OPT1.NEWCTL]MSERNO
_DRA1:[OPT1.NEWCTL]MSG2MU
_DRA1:[OPT1.NEWCTL]MTRSTS
_DRA1:[OPT1.NEWCTL]NPAUSE
_DRA1:[OPT1.NEWCTL]POSUPD
_DRA1:[OPT1.NEWCTL]PROERR
_DRA1:[OPT1.NEWCTL]RDCYC
_DRA1:[OPT1.NEWIO]RECEVE
_DRA1:[OPT1.NEWCTL]REDSTS
_DRA1:[OPT1.NEWCTL]SELVAL
_DRA1:[OPT1.NEWCTL]SEREOE
_DRA1:[OPT1.NEWCTL]SETPOS
_DRA1:[OPT1.NEWCTL]SRVCNV
_DRA1:[OPT1.NEWCTL]SRVREQ
_DRA1:[OPT1.NEWCTL]VALREQ
_DRA1:[OPT1.NEWCTL]XEQHDR
_DRA1:[OPT1.NEWIO]XMIT
```

<<< ASSEMBLY COMMAND STRING - continued >>>

```
;       U T I L I T I E S
_DRA1:[OPT1.NEWUTL]CLRBLK
_DRA1:[OPT1.NEWUTL]CMPARE
_DRA1:[OPT1.NEWUTL]CRC
_DRA1:[OPT1.NEWUTL]CRCNIB
_DRA1:[OPT1.NEWUTL]DBLANK
_DRA1:[OPT1.NEWUTL]DFLUSH
_DRA1:[OPT1.NEWUTL]DSBKBD
_DRA1:[OPT1.NEWUTL]ENAKBD
_DRA1:[OPT1.NEWUTL]FILNIB
_DRA1:[OPT1.NEWUTL]GETNIB
_DRA1:[OPT1.NEWUTL]LSTATE
_DRA1:[OPT1.NEWUTL]MOVBIT
_DRA1:[OPT1.NEWUTL]MVLNIB
_DRA1:[OPT1.NEWUTL]MVRNIB
_DRA1:[OPT1.NEWUTL]PUTNIB
_DRA1:[OPT1.NEWUTL]RSCAN
_DRA1:[OPT1.NEWUTL]TDBITM
_DRA1:[OPT1.NEWUTL]VCALL
_DRA1:[OPT1.NEWUTL]VCALLS
;       N O N   V O L A T I L E   M E M O R Y
_DRA1:[OPT1.NEWNVM]NVM30F
_DRA1:[OPT1.NEWNVM]NVM30T
_DRA1:[OPT1.NEWNVM]NVMBYT
_DRA1:[OPT1.NEWNVM]NVMCHG
_DRA1:[OPT1.NEWNVM]NVMDED
_DRA1:[OPT1.NEWNVM]NVMDXB
_DRA1:[OPT1.NEWNVM]NVMER
_DRA1:[OPT1.NEWNVM]NVMFND
_DRA1:[OPT1.NEWNVM]NVMLOD
_DRA1:[OPT1.NEWNVM]NVMMAP
_DRA1:[OPT1.NEWNVM]NVMNBK
_DRA1:[OPT1.NEWNVM]NVMNXT
_DRA1:[OPT1.NEWNVM]NVMOPN
_DRA1:[OPT1.NEWNVM]NVMPRP
_DRA1:[OPT1.NEWNVM]NVMRD
_DRA1:[OPT1.NEWNVM]NVMSTO
_DRA1:[OPT1.NEWNVM]NVMWN
_DRA1:[OPT1.NEWNVM]NVMWR
;       V R M R S
_DRA1:[OPT1.VRMRS]ACCODE
_DRA1:[OPT1.VRMRS]BINOCT
_DRA1:[OPT1.VRMRS]VRCDR
_DRA1:[OPT1.VRMRS]VRCLR
_DRA1:[OPT1.VRMRS]VRCREC
_DRA1:[OPT1.VRMRS]VRMRS
_DRA1:[OPT1.VRMRS]VRSET
_DRA1:[OPT1.DEBUG]PATENT
;       M O T O R   S U B S Y S T E M
;_DRA1:[OPT1.DEBUG]STUB
_DRA1:[EASWARAN.CONTROL]DMOVE
_DRA1:[EASWARAN.CONTROL]ENCMOV
_DRA1:[EASWARAN.CONTROL]ENDMOV
_DRA1:[EASWARAN.CONTROL]MDSEEK
_DRA1:[EASWARAN.CONTROL]MOPEN
_DRA1:[EASWARAN.CONTROL]MOTMOV
_DRA1:[EASWARAN.CONTROL]POHOME
_DRA1:[EASWARAN.CONTROL]RENC
_DRA1:[EASWARAN.CONTROL]SETCLS
```

<<< end of assembly command string >>>

```
1                   LINES 60
3                   NLIST   M
5               ;  ********************************
6               ;  ***   RAM LABEL DEFINATIONS   ***
7               ;  ********************************
21  0000                +FIXSED  EQU   PTR
26  0008                +VARSED  EQU   PTR
31  0010                +CTLCRC  EQU   PTR
36  0012                +RSTCNT  EQU   PTR
```

```
 41  0013          +ERRST  EQU   PTR
 46  0014          +ERRCOD  EQU   PTR
 51  0016          +ERRCNT  EQU   PTR
 56  0018          +UNLOCK  EQU   PTR
 61  001C          +LOWWRN  EQU   PTR
 66  001E          +SETLIM  EQU   PTR
 71  0020          +SERFLG  EQU   PTR
 76  0021          +SERNUM  EQU   PTR
 81  0028          +PCEREG  EQU   PTR
 86  002F          +DSCREG  EQU   PTR
 91  0036          +DSCCRC  EQU   PTR
 96  0038          +ASCREG  EQU   PTR
101  0040          +ASCCRC  EQU   PTR
106  0042          +POSREG  EQU   PTR
111  0046          +MTRCHR  EQU   PTR
116  0048          +MRSTS1  EQU   PTR
121  004A          +MRSTS2  EQU   PTR
126  004C          +NORFLG  EQU   PTR
131  004E          +KDCTRL  EQU   PTR
136  0050          +BLKTMR  EQU   PTR
141  0052          +DSPTMR  EQU   PTR
146  0054          +KEYBKT  EQU   PTR
151  0056          +CTLBKT  EQU   PTR
156  0058          +CHRBKT  EQU   PTR
161  005A          +CURBKT  EQU   PTR
166  005C          +DBCTR  EQU   PTR
171  005E          +SKPVAL  EQU   PTR
176  0060          +SKPCNT  EQU   PTR
181  0062          +TIMVEC  EQU   PTR
186  0066          +NVMCTL  EQU   PTR
191  0068          +OLDSWT  EQU   PTR
196  006A          +DIEDCM  EQU   PTR
201  006C          +DEFDCM  EQU   PTR
206  006E          +PORTBI  EQU   PTR
214  0070          +SPARE  EQU   PTR
219  0080          +DBUF  EQU   PTR
224  008C          +SPARE1  EQU   PTR
229  0090          +RECBUF  EQU   PTR
234  00A0          +XMTBUF  EQU   PTR
239  00B0          +SPARE2  EQU   PTR
244  00C0          +WORK1  EQU   PTR
249  00D0          +WORK2  EQU   PTR
254  00E0          +AMTBUF  EQU   PTR
259  00F0          +CMBBUF  EQU   PTR
265  0000          +DIMAGE  EQU   PTR
269            NLIST M
272          ;                    FLAG ASSIGNMENTS


274          ; RAM                BIT
275          ; LABEL     BIT      LABEL     DESCRIPTION

277          ; Serflg    0        Dead      Unrecoverable Fatal Error
278          ;            1
279          ;             2      Weknvm    Retention qualities of NVM poor
280          ;              3     Snolck    Sernum can no longer be changed
281          ;
282          ; Mrsts1    0        Unksel    Unknown selection value
283          ;            1       Datdor    Check date warning
284          ;             2      Insfnd    Insufficient funds
285          ;              3     Lowpos    Low postage warning
286          ;               4    Sermod    In service mode
287          ;                5   Enabld    Meter enabled
288          ;                 6  Incyc     Trip mechanism in cycle
289          ;                  7 Quereq    Trip request being processed
290          ;
291          ; Mrsts2    0        Fatmod    Detected fatal error condition
292          ;            1
293          ;             2
294          ;              3
295          ;               4    Trpsw     Trip switch status
296          ;                5
297          ;                 6
298          ;                  7 Prvmod    Privileged mode set
```

```
299                 ;
300                 ; Norflg    0         Quests    Status is to be transmitted
301                 ;            1        Quepos    Current selection is to be transmitted
302                 ;             2       Cmbin     Combination entered
303                 ;              3      Amtin     Amount entered
304                 ;               4     Trpreq    Trip waiting to be processed
305                 ;                5    Comdsb    External communications disabled
306                 ;                 6   Unvsel    Selected postage not verified
307                 ;                  7  Latdsb    Commanded disable (latched)
308                 ;
309                 ; Kdctrl    0         Stgdsp    Setting is on display
310                 ;            1        Flsdsp    Flashing display
311                 ;             2       Timed     Display is timed
312                 ;              3
313                 ;               4
314                 ;                5    Flsdcm    Flashing decimal
315                 ;                 6
316                 ;                  7  Kbddsb    Keyboard disabled


318                 ; ************************************
319                 ; ***   HARDWARE ADDRESS POINTERS   ***
320                 ; ************************************

322 7400            X       EQU   7400H  BASE ADDRESS OF RAM
323 7480            Y   EQU   7480H  BASE ADDRESS OF RAM UPPER HALF
324 7000            CTLREG  EQU   7000H  8155 CONTROL REGISTER
325 6800            DATA1   EQU   6800H  SWITCH DATA ADDRESS
326 02BE            KILCOD  EQU    2BEH  ADDRESS OF KILCODES IN NVM
327 4800            NVMWRT  EQU   4800H  WRITE ADDRESS FOR NON VOLATILE MEMORY
328 4400            NVMRED  EQU   4400H  READ ADDRESS FOR NON VOLATILE MEMORY
329 4000            NVMERS  EQU   4000H  ERASE ADDRESS FOR NON VOLATILE MEMORY
330 6800            PORT2A  EQU   DATA1
331 7001            PORTA   EQU   7001H  8155 PORT A ADDRESS
332 7002            PORTB   EQU   7002H  8155 PORT B ADDRESS
333 7003            PORTC   EQU   7003H  8155 PORT C ADDRESS
334 00FE            RETAIN  EQU    0FEH  ADDRESS OF NVM RETENTION LOCATION
335 8000            TEST    EQU   8000H  ADDRESS OF EXTERNAL TEST SOFTWARE
336 7004            TIMER   EQU   7004H  8155 TIMER DATA ADDRESS


338                 ; ********************************
339                 ; ***   P A R A M E T E R S   ***
340                 ; ********************************

342 0002            DBVAL   EQU   2      DEBOUNCE COUNT
343 0007            DSPVAL  EQU   7.     COUNT FOR 5.5 SEC TIMED DISPLAY
344 0002            KDSKIP  EQU   2      TIMER INT SKIP COUNT
345 4C96            KEYINT  EQU   (18.*179.).OR.4000H   VALUE FOR 1.8 MILLI SEC INT RATE
346 7FA1            MAXINT  EQU   (91.*179.).OR.4000H  MAX TIMER INTERVAL , 9.1 MILLI SEC
347 0080            MULKEY  EQU   80H    VALUE ASSIGNED TO MULTI KEY DEPRESSION
348 0002            NDISP   EQU   2      NO. OF DISPLAY PACKS
349 0008            DSPCHR  EQU   (NDISP*4) MAX NO. OF CHAR DISPLAYABLE
350                 ;   NON-VOLATILE MEMORY PARAMETERS
351 0000            SRVSTR   EQU   FIXSED  NIBB OFFSET FOR START OF SERVICE BLOCK IN RAM
352 0028            NORSTR   EQU   PCEREG  NIBB OFFSET FOR START OF NORMAL BLOCK IN RAM
353 0028            SRVSIZ   EQU   NORSTR-SRVSTR
354 0022            NORSIZ   EQU   MRSTS2-NORSTR


356                 ;  ******************************************
357                 ; ***   VALUE SIZE IN NIBBLES ( DIGITS )   ***
358                 ; ******************************************

360 0008            ASCSIZ   EQU   8     ASCENDING REGISTER
361 0007            DSCSIZ   EQU   7     DESCENDING REGISTER
362 0004            NBANKS   EQU   4     BANKS FOR POSTAGE PRINTING
363 0007            PCESIZ   EQU   7     PIECE REGISTER
```

```
365                ; ************************************
366                ; ***   V A L U E   F O R M A T S   ***
367                ; ************************************

369                ; FORMAT OF DATA  2 DIGITS
370                ;    LEFT DIGIT = NO. OF DIGITS
371                ;    RIGHT DIGIT = NO. OF DECIMAL PLACES EXCEPT
372                ;                = F HEX  NOT DECIMAL NO ( COUNT )
373                ;                = 0 USE NO. OF DECIMALS INDICATED BY DIEDCM

375 008F           ACCFMT  EQU   8FH    ACCESS CODE
376 0080           ASCFMT  EQU   80H    ASCENDING REG
377 0080           CSMFMT  EQU   80H    CONTROL SUM
378 005F           DIAFMT  EQU   5FH    DIAGNOSTIC STATUS
379 0070           DSCFMT  EQU   70H    DESCENDING REG
380 0040           LOKFMT  EQU   40H    UNLOCK
381 007F           MSNFMT  EQU   7FH    METER SERIAL NO
382 007F           PCEFMT  EQU   7FH    PEICE COUNT
383 0040           POSFMT  EQU  NBANKS*10H SELECTION



385                ; ************************************
386                ; ***   MISSING ENTRY POINT TRAPS   ***
387                ; ************************************



390                ; ******************************
391                ; ***   FATAL ERROR CODES   ***
392                ; ******************************

394 0002           SFTWRE   EQU   02H   DETECTED INCONSISTANT SET OF ARGUMENTS ON CALL
395 0008           TRPTIM   EQU   08H   TRIP FAILED TO COMPLETE WITHIN ALLOWED TIME
396 0009           RSTTRY   EQU   09H   EXCEEDED ALLOWED NO OF UNSUCESSFUL RESET ATTEMPTS
397 0011           BADSW    EQU   11H   DETECTED ILLOGICAL SWITCH CONDITION
398 0012           BUFOVR   EQU   12H   INFORMATION WAS OVER WRITTEN IN TRANSMIT BUF
399 0017           BARF     EQU   17H   UNEXPECTED INTERRUPT
400 0018           NINCYC   EQU   18H   CYCLE SWITCH FAILED TO INDICATE NOT HOME



402                ; ***********************
403                ; ***   KILL CODES   ***
404                ; ***********************

406                ; CODES 0 - 9 WILL RESULT IN THE METER BEING
407                ;             PERMINITELY INOPERATIVE
408                ; CODES A - E WILL RESULT IN CPU BEING HALTED
409                ; CODE F  IS NORMAL OPERATION
410 0000           BADCRC   EQU    0H   DETECTED BAD CRC
411 0001           NVMBAD   EQU    1H   ERRASE OR WRITE TO NVM UNSUCESSFUL
412 0002           NVMRET   EQU    2H   READ BEFORE ERASE FAILED,  IE UNACCEPTABLE RETENTIO
413 0003           FATRST   EQU    3H   DESCENDING REG CLEARED WHILE FATAL MODE
414 0004           BADCYC   EQU    4H   UNACCEPTABLE RESPONSE FROM CYCLE SWITCH
415                ;        EQU    5H   SPARE
416                ;        EQU    6H   SPARE
417                ;        EQU    7H   SPARE
418                ;        EQU    8H   SPARE
419                ;        EQU    9H   SPARE
420                ;   WILL RESULT IN CPU HALTING ON POWER UP
421 000A           BADRAM   EQU   0AH   DETECTED BAD RAM ON POWERUP
422                ;        EQU   0BH   SPARE
423                ;        EQU   0CH   SPARE
424                ;        EQU   0DH   SPARE
425                ;        EQU   0EH   SPARE
```

```
427                 ; ****************************
428                 ; ***   MESSAGE HEADERS   ***
429                 ; ****************************

431                 ; COMMANDS
432 0041            HENABL  EQU   41H    ENABLE METER
433 0042            HDISAB  EQU   42H    DISABLE METER
434 0043            HENDEN  EQU   43H    END OF ENTRY
435 0046            HSETSV  EQU   46H    SET SERVICE MODE
436 0047            HCLRSV  EQU   47H    CLEAR SERVICE MODE
437 004E            HEXTRP  EQU   4EH    EXTERNAL TRIP
438 0062            HENAKB  EQU   62H    ENABLE KEYBOARD
439 0063            HDISKB  EQU   63H    DISABLE KEYBOARD

441 00C0            HSETMN  EQU   0C0H   ENTER METER SERIAL NUMBER
442 00C1            HSETPO  EQU   0C1H   SET POSTAGE
443 00C4            HSETDA  EQU   0C4H   CLEAR CHECK DATE
444 00C5            HENTAM  EQU   0C5H   ENTER AMOUNT
445 00C6            HENTCO  EQU   0C6H   ENTER COMBINATION
446                 ; SERVICE
447                 ; NAME            COMBO    AMT FMT MAX
448                 ; UNLOCK VALUE       0        42
449                 ; LOW POSTAGE WARN   1        2F
450                 ; SETTABLE LIMIT     2        2F

452                 ;REQUESTS - NORMAL MODE
453 0040            HREQAC  EQU   40H    ACCESSCODE REQUEST
454 0050            HREQST  EQU   50H    STATUS REQUEST
455 0051            HREQPO  EQU   51H    CURRENT SELECTION VALUE
456 0052            HREQAR  EQU   52H    ASCENDING REGISTER VALUE
457 0053            HREQDR  EQU   53H    DESCENDING REGISTER VALUE
458 0054            HREQCS  EQU   54H    CONTROL SUM VALUE
459 0055            HREQPC  EQU   55H    PEICE COUNT VALUE
460 005B            HREQCF  EQU   5BH    CONFIGURATION REQUEST
461 005C            HREQSN  EQU   5CH    SERIAL NUMBER VALUE

463                 ;REQUESTS - SERVICE MODE

465                 ;             50H    STATUS REQUEST
466                 ;             51H    CURRENT SELECTION VALUE
467 0052            HREQDL  EQU   52H    LOCK VALUE
468 0053            HREQLP  EQU   53H    LOW POSTAGE WARNING
469 0054            HREQMN  EQU   54H    METER SERIAL NO.
470 0055            HREQDS  EQU   55H    DIAGNOSTIC STATUS
471 0056            HREQSL  EQU   56H    SETTABLE LIMIT
472                 ;             5CH    SERIAL NUMBER VALUE
473 0000            EJEC
474                 ;VALUE HEADERS
475 0080            HSTAT   EQU   80H    METER STATUS
476 0081            HPSET   EQU   81H    POSTAGE VALUE
477 0082            HAREG   EQU   82H    ASCENDING REGISTER
478 0083            HDREG   EQU   83H    DESCENDING REGISTER
479 0084            HCSUM   EQU   84H    CONTROL SUM
480 0085            HPCNT   EQU   85H    PIECE COUNT
481 008A            HDLOCK  EQU   8AH    UNLOCK VALUE
482 008B            HLOPOS  EQU   8BH    LOW POSTAGE WARNING
483 008C            HMTRNO  EQU   8CH    METER SERIAL NUMBER
484 008D            HDIAGS  EQU   8DH    DIAGNOSTIC STATUS
485 008E            HHSLIM  EQU   8EH    SETTABLE LIMIT
486 0090            HACODE  EQU   90H    ACCESS CODE
487 00AB            HCONFG  EQU   0ABH   METER CONFIGURATION

490                 ;   INTERRUPT JUMP TABLE TO VECTOR INTERRUPTS TO CORRECT ENTRY POINT
491                  ORG   0
492 0000 C3 C5 01    JMP   PWRUP     RST 0  POWER ON RESET
493                  ORG   8H        RST1
494 0008 C3 A1 0B    JMP   PROERR
495                  ORG   10H       RST2
496 0010 C3 A1 0B    JMP   PROERR
497                  ORG   18H       RST3
498 0018 C3 A1 0B    JMP   PROERR
499                  ORG   20H       RST4
```

```
500 0020 C3 A1 0B  JMP   PROERR
501                ORG   24H       TRAP  ( WATCH DOG TIMER )
502 0024 C3 7E 08  JMP   FATINT
503                ORG   28H       RST5
504 0028 C3 A1 0B  JMP   PROERR
505                ORG   2CH       5.5  ( POWER FAIL )
506 002C C3 7E 08  JMP   FATINT
507                ORG   30H       RST6
508 0030 C3 A1 0B  JMP   PROERR
509                ORG   34H       6.5
510 0034 C3 B6 01  JMP   PWRDN
511                ORG   38H       RST7
512 0038 C3 A1 0B  JMP   PROERR
513                ORG   3CH       7.5  ( TIMER )
514 003C C3 9D 00  JMP   INT75
515                   ORG     40H
518               ;CLKDEC/CLKDGT(KDCTRL,BLKMSK,PORTA )
519               ;             (BITSTR,BYTE  ,BITSTR)
520               ;             ( I    , I    , I/O  )
521               ;             ( PSW  , B    , @HL  )
522               ;             ( C    , NC   , C    )
523               ;
524               ;REGISTER A DESTROYED
525               ;PSW DESTROYED
526               ;
527               ;CLOCK DECIMAL/DIGIT BITS FROM PORTA INTO DISPLAYS.
528               ;MODIFIES BITS TO CAUSE BLINKING.
529               ;
530               CLKDEC;              ****ENTRY FROM DSPLY ONLY
531 0040 EA 46 00   JPE  CLKD01        IF(KDCTRL.FLSDCM .OR. KDCTRL.FLSDSP)
532               ;                      .EQ. TRUE
533               ;                      MODIFY BITS WITH BLINK CONTROL MASK
534               ;                    ENDIF
535               ;                    PULSE CLOCK BITS
536               ;                    RETURN
537               CLKDGT;              ****ENTRY FROM DSPLY ONLY
538 0043 C2 49 00   JNZ  CLKD02        IF KDCTRL.FLSDSP .EQ. TRUE
539               CLKD01;                MODIFY BITS WITH BLINK CONTROL MASK
540 0046 7E         MOV  A,M             PORTA = PORTA .OR. BLKMSK
541 0047 B0         ORA  B
542 0048 77         MOV  M,A
543               CLKD02;              ENDIF
544 0049 35         DCR  M             PULSE CLOCK BIT
545 004A 34         INR  M
546 004B C9         RET                RETURN
549               ;DBOUNC()(KEYBKT,CTLBKT,CHRBKT)(DBCTR)
550               ;        (BYTE  ,BYTE  ,BYTE  )(UBYTE)
551               ;        ( I    , O    , O    )( I/O )
552               ;        ( RAM  , RAM  , RAM  )( RAM )
553               ;        ( NC   , C    , C    )( C   )
554               ;
555               ;REGISTERS DESTROYED
556               ;PSW DESTROYED
557               ;
558               ;DEFINES DEBOUNCED KEYCODES CTLBKT AND CHRBKT FOR USE OF
559               ;MAINLINE KEYBOARD ROUTINE.  CHRBKT DIFFERS FROM CTLBKT
560               ;IN THAT THE MAINLINE ROUTINE MAY SET CHRBKT = 0.
561               ;
562               DBOUNC;              ****ENTRY FROM KDIO ONLY
563 004C 3A 2A 74   LDA  KEYBKT/2+X    A = KEYBKT
564               ;                    DECREMENT DBOUNCE COUNTER
565 004F 21 2E 74   LXI  H,DBCTR/2+X   HL = ADDRESS, DBCTR
566 0052 35         DCR  M             DBCTR = DBCTR - 1
567               ;                    CHECK WHETHER COUNTER WAS STOPPED AT 1
568 0053 C2 5D 00   JNZ  DBOUN1        IF DBCTR .EQ. 0
569               ;                      KEEP COUNTER AT 1
570 0056 34         INR  M               DBCTR = 1
571               ;                      KEYBOARD IS DEBOUNCED
572               ;                      DEFINE NEW KEYCODE OUTPUT BUCKETS
573 0057 32 2C 74   STA  CHRBKT/2+X      CHRBKT = KEYBKT
574 005A 32 2B 74   STA  CTLBKT/2+X      CTLBKT = KEYBKT
575               DBOUN1;              ENDIF
```

```
576                 ;                       CHECK WHETHER KEY IS  PRESSED
577 005D B7           ORA  A                IF KEYBKT .NE. HEX00
578 005E C8           RZ
579                 ;                         SET DEBOUNCE PERIOD
580 005F 36 02        MVI  M,DBVAL            DBCTR = DBVAL
581                 ;                       ENDIF
582 0061 C9           RET                   RETURN
585                 ;DISPLY()(KDCTRL,BLKTMR,PORTA )
586                 ;        (BITSTR,BYTE  ,BITSTR)
587                 ;        ( I    , I    , I/O  )
588                 ;        ( RAM  , RAM  , 7001 )
589                 ;        ( NC   , NC   , C    )
590                 ;
591                 ;REGISTERS DESTROYED
592                 ;PSW DESTROYED
593                 ;
594                 ;DISPLAY ROUTINE
595                 ;
596                 DISPLY;                 ****ENTRY FROM KDIO ONLY
597                 ;                       FETCH DISPLAY CONTROL BYTE
598 0062 2A 27 74     LHLD KDCTRL/2+X
599                 ;                       L = KDCTRL
600                 ;                       H = BLKTMR
601 0065 5D           MOV  E,L              E = KDCTRL
602                 ;                       DEFINE DISPLAY BLINK CONTROL MASK
603 0066 06 01        MVI  B,01H            B = BLKMSK = HEX01, FOR DISPLAY ON
604 0068 24           INR  H                IF (BLKTMR+1) .GE. 0
605 0069 FA 72 00     JM   DISP02
606 006C 2C           INR  L                  IF KDCTRL.STGDSP .EQ. TRUE
607 006D F2 72 00     JP   DISP01
608 0070 06 0F        MVI  B,0FH                B = BLKMSK = HEX0F, FOR DISPLAY OFF
609                 DISP01;                   ENDIF
610                 DISP02;                 ENDIF
611                 ;                       OUTPUT START BITS FOR DISPLAY LOAD
612 0072 21 01 70     LXI  H,PORTA          HL = ADDRESS, PORTA
613 0075 7E           MOV  A,M              PORTA = PORTA.AND.HEXF1, 3 START BITS
614 0076 E6 F1        ANI  0F1H
615 0078 77           MOV  M,A
616 0079 35           DCR  M                PULSE CLOCK BIT
617 007A 34           INR  M
618                 ;                       SET TO LOAD 4 DIGITS INTO EACH DISPLAY
619 007B 0E 04        MVI  C,4              C = CHRCNT = 4
620                 DISP03;                 DO UNTIL CHRCNT .EQ. 0
621                 ;                         DEFINE BIT SELECTION MASK
622 007D 16 80        MVI  D,80H              D = BITMSK = HEX80
623                 DISP04;                   DO UNTIL BITMSK .EQ. HEX01
624                 ;                           MOVE DIGIT BITS FROM DIMAGE TO
625                 ;                           PORTA
626 007F CD DE 00     CALL MVDDAT               MVDDAT(CHRCNT,BITMSK,KDCTRL,PORTA,
627                 ;                                ( C    , D    , E    , @HL ,
628                 ;                                ( I    , I    , I    , I/O ,
629                 ;
630                 ;                                KDCTRL)
631                 ;                                 PSW  )
632                 ;                                 0    )
633                 ;                           CLOCK OUT DIGIT BITS
634 0082 CD 43 00     CALL CLKDGT               CLKDGT(KDCTRL,BLKMSK,PORTA )
635                 ;                                ( PSW  , B    , @HL  )
636                 ;                                ( I    , I    , I/O  )
637                 ;                           SHIFT BIT SELECTION MASK TO RIGHT
638 0085 7A           MOV  A,D                  D = BITMSK = BITMSK/2
639 0086 0F           RRC
640 0087 57           MOV  D,A
641 0088 1F           RAR                       TEST BITMSK
642 0089 D2 7F 00     JNC  DISP04
643                 ;                         ENDDO
644                 ;                         MOVE DECIMAL BITS FROM DIMAGE TO
645                 ;                         PORTA
646 008C CD DE 00     CALL MVDDAT             MVDDAT(CHRCNT,BITMSK,KDCTRL,PORTA,
647                 ;                              ( C    , D    , E    , @HL ,
648                 ;                              ( I    , I    , I    , I/O ,
649                 ;
```

```
650                 ;                                KDCTRL)
651                 ;                                 PSW  )
652                 ;                                 D    )
653                 ;                          CLOCK OUT DECIMAL BITS
654 008F CD 40 00     CALL CLKDEC              CLKDEC(KDCTRL,BLKMSK,PORTA)
655                 ;                                 ( PSW  , B    , @HL )
656                 ;                                 ( I    , I    , I/O )
657 0092 0D           DCR  C                   C = CHRCNT = CHRCNT-1
658 0093 C2 7D 00     JNZ DISP03
659                 ;                        ENDDO
660 0096 35           DCR  M                   3 CLOCK CYCLES TO FINISH LOAD
661 0097 34           INR  M
662 0098 35           DCR  M
663 0099 34           INR  M
664 009A 35           DCR  M
665 009B 34           INR  M
666 009C C9           RET                      RETURN
669                 ;INT75
670                 ;
671                 ;SERVICE INTERRUPT 7.5
672                 ;
673                 INT75;                   ****INTERRUPT ENTRY 7.5
674 009D E5           PUSH H                   SAVE HL
675 009E 21 7C 01     LXI  H,TIMINT            HL = ADRESS = ADDRESS, TIMINT
676 00A1 CD 25 10     CALL VCALLS              VCALLS(ADRESS)
677                 ;                                 ( HL   )
678                 ;                                 ( I    )
679 00A4 E1           POP  H                   RESTORE HL
680 00A5 FB           EI                       ENABLE INTERRUPTS
681 00A6 C9           RET                      RETURN
684                 ;KDIO()(KDCTRL,PORTBI,PORTB ,BLKTMR,DSPTMR,KEYBKT)
685                 ;      (BITSTR,BITSTR,BITSTR,BYTE  ,UBYTE ,BITSTR)
686                 ;      ( I    , I    , I/O  , I/O  , I/O  , O    )
687                 ;      ( RAM  , RAM  , 7002 , RAM  , RAM  , RAM  )
688                 ;      ( NC   , NC   , C    , C    , C    , C    )
689                 ;
690                 ;REGISTERS DESTROYED
691                 ;PSW DESTROYED
692                 ;
693                 ;KEYBOARD/DISPLAY I/O ROUTINE MAKES REAL TIME ASPECTS OF
694                 ;KEYBOARD/DISPLAY PROCESSING INVISIBLE TO APPLICATION
695                 ;LEVEL ROUTINES.
696                 ;
697                 KDIO;                    ****ENTRY FROM TIMINT ONLY
698                 ;                        INCREMENT CONTINUOUS RUN BLINK TIMER
699 00A7 21 28 74    LXI  H,BLKTMR/2+X        HL = ADDRESS, BLKTMR
700 00AA 34           INR  M                   BLKTMR = BLKTMR+1
701 00AB 5E           MOV  E,M                 E = BLKTMR
702 00AC C2 B7 00     JNZ  KDIO02              IF BLKTMR .EQ. 0
703                 ;                            DECREMENT TIMED DISPLAY TIMER. 1=STOP
704 00AF 21 29 74     LXI  H,DSPTMR/2+X        HL = ADDRESS, DSPTMR
705 00B2 35           DCR  M                   DSPTMR = DSPTMR-1
706 00B3 C2 B7 00     JNZ  KDIO01              IF DSPTMR .EQ. 0
707 00B6 34           INR  M                     DSPTMR = 1
708                 KDIO01;                    ENDIF
709                 KDIO02;                  ENDIF
710                 ;                        TOGGLE MOTOR FOR HALF POWER HOLD
711 00B7 3A 37 74     LDA  PORTBI/2+X          A = PORTBI
712 00BA 21 02 70     LXI  H,PORTB             HL = ADDRESS, PORTB
713 00BD AE           XRA  M                   PORTB = PORTB .XOR. PORTBI
714 00BE 77           MOV  M,A
715                 ;                        DEFINE PROGRAM CONTROL COUNTER
716 00BF 7B           MOV  A,E                 E = IOCTR = BLKTMR .AND. HEX07
717 00C0 E6 07        ANI  07H
718 00C2 5F           MOV  E,A
719                 ;                        CASE (IOCTR)
720 00C3 FE 05        CPI  5
721 00C5 D2 D0 00     JNC  KDIO03
722                 ;                          **0,1,2,3,4: READ KEYROWS
723 00C8 3A 27 74     LDA  KDCTRL/2+X            IF KDCTRL.KBDDSB .EQ. FALSE
724 00CB 1F           RAR
725                 ;                              KEYBOARD IS NOT DISABLED
726 00CC D2 0A 01     JNC  RDROW                     RDROW(IOCTR)
```

```
727                 ;                                   ( E   )
728                 ;                                   ( I   )
729                 ;                             ENDIF
730 00CF C9           RET
731                 KDID03;
732 00D0 C0           RNZ                     **5: START KEYBOARD/DISPLAY OUTPUT
733 00D1 CD 4C 00     CALL DBOUNC               DEBOUNCE KEYBOARD
734                 ;                           INITIALIZE FOR NEXT KEYBOARD SCAN
735 00D4 AF           XRA  A                    KEYBKT = 0
736 00D5 32 2A 74     STA  KEYBKT/2+X
737 00D8 CD F6 0E     CALL DFLUSH               FLUSH NOISE FROM DISPLAY SHIFT REG
738 00DB C3 62 00     JMP  DISPLY               OUTPUT TO DISPLAY
739                 ;                         **ELSE:
740                 ;                           COMPLETE PROCESSING INITIATED
741                 ;                           IN CASE **5:. THIS INTERRUPT LEVEL
742                 ;                           ROUTINE IS ITSELF INTERRUPTED.
743                 ;                       ENDCASE
744                 ;                       RETURN
747                 ;MVDDAT(CHRCNT,BITMSK,KDCTRL,PORTA ,KDCTRL)(DIMAGE)
748                 ;      (BYTE  ,BYTE  ,BITSTR,BITSTR,BITSTR)(BYTSTR)
749                 ;      ( I    , I    , I    , I/O  , O    )( I    )
750                 ;      ( C    , D    , E    , @HL  , PSW  )( RAM  )
751                 ;      ( NC   , NC   , NC   , C    , C    )( NC   )
752                 ;
753                 ;REGISTER A DESTROYED
754                 ;PSW DESTROYED
755                 ;
756                 ;FETCH SELECTED BITS FROM DIMAGE, INVERT THEM,
757                 ;AND MOVE THEM TO PORTA.
758                 ;COPY KDCTRL INTO PSW FOR LATER USE
759                 ;
760                 MVDDAT;                 ****ENTRY FROM DSPLY ONLY
761 00DE C5           PUSH B                SAVE REGISTERS
762 00DF E5           PUSH H
763                 ;                       SET DATA AND CLOCK BITS
764 00E0 7E           MOV  A,M              PORTA = PORTA .OR. HEXOF
765 00E1 F6 0F        ORI  0FH
766 00E3 77           MOV  M,A
767                 ;                       DEFINE INVERTED OUTPUT BIT FOR PORTA
768 00E4 06 FD        MVI  B,0FDH           B = OUTBIT = HEXFD
769                 ;                       CALCULATE INDEX
770 00E6 3E 04        MVI  A,4              A = INDEX = 4-CHRCNT
771 00E8 91           SUB  C
772                 ;                       SET TO MOVE 1 BIT INTO EACH DISPLAY
773 00E9 0E 02        MVI  C,NDISP          C = BITCTR = NDISP
774                 ;                       HL = ADDRESS,
775                 ;                       DIMAGE[INDEX+(NDISP-BITCTR)*4]
776 00EB 21 80 74     LXI  H,DIMAGE/2+Y
777 00EE 85           ADD  L
778 00EF 6F           MOV  L,A
779                 MVDD01;                 DO UNTIL BITCTR .EQ. 0
780 00F0 7E           MOV  A,M                IF(DIMAGE[INDEX+(NDISP-BITCTR)*4]
781                 ;                           .AND. BITMSK) .NE. 0
782 00F1 A2           ANA  D
783 00F2 CA FA 00     JZ   MVDD02
784                 ;                           PUT OUTBIT INTO PORTA
785 00F5 E3           XTHL                      HL = ADDRESS, PORTA
786 00F6 7E           MOV  A,M                  PORTA = PORTA .AND. OUTBIT
787 00F7 A0           ANA  B
788 00F8 77           MOV  M,A
789 00F9 E3           XTHL                      HL = ADDRESS,
790                 ;                           DIMAGE[INDEX+(NDISP-BITCTR)*4]
791                 MVDD02;                 ENDIF
792                 ;                       SHIFT OUTBIT TO LEFT
793 00FA 78           MOV  A,B              B = OUTBIT = OUTBIT*2+1
794 00FB 07           RLC
795 00FC 47           MOV  B,A
796 00FD 0D           DCR  C                C = BITCTR = BITCTR-1
797                 ;                       HL = ADDRESS,
798                 ;                       DIMAGE[INDEX+(NDISP-BITCTR)*4]
799 00FE 23           INX  H
```

```
800 00FF 23          INX  H
801 0100 23          INX  H
802 0101 23          INX  H
803 0102 C2 F0 00    JNZ  MVDD01          TEST BITCTR
804                ;                    ENDDO
805 0105 E1          POP  H              RESTORE REGISTERS
806 0106 C1          POP  B
807                ;                    SET PSW FOR CALL TO CLKDEC/CLKDAT
808 0107 D5          PUSH D              PSW = KDCTRL
809 0108 F1          POP  PSW
810 0109 C9          RET                 RETURN
813                ;RDROW(IOCTR )(PORTA ,PORTC ,KEYBKT)
814                ;     ( MOD8 )(BITSTR,BITSTR,NIBSTR)
815                ;     ( I    )( I/O  , I    , I/O  )
816                ;     ( E    )( 7001 , 7002 , RAM  )
817                ;     ( C    )( C    , NC   , C    )
818                ;
819                ;REGISTERS DESTROYED
820                ;STATUS DESTROYED
821                ;
822                ;READS THE KEYROWS DESIGNATED BY IOCTR.  CONSOLIDATES
823                ;DATA AS THE SCAN OF 5 KEYROWS PROGRESSES.  OUTPUTS
824                ;CODES TO KEYBKT INDICATING WHICH KEY, OR WHETHER NO
825                ;SINGLE KEY IS DOWN.
826                ;
827                RDROW;               ****ENTRY FROM KDIO ONLY
828                ;                    FORM STROBE MASK
829 010A 7B          MOV  A,E            B = STRMSK = (2*IOCTR) .XOR. HEXFF
830 010B 07          RLC
831 010C 2F          CMA
832 010D 47          MOV  B,A
833                ;                    FORM ROW CODE
834 010E 2F          CMA                 C = ROWCOD = IOCTR*HEX10
835 010F 07          RLC
836 0110 07          RLC
837 0111 07          RLC
838 0112 4F          MOV  C,A
839                ;                    STROBE KEYROW
840 0113 21 01 70    LXI  H,PORTA        HL = ADDRESS, PORTA
841 0116 7E          MOV  A,M            PORTA =
842                ;                    PORTA .OR. HEX0F .AND. STRMSK
843 0117 F6 0F       ORI  0FH
844 0119 A0          ANA  B
845 011A 77          MOV  M,A
846                ;                    READ POSITIVE LOGIC IMAGE OF KEYROW
847 011B 3A 03 70    LDA  PORTC          A = COLCOD = PORTC .AND. HEX0F
848 011E E6 0F       ANI  0FH
849 0120 C8          RZ                  IF COLCOD .NE. 0
850                ;                      A KEY IN CURRENT ROW IS DOWN
851 0121 21 2A 74    LXI  H,KEYBKT/2+X     HL = ADDRESS, KEYBKT
852 0124 34          INR  M                PSW:Z = NOPREV = KEYBKT .EQ. 0
853 0125 35          DCR  M
854                ;                      ASSUME MULTIPLE KEYS DOWN
855 0126 36 80       MVI  M,MULKEY         KEYBKT = MULKEY
856 0128 C0          RNZ                   IF NOPREV .EQ. TRUE
857                ;                        NO KEY SEEN IN PREVIOUS ROW
858 0129 FE 09       CPI  9                 IF COLCOD .LT. 9
859 012B D0          RNC
860                ;                          COL CODE VALUES 1 THRU 8 REMAIN
861 012C B7          ORA  A                     PSW:P = PARITY, COLCOD
862 012D E8          RPE                        IF PARITY .EQ. ODD
863                ;                            COL CODES 1,2,4,7,8 REMAIN
864 012E FE 07       CPI  7                     IF COLCOD .NE. 7
865 0130 C8          RZ
866                ;                              A SINGLE KEY IN ROW IS DOWN
867 0131 B1          ORA  C                       KEYBKT = ROWCOD .OR. COLCOD
868 0132 77          MOV  M,A
869                ;                            ENDIF
870                ;                          ENDIF
871                ;                        ENDIF
872                ;                      ENDIF
873                ;                    ENDIF
874 0133 C9          RET                 RETURN
```

```
877                 ;STPTMR(WASOFF)(PORTBI,PORTB ,SKPCNT,CTLREG)
878                 ;      (BIT   )(BITSTR,BITSTR,UBYTE ,TIMCTL)
879                 ;      ( 0    )( I    , 0    , 0    , 0    )
880                 ;      (PSW:Z )(RAM   ,7002  ,RAM   ,7000  )
881                 ;      ( C    )( NC   , C    , C    , C    )
882                 ;
883                 ;PSW:CY = NO CHANGE
884                 ;PSW:S, Z, P CHANGED; CORRESPOND TO SKPCNT AT ENTRY
885                 ;
886                 ;STOP INTERRUPT TIMER
887                 ;
888                 STPTMR;              ****ENTRY POINT
889 0134 E5           PUSH H             SAVE HL
890                 ;                    INDICATE TIMER STATUS AT ENTRY
891 0135 2A 30 74     LHLD SKPCNT/2+X    L = SKPCNT
892 0138 2C           INR  L             PSW:Z = WASOFF = SKPCNT .EQ. 0
893 0139 2D           DCR  L
894 013A E1           POP  H             RESTORE HL
895 013B F5           PUSH PSW           SAVE A, PSW:CY, WASOFF
896                 ;                    CHECK FOR RUNNING TIMER
897 013C CA 51 01     JZ   STPTM1        IF WASOFF .EQ. FALSE
898 013F 3E 43        MVI  A,43H           STOP TIMER
899 0141 32 00 70     STA  CTLREG
900                 ;                      DISABLE TIMER INTERRUPT
901 0144 3E 0D        MVI  A,0DH           A = HEX0D
902 0146 30           SIM
903                 ;                      INDICATE THAT TIMER IS STOPPED
904 0147 AF           XRA  A               SKPCNT = 0
905 0148 32 30 74     STA  SKPCNT/2+X
906                 ;                      HOLD DIGIT MOTOR IN POSITION
907 014B 3A 37 74     LDA  PORTBI/2+X      PORTB = PORTBI
908 014E 32 02 70     STA  PORTB
909                 STPTM1;              ENDIF
910 0151 F1           POP  PSW           RESTORE A, PSW:CY
911                 ;                    PSW:Z = WASOFF
912 0152 C9           RET                RETURN
915                 ;STRTMR(ISADR,SKIPCT,PERIOD,WASOFF)(TIMER ,SKPCNT,SKPVAL,
916                 ;      (ADDR ,UBYTE ,TMODCT,BIT   )(TMODCT,UBYTE ,UBYTE ,
917                 ;      ( I   , I    , I    , 0    )( 0    , 0    , 0    ,
918                 ;      ( HL  , A    , DE   , PSW:Z)(7004  , RAM  , RAM  ,
919                 ;      ( NC  , NC   , NC   , C    )( C    , C    , C    ,
920                 ;
921                 ;      TIMVEC,CTLREG,PORTB ,PORTBI)
922                 ;      ADDR  ,TIMCTL,BYTE  ,BYTE  )
923                 ;       0    , 0    , I    , 0    )
924                 ;      RAM   ,7000  ,7002  , RAM  )
925                 ;       C    , C    , NC   , C    )
926                 ;
927                 ;PSW:CY = NO CHANGE
928                 ;PSW:S, Z, P CHANGED; CORRESPOND TO SKPCNT AT ENTRY
929                 ;
930                 ;STARTS TIMER INTERRUPTS AFTER DEFINING INFORMATION NEEDED
931                 ;BY TIMINT.  ISADR IS ADDRESS OF INTERRUPT SERVICE RTN
932                 ;WHICH WILL BE ENTERED EVERY SKIPCT(TH) OCCURRENCE OF
933                 ;INTERRUPT.
934                 ;PERIOD WILL CONTAIN THE PARAMETER VALUE KEYINT.
935                 ;
936                 STRTMR;              ****ENTRY POINT
937 0153 E5           PUSH H             SAVE HL
938                 ;                    INDICATE TIMER STATUS AT ENTRY
939 0154 2A 30 74     LHLD SKPCNT/2+X    L = SKPCNT
940 0157 2C           INR  L             PSW:Z = WASOFF = SKPCNT .EQ. 0
941 0158 2D           DCR  L
942 0159 E1           POP  H             RESTORE HL
943 015A F5           PUSH PSW           SAVE A, PSW:CY, WASOFF
944                 ;                    CHECK FOR STOPPED TIMER
945 015B C2 7A 01     JNZ  STRTM1        IF WASOFF .EQ. TRUE
946                 ;                      SET TIMER MODE AND COUNT
947 015E EB           XCHG                 HL = PERIOD
948                 ;                      DE = ISADR
949 015F 22 04 70     SHLD TIMER           TIMER = PERIOD
950 0162 EB           XCHG                 HL = ISADR
```

```
951                 ;                       DE = PERIOD
952                 ;                       INITIALIZE SKIP COUNTER
953 0163 32 30 74     STA  SKPCNT/2+X       SKPCNT = SKIPCT
954                 ;                       SET REINITIALIZATION VALUE
955 0166 32 2F 74     STA  SKPVAL/2+X       SKPVAL = SKIPCT
956                 ;                       SET INTERRUPT SERVICE ROUTINE ADDR
957 0169 22 31 74     SHLD TIMVEC/2+X       TIMVEC = ISADR
958 016C 3E 19        MVI  A,19H            RESET AND ENABLE TIMER INTERRUPT
959 016E 30           SIM
960 016F 3E C3        MVI  A,0C3H           START TIMER
961 0171 32 00 70     STA  CTLREG
962                 ;                       UPDATE IMAGE OF PORTB
963 0174 3A 02 70     LDA  PORTB            PORTBI = PORTB
964 0177 32 37 74     STA  PORTBI/2+X
965                 STRTM1;               ENDIF
966 017A F1           POP  PSW              RESTORE A, PSW:CY
967                 ;                       PSW:Z = WASOFF
968 017B C9           RET                   RETURN
971                 ;TIMINT()(SKPCNT,SKPVAL,TIMVEC)
972                 ;        (UBYTE ,UBYTE ,ADDR  )
973                 ;        ( I/O  , I    , I    )
974                 ;        ( RAM  , RAM  , RAM  )
975                 ;        ( C    , NC   , NC   )
976                 ;
977                 ;PSW:S, Z, P, CY CHANGED
978                 ;
979                 ;DETERMINE WHETHER IT IS TIME TO TRANSFER CONTROL
980                 ;TO CURRENTLY ACTIVE INTERRUPT SERVICE ROUTINE.
981                 ;
982                 TIMINT;               ****ENTRY FROM INT75 ONLY
983 017C CD C7 0B     CALL RECEVE         TRY TO RECEIVE MESSAGE
984                 ;                     DECREMENT SKIP COUNTER
985 017F 21 30 74     LXI  H,SKPCNT/2+X HL = ADDRESS, SKPCNT
986 0182 35           DCR  M              SKPCNT = SKPCNT-1
987                 ;                     CHECK FOR COMPLETED COUNTDOWN
988 0183 C0           RNZ                 IF SKPCNT .EQ. 0
989                 ;                       REINITIALIZE SKIP COUNTER
990 0184 3A 2F 74     LDA  SKPVAL/2+X       A = SKPVAL
991 0187 77           MOV  M,A              SKPCNT = SKPVAL
992 0188 FB           EI                    ENABLE INTERRUPT
993                 ;                       PERFORM CURRENT INTRPT SERVICE RTN
994 0189 2A 31 74     LHLD TIMVEC/2+X       HL = ADRESS = TIMVEC
995 018C E9           PCHL
996                 ;                     ENDIF
997                 ;                     RETURN
1000                ;PWRABN
1001                ;
1002                ;A,PSW DESTROYED
1003                ;REGISTERS DESTROYED
1004                ;
1005                ;ABNORMAL POWER-UP OF METER WHICH POWERED DOWN DURING
1006                ;SETTING OR TRIP CYCLE
1007                ;
1008                PWRABN;               ****ENTRY POINT
1009 018D 3A 24 74    LDA  MRSTS1/2+X     IF MRSTS1.QUEREG .EQ. TRUE
1010 0190 1F          RAR
1011 0191 D2 AA 01    JNC  PWRAB2
1012                ;                       POWERED DOWN DURING TRIP
1013 0194 1F          RAR                     IF MRSTS1.INCYC .EQ. FALSE
1014 0195 DA A7 01    JC   PWRAB1
1015                ;                         ACCOUNTING NOT COMPLETED
1016 0198 CD 71 18    CALL SEKTRP             PREPARE TO TRIP
1017 019B F3          DI                      DISABLE INTERRUPTS
1018 019C CD 44 07    CALL DOACCT             DO ACCOUNTING
1019                ;                         INDICATE ACCOUNTING COMPLETE
1020 019F 21 24 74    LXI  H,MRSTS1/2+X       HL = ADDRESS, MRSTS1
1021 01A2 7E          MOV  A,M                MRSTS1.INCYC = TRUE
1022 01A3 F6 02       ORI  2
1023 01A5 77          MOV  M,A
1024 01A6 FB          EI                      ENABLE INTERRUPTS
1025                PWRAB1;                 ENDIF
```

```
1026 01A7 C3 A0 08   JMP  FINTRP          COMPLETE TRIP CYCLE
1027                PWRAB2;              ENDIF
1028                ;                    TRIP CYCLE COMPLETE
1029                ;                    PREPARE TO ZERO SET METER
1030 01AA CD 4E 0F   CALL LSTATE         LSTATE(FATMOD,NORMOD,SERMOD,PRVMOD)
1031                ;                          (PSW:S ,PSW:Z ,PSW:P ,PSW:CY)
1032                ;                          ( 0    , 0    , 0    , 0    )
1033 01AD F8         RM                  IF FATMOD .NE. TRUE
1034                ;                      METER IS HOME AND NOT DEAD
1035                ;                      DRIVE METER TO ZERO SETTING
1036 01AE CD 25 16   CALL SEKPOS          SEKPOS(ERROR)
1037                ;                            ( A   )
1038                ;                            ( 0   )
1039 01B1 B7         ORA  A                IF ERROR .NE. 0
1040                ;                        DECLARE FATAL ERROR
1041 01B2 C2 80 08   JNZ  FATERR            FATERR(ERROR,ERRFLG)
1042                ;                              ( A   ,PSW:Z )
1043                ;                              ( I   , 0    )
1044                ;                      ENDIF
1045                ;                    ENDIF
1046 01B5 C9         RET                 RETURN
1049                ;PWRDN/PWRUP
1050                ;
1051                ;A,PSW DESTROYED
1052                ;REGISTERS DESTROYED
1053                ;
1054                ;ENFORCE ORDERLY POWER-UP AND POWER-DOWN
1055                ;
1056                PWRDN;               ****ENTRY POINT
1057 01B6 F3         DI                  DISABLE INTERRUPTS
1058                ;                    TURN OFF DEVICES ON PORTA AND PORTB
1059 01B7 AF         XRA  A              PORTB = HEX00
1060 01B8 32 02 70   STA  PORTB
1061 01BB 3D         DCR  A              PORTA = HEXFF
1062 01BC 32 01 70   STA  PORTA
1063 01BF CD DE 0E   CALL DBLANK         CLEAR DISPLAY
1064                ;                    WRITE AND CLOSE ANY OPEN BLOCK
1065 01C2 CD 9E 12   CALL NVMWR          NVMWR(ERRFLG)
1066                ;                         (PSW:Z )
1067                ;                         ( 0    )
1068                PWRUP;               ****ENTRY POINT
1069                PWRU01;              DO UNTIL INT6.5 .EQ. 0
1070 01C5 20         RIM
1071 01C6 07         RLC
1072 01C7 07         RLC
1073 01C8 07         RLC                   PSW:CY = INT6.5
1074                ;                      A.0  = INT5.5
1075 01C9 DA C5 01   JC   PWRU01
1076                ;                    ENDDO
1077                ;                    POWER IS NOW FULLY ON
1078 01CC B7         ORA  A              PSW:S = INT5.5
1079                ;                    IF INT5.5 .EQ. TRUE
1080 01CD FA 00 80   JM   TEST              GO TO SPECIAL SERVICE ROUTINE
1081                ;                    ENDIF
1082                ; >>OMITTED<<        PULSE DEAD STICK TIMER
1083                ;                    INITIALIZE STACK POINTER
1084 01D0 31 00 75   LXI  SP,7500H       SP = HEX7500
1085                ;                    INITIALIZE 8155 TIMER AND PORTS
1086 01D3 3E 43      MVI  A,043H         CTLREG = HEX43
1087 01D5 32 00 70   STA  CTLREG
1088                ;                    TIMER SET FOR REPETITIVE SQUARE WAVE
1089                ;                    PORTA = PORTB = 0; OUTPUT MODE SET
1090                ;                    PORTC; INPUT MODE SET
1091 01D8 3E FF      MVI  A,0FFH         PORTA = HEXFF
1092 01DA 32 01 70   STA  PORTA
1093                ;                    TEST AND CLEAR ALL OF RAM
1094                ;                    FILL 256 BYTES OF RAM WITH HEXAA
1095 01DD 06 AA      MVI  B,0AAH         B = HEXAA
1096 01DF 21 00 74   LXI  H,X            HL = ADDRESS, X(I=0)
1097                PWRU02;              DO UNTIL (ADDR,X(I)) .EQ. (ADDR,X(0))
1098 01E2 70         MOV  M,B              X(I) = HEXAA
1099 01E3 2C         INR  L                HL = ADDRESS, X(I=I+1)
```

```
01E4 C2 E2 01   JNZ  PWRU02
                ;                   ENDDO
                ;                   XOR 256 BYTES OF RAM WITH HEX55
01E7 06 55      MVI  B,55H          B = HEX55
                PWRU03;             DO UNTIL (ADDR,X(I)) .EQ. (ADDR,X(0))
01E9 7E         MOV  A,M              X(I) = X(I) .XOR. HEX55
01EA A8         XRA  B
01EB 77         MOV  M,A
01EC 2C         INR  L                HL = ADDRESS, X(I=I+1)
01ED C2 E9 01   JNZ  PWRU03
                ;                   ENDDO
01F0 3E 0A      MVI  A,BADRAM       A = BADRAM
                ;                   INCREMENT AND TEST 256 BYTES OF RAM
                PWRU04;             DO UNTIL (ADDR,X(I)) .EQ. (ADDR,X(0))
01F2 34         INR  M                X(I) = X(I)+1
01F3 CA FC 01   JZ   PWRU05           IF X(I) .NE. 0
                ;                       DECLARE DEAD METER. BAD RAM
01F6 CD 85 10   CALL NVMDED             NVMDED(BADRAM,ERRFLG)
                ;                             ( A    ,PSW:Z )
                ;                             ( I    , 0    )
01F9 C3 00 02   JMP  PWRU06             BREAK
                PWRU05;               ENDIF
01FC 2C         INR  L                HL = ADDRESS, X(I=I+1)
01FD C2 F2 01   JNZ  PWRU04
                PWRU06;             ENDDO
                ;                   READ SPECIAL NVM LOCATION
0200 3A BE 46   LDA  NVMRED+KILCOD  A = NVMRED[KILCOD]
0203 3C         INR  A              IF (A .GE. 10).AND.(A .LT. 15) = TRUE
0204 E6 0F      ANI  0FH
0206 FE 0B      CPI  11
0208 DA 0C 02   JC   PWRU07
                ;                     METER IS OUT OF SERVICE
020B 76         HLT                   HALT
                PWRU07;             ENDIF
020C CD 6D 15   CALL INITSM         INITIALIZE STEPPER MOTORS
                ;                   FILL NVM DATA AREA WITH HEXFF
020F 01 00 48   LXI  B,((MTRCHR+1)-(FIXSED+0)+1)*100H+(FIXSED+0)
                ;                   B = NIBCNT; NVM DATA AREA
                ;                   C = OFFSET, FIXSED[0]
0212 3E FF      MVI  A,0FFH         A = HEXFF
0214 CD 24 0F   CALL FILNIB         FILNIB(FIXSED[0],HEXFF,NIBCNT)
                ;                         ( @C     , A   , B    )
                ;                         ( 0      , I   , I    )
                ;                   CLEAR DISPLAY IMAGE
0217 AF         XRA  A              A = HEX00
0218 CD 22 03   CALL FILDIM         FILDIM(HEX00)
                ;                         ( A   )
                ;                         ( I   )
                ;                   ENABLE INTERRUPT 6.5
021B 3E 0D      MVI  A,0DH          INTMSK = HEX0D
021D 30         SIM
021E CD 6B 11   CALL NVMLOD         LOAD AND CHECK NON VOLATILE MEMORY
                ;                   CHECK METER STATUS
0221 CD 4E 0F   CALL LSTATE         LSTATE(FATMOD,NORMOD,SERMOD,PRVMOD)
                ;                         (PSW:S ,PSW:Z ,PSW:P ,PSW:CY)
                ;                         ( 0    , 0    , 0    , 0    )
0224 FA 45 02   JM   PWRU09         IF FATMOD .EQ. FALSE
                ;                     NVM LOADED OK
                ;                     DEFINE DECIMAL POSITIONS ON DIE
0227 3A 23 74   LDA  MTRCHR/2+X       A = MTRCHR
022A E6 03      ANI  3                DIEDCM = MTRCHR .AND. HEX03
022C 32 35 74   STA  DIEDCM/2+X
                ;                     DEFINE DEFAULT DECIMAL POSITION
022F E6 02      ANI  2                DEFDCM = DIEDCM .AND. HEX02
0231 32 36 74   STA  DEFDCM/2+X
                ;                     CHECK NVM STATUS
0234 21 45 02   LXI  H,PWRU08         SET TO RETURN TO ENDIF
0237 E5         PUSH H
0238 3A BE 46   LDA  NVMRED+KILCOD    A = CODE = NVMRED[KILCOD]
023B E6 0F      ANI  0FH
023D FE 0F      CPI  0FH              IF NVMRED[KILCOD] .EQ. HEX0F
023F CA 9B 02   JZ   PWRU0K             CONTINUE NORMAL INITIALIZATION
```

```
1172                ;                          ELSE
1173                ;                            CONTINUE FATAL INITIALIZATION
1174 0242 C2 83 02   JNZ  PWRUNG                 PWRUNG(CODE)
1175                ;                                  ( A  )
1176                ;                                  ( I  )
1177                PWRU08;                    ENDIF
1178                PWRU09;                  ENDIF
1179                ;                        RECHECK METER STATUS
1180 0245 CD 4E 0F   CALL LSTATE             LSTATE(FATMOD,NORMOD,SERMOD,PRVMOD)
1181                ;                              (PSW:S ,PSW:Z ,PSW:P ,PSW:CY)
1182                ;                              ( 0    , 0    , 0    , 0    )
1183 0248 F2 50 02   JP   PWRU10             IF FATMOD .EQ. TRUE
1184                ;                          TURN ON SENSOR LEDS FOR SERVICE CHECK
1185 024B 3E DF      MVI  A,0DFH             PORTA = HEXDF
1186 024D 32 01 70   STA  PORTA
1187                PWRU10;                  ENDIF
1188                ;                        INITIALIZE DEBOUNCE COUNTER
1189 0250 3E 01      MVI  A,1                DBCTR = 1
1190 0252 32 2E 74   STA DBCTR/2+X
1191 0255 C3 7E 09   JMP  IDLE               ENTER IDLE STATE
1194                ;PWRNOR
1195                ;
1196                ;A,PSW DESTROYED
1197                ;REGISTERS DESTROYED
1198                ;
1199                ;CONTINUE POWER-UP FOR NORMAL SITUATION THAT POWER-DOWN
1200                ;OCCURRED WHEN METER WAS HOME
1201                ;
1202                PWRNOR;                  ****ENTRY POINT
1203                ;                        SET METER TO ALL NINES
1204 0258 21 24 74   LXI  H,MRSTS1/2+X       HL = ADDRESS, MRSTS1
1205 025B 7E         MOV  A,M                MRSTS1.UNKSEL = TRUE
1206 025C F6 80      ORI  80H
1207 025E 77         MOV  M,A
1208 025F 01 CC 04   LXI  B,NBANKS*100H+(WORK1+16-NBANKS)
1209                ;                        B = NIBCNT = NBANKS
1210                ;                        C = OFFSET, WORK1[I=16-NBANKS]
1211 0262 3E 09      MVI  A,9                A = HEX09
1212 0264 CD 24 0F   CALL FILNIB             FILNIB(WORK1[I],HEX09,NIBCNT)
1213                ;                              ( @C     , A    , B    )
1214                ;                              ( 0      , I    , I    )
1215 0267 CD 25 1A   CALL MVPOST             MVPOST(ERROR)
1216                ;                              ( A    )
1217                ;                              ( 0    )
1218 026A B7         ORA  A                  IF ERROR .NE. 0
1219                ;                          SETTING ERROR IS FATAL
1220 026B C2 80 08   JNZ  FATERR              FATERR(ERROR,ERRFLG)
1221                ;                                ( A    ,PSW:Z )
1222                ;                                ( I    , 0    )
1223                ;                        ELSE
1224                ;                          UPDATE BUFFER TO AGREE WITH SETTING
1225 026E 01 42 04   LXI  B,NBANKS*100H+POSREG
1226                ;                          B = NIBCNT = NBANKS
1227                ;                          C = OFFSET, POSREG
1228 0271 3E 09      MVI  A,9                A = HEX09
1229 0273 CD 24 0F   CALL FILNIB              FILNIB(POSREG,HEX09,NIBCNT)
1230                ;                                ( @C    , A    , B    )
1231                ;                                ( 0     , I    , I    )
1232                ;                          SET METER TO ALL ZEROES
1233 0276 3E C0      MVI  A,WORK1            A = OFFSET, WORK1
1234 0278 CD 85 0E   CALL CLRBLK              CLRBLK(WORK1)
1235                ;                                ( @A   )
1236                ;                                ( 0    )
1237 027B CD 25 1A   CALL MVPOST              MVPOST(ERROR)
1238                ;                                ( A    )
1239                ;                                ( 0    )
1240 027E B7         ORA  A                  IF ERROR .NE. 0
1241                ;                          SETTING ERROR IS FATAL
1242 027F C2 80 08   JNZ  FATERR              FATERR(ERROR,ERRFLG)
1243                ;                                ( A    ,PSW:Z )
1244                ;                                ( I    , 0    )
1245                ;                          ENDIF
1246                ;                        ENDIF
1247 0282 C9         RET                     RETURN
```

```
1250                ;PWRUNG(CODE  )
1251                ;      (NIBBLE)
1252                ;      ( I    )
1253                ;      ( A    )
1254                ;      ( C    )
1255                ;
1256                ;A,PSW DESTROYED
1257                ;REGISTERS CHANGED
1258                ;
1259                ;HANDLE POWER-UP OF METER PREVIOUSLY DECLARED DEAD
1260                ;
1261                PWRUNG;              ****ENTRY POINT
1262 0283 F5          PUSH PSW           SAVE A,PSW
1263                ;                    DECLARE FATAL ERROR
1264                ;                    FLAG METER DEAD
1265 0284 47          MOV  B,A           B = CODE
1266 0285 CD 99 10    CALL NVMDE1        NVMDE1(CODE,ERRFLG)
1267                ;                          ( B  ,PSW:Z )
1268                ;                          ( I  , 0    )
1269 0288 F1          POP  PSW           RESTORE A,PSW
1270 0289 FE 03       CPI  FATRST        IF CODE .EQ. FATRST
1271 028B C0          RNZ
1272                ;                      FAILED WHILE CLEARING DESC REGISTER
1273                ;                      CLEAR DESCENDING REGISTER
1274 028C 01 2F 07    LXI  B,DSCSIZ*100H+DSCREG
1275                ;                      B = NIBCNT = DSCSIZ
1276                ;                      C = OFFSET, DSCREG
1277 028F AF          XRA  A               A = HEX00
1278 0290 CD 24 0F    CALL FILNIB          FILNIB(DSCREG,HEX00,NIBCNT)
1279                ;                            ( @C   , A   , B    )
1280                ;                            ( 0    , I   , I    )
1281                ;                      UPDATE CRC
1282 0293 CD B1 0E    CALL CRC             CRC(DSCREG,NIBCNT,CRCVAL)
1283                ;                         ( @C   , B    , D    )
1284                ;                         ( I    , I    , 0    )
1285 0296 7A          MOV  A,D             DSCCRC = CRCVAL
1286 0297 32 1B 74    STA  DSCCRC/2+X
1287                ;                    ENDIF
1288 029A C9          RET                  RETURN
1291                ;PWRUOK
1292                ;
1293                ;A,PSW DESTROYED
1294                ;REGISTERS DESTROYED
1295                ;
1296                ;CONTINUATION OF SUCCESSFUL POWER-UP SEQUENCE
1297                ;
1298                PWRUOK;              ****ENTRY POINT
1299                ;                    OPEN NORMAL NVM BLOCK
1300 029B CD C4 11    CALL NVMOPN        NVMOPN(ERRFLG)
1301                ;                          (PSW:Z )
1302                ;                          ( 0    )
1303 029E C8          RZ                 IF ERRFLG .EQ. FALSE
1304                ;                      NVM BLOCK IS NOW OPEN
1305 029F 21 AD 02    LXI  H,PWRUO1        SET TO RETURN TO ENDIF
1306 02A2 E5          PUSH H
1307 02A3 3A 24 74    LDA  MRSTS1/2+X      IF MRSTS1.UNKSEL .EQ. TRUE
1308 02A6 B7          ORA  A
1309                ;                        POWERED DOWN DURING SETTING OR TRIP
1310 02A7 FA 8D 01    JM   PWRABN            PERFORM ABNORMAL POWER-UP
1311                ;                      ELSE
1312 02AA F2 58 02    JP   PWRNOR            PERFORM NORMAL POWER-UP
1313                PWRUO1;                ENDIF
1314                ;                      CHECK METER STATUS
1315 02AD CD 4E 0F    CALL LSTATE          LSTATE(FATMOD,NORMOD,SERMOD,PRVMOD)
1316                ;                            (PSW:S ,PSW:Z ,PSW:P ,PSW:CY)
1317                ;                            ( 0    , 0    , 0    , 0    )
1318 02B0 FA C1 02    JM   PWRUO2          IF FATMOD .EQ. FALSE
1319                ;                        POWER-UP COMPLETED
1320                ;                        CONTINUE WITH INITIALIZATION
1321                ;                        CLEAR POSTAGE REGISTER
1322 02B3 01 42 04    LXI  B,NBANKS*100H+POSREG
1323                ;                        B = NIBCNT = NBANKS
```

```
1324                ;                          C = OFFSET, POSREG
1325 02B6 AF          XRA  A                   A = HEX00
1326 02B7 CD 24 0F    CALL FILNIB              FILNIB(POSREG,HEX00,NIBCNT)
1327                ;                                ( @C   , A   , B    )
1328                ;                                ( O    , I   , I    )
1329                ;                          REGISTER NOW MATCHES SETTING
1330 02BA 21 24 74    LXI  H,MRSTS1/2+X        HL = ADDRESS, MRSTS1
1331 02BD 7E          MOV  A,M                 MRSTS1.UNKSEL = FALSE
1332 02BE E6 7F       ANI  7FH
1333 02C0 77          MOV  M,A
1334                PWRU02;                  ENDIF
1335                ;                        CHECK MEMORY RETENTION OF NVM
1336 02C1 3A FE 44    LDA  NVMRED+RETAIN       A = NVMRED[RETAIN]
1337 02C4 E6 0F       ANI  0FH
1338 02C6 FE 0A       CPI  0AH                 IF NVMRED[RETAIN] .NE. HEX0A
1339 02C8 CA DE 02    JZ   PWRU04
1340                ;                          MEMORY IS FAILING
1341 02CB 21 10 74    LXI  H,SERFLG/2+X        HL = ADDRESS, SERFLG
1342 02CE 7E          MOV  A,M                 IF SERFLG.WEKNVM .EQ. FALSE
1343 02CF E6 20       ANI  20H
1344 02D1 C2 DE 02    JNZ  PWRU03
1345                ;                            SERFLG.WEKNVM NOT SET IN NVM
1346 02D4 7E          MOV  A,M                     SERFLG.WEKNVM = TRUE
1347 02D5 F6 20       ORI  20H
1348 02D7 77          MOV  M,A
1349                ;                            WRITE NORMAL BLOCK
1350                ;                            LEAVE NO BLOCKS OPEN
1351 02D8 CD 9E 12    CALL NVMWR                   NVMWR(ERRFLG)
1352                ;                                 (PSW:Z )
1353                ;                                 ( O    )
1354                ;                            WRITE NEW SERVICE BLOCK
1355                ;                            OPEN ERASED NORMAL BLOCK
1356 02DB CD 19 12    CALL NVMSTO                  NVMSTO(ERRFLG)
1357                ;                                  (PSW:Z )
1358                ;                                  ( O    )
1359                PWRU03;                    ENDIF
1360                PWRU04;                  ENDIF
1361 02DE CD 47 10    CALL NVM30T              TURN ON -30V FOR NVM
1362                ;                        START ERASING RETENTION LOCATION
1363 02E1 32 FE 40    STA  NVMERS+RETAIN       NVMERS[RETAIN] = A
1364                ;                        PAUSE FOR 10 MSEC
1365 02E4 01 64 00    LXI  B,100               BC = LOOPCT = 100
1366                PWRU05;                    DO UNTIL LOOPCT .EQ. 0
1367 02E7 CD 19 0B    CALL NPAUSE                NPAUSE(LOOPCT,ZROFLG)
1368                ;                                ( BC   ,PSW:Z )
1369                ;                                ( I/O  , O    )
1370 02EA C2 E7 02    JNZ  PWRU05
1371                ;                        ENDDO
1372                ;                        TERMINATE ERASURE
1373 02ED 3A FE 44    LDA  NVMRED+RETAIN       A[1] = NVMRED[RETAIN] = GARBAGE
1374                ;                        CHECK ERASURE
1375 02F0 3A FE 44    LDA  NVMRED+RETAIN       A[1] = NVMRED[RETAIN]
1376 02F3 F6 F0       ORI  0F0H                A[0] = HEXF
1377 02F5 3C          INR  A                   PSW:Z=ERASED=NVMRED[RETAIN].EQ.HEXF
1378 02F6 3E 01       MVI  A,NVMBAD            A = NVMBAD
1379                ;                          IF ERASED .EQ. FALSE
1380                ;                            DECLARE DEAD METER. BAD NVM.
1381 02F8 C2 85 10    JNZ  NVMDED                NVMDED(NVMBAD,ERRFLG)
1382                ;                                ( A    ,PSW:Z )
1383                ;                                ( I    , O    )
1384                ;                          ENDIF
1385                ;                          WRITE HEX0A INTO RETENTION LOCATION
1386 02FB 21 FE 00    LXI  H,RETAIN            HL = BASE = ADDRESS, RETAIN
1387 02FE 3E 0A       MVI  A,0AH               A = HEX0A
1388 0300 CD 61 12    CALL NVMWN               NVMWN(HEX0A,BASE,ERRFLG)
1389                ;                                ( A[1], HL ,PSW:Z )
1390                ;                                ( I   , I  , O    )
1391 0303 C3 31 10    JMP  NVM30F              TURN OFF -30 V TO NVM
1392                ;                        ENDIF
1393                ;                        RETURN
```

```
1396                ;CDBUF/CDBUFC/CDBUFD()(DBUF  )
1397                ;                     (NIBSTR)
1398                ;                     ( I/O  )
1399                ;                     ( RAM  )
1400                ;                     ( C    )
1401                ;
1402                ;PSW:S, Z, P, CY = NO CHANGE
1403                ;
1404                ;-----------------------------------------------------------
1405                ;                   DISABLE METER AND CLEAR DBUF ONLY ON
1406                ;                   CONDITION THAT DISPLAYED VALUE WAS
1407                ;                   NOT ENTERED FROM KEYBOARD
1408                ;
1409                CDBUFC;             ****ENTRY POINT
1410 0306 F5          PUSH PSW          SAVE A, PSW
1411                ;                   CHECK FOR KEY ENTERED DISPLAY
1412 0307 3A 40 74    LDA  DBUF/2+X     A = DBUF[0..1]
1413 030A B7          ORA  A            IF DBUF[0..1] .EQ. HEX00
1414 030B CA 20 03    JZ   CDBUF1
1415                ; >>JUMP AHEAD<<
1416                ;                     DISPLAY WAS KEY ENTERED
1417                ;                     RESTORE A, PSW
1418                ;                     RETURN
1419                ;                   ENDIF
1420 030E F1          POP  PSW          RESTORE A, PSW
1421                ;-----------------------------------------------------------
1422                ;                   DISABLE METER AND CLEAR DISPLAY BUFFER
1423                ;
1424                CDBUFD;             ****ENTRY POINT
1425 030F F5          PUSH PSW          SAVE A, PSW
1426                ;                   DISABLE METER
1427 0310 3E 42       MVI  A,HDISAB     A = HDISAB
1428 0312 CD C7 0D    CALL XEQHDR       XEQHDR(HDISAB,ERROR)
1429                ;                         ( A    ,PSW:Z)
1430                ;                         ( I    , 0   )
1431 0315 F1          POP  PSW          RESTORE A, PSW
1432                ;-----------------------------------------------------------
1433                ;                   CLEAR DISPLAY BUFFER
1434                ;
1435                CDBUF;              ****ENTRY POINT
1436 0316 F5          PUSH PSW          SAVE A, PSW
1437                ;                   SET DBUF HEADER TO KEY ENTRY
1438 0317 AF          XRA  A            A = HEX00
1439 0318 32 40 74    STA  DBUF/2+X     OUTPUT DBUF[0..1] = HEX00
1440                ;                   SET DBUF FORMAT FOR NUL MESSAGE
1441 031B 3E 0F       MVI  A,0FH        DBUF[2..3] = HEX0F
1442 031D 32 41 74    STA  DBUF/2+X+1
1443                CDBUF1;             >>TARGET OF JUMP AHEAD<<
1444 0320 F1          POP  PSW          RESTORE A, PSW
1445 0321 C9          RET               RETURN
1448                ;FILDIM(VALUE )(DIMAGE)
1449                ;      (UBYTE )(BITSTR)
1450                ;      ( I    )( O    )
1451                ;      ( A    )( RAM  )
1452                ;      ( NC   )( C    )
1453                ;
1454                ;PSW DESTROYED
1455                ;REGISTERS DESTROYED
1456                ;
1457                ;FILL DISPLAY IMAGE BUFFER WITH VALUE
1458                ;
1459                FILDIM;              ****ENTRY POINT
1460                ;                    SET TO FILL (NDISP*4) BYTES
1461 0322 06 07       MVI  B,NDISP*4-1   B = BYTNO = NDISP*4-1
1462 0324 21 87 74    LXI  H,DIMAGE/2+Y+NDISP*4-1
1463                ;                    HL = ADDRESS, DIMAGE[BYTNO]
1464                FILDI1;              DO UNTIL BYTNO .LT. 0
1465 0327 77          MOV  M,A             DIMAGE[BYTNO] = VALUE
1466 0328 05          DCR  B               BYTNO = BYTNO-1
1467 0329 2B          DCX  H               HL = ADDRESS, DIMAGE[BYTNO]
1468 032A F2 27 03    JP   FILDI1          TEST BYTNO
1469                ;                    ENDDO
1470 032D C9          RET                  RETURN
```

```
                ;KEYBRD()(NORFLG,CTLBKT,CHRBKT,KDCTRL,DSPTMR,CURBKT)
                ;        (BITSTR,BYTE  ,BYTE  ,BITSTR,UBYTE ,BYTE  )
                ;        ( I    , I    , I/O  , I    , I    , O    )
                ;        ( RAM  , RAM  , RAM  , RAM  , RAM  , RAM  )
                ;        ( NC   , NC   , C    , NC   , NC   , C    )
                ;
                ;PSW AND REGISTERS DESTROYED
                ;
                ;SAMPLES INTERRUPT LEVEL KEYCODE BUCKETS.  DEFINES A
                ;STABLE KEYCODE BUCKET FOR APPLICATION USE.  INITIATES
                ;PROCESSING OF KEYPRESS.  UPDATES DISPLAY TO CONFORM TO
                ;METER STATUS.  INITIATES END OF ENTRY PROCESSING.
                ;
                KEYBRD;              ****ENTRY POINT
032E 3A 27 74     LDA  KDCTRL/2+X    IF (KDCTRL.KBDDSB .EQ. FALSE) .AND.
0331 1F           RAR                  ((NORFLG.CMBIN .AND. NORFLG.AMTIN).EQ.
0332 DA 4A 03     JC   KEYB01          TRUE)
0335 3A 26 74     LDA  NORFLG/2+X
0338 E6 30        ANI  30H
033A FE 30        CPI  30H
033C C2 4A 03     JNZ  KEYB01
033F CD DE 0E     CALL DBLANK          BLANK DISPLAY
                ;                      EXECUTE END OF ENTRY
0342 3E 43        MVI  A,HENDEN        A = HENDEN
0344 CD C7 0D     CALL XEQHDR          XEQHDR(HENDEN,ERROR)
                ;                            ( A    ,PSW:Z)
                ;                            ( I    , O   )
0347 C3 8C 03     JMP  KEYB09
                KEYB01;              ELSE
                ;                      READ INTERRUPT BUCKETS TOGETHER
034A 2A 2B 74     LHLD CTLBKT/2+X
034D EB           XCHG                 E = CTLBKT
                ;                      D = CHRBKT
034E 1C           INR  E               IF CTLBKT .EQ. HEX00
034F 1D           DCR  E
0350 C2 78 03     JNZ  KEYB06
                ;                        NO KEY IS DOWN
0353 21 27 74     LXI  H,KDCTRL/2+X      HL = ADDRESS, KDCTRL
0356 7E           MOV  A,M               A = KDCTRL
0357 E6 20        ANI  20H               IF KDCTRL.TIMED .EQ. TRUE
0359 CA 75 03     JZ   KEYB05
                ;                          CURRENT DISPLAY IS TIMED
035C 3A 29 74     LDA  DSPTMR/2+X          A = DSPTMR
035F 3D           DCR  A                   IF DSPTMR .EQ. 1
0360 C2 75 03     JNZ  KEYB04
                ;                            DISPLAY TIME IS UP
                ;                            REVERT TO POSTAGE DISPLAY
                ;                            CHECK FOR FATAL ERROR
0363 CD 4E 0F     CALL LSTATE                LSTATE(FATAL,NORM,SERV,PRIV)
                ;                                  (PSW:S, :Z , :P , :C )
                ;                                  ( O   , O  , O  , O  )
0366 F2 70 03     JP   KEYB02                IF FATAL .EQ. TRUE
                ;                              SET FOR FATAL SETTING DISPLY
0369 7E           MOV  A,M                     KDCTRL.STGDSP = TRUE
036A F6 80        ORI  80H
036C 77           MOV  M,A
036D C3 75 03     JMP  KEYB03
                KEYB02;                      ELSE
                ;                              MAKE NORMAL SETTING DISPLAY
0370 3E 51        MVI  A,HREQPO                A = HREQPO
0372 CD C7 0D     CALL XEQHDR                  XEQHDR(HREQPO,ERROR)
                ;                                    ( A    ,PSW:Z)
                ;                                    ( I    , O   )
                KEYB03;                      ENDIF
                KEYB04;                    ENDIF
                KEYB05;                  ENDIF
0375 C3 8C 03     JMP  KEYB08
                KEYB06;                ELSE
                ;                        KEYS ARE DOWN
                ;                        RESTART DISPLAY TIMER
0378 3E 07        MVI  A,DSPVAL            DSPTMR = DSPVAL
037A 32 29 74     STA  DSPTMR/2+X
```

```
1545 037D 7A          MOV  A,D              A = CHRBKT
1546 037E B7          ORA  A                IF CHRBKT .NE. HEX00
1547 037F CA 8C 03    JZ   KEYB07
1548                ;                         A SINGLE UNPROCESSED KEY IS DOWN
1549                ;                         DEFINE A STABLE KEYBUCKET
1550 0382 32 2D 74    STA  CURBKT/2+X           CURBKT = CHRBKT
1551                ;                         PREVENT REPROCESSING KEYPRESS
1552 0385 AF          XRA  A                    CHRBKT = NOKEY
1553 0386 32 2C 74    STA  CHRBKT/2+X
1554 0389 CD CE 04    CALL PROKEY               PROCESS KEYPRESS
1555                KEYB07;                 ENDIF
1556                KEYB08;               ENDIF
1557                KEYB09;             ENDIF
1558 038C 3A 26 74    LDA  NORFLG/2+X   IF NORFLG.QUEPOS .EQ. TRUE
1559 038F E6 40       ANI  40H
1560 0391 C0          RNZ                 RETURN
1561                ;                   ELSE
1562 0392 CD A0 03    CALL MODDSP           MODIFY DISPLAY TO MATCH METER STATUS
1563                ;                       START KEYBOARD/DISPLAY INTERRUPTS
1564 0395 21 A7 00    LXI  H,KDIO           HL = ADRESS = ADDRESS, KDIO
1565 0398 3E 02       MVI  A,KDSKIP         A = KDSKIP
1566 039A 11 96 4C    LXI  D,KEYINT         DE = KEYINT
1567 039D C3 53 01    JMP  STRTMR           STRTMR(ADRESS,KDSKIP,KEYINT,WASOFF)
1568                ;                             ( HL   , A    , DE   ,PSW:Z )
1569                ;                             ( I    , I    , I    , O    )
1570                ;                       RETURN
1571                ;                   ENDIF
1574                ;MODDSP()(DIMAGE, MRSTS1, KDCTRL)
1575                ;        (BYTSTR, BITSTR, BITSTR)
1576                ;        (  O   ,   I   ,   O   )
1577                ;        ( RAM  ,  RAM  ,  RAM  )
1578                ;        (  C   ,   NC  ,   C   )
1579                ;
1580                ;ALL REGISTERS CHANGED
1581                ;PSW: S, Z, P, CY CHANGED
1582                ;
1583                ;UPDATE DISPLAY CONTROL FLAGS AND DISPLAY IMAGE
1584                ;TO REFLECT CURRENT METER STATUS
1585                ;
1586                MODDSP;             ****ENTRY POINT
1587                ;                    CHECK DISPLAY TYPE
1588 03A0 21 27 74    LXI  H,KDCTRL/2+X  HL = ADDRESS, KDCTRL
1589 03A3 7E          MOV  A,M           A = KDCTRL
1590 03A4 E6 BB       ANI  0BBH          A.FLSDSP = FALSE
1591                ;                    A.FLSDCM = FALSE
1592                ;                    PSW:S = KDCTRL.STGDSP
1593 03A6 FA AD 03    JM   MODD01        IF KDCTRL.STGDSP .EQ. FALSE
1594                ;                      SETTING NOT ON DISPLAY
1595                ;                      PREVENT FLASHING DISPLAY
1596 03A9 77          MOV  M,A             KDCTRL.FLSDSP = FALSE
1597                ;                      KDCTRL.FLSDCM = FALSE
1598 03AA C3 FF 03    JMP  MODD07
1599                MODD01;             ELSE
1600                ;                      SETTING IS ON DISPLAY
1601                ;                      DECIDE WHETHER TO FLASH DISPLAY
1602 03AD 3A 24 74    LDA  MRSTS1/2+X      B = MRSTS1
1603 03B0 47          MOV  B,A
1604                ;                      D.DATDOR = D.0 = MRSTS1.DATDOR
1605                ;                      E.FLSDSP = E.1 = MRSTS1.DATDOR .OR.
1606                ;                                       MRSTS1.INSFND
1607                ;                      E.FLSDCM = E.5 = MRSTS1.LOWPOS
1608 03B1 E6 70       ANI  70H
1609 03B3 57          MOV  D,A
1610 03B4 0F          RRC
1611 03B5 0F          RRC
1612 03B6 B2          ORA  D
1613 03B7 57          MOV  D,A
1614 03B8 07          RLC
1615 03B9 B2          ORA  D
1616 03BA 57          MOV  D,A
1617 03BB E6 44       ANI  44H
1618 03BD 5F          MOV  E,A
```

```
1619                ;                          KDCTRL.FLSDSP = E.FLSDSP
1620                ;                          KDCTRL.FLSDCM = E.FLSDCM
1621 03BE 21 27 74    LXI  H,KDCTRL/2+X
1622 03C1 7E          MOV  A,M
1623 03C2 E6 BB       ANI  0BBH
1624 03C4 B3          ORA  E
1625 03C5 77          MOV  M,A
1626                ;                          DETERMINE METER STATUS
1627 03C6 CD 4E 0F    CALL LSTATE              LSTATE(FATMOD,NORMOD,SERMOD,PRVMOD)
1628                ;                                (PSW:S ,PSW:Z ,PSW:P ,PSW:CY)
1629                ;                                ( 0    , 0    , 0    , 0    )
1630 03C9 FA F5 03    JM   MODD04              IF FATMOD .EQ. FALSE
1631                ;                            METER NOT FATAL
1632                ;                            TURN DATER DOOR LAMP ON OR OFF
1633 03CC 21 80 74    LXI  H,DIMAGE/2+Y        HL = ADDRESS, DIMAGE
1634 03CF 7E          MOV  A,M                 A = DIMAGE
1635 03D0 E6 FD       ANI  0FDH                A.DATLMP = FALSE
1636 03D2 14          INR  D                   PSW:S = D.DATDOR
1637 03D3 F2 D8 03    JP   MODD02              IF D.DATDOR .EQ. TRUE
1638 03D6 F6 02       ORI  2                     A.DATLMP = TRUE
1639                MODD02;                    ENDIF
1640 03D8 77          MOV  M,A                 DIMAGE = A
1641                ;                          SELECT WING TYPE
1642 03D9 16 02       MVI  D,02H               D = WING, DISABLED
1643 03DB 3E 04       MVI  A,04H               A = MRSTS1.ENABLD
1644 03DD A0          ANA  B
1645 03DE CA E3 03    JZ   MODD03              IF MRSTS1.ENABLD .EQ. TRUE
1646 03E1 16 92       MVI  D,92H                 D = WING, ENABLED
1647                MODD03;                    ENDIF
1648                ;                          INSERT RIGHT HAND WING
1649 03E3 21 87 74    LXI  H,DIMAGE/2+Y+(NDISP*4-1)
1650                ;                          HL = ADDRESS, DIMAGE[(NDISP*4-1)]
1651 03E6 72          MOV  M,D                 DIMAGE[(NDISP*4-1)] = WING
1652                ;                          INSERT LEFT HAND WING
1653 03E7 06 82       MVI  B,DBUF+2            B = OFFSET, DBUF[2]
1654 03E9 CD 35 0F    CALL GETNIB              GETNIB(NCHAR,ZERO ,DBUF[2])
1655                ;                                ( A    ,PSW:Z, @B     )
1656                ;                                ( 0    , 0    , I     )
1657 03EC 2F          CMA                      BC = -NCHAR-1
1658 03ED 4F          MOV  C,A
1659 03EE 06 FF       MVI  B,0FFH
1660 03F0 09          DAD  B                   HL = ADDRESS,
1661                ;                          DIMAGE[(NDISP*4-2)-NCHAR]
1662 03F1 72          MOV  M,D                 DIMAGE[(NDISP*4-2)-NCHAR] = WING
1663 03F2 C3 FF 03    JMP  MODD06
1664                MODD04;                  ELSE
1665                ;                          METER IS FATAL
1666                ;                          SET TO DISPLAY ALL DECIMALS
1667 03F5 3E 01       MVI  A,01H               A = DECBIT = HEX01
1668 03F7 E2 FC 03    JPO  MODD05              IF SERMOD .EQ. TRUE
1669                ;                            SET TO DISPLAY DECIMALS+DASHES
1670 03FA 3E 11       MVI  A,11H                 A = DECBIT = HEX11
1671                MODD05;                    ENDIF
1672 03FC CD 22 03    CALL FILDIM              FILDIM(DECBIT)
1673                ;                                ( A    )
1674                ;                                ( I    )
1675                MODD06;                  ENDIF
1676                MODD07;                ENDIF
1677                ;                      BUILD SERVICE/NORMAL MODE EDIT MASK
1678 03FF AF          XRA  A               A = MASK, BLANK
1679 0400 CD 4E 0F    CALL LSTATE          LSTATE(FATMOD,NORMOD,SERMOD,PRVMOD)
1680                ;                            (PSW:S ,PSW:Z ,PSW:P ,PSW:CY)
1681                ;                            ( 0    , 0    , 0    , 0    )
1682 0403 E2 08 04    JPO  MODD08          IF SERMOD .EQ. TRUE
1683 0406 3E 10       MVI  A,10H             A = MASK, UNDERSCORE
1684                MODD08;                ENDIF
1685 0408 4F          MOV  C,A             C = MASK
1686                ;                      EDIT MASK INTO DISPLAY
1687 0409 06 07       MVI  B,(NDISP*4-1)   B = DISPNO = (NDISP*4-1)
1688 040B 21 87 74    LXI  H,DIMAGE/2+Y+(NDISP*4-1)
1689                ;                      HL = ADDRESS, DIMAGE[DISPNO]
1690                MODD09;                FOR DISPNO = (NDISP*4-1) DOWNTO 0
1691 040E 7E          MOV  A,M               IF(DIMAGE[DISPNO] .AND. HEXEE).EQ.0
```

```
1692 040F E6 EE      ANI  0EEH
1693 0411 C2 19 04   JNZ  MODD10
1694               ;                        COPY MASK INTO DISPLAY
1695 0414 7E         MOV  A,M               A = IMAGE = DIMAGE[DISPNO]
1696 0415 E6 EF      ANI  0EFH              IMAGE = IMAGE, WITHOUT UNDERSCORE
1697 0417 B1         ORA  C                 IMAGE = IMAGE, WITH EDIT MASK
1698 0418 77         MOV  M,A               DIMAGE[DISPNO] = IMAGE
1699               MODD10;                ENDIF
1700 0419 05         DCR  B                 B = DISPNO = DISPNO-1
1701 041A 2B         DCX  H                 HL = ADDRESS, DIMAGE[DISPNO]
1702 041B F2 0E 04   JP   MODD09            TEST DISPNO
1703               ;                      ENDFOR
1704 041E C9         RET                    RETURN
1707               ;PAUTHK()(DBUF  ,NORFLG)
1708               ;        (NIBSTR,BITSTR)
1709               ;        ( I    , I    )
1710               ;        ( RAM  , RAM  )
1711               ;
1712               ;PSW DESTROYED
1713               ;REGISTERS DESTROYED
1714               ;
1715               ;PROCESS AUTHORIZATION KEY
1716               ;
1717               PAUTHK;                ****ENTRY POINT
1718               ;                      TEST DISPLAY HEADER
1719 041F 21 40 74   LXI  H,DBUF/2+X      HL = ADDRESS, DBUF[0..1]
1720 0422 7E         MOV  A,M             A = DHEAD = DBUF[0..1]
1721 0423 B7         ORA  A               PSW:Z = KEYDAT = DHEAD .EQ. 0
1722               ;                      DEFINE REQUEST HEADER
1723 0424 3E 40      MVI  A,HREQAC        A = RHEAD = HREQAC
1724               ;                      IF KEYDAT .EQ. FALSE
1725               ;                        NO KEYENTERED DATA IN DISPLAY
1726               ;                        REQUEST AUTHORIZATION CODE
1727 0426 C2 C7 0D   JNZ  XEQHDR            XEQHDR(RHEAD,ERRFLG)
1728               ;                              ( A   ,PSW:Z )
1729               ;                              ( I   , 0    )
1730               ;                      ELSE
1731 0429 23         INX  H               HL = ADDRESS, DBUF[2..3]
1732 042A 7E         MOV  A,M             A = FORMAT = DBUF[2..3]
1733 042B FE 4F      CPI  4FH             IF FORMAT .NE. HEX4F
1734               ;                        DISPLAY NOT 4 CHAR WITHOUT DECIMAL
1735               ;                        DECLARE PROCEDURAL ERROR
1736 042D C2 A1 0B   JNZ  PROERR            PROERR(ERRFLG)
1737               ;                              (PSW:Z )
1738               ;                              ( 0    )
1739               ;                      ELSE
1740 0430 23         INX  H               HL = ADDRESS, DBUF[4..5]
1741 0431 7E         MOV  A,M             A = CODE = DBUF[4..5]
1742 0432 FE 69      CPI  69H             IF CODE .NE. HEX69
1743               ;                        FIRST 2 CHARACTERS IN DISPLAY NOT 69
1744               ;                        DECLARE PROCEDURAL ERROR
1745 0434 C2 A1 0B   JNZ  PROERR            PROERR(ERRFLG)
1746               ;                              (PSW:Z )
1747               ;                              ( 0    )
1748               ;                      ELSE
1749               ;                        ISSUE LAST 2 CHARACTERS OF DISPLAY
1750               ;                        AS REQUEST HEADER
1751 0437 23         INX  H               HL = ADDRESS, DBUF[6..7]
1752 0438 7E         MOV  A,M             A = RHEAD = DBUF[6..7]
1753 0439 CD C7 0D   CALL XEQHDR          XEQHDR(RHEAD,ERRFLG)
1754               ;                              ( A   ,PSW:Z )
1755               ;                              ( I   , 0    )
1756               ;                        TEST THE REQUEST HEADER
1757 043C FE 46      CPI  HSETSV          IF RHEAD .EQ. HSETSV
1758 043E C0         RNZ
1759               ;                          SERVICE MODE ENTERED VIA KEYBOARD
1760               ;                          DISABLE COMMUNICATIONS
1761 043F 21 26 74   LXI  H,NORFLG/2+X      HL = ADDRESS, NORFLG
1762 0442 7E         MOV  A,M               NORFLG.COMDSB = TRUE
1763 0443 F6 04      ORI  04H
1764 0445 77         MOV  M,A
1765               ;                        ENDIF
1766               ;                      ENDIF
1767 0446 C9         RET                    RETURN
```

```
1770                ;PCLRK
1771                ;
1772                ;PSW:S, Z, P, CY = NO CHANGE
1773                ;
1774                ;PROCESS CLEAR KEY
1775                ;
1776                PCLRK;              ****ENTRY POINT
1777 0447 CD 06 03   CALL CDBUFC        IF DISPLAY WAS NOT KEY ENTERED
1778                ;                     DISABLE METER
1779                ;                     CLEAR DISPLAY BUFFER
1780                ;                   ENDIF
1781 044A CD 16 03   CALL CDBUF         CLEAR DISPLAY BUFFER
1782 044D C3 5A 05   JMP  VALDSP        DISPLAY VALUE IN DBUF
1783                ;                   RETURN
1786                ;PDCMK()(DBUF  )
1787                ;       (NIBSTR)
1788                ;       ( I/O  )
1789                ;       ( RAM  )
1790                ;       ( C    )
1791                ;
1792                ;PSW AND REGISTERS DESTROYED
1793                ;
1794                ;PROCESS DECIMAL KEY
1795                ;
1796                PDCMK;              ****ENTRY POINT
1797                ;                   CHECK FOR NON KEYENTRY DISPLAY
1798                ;                   IF DBUF[0..1] .NE. HEX00
1799 0450 CD 06 03   CALL CDBUFC          PUT NUL MESSAGE IN DBUF
1800                ;                     DISABLE METER
1801                ;                   ENDIF
1802                ;                   CHECK THAT DECIMAL NOT ALREADY ENTERED
1803 0453 01 83 83   LXI B,(DBUF+3)*100H+DBUF+3
1804                ;                   B = OFFSET, DBUF[3]
1805                ;                   C = OFFSET, DBUF[3]
1806 0456 CD 35 0F   CALL GETNIB        GETNIB(DECPOS,ZERO ,DBUF[3])
1807                ;                         ( A    ,PSW:Z, @B    )
1808                ;                         ( D    , D   , I     )
1809 0459 D6 0F      SUI  0FH           IF DECPOS .EQ. HEX0F
1810 045B C2 61 04   JNZ  PDCMK1
1811                ;                     A = DECPOS = 0, RIGHTMOST POSITION
1812                ;                     OUTPUT DECPOS
1813 045E CD EE 0F   CALL PUTNIB          PUTNIB(DBUF[3],DECPOS)
1814                ;                           ( @C    , A    )
1815                ;                           ( D     , I    )
1816                PDCMK1;             ENDIF
1817 0461 C3 5A 05   JMP  VALDSP        MAKE NEW DISPLAY
1818                ;                   RETURN
1821                ;PERDSP()(KDCTRL,DIMAGE,DSPTMR)
1822                ;        (BITSTR,BYTSTR,UBYTE )
1823                ;        ( D    , D    , D    )
1824                ;        ( RAM  , RAM  , RAM  )
1825                ;        ( C    , C    , C    )
1826                ;
1827                ;PSW:S, Z, P, CY = NO CHANGE
1828                ;
1829                ;MAKE PROCEDURAL ERROR DISPLAY
1830                ;
1831                PERDSP;             ****ENTRY POINT
1832 0464 F5         PUSH PSW           SAVE A, PSW
1833                ;                   CLEAR SETTING-ON-DISPLAY FLAG
1834 0465 3A 27 74   LDA  KDCTRL/2+X    A = KDCTRL
1835 0468 E6 7F      ANI  7FH           KDCTRL.STGDSP = FALSE
1836                ;                   SET DISPLAY-IS-TIMED FLAG
1837 046A F6 20      ORI  20H           KDCTRL.TIMED = TRUE
1838 046C 32 27 74   STA  KDCTRL/2+X
1839 046F CD 16 03   CALL CDBUF         CLEAR DISPLAY BUFFER
1840                ;                   CLEAR DISPLAY IMAGE BUFFER
1841 0472 AF         XRA  A             A = BLANK
1842 0473 CD 22 03   CALL FILDIM        FILDIM(BLANK)
1843                ;                         ( A   )
1844                ;                         ( I   )
1845                ;                   INSERT 'ERR' IN DISPLAY IMAGE
```

```
0476 3E 9E      MVI  A,9EH        DIMAGE[0] = 'E'
0478 32 80 74   STA  DIMAGE/2+Y
047B 3E 0A      MVI  A,0AH        DIMAGE[1] = 'r'
047D 32 81 74   STA  DIMAGE/2+Y+1
0480 32 82 74   STA  DIMAGE/2+Y+2 DIMAGE[2] = 'r'
                ;                 START DISPLAY TIMER
0483 3E 07      MVI  A,DSPVAL     DSPTMR = DSPVAL
0485 32 29 74   STA  DSPTMR/2+X
0488 F1         POP  PSW          RESTORE A, PSW
0489 C9         RET               RETURN
                ;PNUMK(CURKEY)(DBUF  ,WORK1 )
                ;     (BYTE  )(NIBSTR,NIBSTR)
                ;     ( I    )( I/O  , O    )
                ;     ( A    )( RAM  , RAM  )
                ;     ( C    )( C    , C    )
                ;
                ;PSW AND REGISTERS DESTROYED
                ;
                ;PROCESS NUMERIC KEY
                ;
                PNUMK;                ****ENTRY POINT
048A 57         MOV  D,A              D = CURKEY
048B CD 06 03   CALL CDBUFC           IF DBUF[0..1] .NE. HEX00
                ;                       NOT IN KEYENTRY MODE
                ;                       DISABLE METER
                ;                       ENTER KEYENTRY MODE
                ;                       DBUF[0..1] = HEADER = HEX00
                ;                       DECLARE DBUF CLEAR
                ;                       DBUF[2..3] = FORMAT = HEX0F
                ;                     ENDIF
                ;                     CHECK DATA LENGTH IN DISPLAY
048E 21 41 74   LXI  H,(DBUF+2)/2+X
                ;                     HL = ADDRESS, DBUF[2..3]
0491 7E         MOV  A,M              E = NCHAR*16 = DBUF[2]*16
0492 E6 F0      ANI  0F0H
0494 5F         MOV  E,A
0495 FE 80      CPI  DSPCHR*16        IF NCHAR .LT. DSPCHR
0497 D0         RNC
                ;                       THERE IS ROOM IN DISPLAY FOR CHAR
                ;                       CALCULATE NEXT DECIMAL POSITION
0498 7E         MOV  A,M              A = DECPOS = (DBUF[3]+1) .AND. HEX0F
0499 3C         INR  A
049A E6 0F      ANI  0FH
049C FE 08      CPI  DSPCHR           IF DECPOS .LT. DSPCHR
049E D0         RNC
                ;                       THERE IS ROOM TO SHIFT DECIMAL
049F B7         ORA  A                  IF DECPOS .EQ. 0
04A0 C2 A5 04   JNZ  PNUMK1
                ;                         DECIMAL HASN'T BEEN ENTERED
                ;                         INDICATE NO DECIMAL
04A3 3E 0F      MVI  A,0FH                A = DECPOS = HEX0F
                PNUMK1;                 ENDIF
                ;                       UPDATE FORMAT BYTE
04A5 B3         ORA  E                  DBUF[2..3] = (NCHAR+1)*16+DECPOS
04A6 C6 10      ADI  10H
04A8 77         MOV  M,A
04A9 06 82      MVI  B,DBUF+2           B = OFFSET, DBUF[2]
04AB CD 35 0F   CALL GETNIB             GETNIB(NCHAR,ZROFLG,DBUF[2])
                ;                             ( A   ,PSW:Z , @B    )
                ;                             ( O   , O    , I     )
04AE 5F         MOV  E,A                E = NCHAR
                ;                       COPY DBUF INTO WORK AREA
04AF 01 C0 84   LXI  B,(DBUF+4)*100H+(WORK1+0)
                ;                       B = OFFSET, DBUF[I=4]
                ;                       C = OFFSET, WORK1[J=0]
04B2 CD B3 0F   CALL MVLNIB             MVLNIB(WORK1[J],DBUF[I],NCHAR,
                ;                             ( @C     , @B    , A   ,
                ;                             ( O      , I     , I   ,
                ;
                ;                             NONBCD,ZROFLG)
                ;                             PSW:S ,PSW:Z )
                ;                              O    , O    )
```

```
1920                ;                          ZERO PAD DISPLAY BUFFER
1921 04B5 23          INX  H                   HL = ADDRESS, DBUF[4..5]
1922 04B6 36 00       MVI  M,0                 DBUF[4..5] = 0
1923                ;                          INSERT NEW CHAR IN WORK AREA
1924 04B8 81          ADD  C                   C=OFFSET, WORK1[J=NCHAR.AND.HEXFE]
1925 04B9 E6 FE       ANI  0FEH
1926 04BB 4F          MOV  C,A
1927 04BC 7A          MOV  A,D                 A = CURKEY
1928 04BD CD EE 0F    CALL PUTNIB              PUTNIB(WORK1[J],CURKEY)
1929                ;                                ( @C     , A    )
1930                ;                                ( 0      , I    )
1931                ;                          MOVE WORK AREA TO DISPLAY BUFFER
1932 04C0 41          MOV  B,C                 B = OFFSET, WORK1[I=J]
1933 04C1 3E 83       MVI  A,DBUF+3            C=OFFSET,DBUF[J=(3+NCHAR).OR.HEX01]
1934 04C3 83          ADD  E
1935 04C4 F6 01       ORI  1
1936 04C6 4F          MOV  C,A
1937 04C7 7B          MOV  A,E                 A = NCHAR
1938 04C8 CD C2 0F    CALL MVRNIB              MVRNIB(DBUF[J],WORK1[I],NCHAR,
1939                ;                                ( @C    , @B     , A   ,
1940                ;                                ( 0     , I      , I   ,
1941                ;
1942                ;                                NONBCD,ZROFLG)
1943                ;                                PSW:S ,PSW:Z )
1944                ;                                 0    , 0    )
1945 04CB C3 5A 05    JMP  VALDSP              UPDATE DISPLAY IMAGE
1946                ;                        ENDIF
1947                ;                      ENDIF
1948                ;                      RETURN
1951                ;PROKEY()(CURBKT)
1952                ;        ( BYTE )
1953                ;        ( I    )
1954                ;        ( RAM  )
1955                ;        ( NC   )
1956                ;
1957                ;PSW AND REGISTERS DESTROYED
1958                ;
1959                ;INITIATE PROCESSING OF A KEYPRESS
1960                ;
1961                PROKEY;                 ****ENTRY POINT
1962 04CE CD DE 0E    CALL DBLANK            STOP TIMER, BLANK DISPLAY
1963                ;                        BUILD INDEX FOR TABLE LOOKUP
1964                ;                        CURBKT = 0RRR CCCC WHERE:
1965                ;                        RRR = 0, 1, 2, 3, OR 4 = ROW CODE
1966                ;                        CCCC= 1, 2, 4, OR 8 = COLUMN CODE
1967 04D1 3A 2D 74    LDA CURBKT/2+X         A = CURBKT
1968 04D4 57          MOV  D,A               D = CURBKT
1969 04D5 E6 70       ANI  70H               E = INDEX = (CURBKT .AND. HEX70)/4
1970 04D7 0F          RRC
1971 04D8 0F          RRC
1972 04D9 5F          MOV  E,A
1973 04DA 7A          MOV  A,D               A = CURBKT
1974                PROKE1;                  DO WHILE COLUMN CODE BIT NOT IN CARRY
1975 04DB 1F          RAR
1976 04DC DA E3 04    JC   PROKE2
1977 04DF 1C          INR  E                   E = INDEX = INDEX + 1
1978 04E0 C3 DB 04    JMP  PROKE1
1979                PROKE2;                  ENDDO
1980                ;                        DEFINE CURRENT KEYCODE OR HEADER
1981 04E3 16 00       MVI  D,0               DE = INDEX
1982 04E5 21 02 05    LXI  H,PROKE3          HL = ADDRESS, PROKE3
1983 04E8 19          DAD  D                 HL = ADDRESS, PROKE3[INDEX]
1984 04E9 7E          MOV  A,M               A = CURKEY = PROKE3[INDEX]
1985                ;                        PROCESS CURRENT KEYCODE
1986 04EA FE 0A       CPI  10                IF CURKEY .LT. 10
1987                ;                          PROCESS NUMERIC KEY
1988 04EC DA 8A 04    JC   PNUMK               PNUMK(CURKEY)
1989                ;                                ( A    )
1990                ;                                ( I    )
1991                ;                          RETURN
1992                ;                        ELSE IF CURKEY .EQ. 10
1993 04EF CA 47 04    JZ   PCLRK               PROCESS CLEAR KEY
1994                ;                          RETURN
```

```
1995 04F2 FE 0C      CPI  12          ELSE IF CURKEY .EQ. 11
1996 04F4 DA 50 04   JC   PDCMK         PROCESS DECIMAL KEY
1997               ;                    RETURN
1998               ;                  ELSE IF CURKEY .EQ. 12
1999 04F7 CA 16 05   JZ   PSETK         PROCESS SET KEY
2000               ;                    RETURN
2001 04FA FE 0D      CPI  13          ELSE IF CURKEY .EQ. 13
2002 04FC CA 1F 04   JZ   PAUTHK        PROCESS AUTHORIZATION KEY
2003               ;                    RETURN
2004               ;                  ELSE
2005               ;                    A = HEADER = PROKE3[INDEX]
2006               ;                    EXECUTE HEADER
2007 04FF C3 C7 0D   JMP  XEQHDR        XEQHDR(HEADER,ERROR)
2008               ;                          ( A    ,PSW:Z)
2009               ;                          ( I    , 0   )
2010               ;                    RETURN
2011               ;                  ENDIF
2012               PROKE3;   CURKEY    INDEX   DESCRIPTION
2013               ;           OR
2014               ;         HEADER
2015               ;
2016 0502 C4         DB      HSETDA      0     SET DATE
2017 0503 C6         DB      HENTCO      1     ENTER COMBINATION
2018 0504 C5         DB      HENTAM      2     ENTER AMOUNT
2019 0505 0D         DB      13          3     AUTHORIZATION KEY
2020 0506 0C         DB      12          4     SET KEY
2021 0507 0B         DB      11          5     DECIMAL KEY
2022 0508 00         DB       0          6     0 KEY
2023 0509 0A         DB      10          7     CLEAR KEY
2024 050A 55         DB      HREQPC      8     REQUEST PIECE COUNT
2025 050B 09         DB       9          9     9 KEY
2026 050C 08         DB       8         10     8 KEY
2027 050D 07         DB       7         11     7 KEY
2028 050E 53         DB      HREQDR     12     REQUEST DESCENDING REGISTER
2029 050F 06         DB       6         13     6 KEY
2030 0510 05         DB       5         14     5 KEY
2031 0511 04         DB       4         15     4 KEY
2032 0512 52         DB      HREQAR     16     REQUEST ASCENDING REGISTER
2033 0513 03         DB       3         17     3 KEY
2034 0514 02         DB       2         18     2 KEY
2035 0515 01         DB       1         19     1 KEY

2038               ;PSETK()(DBUF  ,NORFLG)
2039               ;       (NIBSTR,BITSTR)
2040               ;       ( I    , 0    )
2041               ;       ( RAM  , RAM  )
2042               ;       ( C    , C    )
2043               ;
2044               ;PSW AND REGISTERS DESTROYED
2045               ;
2046               ;PROCESS SET KEY
2047               ;
2048               PSETK;              ****ENTRY POINT
2049               ;                   PROCESS SET KEY ACCORDING TO DISPLAY
2050 0516 3A 40 74   LDA  DBUF/2+X     A = DBUF[0..1]
2051 0519 B7         ORA  A            IF DBUF[0..1] .EQ. HEX00
2052 051A C2 2F 05   JNZ  PSETK1
2053               ;                     DISPLAY IS IN KEYENTRY MODE
2054 051D 21 36 05   LXI  H,PSETK2       SET TO QUE POSTAGE VIA RETURN
2055 0520 E5         PUSH H
2056 0521 3A 41 74   LDA  (DBUF+2)/2+X   A = DBUF[2..3]
2057 0524 FE 0F      CPI  0FH            IF DBUF[2..3] .EQ. HEX0F
2058 0526 C8         RZ                    DISPLAY IS CLEAR
2059               ; >>RETURN AHEAD<<      QUE POSTAGE REQUEST
2060               ;                       NORFLG.QUEPOS = TRUE
2061               ;                     ELSE
2062               ;                       DISPLAY CONTAINS KEYENTERED VALUE
2063               ;                       SET POSTAGE
2064 0527 3E C1      MVI  A,HSETPO         A = HSETPO
2065 0529 CD C7 0D   CALL XEQHDR           XEQHDR(HSETPO,ERRFLG)
2066               ;                             ( A    ,PSW:Z )
2067               ;                             ( I    , 0    )
2068 052C C0         RNZ                   IF ERRFLG .EQ. FALSE
2069               ; >>RETURN AHEAD<<        QUE POSTAGE REQUEST
```

```
2070                ;                          NORFLG.QUEPOS = TRUE
2071                ;                        ENDIF
2072                ;                      ENDIF
2073 052D E1          POP  H               CLEAN UP STACK
2074 052E C9          RET
2075                PSETK1;              ELSE
2076                ;                      DISPLAY NOT IN KEYENTRY MODE
2077 052F FE 81       CPI  HPSET           PSW:Z = SETTING=DBUF[0..1].EQ.HPSET
2078 0531 3E 41       MVI  A,HENABL        A = HENABL
2079                ;                      IF SETTING .EQ. TRUE
2080                ;                        SETTING IS ON DISPLAY
2081                ;                        ENABLE METER
2082 0533 CA C7 0D    JZ   XEQHDR            XEQHDR(HENABL,ERRFLG)
2083                ;                              ( A    ,PSW:Z )
2084                ;                              ( I    , 0    )
2085                ;                      ELSE
2086                ;                        SETTING IS NOT ON DISPLAY
2087                PSETK2;                  >>TARGET OF RETURN AHEAD<<
2088                ;                        QUE POSTAGE REQUEST
2089 0536 21 26 74    LXI  H,NORFLG/2+X      HL = ADDRESS, NORFLG
2090 0539 7E          MOV  A,M               A = NORFLG
2091 053A F6 40       ORI  40H               NORFLG.QUEPOS = TRUE
2092 053C 77          MOV  M,A
2093                ;                      ENDIF
2094                ;                    ENDIF
2095 053D C9          RET                RETURN

2098                ;SEGCOD(CODE)
2099                ;      (BYTE)
2100                ;      (I/O )
2101                ;      ( A  )
2102                ;      ( C  )
2103                ;
2104                ;PSW:S, Z, P, CY DESTROYED
2105                ;
2106                ;CONVERT 4 BIT HEX VALUE INTO 7 SEGMENT DISPLAY CODE
2107                ;
2108                SEGCOD;              ****ENTRY POINT
2109 053E E5          PUSH H             SAVE HL
2110                ;                    FETCH 7 SEGMENT DISPLAY CODE
2111 053F C6 4A       ADI  >SEGC01       HL = ADDRESS, SEGC01[CODE]
2112 0541 6F          MOV  L,A
2113 0542 3E 00       MVI  A,0
2114 0544 CE 05       ACI  <SEGC01
2115 0546 67          MOV  H,A
2116 0547 7E          MOV  A,M           A = CODE = SEGC01[CODE]
2117 0548 E1          POP  H             RESTORE HL
2118 0549 C9          RET                RETURN
2119                ;
2120                SEGC01; 7 SEG CODE;  HEX VALUE;  GRAPHIC
2121                ;
2122 054A FC          DB      0FCH          0        0
2123 054B 60          DB      060H          1        1
2124 054C DA          DB      0DAH          2        2
2125 054D F2          DB      0F2H          3        3
2126 054E 66          DB      066H          4        4
2127 054F B6          DB      0B6H          5        5
2128 0550 BE          DB      0BEH          6        6
2129 0551 E0          DB      0E0H          7        7
2130 0552 FE          DB      0FEH          8        8
2131 0553 F6          DB      0F6H          9        9
2132 0554 9E          DB      09EH          A        E
2133 0555 0A          DB      00AH          B        r
2134 0556 3A          DB      03AH          C        o
2135 0557 92          DB      092H          D        WING, ENABLED
2136 0558 02          DB      002H          E        WING, DISABLED
2137 0559 00          DB      000H          F        BLANK

2140                ;VALDSP()(DIMAGE,KDCTRL,DBUF  ,DSPTMR)
2141                ;        (BYTSTR,BITSTR,NIBSTR,UBYTE )
2142                ;        ( 0    , 0    , I    , 0    )
2143                ;        ( RAM  , RAM  , RAM  , RAM  )
2144                ;        ( C    , C    , NC   , C    )
2145                ;
```

```
2146                ;PSW:S, Z, P, CY = NO CHANGE
2147                ;
2148                ;TRANSLATE CONTENTS OF DISPLAY BUFFER INTO 7 SEGMENT
2149                ;CHARACTER CODES WHICH ARE PLACED IN THE DISPLAY IMAGE
2150                ;BUFFER
2151                ;
2152                VALDSP;              ****ENTRY POINT
2153 055A E5          PUSH H             SAVE HL
2154 055B D5          PUSH D             SAVE DE
2155 055C C5          PUSH B             SAVE BC
2156 055D F5          PUSH PSW           SAVE A, PSW
2157                ;                    CLEAR DISPLAY IMAGE BUFFER
2158 055E AF          XRA A              A = BLANK
2159 055F CD 22 03    CALL FILDIM        FILDIM(BLANK)
2160                ;                          ( A   )
2161                ;                          ( I   )
2162                ;                    DEFINE DEFAULT DISPLAY MODE
2163 0562 3A 27 74    LDA  KDCTRL/2+X    A = KDCTRL
2164 0565 E6 7F       ANI  7FH           KDCTRL.STGDSP = FALSE
2165 0567 F6 20       ORI  20H           KDCTRL.TIMED = TRUE
2166 0569 57          MOV  D,A           D = KDCTRL
2167                ;                    FETCH VALUES FROM DBUF'S FORMAT BYTE
2168 056A 06 82       MVI  B,DBUF+2      B = OFFSET, DBUF[2]
2169 056C CD 35 0F    CALL GETNIB        GETNIB(NCHAR,ZERO ,DBUF[2])
2170                ;                          ( A   ,PSW:Z, @B    )
2171                ;                          ( O   , O   , I     )
2172 056F 4F          MOV  C,A           C = NCHAR
2173 0570 04          INR  B             B = OFFSET, DBUF[3]
2174 0571 CD 35 0F    CALL GETNIB        GETNIB(DECPOS,ZERO ,DBUF[3])
2175                ;                          ( A    ,PSW:Z, @B    )
2176                ;                          ( O    , O   , I     )
2177 0574 5F          MOV  E,A           E = DECPOS
2178                ;                    POINT AT L/O OF DISPLAY IMAGE BUFFER
2179 0575 21 87 74    LXI  H,DIMAGE/2+Y+(NDISP*4-1)
2180                ;                    HL = ADDRESS, DIMAGE[NDISP*4-1]
2181                ;                    CHECK FOR KEYENTRY IN DISPLAY BUFFER
2182 0578 3A 40 74    LDA  DBUF/2+X      A = DBUF[0..1]
2183 057B B7          ORA  A             IF DBUF[0..1] .EQ. HEX00
2184 057C C2 8D 05    JNZ  VALDS2
2185                ;                      CHECK FOR NULL MESSAGE IN DBUF
2186 057F 3A 41 74    LDA  (DBUF+2)/2+X    A = DBUF[2..3]
2187 0582 FE 0F       CPI  0FH             IF DBUF[2..3] .EQ. HEX0F
2188 0584 C2 89 05    JNZ  VALDS1
2189                ;                        PUT SMALL O IN DISPLAY
2190 0587 36 3A       MVI  M,3AH               OUTPUT DIMAGE[NDISP*4-1] = 'o'
2191                VALDS1;                ENDIF
2192 0589 7A          MOV  A,D             A = KDCTRL
2193                ;                      MAKE UNTIMED DISPLAY
2194 058A C3 97 05    JMP  VALDS3
2195                ; >>JUMP AHEAD<<
2196                VALDS2;              ENDIF
2197                ;                    CHECK WHETHER SETTING IS ON DISPLAY
2198 058D FE 81       CPI  HPSET         COMPARE DBUF[0..1] WITH HPSET
2199 058F 7A          MOV  A,D           A = KDCTRL
2200 0590 C2 99 05    JNZ  VALDS4        IF DBUF[0..1] .EQ. HPSET
2201                ;                      SHIFT DESTINATION TO LEFT
2202 0593 1C          INR  E               E = DECPOS = DECPOS + 1
2203 0594 2B          DCX  H               HL = ADDRESS, DIMAGE[DST=NDISP*4-2]
2204                ;                      SET SETTING-ON-DISPLAY FLAG
2205 0595 F6 80       ORI  80H             KDCTRL.STGDSP = TRUE
2206                VALDS3;                >>TARGET OF JUMP AHEAD<<
2207                ;                      CLEAR DISPLAY-IS-TIMED FLAG
2208 0597 E6 DF       ANI  0DFH            KDCTRL.TIMED = FALSE
2209                VALDS4;              ENDIF
2210 0599 32 27 74    STA  KDCTRL/2+X    OUTPUT KDCTRL
2211                ;                    POINT AT L/O DATA IN DBUF
2212 059C 79          MOV  A,C           A = N = NCHAR
2213 059D B7          ORA  A             A = N/2;  CY = N .MOD. 2
2214 059E 1F          RAR
2215 059F CE 00       ACI  0             B = OFFSET, DBUF[SRC=(N/2+N.MOD.2)*2+3]
2216 05A1 17          RAL
2217 05A2 C6 83       ADI  DBUF+3
```

```
2218 05A4 47          MOV  B,A
2219                VALDS5;             DO WHILE NCHAR .GT. 0
2220 05A5 0D          DCR  C
2221 05A6 FA B5 05    JM   VALDS6
2222                ;                     FETCH BCD CHARACTER FROM DBUF
2223 05A9 CD 35 0F    CALL GETNIB           GETNIB(CODE,ZERO ,DBUF[SRC])
2224                ;                           ( A  ,PSW:Z, @B      )
2225                ;                           ( 0  , 0   , I       )
2226                ;                     TRANSLATE TO 7 BIT DISPLAY CODE
2227 05AC CD 3E 05    CALL SEGCOD           SEGCOD(CODE)
2228                ;                           ( A  )
2229                ;                           ( I/O)
2230                ;                     PUT CODE INTO DISPLAY IMAGE BUFFER
2231 05AF 77          MOV  M,A              DIMAGE[DST] = CODE
2232                ;                     MOVE INDICES LEFT
2233 05B0 05          DCR  B                B = OFFSET, DBUF[SRC=SRC-1]
2234 05B1 2B          DCX  H                HL = ADDRESS, DIMAGE[DST=DST-1]
2235 05B2 C3 A5 05    JMP  VALDS5
2236                VALDS6;             ENDDO
2237                ;                   CHECK WHETHER DECIMAL IS DISPLAYABLE
2238 05B5 7B          MOV  A,E            A = DECPOS
2239 05B6 FE 08       CPI  DSPCHR         IF DECPOS .LT. DSPCHR
2240 05B8 D2 C3 05    JNC  VALDS7
2241                ;                     CALC DECIMAL'S ADDRESS IN DIAMGE
2242 05BB 2F          CMA                   A = -DECPOS-1
2243 05BC C6 88       ADI  (DIMAGE/2+Y-X)+(NDISP*4)
2244 05BE 6F          MOV  L,A
2245                ;                     HL = ADDRESS,
2246                ;                     DIMAGE[N=(NDISP*4-1)-DECPOS]
2247                ;                     INSERT DECIMAL INTO DISPLAY
2248 05BF 7E          MOV  A,M              DIMAGE[N] = DIMAGE[N] .OR. HEX01
2249 05C0 F6 01       ORI  01H
2250 05C2 77          MOV  M,A
2251                VALDS7;             ENDIF
2252                ;                   START DISPLAY TIMER
2253 05C3 3E 07       MVI  A,DSPVAL       DSPTMR = DSPVAL
2254 05C5 32 29 74    STA  DSPTMR/2+X
2255 05C8 F1          POP  PSW            RESTORE A, PSW
2256 05C9 C1          POP  B              RESTORE BC
2257 05CA D1          POP  D              RESTORE DE
2258 05CB E1          POP  H              RESTORE HL
2259 05CC C9          RET                 RETURN
2262                ;CMDDSB/DISABL()(MRSTS1,NORFLG)
2263                ;                (BITSTR,BITSTR)
2264                ;                ( I/O  , 0    )
2265                ;                ( RAM  , RAM  )
2266                ;                ( C    , C    )
2267                ;
2268                ;PSW = NO CHANGE
2269                ;
2270                ;DISABLE METER
2271                ;
2272                CMDDSB;               ****ENTRY POINT FOR EXTERNAL DISABLES
2273 05CD F5          PUSH PSW            SAVE A, PSW
2274                ;                     SET TO SET NORFLG.LATDSB = TRUE
2275 05CE 3E 01       MVI  A,1            A = LATMSK = HEX01
2276 05D0 C3 D5 05    JMP  DISAB1
2277                ; >>JUMP AHEAD<<
2278                DISABL;               ****ENTRY POINT FOR INTERNAL DISABLES
2279 05D3 F5          PUSH PSW            SAVE A,PSW
2280                ;                     SET TO PRESERVE NORFLG.LATSDB
2281 05D4 AF          XRA  A              A = LATMSK = HEX00
2282                DISAB1;               >>TARGET OF JUMP AHEAD<<
2283 05D5 D5          PUSH D              SAVE DE
2284 05D6 E5          PUSH H              SAVE HL
2285 05D7 21 26 74    LXI  H,NORFLG/2+X   HL = ADDRESS, NORFLG
2286                ;                     UPDATE NORFLG.LATDSB
2287 05DA B6          ORA  M              NORFLG = NORFLG .OR. LATMSK
2288 05DB 77          MOV  M,A
2289 05DC 11 24 74    LXI  D,MRSTS1/2+X   DE = ADDRESS, MRSTS1
2290 05DF 1A          LDAX D              IF MRSTS1.ENABLD .EQ. TRUE
2291 05E0 E6 04       ANI  4
```

```
05E2 CA EF 05   JZ   DISAB2
05E5 1A         LDAX D              MRSTS1.ENABLD = FALSE
05E6 E6 FB      ANI  0FBH
05E8 12         STAX D
05E9 7E         MOV  A,M            NORFLG.TRPREQ = FALSE
05EA E6 F7      ANI  0F7H
05EC F6 80      ORI  80H            NORFLG QUESTS = TRUE
05EE 77         MOV  M,A
               DISAB2;             ENDIF
05EF E1         POP  H              RESTORE HL
05F0 D1         POP  D              RESTORE DE
05F1 F1         POP  PSW            RESTORE A, PSW
05F2 C9         RET                 RETURN
               ;CMDENB/ENABLE()(MRSTS1,NORFLG,NVMCTL)
               ;                (BITSTR,BITSTR,BITSTR)
               ;                ( I/O  , I/O  , I    )
               ;                ( RAM  , RAM  , RAM  )
               ;                ( C    , C    , NC   )
               ;
               ;PSW = NO CHANGE
               ;
               ;ENABLE METER
               ;
               CMDENB;             ****ENTRY POINT FOR EXTERNAL ENABLES
05F3 F5         PUSH PSW            SAVE A, PSW
               ;                   SET TO SET NORFLG.LATDSB = FALSE
05F4 3E FE      MVI  A,0FEH         A = LATMSK = HEXFE
05F6 C3 FC 05   JMP  ENABL1
               ; >>JUMP AHEAD<<
               ENABLE;             ****ENTRY POINT FOR INTERNAL ENABLES
05F9 F5         PUSH PSW            SAVE A, PSW
               ;                   SET TO PRESERVE NORFLG.LATDSB
05FA 3E FF      MVI  A,0FFH         A = LATMSK = HEXFF
               ENABL1;             >>TARGET OF JUMP AHEAD<<
05FC C5         PUSH B              SAVE BC
05FD D5         PUSH D              SAVE DE
05FE E5         PUSH H              SAVE HL
05FF 21 26 74   LXI  H,NORFLG/2+X   HL = ADDRESS, NORFLG
               ;                   UPDATE NORFLG.LATDSB
0602 A6         ANA  M              NORFLG = NORFLG .AND. LATMSK
0603 77         MOV  M,A
0604 3A 33 74   LDA  NVMCTL/2+X     IF NVMCTL[0] .NE. HEXF
0607 B7         ORA  A
0608 FA 27 06   JM   ENABL4
               ;                     A BLOCK IS OPEN
060B CD 4E 0F   CALL LSTATE           LSTATE(FATMOD,NORMOD,SERMOD,PRVMOD)
               ;                           (PSW:S ,PSW:Z ,PSW:P ,PSW:CY)
               ;                           ( 0    , 0    , 0    , 0    )
060E C2 27 06   JNZ  ENABL3           IF NORMOD .EQ. TRUE
0611 11 24 74   LXI  D,MRSTS1/2+X       DE = ADDRESS, MRSTS1
0614 1A         LDAX D
0615 E6 EC      ANI  0ECH
0617 47         MOV  B,A                B = FLAGS = MRSTS1.UNKSEL,
               ;                                   MRSTS1.DATDOR,
               ;                                   MRSTS1.INSFND,
               ;                                   MRSTS1.ENABLD
0618 7E         MOV  A,M
0619 E6 03      ANI  3
061B B0         ORA  B                  A = FLAGS = FLAGS .OR.
               ;                                   NORFLG.UNVSEL,
               ;                                   NORFLG.LATDSB
061C C2 27 06   JNZ  ENABL2             IF FLAGS .EQ. FALSE
061F 7E         MOV  A,M                  NORFLG.QUESTS = TRUE
0620 F6 80      ORI  80H
0622 77         MOV  M,A
0623 1A         LDAX D                    MRSTS1.ENABLD = TRUE
0624 F6 04      ORI  4
0626 12         STAX D
               ENABL2;                   ENDIF
               ENABL3;                 ENDIF
               ENABL4;             ENDIF
0627 E1         POP  H              RESTORE HL
```

```
2366 0628 D1          POP  D              RESTORE DE
2367 0629 C1          POP  B              RESTORE BC
2368 062A F1          POP  PSW            RESTORE A, PSW
2369 062B C9          RET                 RETURN
2372                ;CONFIG(ERRFLG)(MTRCHR,XMTBUF)
2373                ;      (BIT   )(BYTE  ,BYTSTR)
2374                ;      ( O    )( I    , O    )
2375                ;      (PSW:S )( RAM  , RAM  )
2376                ;      ( C    )( NC   , C    )
2377                ;
2378                ;REGISTERS DESTROYED
2379                ;PSW DESTROYED
2380                ;
2381                ;PUT METER CONFIGURATION MESSAGE IN TRANSMIT BUFFER
2382                ;
2383                CONFIG;             ****ENTRY POINT
2384 062C 21 50 74    LXI  H,XMTBUF/2+X  HL = ADDRESS, XMTBUF[0]
2385                ;                   DEFINE MESSAGE LENGTH
2386 062F 36 02       MVI  M,2          XMTBUF[0] = 2
2387                ;                   DEFINE MESSAGE HEADER
2388 0631 23          INX  H            HL = ADDRESS, XMTBUF[1]
2389 0632 36 AB       MVI  M,HCONFG     XMTBUF[1] = HCONFG
2390                ;                   DEFINE ERROR FLAG
2391 0634 2C          INR  L            HL = ADDRESS, XMTBUF[2]
2392                ;                   PSW:Z = ERRFLG = FALSE
2393                ;                   DEFINE METER CHARACTERISTICS
2394 0635 3A 23 74    LDA  MTRCHR/2+X   XMTBUF[2] = MTRCHR
2395 0638 77          MOV  M,A
2396 0639 C9          RET               RETURN
2399                ;CONSUM(ERRFLG)(CTLCRC)
2400                ;      (BIT   )(BYTE  )
2401                ;      ( O    )( I    )
2402                ;      (PSW:Z )( RAM  )
2403                ;      ( C    )( NC   )
2404                ;
2405                ;REGISTERS DESTROYED
2406                ;PSW DESTROYED
2407                ;
2408                ;CHECK CONTROL SUM CRC AGAINST EXPECTED CRC
2409                ;
2410                CONSUM;             ****ENTRY POINT
2411                ;                   CALCULATE CONTROL SUM CRC
2412 063A CD 4E 06    CALL CTLSUM       CTLSUM(CSMCRC,ERRFLG)
2413                ;                         ( D    ,PSW:Z )
2414                ;                         ( O    , O    )
2415 063D CA 47 06    JZ   CONSU1       IF ERRFLG .EQ. TRUE
2416                ; >>JUMP AHEAD<<       DECLARE DEAD METER. BAD CRC
2417                ;                      A = BADCRC
2418                ;                      NVMDED(BADCRC,ERRFLG)
2419                ;                             ( A    ,PSW:Z )
2420                ;                             ( I    , O    )
2421                ;                   ELSE
2422 0640 3A 08 74    LDA  CTLCRC/2+X   A = DIF = CTLCRC-CSMCRC
2423 0643 92          SUB  D
2424 0644 CA 4C 06    JZ   CONSU2       IF DIF .NE. 0
2425                CONSU1;               >>TARGET OF JUMP AHEAD<<
2426                ;                     DECLARE DEAD METER. BAD CRC
2427 0647 3E 00       MVI  A,BADCRC       A = BADCRC
2428 0649 C3 85 10    JMP  NVMDED         NVMDED(BADCRC,ERRFLG)
2429                ;                             ( A    ,PSW:Z )
2430                ;                             ( I    , O    )
2431                CONSU2;             ELSE
2432 064C 3C          INR  A              PSW:Z = ERRFLG = FALSE
2433                ;                   ENDIF
2434 064D C9          RET               RETURN
2437                ;CTLSUM(CSMCRC,ERRFLG)(ASCREG,DSCREG,WORK1 )
2438                ;      (BYTE  ,BIT   )(NIBSTR,NIBSTR,NIBSTR)
2439                ;      ( O    , O    )( I    , I    , O    )
2440                ;      ( D    ,PSW:Z )( RAM  , RAM  , RAM  )
2441                ;      ( C    , C    )( NC   , NC   , C    )
2442                ;
2443                ;REGISTERS DESTROYED
2444                ;PSW DESTROYED
2445                ;
```

```
2446                ;CALCULATE CONTROL SUM AND ITS CRC FOR THE CURRENT VALUES
2447                ;OF THE ASCENDING AND DESCENDING REGISTERS
2448                ;
2449                CTLSUM;                 ****ENTRY POINT
2450                ;                       COPY ASCENDING REGISTER INTO WORK AREA
2451 064E 01 C9 3F   LXI  B,(ASCREG+ASCSIZ-1)*100H+(WORK1+9)
2452                ;                       B = OFFSET, ASCREG[I=ASCSIZ-1]
2453                ;                       C = OFFSET, WORK1[J=10-1]
2454 0651 3E 08      MVI  A,ASCSIZ          A = ASCSIZ
2455 0653 CD C2 0F   CALL MVRNIB            MVRNIB(WORK1[J],ASCREG[I],ASCSIZ,
2456                ;                             ( @C     , @B      , A    ,
2457                ;                             ( 0      , I       , I    ,
2458                ;
2459                ;                             NONBCD,ZROFLG)
2460                ;                             PSW:S ,PSW:Z )
2461                ;                              0    , 0    )
2462 0656 F2 5B 06   JP   CTLSU1            IF NONBCD .EQ. TRUE
2463 0659 AF         XRA  A                   PSW:Z = ERRFLG = TRUE
2464 065A C9         RET
2465                CTLSU1;                 ELSE
2466 065B 3A 17 74   LDA  DSCREG/2+X        IF DSCREG[0..1] .EQ. HEXFF
2467 065E FE FF      CPI  0FFH                PSW:Z = ERRFLG = TRUE
2468 0660 C8         RZ
2469                ;                       ELSE
2470                ;                         CALCULATE CONTROL SUM IN WORK AREA
2471 0661 06 35      MVI  B,DSCREG+DSCSIZ-1
2472                ;                         B = OFFSET, DSCREG[K=DSCSIZ-1]
2473 0663 11 08 07   LXI  D,DSCSIZ*100H+ASCSIZ
2474                ;                         D = DSCSIZ
2475                ;                         E = ASCSIZ
2476 0666 CD F8 06   CALL DECADD             DECADD(WORK1[J],DSCREG[K],
2477                ;                              ( 0      , I       ,
2478                ;                              ( @C     , @B      ,
2479                ;
2480                ;                              ASCSIZ,DSCSIZ,OVRFLO)
2481                ;                               I    , I    , 0    )
2482                ;                               E    , D    ,PSW:CY)
2483                ;                         CALCULATE CRC FOR CONTROL SUM
2484 0669 01 C2 08   LXI  B,(ASCSIZ)*100H+(WORK1+10-ASCSIZ)
2485                ;                         B = ASCSIZ
2486                ;                         C = OFFSET, WORK1[L=10-ASCSIZ]
2487 066C CD B1 0E   CALL CRC                CRC(WORK1[L],ASCSIZ,CSMCRC)
2488                ;                            ( I      , I    , 0    )
2489                ;                            ( @C     , B    , D    )
2490 066F 04         INR  B                  PSW:Z = ERRFLG = FALSE
2491                ;                       ENDIF
2492 0670 C9         RET                     RETURN
2495                ;DBLHDR(HEADER,ERRFLG)(LOWWRN,SERNUM,ERRST ,SETLIM,ASCREG,
2496                ;      (BYTE  ,BIT   )(NIBSTR,NIBSTR,NIBSTR,NIBSTR,NIBSTR,
2497                ;      ( I    , 0    )( I    , I    , I    , I    , I    ,
2498                ;      ( A    ,PSW:Z )( RAM  , RAM  , RAM  , RAM  , RAM  ,
2499                ;      ( NC   , C    )( NC   , NC   , NC   , NC   , NC   ,
2500                ;
2501                ;      DSCREG,WORK1 ,PCEREG,MRSTS1)
2502                ;      NIBSTR,NIBSTR,NIBSTR,BITSTR)
2503                ;       I    , I    , I    , 0    )
2504                ;       RAM  , RAM  , RAM  , RAM  )
2505                ;       NC   , NC   , NC   , C    )
2506                ;
2507                ;REGISTERS DESTROYED
2508                ;PSW DESTROYED
2509                ;
2510                ;PROCESS DOUBLY DEFINED HEADERS
2511                ;
2512                DBLHDR;                 ****ENTRY POINT
2513 0671 CD 4E 0F   CALL LSTATE             LSTATE(FATMOD,NORMOD,SERMOD,PRVMOD)
2514                ;                             (PSW:S ,PSW:Z ,PSW:P ,PSW:CY)
2515                ;                             ( 0    , 0    , 0    , 0    )
2516 0674 21 E2 06   LXI  H,DBLH04           SET TO RETURN TO ENDCASE
2517 0677 E5         PUSH H
2518 0678 E2 A6 06   JPO  DBLH02             IF SERMOD .EQ. TRUE
2519                ;                       --CASE (HEADER)
```

```
2520 067B FE 52      CPI  HREQDL          **52: DOLLAR LOCK VALUE REQUEST
2521 067D 11 E3 06   LXI  D,DBLH05+0
2522 0680 CA 5B 0D   JZ   VALREQ          VALREQ(UNLOCK,LOKFMT,HDLOCK,ERRFLG)
2523                ;                           (@@DE+0,@DE+1 ,@DE+2 ,PSW:Z )
2524                ;                           ( I    , I    , I    , O    )
2525 0683 FE 53      CPI  HREQLP          **53: LOW POSTAGE WARNING VALUE REQ
2526 0685 01 8B 1C   LXI  B,LOWWRN*100H+HLOPOS
2527 0688 CA 34 0D   JZ   SRVREQ          SRVREQ(LOWWRN,HLOPOS,ERRFLG)
2528                ;                           ( @B   , C    ,PSW:Z )
2529                ;                           ( I    , I    , O    )
2530 068B FE 54      CPI  HREQMN          **54: METER SERIAL NUMBER REQUEST
2531                DBLH01;               ****ALTERNATE ENTRY POINT
2532 068D 11 E6 06   LXI  D,DBLH05+3
2533 0690 CA 5B 0D   JZ   VALREQ          VALREQ(SERNUM,MSNFMT,HMTRNO,ERRFLG)
2534                ;                           (@@DE+0,@DE+1 ,@DE+2 ,PSW:Z )
2535                ;                           ( I    , I    , I    , O    )
2536 0693 FE 55      CPI  HREQDS          **55: DIAGNOSTIC REQUEST
2537 0695 11 E9 06   LXI  D,DBLH05+6
2538 0698 CA 5B 0D   JZ   VALREQ          VALREQ(ERRST ,DIAFMT,HDIAGS,ERRFLG)
2539                ;                           (@@DE+0,@DE+1 ,@DE+2 ,PSW:Z )
2540                ;                           ( I    , I    , I    , O    )
2541 069B FE 56      CPI  HREQSL          **56: SETTING LIMIT VALUE REQUEST
2542 069D 01 8E 1E   LXI  B,SETLIM*100H+HHSLIM
2543 06A0 CA 34 0D   JZ   SRVREQ          SRVREQ(SETLIM,HHSLIM,ERRFLG)
2544                ;                           ( @B   , C    ,PSW:Z )
2545                ;                           ( I    , I    , O    )
2546                ;                     **ELSE: PROCESS ERROR
2547 06A3 C3 A1 0B   JMP  PROERR          PROERR(ERRFLG)
2548                ;                           (PSW:Z )
2549                ;                           ( O    )
2550                ;                    --ENDCASE
2551                DBLH02;              ELSE
2552                ;                    --CASE (HEADER)
2553 06A6 FE 52      CPI  HREQAR          **52: ASCENDING REGISTER REQUEST
2554 06A8 11 EC 06   LXI D,DBLH05+9
2555 06AB CA 5B 0D   JZ   VALREQ          VALREQ(ASCREG,ASCFMT,HAREG ,ERRFLG)
2556                ;                           (@@DE+0,@DE+1 ,@DE+2 ,PSW:Z )
2557                ;                           ( I    , I    , I    , O    )
2558 06AE FE 53      CPI  HREQDR          **53: DESCENDING REGISTER REQUEST
2559 06B0 11 EF 06   LXI  D,DBLH05+12
2560 06B3 CA 5B 0D   JZ   VALREQ          VALREQ(DSCREG,DSCFMT,HDREG ,ERRFLG)
2561                ;                           (@@DE+0,@DE+1 ,@DE+2 ,PSW:Z )
2562                ;                           ( I    , I    , I    , O    )
2563 06B6 FE 54      CPI  HREQCS          **54: CONTROL SUM REQUEST
2564 06B8 C2 C5 06   JNZ  DBLH03
2565 06BB CD 3A 06   CALL CONSUM          CONSUM(ERRFLG)
2566                ;                           (PSW:Z )
2567                ;                           ( O    )
2568 06BE 11 F2 06   LXI  D,DBLH05+15
2569                ;                     IF ERRFLG .EQ. FALSE
2570                ;                       I = 10-ASCSIZ
2571 06C1 C4 5B 0D   CNZ  VALREQ            VALREQ(WORK1[I],CSMFMT,HCSUM,ERRFLG)
2572                ;                              (@@DE+0  ,@DE+1 ,@DE+2,PSW:Z )
2573                ;                              ( I      , I    , I   , O    )
2574                ;                     ENDIF
2575 06C4 C9         RET
2576                DBLH03;
2577 06C5 FE 55      CPI  HREQPC          **55: PIECE COUNT REQUEST
2578 06C7 11 F5 06   LXI  D,DBLH05+18
2579 06CA CA 5B 0D   JZ   VALREQ          VALREQ(PCEREG,PCEFMT,HPCNT ,ERRFLG)
2580                ;                           (@@DE+0,@DE+1 ,@DE+2 ,PSW:Z )
2581                ;                           ( I    , I    , I    , O    )
2582 06CD FE 5B      CPI  HREQCF          **5B: CONFIGURATION DATA REQUEST
2583 06CF CA 2C 06   JZ   CONFIG          CONFIG(ERRFLG)
2584                ;                           (PSW:Z )
2585                ;                           ( O    )
2586 06D2 FE C4      CPI  HSETDA          **C4: RESET DATER DOOR
2587 06D4 C2 A1 0B   JNZ  PROERR
2588 06D7 21 24 74   LXI  H,MRSTS1/2+X    HL = ADDRESS, MRSTS1
2589 06DA 7E         MOV  A,M             MRSTS1.DATDOR = FALSE
2590 06DB E6 BF      ANI  0BFH
2591 06DD 77         MOV  M,A
```

```
2592 06DE 24          INR  H                PSW:Z = ERRFLG = FALSE
2593 06DF C3 48 0C    JMP  SELVAL           DISPLAY SELECTION VALUE
2594                ;                       **ELSE: PROCESS ERROR
2595                ;                       PROERR(ERRFLG)
2596                ;                             (PSW:Z )
2597                ;                             ( 0    )
2598                DBLH04;               --ENDCASE
2599                ;                     ENDIF
2600 06E2 C9          RET                 RETURN
2601                DBLH05;               ARGUMENTS FOR VALREQ
2602 06E3 18 40 8A    DB   UNLOCK,LOKFMT,HDLOCK           ;+0
2603 06E6 21 7F 8C    DB   SERNUM,MSNFMT,HMTRNO           ;+3
2604 06E9 13 5F 8D    DB   ERRST,DIAFMT,HDIAGS            ;+6
2605 06EC 38 80 82    DB   ASCREG,ASCFMT,HAREG            ;+9
2606 06EF 2F 70 83    DB   DSCREG,DSCFMT,HDREG            ;+12
2607 06F2 C2 80 84    DB   WORK1+10-ASCSIZ,CSMFMT,HCSUM   ;+15
2608 06F5 28 7F 85    DB   PCEREG,PCEFMT,HPCNT            ;+18
2611                ;DECADD(V1[V1DGTS-1],V2[V2DGTS-1],V1DGTS,V2DGTS,OVRFLO)
2612                ;      (NIBSTR      ,NIBSTR      ,BYTE  ,BYTE  , BIT  )
2613                ;      ( I/O        , I          , I    , I    , O    )
2614                ;      ( @C         , @B         , E    , D    ,PSW:CY)
2615                ;      ( C          , NC         , C    , C    , C    )
2616                ;
2617                ;PSW DESTROYED
2618                ;REGISTERS DESTROYED
2619                ;
2620                ;BCD ADDITION OF UNSIGNED BCD VALUE STRINGS
2621                ;V1[0..V1DGTS-1] = V1[0..V1DGTS-1] + V2[0..V2DGTS-1]
2622                ;WHERE V1DGTS .GE. V2DGTS
2623                ;
2624                DECADD;               ****ENTRY POINT
2625                ;                     C  OFFSET, V1[I=V1DGTS-1]
2626                ;                     B  OFFSET, V2[J=V2DGTS-1]
2627 06F8 7B          MOV  A,E            IF V1DGTS .LT. V2DGTS
2628 06F9 BA          CMP  D
2629 06FA DA 20 07    JC   DECERR           DECLARE BAD ARGUMENT
2630                ;                       ENTER FATAL ERROR MODE
2631                ;                     ENDIF
2632 06FD AF          XRA  A              PSW:CY = CARRY = FALSE
2633                DECAD1;               DO WHILE V1DGTS .GE. 0
2634 06FE 1D          DCR  E                E = V1DGTS = V1DGTS-1
2635 06FF F8          RM
2636 0700 CD 0C 07    CALL DECCOM           DECCOM(V1[I],V2[J],V1DGTS,V2DGTS,
2637                ;                             ( @C  , @B  , E    , D    ,
2638                ;                             ( I   , I/O , -    , I/O  ,
2639                ;
2640                ;                             VAL1,VAL2)
2641                ;                              L  , A  )
2642                ;                              O  , O  )
2643                ;                       L[0..1] = VAL1 = HEX90 .OR. V1[I]
2644                ;                       A[0..1] = VAL2 = V2[J]
2645                ;                       B = OFFSET, V2[J=J-1]
2646                ;                       D = V2DGTS = V2DGTS-1
2647 0703 8D          ADC  L                A[1] = VAL1 = VAL1+VAL2+CARRY
2648 0704 27          DAA
2649                ;                       PSW:CY = CARRY
2650 0705 CD EE 0F    CALL PUTNIB           PUTNIB(V1[I],VAL1)
2651                ;                             ( @C  ,A[1])
2652                ;                             ( O   , I  )
2653 0708 0D          DCR  C                C = OFFSET, V1[I=I-1]
2654 0709 C3 FE 06    JMP  DECAD1
2655                ;                     ENDDO
2656                ;                     RETURN
2659                ;DECCOM(V1[I] ,V2[J] ,V1DGTS,V2DGTS,VAL1,VAL2)
2660                ;      (NIBBLE,NIBBLE,BYTE  ,BYTE  ,BYTE,BYTE)
2661                ;      ( I    , I/O  , -    , I/O  , O  , O  )
2662                ;      ( @C   , @B   , E    , D    , L  , A  )
2663                ;      ( NC   , C    , NC   , C    , C  , C  )
2664                ;
2665                ;PSW:CY = NO CHANGE
2666                ;PSW:S, Z, P CHANGED
2667                ;REGISTERS DESTROYED
2668                ;
```

```
2669                ;COMMON ROUTINE CALLED BY DECADD AND DECSUB
2670                ;FETCHES NEXT PAIR OF OPERANDS
2671                ;VAL1 = HEX90 .OR. V1[I]
2672                ;VAL2 = V2[J]
2673                ;J AND V2DGTS WILL BE DECREMENTED
2674                ;
2675                DECCOM;                 ****ENTRY POINT
2676 070C F5          PUSH PSW              SAVE PSW:CY
2677 070D 60          MOV  H,B              H = OFFSET, V2[J]
2678 070E 41          MOV  B,C              B = OFFSET, V1[I]
2679 070F CD 35 0F    CALL GETNIB           GETNIB(VAL1,ZROFLG,V1[I])
2680                ;                             ( A  ,PSW:Z , @B  )
2681                ;                             ( 0  , 0    , I   )
2682 0712 F6 90       ORI  90H              L[0..1] = VAL1 = HEX90 .OR. VAL1
2683 0714 6F          MOV  L,A
2684 0715 44          MOV  B,H              B = OFFSET, V2[J]
2685 0716 F1          POP  PSW              RESTORE PSW:CY
2686 0717 3E 00       MVI  A,0              A[0..1] = VAL2 = 0
2687 0719 15          DCR  D                D = V2DGTS = V2DGTS-1
2688 071A F8          RM                    IF V2DGTS .GE. 0
2689 071B CD 35 0F    CALL GETNIB             GETNIB(VAL2   ,ZROFLG,V2[J])
2690                ;                                (A[0..1],PSW:Z , @B  )
2691                ;                                ( 0     , 0    , I   )
2692 071E 05          DCR  B                  B = OFFSET, V2[J=J-1]
2693                ;                       ENDIF
2694 071F C9          RET                   RETURN
2697                ;DECERR()
2698                ;
2699                ;PSW DESTROYED
2700                ;ALL REGISTERS DESTROYED
2701                ;
2702                ;ERROR ROUTINE CALLED BY DECADD AND DECSUB
2703                ;
2704                DECERR;                 ****ENTRY POINT
2705 0720 3E 02       MVI  A,SFTWRE         A = SFTWRE
2706 0722 CD 80 08    CALL FATERR           ENTER FATAL MODE. SOFTWARE ERROR
2707 0725 CD 68 10    CALL NVMCHG           SAVE NONVOLATILE MEMORY
2708 0728 C3 B6 01    JMP  PWRDN            FREEZE UNTIL NEXT POWER UP
2711                ;DECSUB(V1[V1DIGS-1],V2[V2DGTS-1],V1DGTS,V2DGTS)
2712                ;      (NIBSTR      ,NIBSTR      ,BYTE  ,BYTE  )
2713                ;      ( I/O        , I          , I    , I    )
2714                ;      ( @C         , @B         , E    , D    )
2715                ;      ( C          , NC         , C    , C    )
2716                ;
2717                ;PSW DESTROYED
2718                ;REGISTERS DESTROYED
2719                ;
2720                ;BCD SUBTRACTION OF UNSIGNED BCD VALUE STRINGS
2721                ;V1[0..V1DGTS-1] = V1[0..V1DGTS-1] - V2[0..V2DGTS-1]
2722                ;WHERE V1DGTS .GE. V2DGTS
2723                ;
2724                DECSUB;                 ****ENTRY POINT
2725                ;                       C = OFFSET, V1[I=V1DGTS-1]
2726                ;                       B = OFFSET, V2[J=V2DGTS-1]
2727 072B 7B          MOV  A,E              IF V1DGTS .LT. V2DGTS
2728 072C BA          CMP  D
2729 072D DA 20 07    JC   DECERR             DECLARE BAD ARGUEMENT
2730                ;                         ENTER FATAL ERROR MODE
2731                ;                       ENDIF
2732 0730 AF          XRA  A                PSW:CY = BORROW = FALSE
2733                DECSU1;                 DO WHILE V1DGTS .GE. 0
2734 0731 1D          DCR  E                  E = V1DGTS = V1DGTS-1
2735 0732 F8          RM
2736 0733 CD 0C 07    CALL DECCOM             DECCOM(V1[I],V2[J],V1DGTS,V2DGTS,
2737                ;                                ( @C  , @B  , E    , D    ,
2738                ;                                ( I   , I/O , -    , I/O  ,
2739                ;
2740                ;                                VAL1,VAL2)
2741                ;                                 L  , A  )
2742                ;                                 0  , 0  )
2743                ;                             L[0..1] = VAL1 = HEX90 .OR. V1[I]
2744                ;                             A[0..1] = VAL2 = V2[J]
2745                ;                             B = OFFSET, V2[J=J-1]
```

```
2746                ;                          D = V2DGTS = V2DGTS-1
2747 0736 CE F6      ACI  -10                  A[1] = VAL1-VAL2-BORROW
2748 0738 2F         CMA
2749 0739 3C         INR  A
2750 073A 85         ADD  L
2751 073B 27         DAA
2752 073C 3F         CMC                       PSW:CY = BORROW
2753 073D CD EE 0F   CALL PUTNIB               PUTNIB(V1[I],VAL1)
2754                ;                                ( @C  , A  )
2755                ;                                ( O   , I  )
2756 0740 0D         DCR  C                    C = OFFSET, V1[I=I-1]
2757 0741 C3 31 07   JMP  DECSU1
2758                ;                        ENDDO
2759                ;                        RETURN
2762                ;DOACCT()(POSREG,ASCCRC,ASCREG,DSCCRC,DSCREG,PCEREG,WORK1 )
2763                ;        (NIBSTR,BYTE  ,NIBSTR,BYTE  ,NIBSTR,NIBSTR,NIBSTR)
2764                ;        ( I    , O    , I/O  , O    , I/O  , I/O  , O    )
2765                ;        ( RAM  , RAM  , RAM  , RAM  , RAM  , RAM  , RAM  )
2766                ;        ( NC   , C    , C    , C    , C    , C    , C    )
2767                ;
2768                ;PSW DESTROYED
2769                ;REGISTERS DESTROYED
2770                ;
2771                ;DO ACCOUNTING FOR METER TRIP
2772                ;
2773                DOACCT;                  ****ENTRY POINT
2774                ;                        ADD POSTAGE TO ASCENDING REGISTER
2775 0744 11 08 04   LXI  D,NBANKS*100H+ASCSIZ
2776                ;                        D = NBANKS
2777                ;                        E = ASCSIZ
2778 0747 01 3F 45   LXI  B,(POSREG+NBANKS-1)*100H+(ASCREG+ASCSIZ-1)
2779                ;                        B = OFFSET, POSREG[I=NBANKS-1]
2780                ;                        C = OFFSET, ASCREG[J=ASCSIZ-1]
2781 074A CD F8 06   CALL DECADD             DECADD(ASCREG[J],POSREG[I],
2782                ;                              ( @C      , @B      ,
2783                ;                              ( I/O     , I       ,
2784                ;
2785                ;                              ASCSIZ,NBANKS)
2786                ;                               E    , D    )
2787                ;                               I    , I    )
2788                ;                        COMPUTE CRC FOR ASCENDING REGISTER
2789 074D 01 38 08   LXI  B,ASCSIZ*100H+ASCREG
2790                ;                        B = ASCSIZ
2791                ;                        C = OFFSET, ASCREG
2792 0750 CD B1 0E   CALL CRC                CRC(ASCREG,ASCSIZ,CRCVAL)
2793                ;                           ( @C   , B    , D    )
2794                ;                           ( I    , I    , O    )
2795 0753 7A         MOV  A,D                ASCCRC = CRCVAL
2796 0754 32 20 74   STA  ASCCRC/2+X
2797                ;                        SUBTRACT POSTAGE FROM DESCENDING REG
2798 0757 11 07 04   LXI  D,NBANKS*100H+DSCSIZ
2799                ;                        D = NBANKS
2800                ;                        E = DSCSIZ
2801 075A 01 35 45   LXI  B,(POSREG+NBANKS-1)*100H+(DSCREG+DSCSIZ-1)
2802                ;                        B = OFFSET, POSREG[I=NBANKS-1]
2803                ;                        C = OFFSET, DSCREG[J=DSCSIZ-1]
2804 075D CD 2B 07   CALL DECSUB             DECSUB(DESCREG[J],POSREG[I],
2805                ;                              ( @C       , @B      ,
2806                ;                              ( I/O      , I       ,
2807                ;
2808                ;                              DSCSIZ,NBANKS)
2809                ;                               E    , D    )
2810                ;                               I    , I    )
2811                ;                        COMPUTE CRC FOR DESCENDING REGISTER
2812 0760 01 2F 07   LXI  B,DSCSIZ*100H+DSCREG
2813                ;                        B = DSCSIZ
2814                ;                        C = OFFSET,DSCREG
2815 0763 CD B1 0E   CALL CRC                CRC(DSCREG,DSCSIZ,CRCVAL)
2816                ;                           ( @C   , B    , D    )
2817                ;                           ( I    , I    , O    )
2818 0766 7A         MOV  A,D                DSCCRC = CRCVAL
```

```
2819 0767 32 1B 74   STA  DSCCRC/2+X
2820                ;                    INCREMENT THE PIECE COUNT
2821 076A 3E 10      MVI  A,10H          WORK1[0] = 1
2822 076C 32 60 74   STA  WORK1/2+X
2823 076F 11 07 01   LXI  D,1*100H+PCESIZ
2824                ;                    D = ONESIZ = 1
2825                ;                    E = PCESIZ
2826 0772 01 2E C0   LXI  B,(WORK1+1-1)*100H+(PCEREG+PCESIZ-1)
2827                ;                    B = OFFSET, WORK1[I=ONESIZ-1]
2828                ;                    C = OFFSET, PCEREG[J=PCESIZ-1]
2829 0775 C3 F8 06   JMP  DECADD         DECADD(PCEREG[J],WORK1[I],
2830                ;                          ( @C      , @B     ,
2831                ;                          ( I/O     , I      ,
2832                ;
2833                ;                          PCESIZ,ONESIZ)
2834                ;                           E    , D    )
2835                ;                           I    , I    )
2836                ;                    RETURN
2839                ;DOSTAT()(MRSTS1,MRSTS2,NORFLG)
2840                ;        (BITSTR,BITSTR,BITSTR)
2841                ;        ( I    , I/O  , I/O  )
2842                ;        ( RAM  , RAM  , RAM  )
2843                ;        ( NC   , C    , C    )
2844                ;
2845                ;REGISTERS DESTROYED
2846                ;PSW DESTROYED
2847                ;
2848                ;UPDATE METER STATUS TO AGREE WITH SWITCHES AND SENSORS
2849                ;
2850                DOSTAT;              ****ENTRY POINT
2851                ;                    FETCH PRESENT SWITCH VALUES
2852 0778 CD 31 0C   CALL REDSTS         REDSTS(TRPSW,PRVSW)
2853                ;                          ( B    , A    )
2854                ;                          ( O    , O    )
2855 077B E6 01      ANI  1              C = PRVSW = PRVSW .AND. HEX01
2856 077D 4F         MOV  C,A
2857 077E 78         MOV  A,B            B = TRPSW = TRPSW .AND. HEX08
2858 077F E6 08      ANI  8
2859 0781 47         MOV  B,A
2860 0782 81         ADD  C              C = NEWSWS = PRVSW + TRPSW
2861 0783 4F         MOV  C,A
2862 0784 21 25 74   LXI  H,MRSTS2/2+X   HL = ADDRESS, MRSTS2
2863                ;                    SAVE ENTRY STATUS
2864 0787 7E         MOV  A,M            A = MRSTS2
2865 0788 57         MOV  D,A            D = OLDST2 = MRSTS2
2866                ;                    UPDATE STATUS
2867                ;                    MRSTS2.TRPSW = TRPSW
2868                ;                    MRSTS2.PRVMOD = PRVSW
2869 0789 E6 F6      ANI  0F6H           MRSTS2 = MRSTS2.AND.HEXF6.OR.NEWSWS
2870 078B B1         ORA  C
2871 078C 77         MOV  M,A
2872                ;                    CHECK METER STATUS
2873 078D CD 4E 0F   CALL LSTATE         LSTATE(FATMOD,NORMOD,SERMOD,PRVMOD)
2874                ;                          (PSW:S ,PSW:Z ,PSW:P ,PSW:CY)
2875                ;                          ( O    , O    , O    , O    )
2876 0790 F8         RM                  IF FATMOD .EQ. FALSE
2877                ;                      READ CYCLE SWITCH
2878 0791 CD AF 0B   CALL RDCYC            RDCYC(INCYC,INCYC,ADRESS,MRSTS1)
2879                ;                           ( A   ,PSW:C, HL   , @HL  )
2880                ;                           ( O   , O   , O    , -    )
2881 0794 3E 04      MVI  A,BADCYC         A = BADCYC
2882                ;                      IF INCYC .EQ. TRUE
2883                ;                        CYCLE SWITCH SAYS METER NOT HOME
2884                ;                        DECLARE DEAD METER, BAD SWITCH
2885 0796 DA 85 10   JC   NVMDED            NVMDED(BADCYC,ERRFLG)
2886                ;                              ( A    ,PSW:Z )
2887                ;                              ( I    , O    )
2888                ;                      ELSE
2889                ;                        CALC SEQ SWITCH CLOSURE VALUE
2890 0799 7A         MOV  A,D
2891 079A A0         ANA  B
2892 079B A8         XRA  B
```

```
2893 079C 4F          MOV  C,A              C = CLOSUR = OLDST2.TRPSW .AND.
2894                ;                                   TRPSW .XOR. TRPSW
2895                ;                       DEFINE TRIP REQUEST VALUE
2896 079D 7E          MOV  A,M              A=TRPREQ=MRSTS1.ENABLD.AND.CLOSUR
2897 079E 17          RAL
2898 079F A1          ANA  C
2899                ;                       UPDATE TRIP REQUEST STATUS
2900                ;                       NORFLG.TRPREQ = TRPREQ
2901 07A0 23          INX  H                HL = ADDRESS, NORFLG
2902 07A1 23          INX  H
2903 07A2 B6          ORA  M                NORFLG = TRPREQ .OR. NORFLG
2904 07A3 77          MOV  M,A
2905                ;                     ENDIF
2906                ;                   ENDIF
2907 07A4 C9          RET               RETURN
2910                ;DOTRIP()(MRSTS1,NORFLG,PORTA )
2911                ;        (BITSTR,BITSTR,BITSTR)
2912                ;        ( 0    , 0    , 0    )
2913                ;        ( RAM  , RAM  , 7001 )
2914                ;        ( C    , C    , C    )
2915                ;
2916                ;REGISTERS DESTROYED
2917                ;PSW DESTROYED
2918                ;
2919                ;TRIP METER
2920                ;
2921                DOTRIP;             ****ENTRY POINT
2922 07A5 CD DE 0E    CALL DBLANK       TURN OFF DISPLAY
2923                ;                   CHECK CYCLE SWITCH WHILE METER HOME
2924 07A8 CD AF 0B    CALL RDCYC        RDCYC(INCYC,INCYC,ADRESS,MRSTS1)
2925                ;                       ( A   ,PSW:C, HL   , @HL  )
2926                ;                       ( 0   , 0   , 0    , -    )
2927 07AB 3E 04       MVI  A,BADCYC     A = BADCYC
2928                ;                   IF INCYC .EQ. TRUE
2929                ;                     CYCLE SWITCH SAYS METER NOT HOME
2930                ;                     DECLARE DEAD METER, BAD SWITCH
2931 07AD DA 85 10    JC   NVMDED         NVMDED(BADCYC,ERRFLG)
2932                ;                           ( A    ,PSW:Z )
2933                ;                           ( I    , 0    )
2934                ;                   ELSE
2935                ;                     CYCLE SWITCH SAYS METER IS HOME
2936                ;                     INDICATE TRIP HAS STARTED
2937 07B0 7E          MOV  A,M            A = MRSTS1
2938 07B1 F6 81       ORI  81H            MRSTS1.UNKSEL = TRUE
2939                ;                     MRSTS1.QUEREG = TRUE
2940 07B3 77          MOV  M,A
2941 07B4 23          INX  H              HL = ADDRESS, NORFLG
2942 07B5 23          INX  H
2943 07B6 7E          MOV  A,M            NORFLG.TRPREQ = FALSE
2944 07B7 E6 F7       ANI  0F7H
2945 07B9 F6 40       ORI  40H            NORFLG.QUEPOS = TRUE
2946 07BB 77          MOV  M,A
2947                ;                     TRIP METER
2948 07BC CD 7C 18    CALL MVTRIP         MVTRIP(ERROR)
2949                ;                           ( A   )
2950                ;                           ( 0   )
2951 07BF B7          ORA  A              IF ERROR .NE. 0
2952                ;                       DECLARE TRIP ERROR
2953 07C0 C2 80 08    JNZ  FATERR             FATERR(ERROR,ERRFLG)
2954                ;                               ( A   ,PSW:Z )
2955                ;                               ( I   , 0    )
2956                ;                     ELSE
2957                ;                       TRIP STARTED OK
2958                ;                       START AC MOTOR TO CONTINUE CYCLE
2959 07C3 21 01 70    LXI  H,PORTA        HL = ADDRESS, PORTA
2960 07C6 7E          MOV  A,M            PORTA = PORTA .AND. HEXEF
2961 07C7 E6 EF       ANI  0EFH
2962 07C9 77          MOV  M,A
2963 07CA F3          DI                  DISABLE INTERRUPT
2964 07CB CD 44 07    CALL DOACCT         ACCOUNT FOR TRIP
2965                ;                     PREVENT DOUBLE ACCOUNTING
2966 07CE 21 24 74    LXI  H,MRSTS1/2+X   HL = ADDRESS, MRSTS1
```

```
2967 07D1 7E          MOV  A,M              MRSTS1.INCYC = TRUE
2968 07D2 F6 02       ORI  2
2969 07D4 77          MOV  M,A
2970 07D5 FB          EI                    ENABLE INTERRUPT
2971                ;                       CHECK CYCLE SWITCH WHILE NOT HOME
2972 07D6 01 B8 0B    LXI  B,3000           BC = N = 3000 ;FOR 300 MSEC LOOP
2973                DOTR01;                 LOOP
2974 07D9 CD AF 0B    CALL RDCYC              RDCYC(INCYC,INCYC,ADRESS,MRSTS1)
2975                ;                               ( A   ,PSW:C, HL   , @HL  )
2976                ;                               ( 0   , 0   , 0    , -    )
2977                ;                         IF INCYC .EQ. TRUE
2978 07DC DA ED 07    JC   DOTR02               BREAK
2979                ;                         ENDIF
2980 07DF CD 19 0B    CALL NPAUSE             NPAUSE(N  ,ZROFLG)
2981                ;                               (BC ,PSW:Z )
2982                ;                               (I/O, 0    )
2983 07E2 C2 D9 07    JNZ  DOTR01             IF N .EQ. 0
2984                ;                           TIMEOUT
2985                ;                           CYC SWT SAYS MOTOR STILL HOME
2986                ;                           FATAL ERROR, NOT IN CYCLE
2987 07E5 3E 18       MVI  A,NINCYC             A = NINCYC
2988 07E7 CD 80 08    CALL FATERR               FATERR(NINCYC,ERRFLG)
2989                ;                                 ( A    ,PSW:Z )
2990                ;                                 ( I    , 0    )
2991 07EA C3 A0 08    JMP  FINTRP               TRY TO DRIVE METER HOME
2992                ;                           RETURN
2993                ;                         ENDIF
2994                DOTR02;                 ENDLOOP
2995                ;                       CYCLE SWITCH SAYS CYCLE STARTED
2996                ;                       MOVE FROM TRIP TO LOCK
2997 07ED CD 96 18    CALL MVLOCK             MVLOCK(ERROR)
2998                ;                             ( A   )
2999                ;                             ( 0   )
3000 07F0 B7          ORA  A                  IF ERROR .NE. 0
3001                ;                         DECLARE LOCK ERROR
3002 07F1 C4 80 08    CNZ  FATERR             FATERR(ERROR,ERRFLG)
3003                ;                               ( A   ,PSW:Z )
3004                ;                               ( I   , 0    )
3005                ;                       ENDIF
3006                ;                       CHECK CYCLE SWITCH WHEN HOME AGAIN
3007 07F4 01 10 27    LXI  B,10000          BC = N = 10000 ;FOR 1 SEC LOOP
3008                DOTR03;                 LOOP
3009 07F7 CD AF 0B    CALL RDCYC              RDCYC(INCYC,INCYC,ADRESS,MRSTS1)
3010                ;                               ( A   ,PSW:C, HL   , @HL  )
3011                ;                               ( 0   , 0   , 0    , -    )
3012                ;                         IF INCYC .EQ. FALSE
3013 07FA D2 0D 08    JNC  DOTR04               BREAK
3014                ;                         ENDIF
3015 07FD CD 19 0B    CALL NPAUSE             NPAUSE(N  ,ZROFLG)
3016                ;                               (BC ,PSW:Z )
3017                ;                               (I/O, 0    )
3018 0800 C2 F7 07    JNZ  DOTR03             IF N .EQ. 0
3019                ;                           TIMEOUT
3020                ;                           CYC SWT SAYS MOTOR NOT HOME
3021 0803 E5          PUSH H                    SAVE HL
3022 0804 CD D0 08    CALL FINTR4               FATAL ERROR, SLOW TRIP
3023 0807 E1          POP  H                    RESTORE HL
3024 0808 3E FB       MVI  A,0FBH               A = MASK, WILL SET:
3025                ;                           MRSTS1.ENABLD = FALSE
3026 080A C3 0F 08    JMP  DOTR05               DISABLE METER
3027                ; >>JUMP AHEAD<<            STOP AC MOTOR
3028                ;                           RETURN
3029                ;                         ENDIF
3030                DOTR04;                 ENDLOOP
3031                ;                       CYCLE SWITCH SAYS METER CAME HOME
3032                ;                       INDICATE TRIP COMPLETION
3033 080D 3E 7B       MVI  A,7BH            A = MASK, WILL SET:
3034                ;                       MRSTS1.ENABLD = FALSE
3035                ;                       MRSTS1.UNKSEL = FALSE
3036                DOTR05;                 >>TARGET OF JUMP AHEAD<<
3037                ;                       UPDATE MRSTS1 ACCORDING TO MASK
3038 080F A6          ANA  M                MRSTS1 = MASK .AND. MRSTS1
```

```
3039 0810 77          MOV  M,A
3040                DOTR06;                  ****ALTERNATE ENTRY POINT
3041                ;                        STOP AC MOTOR
3042 0811 21 01 70    LXI  H,PORTA           HL = ADDRESS, PORTA
3043 0814 7E          MOV  A,M               PORTA = PORTA .OR. HEX10
3044 0815 F6 10       ORI  10H
3045 0817 77          MOV  M,A
3046                ;                      ENDIF
3047                ;                    ENDIF
3048 0818 C9          RET                  RETURN
3051                ;ENDENT(ERRFLG)(NORFLG)
3052                ;      (BIT   )(BITSTR)
3053                ;      ( 0    )( I    )
3054                ;      (PSW:Z )( RAM  )
3055                ;      ( C    )( NC   )
3056                ;
3057                ;PSW DESTROYED
3058                ;REGISTERS DESTROYED
3059                ;
3060                ;PROCESS END OF ENTRY HEADER
3061                ;
3062                ENDENT;              ****ENTRY POINT
3063 0819 3A 26 74    LDA  NORFLG/2+X    IF(NORFLG.CMBIN .AND.
3064                ;                       NORFLG.AMTIN) .NE. TRUE
3065 081C 2F          CMA
3066 081D E6 30       ANI  30H
3067                ;                      PROCEEDURAL ERROR
3068 081F C2 A1 0B    JNZ  PROERR            PROERR(ERRFLG)
3069                ;                            (PSW:Z )
3070                ;                            ( 0    )
3071                ;                    ELSE
3072 0822 CD 4E 0F    CALL LSTATE            LSTATE(FATMOD,NORMOD,SERMOD,PRVMOD)
3073                ;                            (PSW:S ,PSW:Z ,PSW:P ,PSW:CY)
3074                ;                            ( 0    , 0    , 0    , 0    )
3075                ;                      IF SERMOD .EQ. TRUE
3076                ;                        SERVICE MODE END OF ENTRY
3077 0825 EA 63 0C    JPE  SEREOE            SEREOE(ERRFLG)
3078                ;                              (PSW:Z )
3079                ;                              ( 0    )
3080                ;                      ELSE
3081                ;                      IF PRVMOD .EQ. TRUE
3082                ;                        MANUAL RESET
3083 0828 DA E9 09    JC   MANRST            MANRST(ERRFLG)
3084                ;                              (PSW:Z )
3085                ;                              ( 0    )
3086                ;                      ELSE
3087                ;                        VARIABLE REMOTE RESET
3088 082B C3 BE 13    JMP  VRMRS             VRMRS(ERRFLG)
3089                ;                            (PSW:Z )
3090                ;                            ( 0    )
3091                ;                      ENDIF
3092                ;                    ENDIF
3095                ;ENTAMT/ENTCMB(MSGBUF)(AMTBUF,CMBBUF,NORFLG)
3096                ;             (NIBSTR)(NIBSTR,NIBSTR,BITSTR)
3097                ;             ( I    )( 0    , 0    , 0    )
3098                ;             ( @B   )( RAM  , RAM  , RAM  )
3099                ;             ( NC   )( C    , C    , C    )
3100                ;REGISTERS DESTROYED
3101                ;PSW DESTROYED
3102                ;
3103                ;MOVE FIELD, FORMAT AND VALUE
3104                ;FROM MESSAGE BUFFER TO APPROPRIATE RESET BUFFER
3105                ;
3106                ENTAMT;              ****ENTRY POINT FOR RESET AMOUNT
3107 082E 0E E0       MVI  C,AMTBUF      C = OFFSET, DEST = OFFSET, AMTBUF
3108                ;                    SET TO SET NORFLG.AMTIN = TRUE
3109 0830 3E 10       MVI  A,10H         A = MASK = HEX10
3110 0832 C3 39 08    JMP  ENTCM1
3111                ; >>JUMP AHEAD<<
3112                ENTCMB;              ****ENTRY POINT FOR RESET COMBINATION
3113 0835 0E F0       MVI  C,CMBBUF      C = OFFSET, DEST = OFFSET, CMBBUF
3114                ;                    SET TO SET NORFLG.CMBIN = TRUE
```

```
3115 0837 3E 20      MVI  A,20H          A = MASK = HEX20
3116               ENTCM1;               >>TARGET OF JUMP AHEAD<<
3117 0839 21 26 74   LXI  H,NORFLG/2+X   HL = ADDRESS, NORFLG
3118               ;                     UPDATE FLAG
3119 083C B6         ORA  M              NORFLG = NORFLG .OR. MASK
3120 083D 77         MOV  M,A
3121               ;                     FETCH COUNT FROM MESSAGE FORMAT
3122 083E CD 35 0F   CALL GETNIB         GETNIB(CNT,ZERO,MSGBUF)
3123               ;                           ( A ,PSW:Z, @B  )
3124               ;                           ( O , O   , I   )
3125               ;                     INCLUDE LEAD ZERO AND FORMAT IN COUNT
3126 0841 C6 03      ADI  3              CNT = (CNT+3) .AND. HEXFE
3127 0843 E6 FE      ANI  0FEH
3128               ;                     MOVE MESSAGE TO DESTINATION BUFFER
3129 0845 C3 B3 0F   JMP  MVLNIB         MVLNIB(DEST,MSGBUF,CNT,PSW)
3130               ;                           ( @C , @B   , A ,PSW)
3131               ;                           ( O  , I    , I , O )
3132               ;                     RETURN
3135               ;ENTSER()(MRSTS1)
3136               ;        (BITSTR)
3137               ;        ( O    )
3138               ;        ( RAM  )
3139               ;        ( C    )
3140               ;
3141               ;PSW DESTROYED
3142               ;REGISTERS DESTROYED
3143               ;
3144               ;ENTER SERVICE MODE
3145               ;
3146               ENTSER;               ****ENTRY POINT
3147 0848 21 24 74   LXI  H,MRSTS1/2+X   HL = ADDRESS, MRSTS1
3148 084B 7E         MOV  A,M            MRSTS1.SERMOD = TRUE
3149 084C F6 08      ORI  08H
3150 084E E6 FB      ANI  0FBH           MRSTS1.ENABLD = FALSE
3151 0850 77         MOV  M,A
3152 0851 C9         RET                 RETURN
3155               ;EXTSER()(MRSTS1,NORFLG)
3156               ;        (BITSTR,BITSTR)
3157               ;        ( O    , O    )
3158               ;        ( RAM  , RAM  )
3159               ;        ( C    , C    )
3160               ;
3161               ;PSW DESTROYED
3162               ;REGISTERS DESTROYED
3163               ;
3164               ;EXIT SERVICE MODE
3165               ;
3166               EXTSER;               ****ENTRY POINT
3167 0852 21 24 74   LXI  H,MRSTS1/2+X   HL = ADDRESS, MRSTS1
3168 0855 7E         MOV  A,M            MRSTS1.SERMOD = FALSE
3169 0856 E6 F7      ANI  0F7H
3170 0858 77         MOV  M,A
3171 0859 23         INX  H              HL = ADDRESS, NORFLG
3172 085A 23         INX  H
3173 085B 7E         MOV  A,M            NORFLG.COMDSB = FALSE
3174 085C E6 FB      ANI  0FBH
3175 085E 77         MOV  M,A
3176 085F C9         RET                 RETURN_
3179               ;EXTIRP()(KDCTRL,MRSTS1,MTRCHR,SERFLG)
3180               ;        (BITSTR,BITSTR,BITSTR,BITSTR)
3181               ;        ( I    , I    , I    , I    )
3182               ;        ( RAM  , RAM  , RAM  , RAM  )
3183               ;        ( NC   , NC   , NC   , NC   )
3184               ;
3185               ;REGISTERS DESTROYED
3186               ;PSW DESTROYED
3187               ;
3188               ;INITIATE TRIP IN RESPONSE TO EXTERNAL MESSAGE
3189               ;
3190               EXTIRP;               ****ENTRY POINT
3191               ;                     SET TO REACH PROERR VIA RETURN
3192 0860 21 A1 0B   LXI  H,PROERR
```

```
3193 0863 E5          PUSH H
3194 0864 3A 27 74    LDA KDCTRL/2+X      PSW:CY = KDCTRL.KBDDSB
3195 0867 1F          RAR
3196                ;                     IF KDCTRL.KBDDSB .EQ. FALSE
3197                ;                       KEYBOARD HAS NOT BEEN DISABLED
3198 0868 D0          RNC                   PROERR(ERRFLG)
3199                ;                     ELSE
3200 0869 21 24 74    LXI  H,MRSTS1/2+X   HL = ADDRESS, MRSTS1
3201 086C 7E          MOV  A,M            PSW:Z =DISABL=MRSTS1.ENABLD .EQ. FALSE
3202 086D E6 04       ANI  4
3203                ;                     IF DISABL .EQ. TRUE
3204                ;                       METER IS DISABLED
3205 086F C8          RZ                    PROERR(ERRFLG)
3206                ;                     ELSE
3207 0870 2B          DCX  H                HL = ADDRESS, MTRCHR
3208 0871 3A 10 74    LDA  SERFLG/2+X       A.2 = (.NOT. SERFLG.SNOLCK) .OR.
3209                ;                             MTRCHR.TRPCTL
3210 0874 17          RAL
3211 0875 2F          CMA
3212 0876 B6          ORA  M
3213 0877 E6 20       ANI  20H              PSW:Z = TRPLCK = A.2 .EQ. FALSE
3214                ;                       IF TRPLCK .EQ. TRUE
3215                ;                         RESPONSE TO EXT TRIP IS FORBIDDEN
3216 0879 C8          RZ                      PROERR(ERRFLG)
3217                ;                       ELSE
3218                ;                         EXTERNAL TRIPPING ALLOWED
3219 087A E1          POP  H                  CLEAN UP STACK
3220 087B C3 A5 07    JMP  DOTRIP             TRIP METER
3221                ;                       ENDIF
3222                ;                     ENDIF
3223                ;                     RETURN
3226                ;FATERR(CODE,ERRFLG)(MRSTS2,ERRCOD,NORFLG,ERRCNT)
3227                ;      (BYTE,BIT   )(BITSTR,BYTE  ,BITSTR,NIBSTR)
3228                ;      ( I  , 0    )( 0    , 0    , 0    , 0    )
3229                ;      ( A  ,PSW:Z )( RAM  , RAM  , RAM  , RAM  )
3230                ;      ( C  , C    )( C    , C    , C    , C    )
3231                ;
3232                ;PSW DESTROYED
3233                ;REGISTERS DESTROYED
3234                ;
3235                ;PROCESS FATAL ERROR
3236                ;
3237                FATINT;               ****ENTRY POINT FROM INTERRUPT VECTOR
3238                ;                     INDICATE WATCHDOG INTERRUPT OR
3239                ;                     INCORRECTLY ENABLED TEST INTERRUPT
3240 087E 3E 17       MVI  A,BARF         A = BARF
3241                FATERR;               ****ENTRY POINT
3242 0880 21 25 74    LXI  H,MRSTS2/2+X   HL = ADDRESS, MRSTS2
3243 0883 46          MOV  B,M            IF MRSTS2.FATMOD .EQ. FALSE
3244 0884 04          INR  B
3245 0885 FA 9E 08    JM   FATE01
3246 0888 32 0A 74    STA  ERRCOD/2+X       ERRCOD = CODE
3247 088B 7E          MOV  A,M              MRSTS2.FATMOD = TRUE
3248 088C F6 80       ORI  80H
3249 088E 77          MOV  M,A
3250 088F 23          INX  H                HL = ADDRESS, NORFLG
3251 0890 7E          MOV  A,M              NORFLG.QUESTS = TRUE
3252 0891 F6 80       ORI  80H
3253 0893 77          MOV  M,A
3254 0894 21 0B 74    LXI  H,ERRCNT/2+X     HL = ADDRESS, ERRCNT
3255 0897 7E          MOV  A,M              ERRCNT[0..1] = ERRCNT[0..1]+1
3256 0898 3C          INR  A
3257 0899 27          DAA
3258 089A 77          MOV  M,A
3259 089B CD 64 04    CALL PERDSP           MAKE ERROR DISPLAY
3260                FATE01;               ENDIF
3261 089E AF          XRA  A              PSW:Z = ERRFLG = TRUE
3262 089F C9          RET                 RETURN
3265                ;FINTRP()(MRSTS1,PORTA )
3266                ;        (BITSTR,BITSTR)
3267                ;        ( 0    , 0    )
3268                ;        ( RAM  , 7001 )
```

```
3269                ;        ( C    , C    )
3270                ;
3271                ;REGISTERS DESTROYED
3272                ;PSW DESTROYED
3273                ;
3274                ;ATTEMPT TO DRIVE METER HOME
3275                ;
3276                FINTRP;                 ****ENTRY POINT
3277                ;                       START AC MOTOR
3278 08A0 21 01 70   LXI  H,PORTA           HL = ADDRESS, PORTA
3279 08A3 7E         MOV  A,M               PORTA = PORTA .AND. HEXEF
3280 08A4 E6 EF      ANI  0EFH
3281 08A6 77         MOV  M,A
3282                ;                       DRIVE METER FOR 0.2 SEC. TO INSURE
3283                ;                       THAT METER AT START OF TRIP CYCLE IS
3284                ;                       DRIVEN FAR ENOUGH TO MAKE THE CYCLE
3285                ;                       SWITCH AGREE WITH THE METER STATE.
3286 08A7 01 D0 07   LXI  B,2000            BC = N = 2000; FOR 0.2 SEC. LOOP
3287                FINTR1;                 DO UNTIL N .EQ. 0
3288 08AA CD 19 0B   CALL NPAUSE              NPAUSE(N  ,ZROFLG)
3289                ;                               (BC ,PSW:Z )
3290                ;                               (I/O, O    )
3291 08AD C2 AA 08   JNZ  FINTR1
3292                ;                       ENDDO
3293                ;                       NOW DRIVE METER HOME
3294 08B0 01 40 1F   LXI  B,8000            BC = N = 8000; FOR 0.8 SEC. LOOP
3295                FINTR2;                 LOOP
3296                ;                         READ CYCLE SWITCH
3297 08B3 CD AF 0B   CALL RDCYC               RDCYC(INCYC,INCYC,ADRESS,MRSTS1)
3298                ;                                ( A   ,PSW:C, HL   , @HL  )
3299                ;                                ( O   , O   , O    , -    )
3300                ;                         IF INCYC .EQ. FALSE
3301 08B6 D2 BF 08   JNC  FINTR3                BREAK
3302                ;                         ENDIF
3303 08B9 CD 19 0B   CALL NPAUSE              NPAUSE(N  ,ZROFLG)
3304                ;                               (BC ,PSW:Z )
3305                ;                               (I/O, O    )
3306 08BC C2 B3 08   JNZ  FINTR2              IF N .EQ. 0
3307                ;                           BREAK
3308                ;                         ENDIF
3309                FINTR3;                 ENDLOOP
3310 08BF CD 11 08   CALL DOTR06            STOP AC MOTOR
3311                ;                       READ CYCLE SWITCH
3312 08C2 CD AF 0B   CALL RDCYC             RDCYC(INCYC,INCYC,ADRESS,MRSTS1)
3313                ;                            ( A   ,PSW:C, HL   , @HL  )
3314                ;                            ( O   , O   , O    , -    )
3315 08C5 F5         PUSH PSW               SAVE A, PSW
3316                ;                       COPY INCYC INTO MRSTS1
3317 08C6 E6 82      ANI  82H
3318 08C8 57         MOV  D,A
3319 08C9 7E         MOV  A,M
3320 08CA E6 7D      ANI  7DH
3321 08CC B2         ORA  D
3322 08CD 77         MOV  M,A               MRSTS1.UNKSEL = INCYC
3323                ;                       MRSTS1.INCYC  = INCYC
3324 08CE F1         POP  PSW               RESTORE A, PSW
3325 08CF D0         RNC                    IF INCYC .EQ. TRUE
3326                ;                         CYC SWT SAYS METER DIDN'T COME HOME
3327                FINTR4;                   ****ALTERNATE ENTRY POINT
3328                ;                         FATAL ERROR, SLOW TRIP
3329 08D0 3E 08      MVI  A,TRPTIM            A = TRPTIM
3330 08D2 C3 80 08   JMP  FATERR              FATERR(TRPTIM,ERRFLG)
3331                ;                               ( A    ,PSW:Z )
3332                ;                               ( I    , O    )
3333                ;                       ENDIF
3334                ;                       RETURN
3337                ;HDRONY(HEADER,ERRFLG)(NORFLG,XMTBUF)
3338                ;      (BYTE  ,BIT   )(BITSTR,NIBSTR)
3339                ;      ( I    , O    )( O    , I    )
3340                ;      ( A    ,PSW:Z )( RAM  , RAM  )
3341                ;      ( NC   , C    )( C    , NC   )
3342                ;
```

```
3343                ;REGISTERS DESTROYED
3344                ;PSW DESTROYED
3345                ;
3346                ;INITIATE PROCESSING  RELATED TO HEADERS WHICH CONSIST
3347                ;OF A HEADER NOT FOLLOWED BY DATA
3348                ;
3349                HDRONY;                 ****ENTRY POINT
3350 08D5 B7          ORA  A                PSW:Z = ERRFLG = HEADER .EQ. HEX00
3351 08D6 F5          PUSH PSW              SAVE A, PSW
3352 08D7 21 1F 09    LXI  H,HDR002         SET TO RETURN TO ENDCASE
3353 08DA E5          PUSH H
3354                ;                       CASE (HEADER)
3355 08DB FE 41       CPI  HENABL             **41: ENABLE METER
3356 08DD CA F3 05    JZ   CMDENB
3357 08E0 FE 42       CPI  HDISAB             **42: DISABLE METER
3358 08E2 CA CD 05    JZ   CMDDSB
3359 08E5 FE 46       CPI  HSETSV             **46: ENTER SERVICE MODE
3360 08E7 CA 48 08    JZ   ENTSER
3361 08EA FE 47       CPI  HCLRSV             **47: EXIT SERVICE MODE
3362 08EC CA 52 08    JZ   EXTSER
3363 08EF FE 4E       CPI  HEXTRP             **4E: EXTERNAL TRIP
3364 08F1 CA 60 08    JZ   EXTTRP
3365 08F4 FE 50       CPI  HREQST             **50: STATUS REQUEST
3366 08F6 C8          RZ                            CONTINUE
3367 08F7 FE 62       CPI  HENAKB             **62: ENABLE KEYBOARD
3368 08F9 CA 14 0F    JZ   ENAKBD
3369 08FC FE 63       CPI  HDISKB             **63: DISABLE KEYBOARD
3370 08FE CA 02 0F    JZ   DSBKBD
3371 0901 21 1C 09    LXI  H,HDR001           SET TO RETURN TO ALTERNATE ENDCASE
3372 0904 E3          XTHL
3373 0905 FE 40       CPI  HREQAC             **40: ACCESS CODE REQUEST
3374 0907 CA EE 12    JZ   ACCODE                   ACCODE(ERRFLG)
3375                ;                                     (PSW:Z )
3376                ;                                     ( O    )
3377 090A FE 43       CPI  HENDEN             **43: END OF ENTRY
3378 090C CA 19 08    JZ   ENDENT                   ENDENT(ERRFLG)
3379                ;                                     (PSW:Z )
3380                ;                                     ( O    )
3381 090F FE 51       CPI  HREQPO             **51: SELECTION VALUE REQUEST
3382 0911 CA 48 0C    JZ   SELVAL                   SELVAL(ERRFLG)
3383                ;                                     (PSW:Z )
3384                ;                                     ( O    )
3385 0914 FE 5C       CPI  HREQSN             **5C: SERIAL NUMBER REQUEST
3386 0916 CA 8D 06    JZ   DBLH01                   DBLH01(TRUE ,ERRFLG)
3387                ;                                     (PSW:Z,PSW:Z )
3388                ;                                     ( I   , O    )
3389                ;                           **ELSE: DOUBLY DEFINED HEADER
3390 0919 C3 71 06    JMP  DBLHDR                   DBLHDR(HEADER,ERRFLG)
3391                ;                                     ( A    ,PSW:Z )
3392                ;                                     ( I    , O    )
3393                HDR001;                 ALTERNATE ENDCASE, SAVES NEW ERRFLG
3394                ;                       PSW:Z = ERRFLG
3395 091C C1          POP  B                A = HEADER
3396 091D 78          MOV  A,B
3397 091E F5          PUSH PSW              SAVE A, PSW
3398                HDR002;                 ENDCASE
3399 091F 21 26 74    LXI  H,NORFLG/2+X     HL = ADDRESS, NORFLG
3400 0922 3A 50 74    LDA  XMTBUF/2+X       IF XMTBUF[0..1] .EQ. 0
3401 0925 B7          ORA  A
3402 0926 C2 2D 09    JNZ  HDR003
3403                ;                       QUE DEFAULT STATUS MESSAGE
3404 0929 7E          MOV  A,M              NORFLG.QUESTS = TRUE
3405 092A F6 80       ORI  80H
3406 092C 77          MOV  M,A
3407                HDR003;                 ENDIF
3408 092D F1          POP  PSW              A = HEADER
3409 092E F5          PUSH PSW
3410 092F FE 42       CPI  HDISAB           IF HEADER .NE. HDISAB
3411 0931 CA 3F 09    JZ   HDR005
3412 0934 E6 F0       ANI  0F0H               IF (HEADER .AND. HEXF0) .NE. HEX50
3413 0936 FE 50       CPI  50H
3414 0938 CA 3F 09    JZ   HDR004
```

```
3415                ;                          CANCEL ANY RESET IN PROGRESS
3416 093B 7E          MOV  A,M
3417 093C E6 CF       ANI  0CFH
3418 093E 77          MOV  M,A                 NORFLG.CMBIN = FALSE
3419                ;                          NORFLG.AMTIN = FALSE
3420                HDR004;                  ENDIF
3421                HDR005;                ENDIF
3422 093F F1          POP  PSW             A = HEADER
3423                ;                      PSW:Z = ERRFLG
3424 0940 C9          RET                  RETURN
3427                ;HDRPLS(HEADER,MSGBUF,ERRFLG)(NORFLG)
3428                ;      (BYTE  ,NIBSTR,BIT   )(BITSTR)
3429                ;      ( I    , I    , 0    )( 0    )
3430                ;      ( A    , @B   ,PSW:Z )( RAM  )
3431                ;      ( NC   , NC   , C    )( C    )
3432                ;
3433                ;REGISTERS DESTROYED
3434                ;PSW DESTROYED
3435                ;
3436                ;INITIATE PROCESSING RELATED TO HEADERS WHICH CONSIST
3437                ;OF A HEADER ASSOCIATED WITH DATA
3438                ;
3439                HDRPLS;                ****ENTRY POINT
3440 0941 B7          ORA  A               PSW:Z = ERRFLG = HEADER .EQ. HEX00
3441 0942 F5          PUSH PSW             SAVE A, PSW
3442 0943 21 26 74    LXI  H,NORFLG/2+X    HL = ADDRESS, NORFLG
3443                ;                      CHECK FOR INTERRUPTED RESET SEQUENCE
3444 0946 FE C5       CPI  HENTAM          IF HEADER .NE. HENTAM
3445 0948 CA 54 09    JZ   HDRP02
3446 094B FE C6       CPI  HENTCO            IF HEADER .NE. HENTCO
3447 094D CA 54 09    JZ   HDRP01
3448 0950 7E          MOV  A,M
3449 0951 E6 CF       ANI  0CFH
3450 0953 77          MOV  M,A                 NORFLG.CMBIN. = FALSE
3451                ;                          NORFLG.AMTIN = FALSE
3452                HDRP01;                  ENDIF
3453                HDRP02;                ENDIF
3454                ;                      QUE STATUS MESSAGE
3455 0954 7E          MOV  A,M             NORFLG.QUESTS = TRUE
3456 0955 F6 80       ORI  80H
3457 0957 77          MOV  M,A
3458 0958 F1          POP  PSW             A = HEADER
3459 0959 F5          PUSH PSW
3460 095A 21 7C 09    LXI  H,HDRP04        SET TO RETURN TO ENDCASE
3461 095D E5          PUSH H
3462                ;                      CASE (HEADER)
3463 095E FE C5       CPI  HENTAM            **C5: ENTER AMOUNT
3464 0960 CA 2E 08    JZ   ENTAMT                  ENTAMT(MSGBUF)
3465                ;                                     ( @B   )
3466                ;                                     ( I    )
3467 0963 FE C6       CPI  HENTCO            **C6: ENTER COMBINATION
3468 0965 CA 35 08    JZ   ENTCMB                  ENTCMB(MSGBUF)
3469                ;                                     ( @B   )
3470                ;                                     ( I    )
3471 0968 21 79 09    LXI  H,HDRP03          SET TO RETURN TO ALTERNATE ENDCASE
3472 096B E3          XTHL
3473 096C FE C0       CPI  HSETMN            **C0: ENTER SERIAL NUMBER
3474 096E CA 38 0A    JZ   MSERNO                  MSERNO(MSGBUF,ERRFLG)
3475                ;                                     ( @B   ,PSW:Z )
3476                ;                                     ( I    , 0    )
3477 0971 FE C1       CPI  HSETPO            **C1: SET POSTAGE
3478 0973 CA 9F 0C    JZ   SETPOS                  SETPOS(MSGBUF,ERRFLG)
3479                ;                                     ( @B   ,PSW:Z )
3480                ;                                     ( I    , 0    )
3481                ;                          **ELSE: PROCESS ERROR
3482 0976 C3 A1 0B    JMP   PROERR                 PROERR(ERRFLG)
3483                ;                                     (PSW:Z )
3484                ;                                     ( 0    )
3485                HDRP03;                  ALTERNATE ENDCASE, SAVES NEW ERRFLG
3486 0979 C1          POP  B               A = HEADER
3487 097A 78          MOV  A,B             PSW:Z = ERRFLG
3488 097B F5          PUSH PSW             SAVE A, PSW
```

```
3489                HDRP04;                 ENDCASE
3490 097C F1          POP  PSW              A = HEADER
3491                ;                       PSW:Z = ERRFLG
3492 097D C9          RET                   RETURN
3495                ;IDLE()(CTLBKT,KDCTRL,MRSTS1,NORFLG,RECBUF,XMTBUF)
3496                ;      (BYTE  ,BITSTR,BITSTR,BITSTR,BYTSTR,BYTSTR)
3497                ;      ( I    , I    , I/O  , I    , I    , I    )
3498                ;      ( RAM  , RAM  , RAM  , RAM  , RAM  , RAM  )
3499                ;      ( NC   , NC   , C    , NC   , NC   , NC   )
3500                ;
3501                ;MAINLINE IDLE LOOP
3502                ;
3503                IDLE;                   LOOP
3504 097E FB          EI                      ENABLE INTERRUPTS
3505                ;                         SET TO RESTART LOOP
3506 097F 21 7E 09    LXI  H,IDLE             HL = ADDRESS, IDLE
3507 0982 E5          PUSH H                  PUSH HL, USED BY RETURN STATEMENTS
3508                ;                         UPDATE METER STATUS:
3509 0983 CD 78 07    CALL DOSTAT             WITH RESPECT TO SWITCHES/SENSORS
3510 0986 CD 23 0B    CALL POSUPD             WITH RESPECT TO POSTAGE SETTING
3511 0989 CD 68 10    CALL NVMCHG             WITH RESPECT TO NONVOLATILE MEMORY
3512 098C 3A 50 74    LDA  XMTBUF/2+X         A = XMTBUF[0]
3513 098F B7          ORA  A                  IF XMTBUF[0] .NE. 0
3514 0990 C2 15 0E    JNZ  XMIT                 TRANSMIT MESSAGE
3515                ;                         ELSE
3516 0993 3A 26 74    LDA  NORFLG/2+X         A = NORFLG
3517 0996 4F          MOV  C,A                C = NORFLG
3518 0997 17          RAL                     PSW:CY = NORFLG.QUESTS
3519                ;                         IF NORFLG.QUESTS .EQ. TRUE
3520 0998 DA F4 0A    JC   MTRSTS               TRANSMIT METER STATUS
3521                ;                         ELSE
3522 099B 17          RAL                     PSW:CY = NORFLG.QUEPOS
3523 099C D2 A4 09    JNC  IDLE01             IF NORFLG.QUEPOS .EQ. TRUE
3524                ;                           REQUEST POSTAGE SETTING
3525 099F 3E 51       MVI  A,HREQPO             A = HREQPO
3526 09A1 C3 C7 0D    JMP  XEQHDR               XEQHDR(HREQPO,ERRFLG)
3527                ;                                 ( A    ,PSW:Z )
3528                ;                                 ( I    , 0    )
3529                IDLE01;
3530                ;                         ELSE
3531 09A4 CD 4E 0F    CALL LSTATE             LSTATE(FATMOD,NORMOD,SERMOD,PRVMOD)
3532                ;                                (PSW:S ,PSW:Z ,PSW:P ,PSW:CY)
3533                ;                                ( 0    , 0    , 0    , 0    )
3534 09A7 C2 D1 09    JNZ  IDLE03             IF NORMOD .EQ. TRUE
3535 09AA 21 24 74    LXI  H,MRSTS1/2+X         HL = ADDRESS, MRSTS1
3536 09AD 7E          MOV  A,M                  PSW:CY = MRSTS1.QUEREG
3537 09AE 1F          RAR
3538 09AF D2 D1 09    JNC  IDLE02               IF MRSTS1.QUEREG .EQ. TRUE
3539                ;                             TRIP HAS COMPLETED NORMALLY
3540 09B2 B7          ORA  A                        MRSTS1.QUEREG = FALSE
3541 09B3 17          RAL
3542 09B4 77          MOV  M,A
3543 09B5 21 2B 74    LXI  H,CTLBKT/2+X             HL = ADDRESS, CTLBKT
3544 09B8 3E 41       MVI  A,41H                    PSW:Z = CTLBKT .EQ. HEX41
3545 09BA AE          XRA  M
3546 09BB 3E 52       MVI  A,HREQAR                 A = HREQAR
3547                ;                               IF CTLBKT .EQ. HEX41
3548                ;                                 REQUEST ASCENDING REGISTER
3549 09BD CA C7 0D    JZ   XEQHDR                       XEQHDR(HREQAR,ERRFLG)
3550                ;                                         ( A    ,PSW:Z )
3551                ;                                         ( I    , 0    )
3552                ;                               ELSE
3553 09C0 3E 31       MVI  A,31H                    PSW:Z = CTLBKT .EQ. HEX31
3554 09C2 AE          XRA  M
3555 09C3 3E 53       MVI  A,HREQDR                 A = HREQDR
3556                ;                               IF CTLBKT .EQ. HEX31
3557                ;                                 REQUEST DESCENDING REGISTER
3558 09C5 CA C7 0D    JZ   XEQHDR                       XEQHDR(HREQDR,ERRFLG)
3559                ;                                         ( A    ,PSW:Z )
3560                ;                                         ( I    , 0    )
3561                ;                               ELSE
3562 09C8 3E 21       MVI  A,21H                    PSW:Z = CTLBKT .EQ. HEX21
```

```
3563 09CA AE          XRA  M
3564 09CB 3E 55       MVI  A,HREQPC            A = HREQPC
3565                ;                          IF CTLBKT .EQ. HEX21
3566                ;                            REQUEST PIECE COUNT
3567 09CD CA C7 0D    JZ   XEQHDR                XEQHDR(HREQPC,ERRFLG)
3568                ;                                  ( A    ,PSW:Z )
3569                ;                                  ( I    , O    )
3570                ;                          ENDIF
3571 09D0 C9          RET
3572                IDLE02;                  ENDIF
3573                IDLE03;                ELSE
3574 09D1 3A 48 74    LDA  RECBUF/2+X        A = RECBUF[0]
3575 09D4 B7          ORA  A                 IF RECBUF[0] .NE. 0
3576 09D5 C2 EE 09    JNZ  MESAGE              PROCESS MESSAGE
3577                ;                        ELSE
3578 09D8 3E 08       MVI  A,08H             PSW:Z = NORFLG.TRPREQ .EQ. FALSE
3579 09DA A1          ANA  C
3580 09DB CA E6 09    JZ   IDLE04            IF NORFLG.TRPREQ .EQ. TRUE
3581 09DE 3A 27 74    LDA  KDCTRL/2+X          PSW:CY = KDCTRL.KBDDSB
3582 09E1 1F          RAR
3583                ;                          IF KDCTRL.KBDDSB .EQ. FALSE
3584 09E2 D2 A5 07    JNC  DOTRIP                PROCESS TRIP REQUEST
3585                ;                          ENDIF
3586 09E5 C9          RET
3587                IDLE04;                  ELSE
3588 09E6 C3 2E 03    JMP  KEYBRD              PROCESS KEYBOARD
3589                ;                        ENDIF
3590                ;                      ENDLOOP
3593                ;MANRST
3594                ;
3595                ;REGISTERS DESTROYED
3596                ;PSW DESTROYED
3597                ;
3598                ;MANUAL METER RESET
3599                ;
3600                MANRST;                ****ENTRY POINT
3601                ;                      DECLARE SOFTWARE ERROR
3602 09E9 3E 02       MVI  A,SFTWRE          A = SFTWRE
3603 09EB C3 80 08    JMP  FATERR            FATERR(SFTWRE,ERRFLG)
3604                ;                                ( A    ,PSW:Z )
3605                ;                                ( I    , O    )
3606                ;                      RETURN
3609                ;MESAGE()(RECBUF,XMTBUF,DBUF  )
3610                ;        (NIBSTR,NIBSTR,NIBSTR)
3611                ;        ( I/O  , I    , O    )
3612                ;        ( RAM  , RAM  , RAM  )
3613                ;        ( C    , NC   , C    )
3614                ;
3615                ;PSW DESTROYED
3616                ;REGISTERS DESTROYED
3617                ;
3618                ;PROCESS MESSAGE RECEIVED FROM EXTERNAL DEVICE
3619                ;
3620                MESAGE;                ****ENTRY POINT
3621                ;                      REMEMBER IF XMTBUF CLEAR ON ENTRY
3622 09EE 3A 50 74    LDA  XMTBUF/2+X        PSW:Z = XMTCLR = XMTBUF[0..1] .EQ. 0
3623 09F1 B7          ORA  A
3624 09F2 F5          PUSH PSW               SAVE A, PSW
3625 09F3 21 48 74    LXI  H,RECBUF/2+X      HL = ADDRESS, RECBUF[0..1]
3626                ;                        FETCH MESSAGE SIZE, IN BYTES
3627 09F6 4E          MOV  C,M               C = SIZE = RECBUF[0..1]
3628                ;                        FLAG MESSAGE AS PROCESSED
3629 09F7 36 00       MVI  M,0               RECBUF[0..1] = 0
3630 09F9 23          INX  H                 HL = ADDRESS, RECBUF[2..3]
3631 09FA 0D          DCR  C                 C = SIZE-1
3632 09FB C2 1A 0A    JNZ  MESAG3            IF (SIZE-1) .EQ. 0
3633 09FE 7E          MOV  A,M                 A = HEADER = RECBUF[2..3]
3634                ;                          PROCESS MESSAGE WITHOUT DATA
3635 09FF CD D5 08    CALL HDRONY              HDRONY(HEADER,ERRFLG)
3636                ;                                ( A    ,PSW:Z )
3637                ;                                ( I    , O    )
3638 0A02 CA 17 0A    JZ   MESAG2              IF ERRFLG .EQ. FALSE
```

```
3639 0A05 FE 51      CPI  HREQPO            IF HEADER .EQ. HREQPO
3640 0A07 C2 17 0A   JNZ  MESAG1
3641                ;                         REVERT TO SETTING DISPLAY
3642 0A0A 01 80 A2   LXI  B,(XMTBUF+2)*100H+DBUF+0
3643                ;                         B = OFFSET, XMTBUF[2]
3644                ;                         C = OFFSET, DBUF[0]
3645 0A0D 3A 50 74   LDA  XMTBUF/2+X          A = NIBCNT = XMTBUF[0..1]*2
3646 0A10 87         ADD  A
3647 0A11 CD B3 0F   CALL MVLNIB              MVLNIB(DBUF[0],XMTBUF[2],NIBCNT,
3648                ;                               ( @C    , @B      , A    ,
3649                ;                               ( 0     , I       , I    ,
3650                ;
3651                ;                               NONBCD,ZERO )
3652                ;                               PSW:S ,PSW:Z)
3653                ;                                0    , 0   )
3654 0A14 CD 5A 05   CALL VALDSP              DISPLAY CONTENTS OF DBUF
3655               MESAG1;                  ENDIF
3656               MESAG2;                ENDIF
3657 0A17 C3 31 0A   JMP  MESAG6
3658               MESAG3;              ELSE
3659                ;                     CHECK FORMAT AGAINST MESSAGE SIZE
3660 0A1A 06 94      MVI  B,RECBUF+4      B = OFFSET, RECBUF[4]
3661 0A1C CD 35 0F   CALL GETNIB          GETNIB(NIBCNT,ZERO ,RECBUF[4])
3662                ;                           ( A    ,PSW:Z, @B      )
3663                ;                           ( 0    , 0   , I       )
3664 0A1F 3C         INR  A               A = BYTCNT = (NIBCNT+1)/2
3665 0A20 B7         ORA  A
3666 0A21 1F         RAR
3667 0A22 0D         DCR  C               C = SIZE-2
3668 0A23 B9         CMP  C               IF BYTCNT .EQ. (SIZE-2)
3669 0A24 C2 2E 0A   JNZ  MESAG4
3670                ;                       PROCESS MESSAGE WITH DATA
3671 0A27 7E         MOV  A,M               A = HEADER = RECBUF[2..3]
3672 0A28 CD 41 09   CALL HDRPLS            HDRPLS(HEADER,RECBUF[4],ERRFLG)
3673                ;                             ( A    , @B      ,PSW:Z )
3674                ;                             ( I    , I       , 0    )
3675 0A2B C3 31 0A   JMP  MESAG5
3676               MESAG4;                ELSE
3677                ;                       BAD MESSAGE, PROCEEDURAL ERROR
3678 0A2E CD A1 0B   CALL PROERR            PROERR(ERRFLG)
3679                ;                             (PSW:Z )
3680                ;                             ( 0    )
3681               MESAG5;                ENDIF
3682               MESAG6;              ENDIF
3683                ;                   CHECK FOR OVERLAY OF TRANSMIT BUFFER
3684 0A31 F1         POP  PSW           PSW:Z = XMTCLR
3685 0A32 3E 12      MVI  A,BUFOVR      A = BUFOVR
3686                ;                   IF XMTCLR .EQ. FALSE
3687                ;                     BUFFER OVERLAY, FATAL ERROR
3688 0A34 C4 80 08   CNZ  FATERR          FATERR(BUFOVR,ERRFLG)
3689                ;                           ( A    ,PSW:Z )
3690                ;                           ( I    , 0    )
3691                ;                   ENDIF
3692 0A37 C9         RET                RETURN
3695               ;MSERNO(MSGBUF,ERRFLG)(ASCCRC,ASCREG,CTLCRC,DSCCRC,DSCREG,
3696               ;      (NIBSTR,BIT   )(BYTE  ,NIBSTR,BYTE  ,BYTE  ,NIBSTR,
3697               ;      ( I    , 0    )( 0    , 0    , 0    , 0    , 0    ,
3698               ;      ( @B   ,PSW:Z )( RAM  , RAM  , RAM  , RAM  , RAM  ,
3699               ;      ( NC   , C    )( C    , C    , C    , C    , C    ,
3700               ;
3701               ;      ERRCNT,ERRCOD,PCEREG,SERFLG,SERNUM)
3702               ;      NIBSTR,BYTE  ,NIBSTR,BITSTR,NIBSTR)
3703               ;       0    , 0    , 0    , I/O  , I/O  )
3704               ;       RAM  , RAM  , RAM  , RAM  , RAM  )
3705               ;       C    , C    , C    , C    , C    )
3706               ;
3707               ;PSW DESTROYED
3708               ;REGISTERS DESTROYED
3709               ;
3710               ;REDEFINE UNLOCKED SERIAL NUMBER OR
3711               ;LOCK SERIAL NUMBER TO PREVENT FURTHER REDEFINITION
3712               ;
```

```
                MSERNO;                 ****ENTRY POINT
                ;                       SET TO REACH PROERR VIA RETURN
0A38 21 A1 0B    LXI  H,PROERR
0A3B E5          PUSH H
                ;                       CONVERT OFFSET INTO ADDRESS
0A3C 16 74       MVI  D,X/100H          DE = ADDRESS, MSGBUF[0..1]
0A3E AF          XRA  A
0A3F 78          MOV  A,B
0A40 1F          RAR
0A41 5F          MOV  E,A
                ;                       ADJUST OFFSET
0A42 04          INR  B                 B = OFFSET, MSGBUF[3]
0A43 04          INR  B
0A44 04          INR  B
                ;                       CHECK FOR VARIOUS ERROR CONDITIONS
0A45 CD 4E 0F    CALL LSTATE            LSTATE(FATMOD,NORMOD,SERMOD,PRVMOD)
                ;                             (PSW:S ,PSW:Z ,PSW:P ,PSW:CY)
                ;                             ( 0    , 0    , 0    , 0    )
                ;                       IF FATMOD .EQ. TRUE
                ;                         METER HAS FATALED
0A48 F8          RM                     PROERR(ERRFLG)
                ;                         RETURN
                ;                       ELSE
                ;                       IF SERMOD .EQ. FALSE
                ;                         METER NOT IN SERVICE MODE
0A49 E0          RPO                    PROERR(ERRFLG)
                ;                         RETURN
                ;                       ELSE
0A4A 3A 10 74    LDA  SERFLG/2+X        PSW:Z = OPEN = SERFLG.SNOLCK .EQ. TRUE
0A4D E6 10       ANI  10H
                ;                       IF OPEN .EQ. FALSE
                ;                         METER NUMBER ALREADY LOCKED
0A4F C0          RNZ                    PROERR(ERRFLG)
                ;                         RETURN
                ;                       ELSE
0A50 1A          LDAX D                 PSW:Z = FMTOK = MSGBUF[0..1].EQ.HEX8F
0A51 FE 8F       CPI  8FH
                ;                       IF FMTOK .EQ. FALSE
                ;                         NOT 8 CHARACTERS WITHOUT DECIMAL
0A53 C0          RNZ                    PROERR(ERRFLG)
                ;                         RETURN
                ;                       ELSE
0A54 13          INX  D                 DE = ADDRESS, MSGBUF[2..3]
0A55 1A          LDAX D                 A = MSGBUF[2..3]
0A56 FE 20       CPI  20H               PSW:CY = CODEOK = MSGBUF[2..3].LT.HEX20
                ;                       IF CODEOK .EQ. FALSE
                ;                         CODE IS NOT 0 OR 1
0A58 D0          RNC                    PROERR(ERRFLG)
                ;                         RETURN
                ;                       ENDIF
                ;                       PROCESS ACCORDING TO CODE IN MSGBUF[2]
0A59 FE 10       CPI  10H               PSW:CY = CODE0 = MSGBUF[2..3].LT.HEX10
0A5B 3E 07       MVI  A,7               A = NIBCNT = 7
0A5D D2 6D 0A    JNC MSERN1             IF CODE0 .EQ. TRUE
                ;                         SERIAL NUMBER IS BEING ENTERED
                ;                         CHECK INPUT DATA
0A60 48          MOV  C,B               C = OFFSET, MSGBUF[3]
0A61 CD B3 0F    CALL MVLNIB            MVLNIB(MSGBUF[3],MSGBUF[3],NIBCNT,
                ;                              ( @C      , @B      , A    ,
                ;                              ( 0       , I       , I    ,
                ;
                ;                              NONBCD,ZROFLG)
                ;                              PSW:S ,PSW:Z )
                ;                               0    , 0    )
                ;                         IF NONBCD .EQ. TRUE
                ;                           BAD INPUT
0A64 F8          RM                       PROERR(ERRFLG)
                ;                         ELSE
                ;                           STORE NEW SERIAL NUMBER
0A65 0E 21       MVI  C,SERNUM            C = OFFSET, SERNUM
0A67 CD B3 0F    CALL MVLNIB              MVLNIB(SERNUM[0],MSGBUF[3],NIBCNT,
                ;                                ( @C      , @B      , A    ,
```

```
3785                ;                                  ( 0       , I       , I    ,
3786                ;
3787                ;                                  NONBCD,ZROFLG)
3788                ;                                  PSW:S ,PSW:Z )
3789                ;                                   0    , 0    )
3790                ;                          ENDIF
3791 0A6A E1          POP  H                   CLEAN UP STACK
3792 0A6B 0C          INR  C                   PSW:Z = ERRFLG = (C+1).EQ.0 = FALSE
3793 0A6C C9          RET
3794                MSERN1;                  ELSE
3795                ;                          SERIAL NUMBER IS BEING LOCKED
3796                ;                          CHECK INPUT DATA
3797 0A6D 50          MOV  D,B                 D = OFFSET, MSGBUF[3]
3798 0A6E 1E 21       MVI  E,SERNUM            E = OFFSET, SERNUM[0]
3799 0A70 CD 8E 0E    CALL CMPARE              CMPARE(MSGBUF[3],SERNUM[0],NIBCNT,
3800                ;                                ( @D      , @E      , A    ,
3801                ;                                ( I       , I       , I    ,
3802                ;
3803                ;                                NEGFLG,ZROFLG)
3804                ;                                PSW:S ,PSW:Z )
3805                ;                                 0    , 0    )
3806                ;                          IF ZROFLG .EQ. FALSE
3807                ;                            INPUT DOESN'T MATCH SERIAL NUMBER
3808 0A73 C0          RNZ                        PROERR(ERRFLG)
3809                ;                          ELSE
3810 0A74 CD 9E 12    CALL NVMWR                 WRITE NEW ACTIVE SERVICE BLOCK
3811                ;                            NO BLOCK IS NOW OPEN
3812                ;                            LOCK SERIAL NUMBER
3813 0A77 21 10 74    LXI  H,SERFLG/2+X          HL = ADDRESS, SERFLG
3814 0A7A 7E          MOV  A,M                   SERFLG.SNOLCK = TRUE
3815 0A7B F6 10       ORI  10H
3816 0A7D 77          MOV  M,A
3817                ;                            UPDATE DATA FOR NORMAL BLOCK
3818                ;                            CLEAR PIECE COUNT REGISTER
3819                ;                            CLEAR ASCENDING REGISTER
3820                ;                            CLEAR DESCENDING REGISTER
3821 0A7E AF          XRA A                      A = NULL = 0
3822 0A7F 01 28 1A    LXI  B,(4+PCESIZ+DSCSIZ+ASCSIZ)*100H+PCEREG
3823                ;                            B = NIBCNT = 4+PCESIZ+DSCSIZ+ASCSIZ
3824                ;                            C = OFFSET, PCEREG
3825 0A82 CD 24 0F    CALL FILNIB                FILNIB(PCEREG,NULL,NIBCNT)
3826                ;                                  ( @C   , A  , B    )
3827                ;                                  ( 0    , I  , I    )
3828                ;                            CLEAR ERROR CODE
3829 0A85 32 0A 74    STA  ERRCOD/2+X            ERRCOD = 0
3830                ;                            CLEAR ERROR COUNT
3831 0A88 32 0B 74    STA  ERRCNT/2+X            ERRCNT = 0
3832                ;                            STORE NEW CONTROL SUM CRC
3833 0A8B CD 4E 06    CALL CTLSUM                CTLSUM(CSMCRC,ERRFLG)
3834                ;                                  ( D    ,PSW:Z )
3835                ;                                  ( 0    , 0    )
3836 0A8E 7A          MOV  A,D                   CTLCRC = CSMCRC
3837 0A8F 32 08 74    STA  CTLCRC/2+X
3838                ;                            STORE NEW ASCENDING REGISTER CRC
3839 0A92 01 38 08    LXI  B,ASCSIZ*100H+ASCREG
3840                ;                            B = NIBCNT = ASCSIZ
3841                ;                            C = OFFSET, ASCREG
3842 0A95 CD B1 0E    CALL CRC                   CRC(ASCREG,NIBCNT,CRCVAL)
3843                ;                                ( @C   , B    , D    )
3844 0A98 7A          MOV  A,D                   ASCCRC = CRCVAL
3845 0A99 32 20 74    STA  ASCCRC/2+X
3846                ;                            STORE NEW DESCENDING REGISTER CRC
3847 0A9C 01 2F 07    LXI  B,DSCSIZ*100H+DSCREG
3848                ;                            B = NIBCNT = DSCSIZ
3849                ;                            C = OFFSET, DSCREG
3850 0A9F CD B1 0E    CALL CRC                   CRC(DSCREG,NIBCNT,CRCVAL)
3851                ;                                ( @C   , B    , D    )
3852                ;                                ( I    , I    , 0    )
3853 0AA2 7A          MOV  A,D                   DSCCRC = CRCVAL
3854 0AA3 32 1B 74    STA  DSCCRC/2+X
3855 0AA6 E1          POP  H                     CLEAN UP STACK
3856                ;                            WRITE NORMAL BLOCK AND
```

```
                ;                          OPEN ERASED SERVICE BLOCK
0AA7 C3 19 12     JMP  NVMSTO              NVMSTO(ERRFLG)
                ;                                (PSW:Z )
                ;                                ( 0    )
                ;                        ENDIF
                ;                      ENDIF
                ;                      RETURN
                ;MSG2MU(FMTNIB,DSTSIZ,ERRFLG)(WORK1 ,DEFDCM,DIEDCM)
                ;      (NIBSTR,UBYTE ,BIT   )(NIBSTR,BYTE  ,BYTE  )
                ;      ( I    , I    , 0    )( 0    , I    , I    )
                ;      ( @B   , D    ,PSW:Z )( RAM  , RAM  , RAM  )
                ;      ( NC   , NC   , C    )( C    , NC   , NC   )
                ;
                ;PSW DESTROYED
                ;REGISTERS DESTROYED
                ;
                ;TRANSFORM FORMAT AND DATA IN MESSAGE FORMAT INTO A  METER
                ;UNIT FORMAT BCD STRING RIGHT JUSTIFIED IN WORK1.
                ;
                MSG2MU;                  ****ENTRY POINT
                ;                        CLEAR OUTPUT BLOCK
0AAA 3E C0        MVI  A,WORK1           A = OFFSET, WORK1[J=0]
0AAC CD 85 0E     CALL CLRBLK            CLRBLK(WORK1)
                ;                              ( @A  )
                ;                              ( 0   )
0AAF 2E 01        MVI  L,1               L = FLAGV = 1; WHICH DECREMENTS TO 0
                ;                        PRODUCING:
                ;                        PSW:Z = ERRFLG = TRUE
                ;                        CALCULATE TOTAL CHARACTER COUNT
                ;                        INCLUDING POSSIBLE LEADING ZERO
                ;                        B = OFFSET, FMTNIB[I=0]
0AB1 CD 35 0F     CALL GETNIB            GETNIB(NTOTAL,ZERO ,FMTNIB[I])
                ;                              ( A    ,PSW:Z, @B      )
                ;                              ( 0    , 0   , I       )
0AB4 3C           INR  A                 H = NTOTAL = (NTOTAL+1) .AND. HEXFE
0AB5 E6 FE        ANI  0FEH
0AB7 67           MOV  H,A
                ;                        CALCULATE COUNT OF CHARACTERS TO RIGHT
                ;                        OF DECIMAL POINT
0AB8 04           INR  B                 B = OFFSET, FMTNIB[I=1]
0AB9 CD 35 0F     CALL GETNIB            GETNIB(NFRAC,ZERO ,FMTNIB[I])
                ;                              ( A   ,PSW:Z, @B      )
                ;                              ( 0   , 0   , I       )
                ;                        CHECK FOR UNSPECIFIED DECIMAL POSITION
0ABC FE 0F        CPI  0FH               IF NFRAC .EQ. HEX0F
0ABE C2 C4 0A     JNZ  MSG2M1
                ;                          USE DEFAULT DECIMAL POSITION
0AC1 3A 36 74     LDA  DEFDCM/2+X          A = NFRAC = DEFDCM
                MSG2M1;                  ENDIF
                ;                        CHECK FOR TOO MANY FRACTIONAL DIGITS
0AC4 4F           MOV  C,A               C = NFRAC
0AC5 3A 35 74     LDA  DIEDCM/2+X        A = DIEDCM
0AC8 B9           CMP  C                 IF DIEDCM .GE. NFRAC
0AC9 DA F2 0A     JC   MSG2M5
                ;                          THERE IS ROOM FOR FRACTIONAL DIGITS
                ;                          CALCULATE INDEX FOR LOW ORDER DIGIT
0ACC 2F           CMA                      A = J = 15-DIEDCM+NFRAC
0ACD C6 10        ADI  16
0ACF 81           ADD  C
                ;                          CHECK DATA LENGTH AND ALIGNMENT WITH
                ;                          RESPECT TO WORK AREA
0AD0 BC           CMP  H                   IF DINDEX .GE. NTOTAL
0AD1 DA F2 0A     JC   MSG2M4
                ;                            DATA FITS IN WORK AREA
                ;                            MOVE DATA INTO WORK AREA
0AD4 C6 C0        ADI  WORK1               C = OFFSET, WORK1[J]
0AD6 4F           MOV  C,A
0AD7 78           MOV  A,B                 B = OFFSET, FMTNIB[I=NTOTAL+1]
0AD8 84           ADD  H
0AD9 47           MOV  B,A
0ADA 7C           MOV  A,H                 A = NTOTAL
0ADB CD C2 0F     CALL MVRNIB              MVRNIB(WORK1[J],FMTNIB[I],NTOTAL,
```

```
3931                ;                                  ( @C     , @B      , A    ,
3932                ;                                  ( 0      , I       , I    ,
3933                ;
3934                ;
3935                ;                            NONBCD,ZROFLG)
3936                ;                            PSW:S ,PSW:Z )
3937                ;                             0    , 0    )
3938                ;                            CHECK CHARACTERS MOVED
3939 0ADE FA F2 0A   JM   MSG2M3                 IF NONBCD .EQ. FALSE
3940                ;                              ONLY NUMERIC CHARS WERE MOVED.
3941                ;                              CHECK DATA LENGTH WITH RESPECT TO
3942                ;                              DECLARED SIZE OF DESTINATION.
3943                ;                              SET INDEX TO LEFT OF DECLARED
3944                ;                              HIGH ORDER DIGIT POSITION.
3945 0AE1 7A         MOV  A,D                      A = I = 15-DSTSIZ
3946 0AE2 2F         CMA
3947 0AE3 C6 10      ADI  16
3948                ;                              CALCULATE NUMBER OF DIGIT
3949                ;                              POSITIONS ABOVE HIGH ORDER
3950                ;                              DIGIT POSITION
3951 0AE5 67         MOV  H,A                      H = NTOTAL = 16-DSTSIZ
3952 0AE6 24         INR  H
3953                ;                              SCAN POSITIONS ABOVE HIGH ORDER
3954                ;                              DIGIT POSITION
3955 0AE7 C6 C0      ADI  WORK1                    B = OFFSET, WORK1[I]
3956 0AE9 47         MOV  B,A
3957 0AEA 7C         MOV  A,H                      A = NTOTAL
3958 0AEB CD 0F 10   CALL RSCAN                    RSCAN(WORK1[I],NTOTAL,
3959                ;                                   ( @B     , A    ,
3960                ;                                   ( I      , I    ,
3961                ;
3962                ;                                   NONBCD,ZROFLG)
3963                ;                                   PSW:S ,PSW:Z )
3964                ;                                    0    , 0    )
3965                ;                              CHECK CHARACTERS SCANNED
3966 0AEE C2 F2 0A   JNZ  MSG2M2                   IF ZROFLG .EQ. FALSE
3967                ;                                DECLARED DATA LENGTH EXCEEDED
3968 0AF1 2C         INR  L                        L = FLAGV = 2; DECREMENTS TO 1
3969                ;                                PRODUCING:
3970                ;                                PSW:Z = ERRFLG = FALSE
3971                MSG2M2;                        ENDIF
3972                MSG2M3;                      ENDIF
3973                MSG2M4;                    ENDIF
3974                MSG2M5;                  ENDIF
3975 0AF2 2D         DCR  L                  PSW:Z = ERRFLG
3976 0AF3 C9         RET                     RETURN
3979                ;MTRSTS()(XMTBUF,KDCTRL,MRSTS1,MRSTS2,NORFLG)
3980                ;        (BYTSTR,BITSTR,BITSTR,BITSTR,BITSTR)
3981                ;        ( 0    , I    , I    , I    , 0    )
3982                ;        ( RAM  , RAM  , RAM  , RAM  , RAM  )
3983                ;        ( C    , NC   , NC   , NC   , C    )
3984                ;
3985                ;ALL REGISTERS DESTROYED
3986                ;PSW DESTROYED
3987                ;
3988                ;PUT CURRENT STATUS MESSAGE INTO TRANSMIT BUFFER
3989                ;
3990                MTRSTS;                  ****ENTRY POINT
3991 0AF4 21 03 80   LXI  H,HSTAT*100H+3
3992                ;                        L = BYTCNT = 3
3993                ;                        H = HSTAT
3994 0AF7 22 50 74   SHLD XMTBUF/2+X+0        XMTBUF[0] = BYTCNT
3995                ;                        XMTBUF[1] = HSTAT
3996 0AFA 11 52 74   LXI  D,XMTBUF/2+X+2
3997                ;                        DE = ADDRESS, XMTBUF[2]
3998 0AFD 21 24 74   LXI  H,MRSTS1/2+X        HL = ADDRESS, MRSTS1
3999                ;                        XMTBUF[2].0 = 0
4000                ;                        XMTBUF[2].1 = MRSTS1.DATDOR
4001                ;                        XMTBUF[2].2 = MRSTS1.INSFND
4002                ;                        XMTBUF[2].3 = MRSTS1.LOWPOS
4003                ;                        XMTBUF[2].4 = MRSTS1.SERMOD
4004                ;                        XMTBUF[2].5 = MRSTS1.ENABLD
```

```
4005                ;                       XMTBUF[2].6 = 0
4006                ;                       XMTBUF[2].7 = MRSTS1.QUEREG
4007 0B00 7E          MOV  A,M
4008 0B01 E6 7D       ANI  7DH
4009 0B03 12          STAX D
4010 0B04 23          INX  H                HL = ADDRESS, MRSTS2
4011 0B05 13          INX  D                DE = ADDRESS, XMTBUF[3]
4012                ;                       XMTBUF[3].0 = MRSTS2.FATMOD
4013                ;                       XMTBUF[3].1 = KDCTRL.KBDDSB
4014                ;                       XMTBUF[3].2..7 = 0
4015 0B06 7E          MOV  A,M
4016 0B07 E6 80       ANI  80H
4017 0B09 47          MOV  B,A
4018 0B0A 3A 27 74    LDA  KDCTRL/2+X
4019 0B0D 0F          RRC
4020 0B0E 0F          RRC
4021 0B0F E6 40       ANI  40H
4022 0B11 B0          ORA  B
4023 0B12 12          STAX D
4024 0B13 23          INX  H                HL = ADDRESS, NORFLG
4025 0B14 7E          MOV  A,M              NORFLG.QUESTS = FALSE
4026 0B15 E6 7F       ANI  7FH
4027 0B17 77          MOV  M,A
4028 0B18 C9          RET                   RETURN
4031                ;NPAUSE(N   ,ZROFLG)
4032                ;      (WORD,BIT   )
4033                ;      (I/O ,0     )
4034                ;      (BC  ,PSW:Z )
4035                ;      ( C  , C    )
4036                ;
4037                ;REGISTERS DESTROYED
4038                ;PSW DESTROYED
4039                ;
4040                ;PAUSE FOR ABOUT 100 USEC, AND DECREMENT N
4041                ;
4042                NPAUSE;               ****ENTRY POINT
4043                ;                     PAUSE
4044 0B19 3E 0A       MVI  A,10           A = 10
4045                NPAUS1;               DO UNTIL A = 0
4046 0B1B 3D          DCR  A                A = A-1
4047 0B1C C2 1B 0B    JNZ  NPAUS1
4048                ;                     ENDDO
4049                ;                     DECREMENT N
4050 0B1F 0B          DCX  B              BC = N = N-1
4051                ;                     DEFINE STATUS OF N
4052 0B20 78          MOV  A,B            PSW:Z = ZROFLG = N .EQ. 0
4053 0B21 B1          ORA  C
4054 0B22 C9          RET                 RETURN
4057                ;POSUPD()(WORK1 ,LOWWRN,POSREG,ASCREG,DSCREG,
4058                ;        (NIBSTR,NIBSTR,NIBSTR,NIBSTR,NIBSTR,
4059                ;        ( I/O  , I    , I    , I    , I    ,
4060                ;        ( RAM  , RAM  , RAM  , RAM  , RAM  ,
4061                ;        ( C    , NC   , NC   , C    , C    ,
4062                ;
4063                ;         ASCCRC,DSCCRC,UNLOCK,MRSTS1,MRSTS2)
4064                ;         BYTE  ,BYTE  ,NIBSTR,BITSTR,BITSTR)
4065                ;          I    , I    , I    , I/O  , I    )
4066                ;          RAM  , RAM  , RAM  , RAM  , RAM  )
4067                ;          NC   , NC   , NC   , C    , NC   )
4068                ;
4069                ;PSW DESTROYED
4070                ;REGISTERS DESTROYED
4071                ;
4072                ;UPDATE METER STATUS FOR CURRENT POSTAGE SETTING
4073                ;
4074                POSUPD;               ****ENTRY POINT
4075                ;-----------------------------------------------------
4076                ;                     BUILD WARNING VALUE SAME LENGTH AS
4077                ;                     DESCENDING REGISTER STARTING AT
4078                ;                     WORK1[0]
4079                ;                     CLEAR WORK AREA
4080 0B23 3E C0       MVI  A,WORK1        A = OFFSET, WORK1
```

```
4081 0B25 CD 85 0E   CALL CLRBLK        CLRBLK(WORK1)
4082                ;                         ( @A  )
4083                ;                         ( 0   )
4084 0B28 06 1D      MVI  B,LOWWRN+1    B = OFFSET, LOWWRN[1]
4085 0B2A CD 35 0F   CALL GETNIB        GETNIB(EXPONT,ZROFLG,LOWWRN[1])
4086                ;                         ( A    ,PSW:Z , @B      )
4087                ;                         ( 0    , 0    , I       )
4088 0B2D 2F         CMA                A = -EXPONT-1
4089 0B2E C6 C7      ADI  WORK1+DSCSIZ  C = OFFSET, WORK1[DSCSIZ-1-EXPONT]
4090 0B30 4F         MOV  C,A
4091 0B31 05         DCR  B             B = OFFSET, LOWWRN[0]
4092 0B32 3E 01      MVI  A,1           A = NIBCNT = 1
4093 0B34 CD B3 0F   CALL MVLNIB        MVLNIB(WORK1[DSCSIZ-1-EXPONT],
4094                ;                         ( @C                   ,
4095                ;                         ( 0                    ,
4096                ;
4097                ;                         LOWWRN[0],NIBCNT,NONBCD,ZROFLG)
4098                ;                          @B      , A    ,PSW:S ,PSW:Z )
4099                ;                          I       , I    , 0    , 0    )
4100                ;-----------------------------------------------------------
4101                ;                    INITIALIZE FOR CALLS TO POSUP1
4102 0B37 21 24 74   LXI  H,MRSTS1/2+X  HL = ADDRESS, MRSTS1
4103 0B3A 7E         MOV  A,M
4104 0B3B E6 CF      ANI  0CFH
4105 0B3D 77         MOV  M,A           MRSTS1.INSFND = FALSE
4106                ;                   MRSTS1.LOWPOS = FALSE
4107                ;-----------------------------------------------------------
4108                ;                    COMPARE DESCENDING REGISTER WITH
4109                ;                    WARNING VALUE
4110 0B3E 06 10      MVI  B,10H         B.LOWPOS = TRUE
4111 0B40 CD 85 0B   CALL POSUP1        IF DSCREG .LT. WORK1[0]
4112                ;                     MRSTS1.LOWPOS = B.LOWPOS = TRUE
4113                ;                   ENDIF
4114                ;-----------------------------------------------------------
4115                ;                    BUILD POSTAGE SETTING REGISTER SAME
4116                ;                    LENGTH AS DESCENDING REGISTER
4117                ;                    STARTING AT WORK1[0]
4118                ;                    CLEAR WORK AREA
4119 0B43 3E C0      MVI  A,WORK1       A = OFFSET, WORK1
4120 0B45 CD 85 0E   CALL CLRBLK        CLRBLK(WORK1)
4121                ;                         ( @A  )
4122                ;                         ( 0   )
4123 0B48 01 C3 42   LXI  B,POSREG*100H+WORK1+0+DSCSIZ-NBANKS
4124                ;                   B = OFFSET, POSREG
4125                ;                   C = OFFSET, WORK1[0+DSCSIZ-NBANKS]
4126 0B4B 3E 04      MVI  A,NBANKS      A = NBANKS
4127 0B4D CD B3 0F   CALL MVLNIB        MVLNIB(WORK1[0+DSCSIZ-NBANKS],
4128                ;                         ( @C                   ,
4129                ;                         ( 0                    ,
4130                ;
4131                ;                         POSREG,NBANKS,NONBCD,ZROFLG)
4132                ;                          @B    , A    ,PSW:S ,PSW:Z )
4133                ;                          I     , I    , 0    , 0    )
4134                ;-----------------------------------------------------------
4135                ;                    COMPARE DESCENDING REGISTER WITH
4136                ;                    POSTAGE SETTING
4137 0B50 06 20      MVI  B,20H         B.INSFND = TRUE
4138 0B52 CD 85 0B   CALL POSUP1        IF DSCREG .LT. WORK1[0]
4139                ;                     MRSTS1.INSFND = B.INSFND = TRUE
4140                ;                   ENDIF
4141                ;-----------------------------------------------------------
4142                ;                    CHECK ASCENDING REGISTER CRC
4143 0B55 01 38 08   LXI  B,ASCSIZ*100H+ASCREG
4144                ;                   B = ASCSIZ
4145                ;                   C = OFFSET, ASCREG[0]
4146 0B58 3A 20 74   LDA  ASCCRC/2+X    A = ASCCRC
4147 0B5B CD 92 0B   CALL POSUP2        IF ASCCRC INCORRECT
4148                ;                     FILL ASCREG WITH HEX0F
4149                ;                     DECLARE DEAD METER. BAD CRC
4150                ;                   ENDIF
4151                ;-----------------------------------------------------------
4152                ;                    CHECK DESCENDING REGISTER CRC
```

```
0B5E 01 2F 07   LXI  B,DSCSIZ*100H+DSCREG
                ;                    B = DSCSIZ
                ;                    C = OFFSET, DSCREG[0]
0B61 3A 1B 74   LDA  DSCCRC/2+X      A = DSCCRC
0B64 CD 92 0B   CALL POSUP2          IF DSCCRC INCORRECT
                ;                      FILL DSCREG WITH HEXOF
                ;                      DECLARE DEAD METER. BAD CRC
                ;                    ENDIF
                ;-------------------------------------------------------
                ;                    CHECK CONTROL SUM CRC
                ;                    MRSTS2.FATMOD WILL BE USED VS ERRFLG
0B67 CD 3A 06   CALL CONSUM          CONSUM(ERRFLG)
                ;                          (PSW:Z )
                ;                          ( 0    )
                ;-------------------------------------------------------
                ;                    ENABLE OR DISABLE METER
0B6A 01 24 74   LXI  B,MRSTS1/2+X    BC = ADDRESS, MRSTS1
0B6D 0A         LDAX B
0B6E E6 68      ANI  68H
0B70 67         MOV  H,A             H = FLAGS = MRSTS1.DATDOR,
                ;                                MRSTS1.INSFND,
                ;                                MRSTS1.SERMOD
0B71 03         INX  B               BC = ADDRESS, MRSTS2
0B72 0A         LDAX B
0B73 E6 81      ANI  81H
0B75 B4         ORA  H               A = FLAGS = FLAGS .OR.
                ;                                MRSTS2.FATMOD,
                ;                                MRSTS2.PRVMOD
                ;                    IF FLAGS .NE. 0
0B76 C2 D3 05   JNZ  DISABL            DISABLE
                ;                    ELSE
                ;                      COMPARE $ UNLOCK VALUE WITH SETTING
0B79 11 18 42   LXI  D,POSREG*100H+UNLOCK
                ;                      D = OFFSET, POSREG
                ;                      E = OFFSET, UNLOCK
0B7C 3E 04      MVI  A,NBANKS          A = NBANKS
0B7E CD 8E 0E   CALL CMPARE            CMPARE(POSREG,UNLOCK,NBANKS,
                ;                            ( @D   , @E   , A    ,
                ;                            ( I    , I    , I    ,
                ;
                ;                            NEGFLG,ZROFLG)
                ;                            PSW:S ,PSW:Z )
                ;                             0    , 0    )
0B81 FC F9 05   CM   ENABLE            IF NEGFLG .EQ. TRUE
                ;                        ENABLE
                ;                      ENDIF
                ;                    ENDIF
                ;-------------------------------------------------------
0B84 C9         RET                  RETURN
                ;-------------------------------------------------------
                ;-------------------------------------------------------
                ;-------------------------------------------------------
                POSUP1;              ****LOCAL ENTRY POINT
0B85 11 C0 2F   LXI  D,DSCREG*100H+WORK1+0
                ;                    D = OFFSET, DSCREG[0]
                ;                    E = OFFSET, WORK1[0]
0B88 3E 07      MVI  A,DSCSIZ        A = DSCSIZ
0B8A CD 8E 0E   CALL CMPARE          CMPARE(DSCREG[0],WORK1[0],DSCSIZ,
                ;                          ( @D      , @E      , A    ,
                ;                          ( I       , I       , I    ,
                ;
                ;                          NEGFLG,ZROFLG)
                ;                          PSW:S ,PSW:Z )
                ;                           0    , 0    )
0B8D F0         RP                   IF NEGFLG .EQ. TRUE
0B8E 7E         MOV  A,M               MRSTS1.FLAG = B.FLAG = TRUE
0B8F B0         ORA  B
0B90 77         MOV  M,A
                ;                    ENDIF
0B91 C9         RET                  RETURN
                ;-------------------------------------------------------
                ;-------------------------------------------------------
```

```
4225                ;-----------------------------------------------------
4226                POSUP2;                 ****LOCAL ENTRY POINT
4227 0B92 CD B1 0E    CALL CRC              CRC(REGSTR[0],REGSIZ,CRCVAL)
4228                ;                          ( @C      , B    , D    )
4229                ;                          ( I       , I    , O    )
4230 0B95 BA          CMP  D                PSW:Z = NOERR = REGCRC .EQ. CRCVAL
4231 0B96 C8          RZ                    IF NOERR .EQ. FALSE
4232                ;                         FILL BAD REGISTER WITH HEXOF
4233 0B97 3E 0F       MVI  A,0FH            A = HEXOF
4234 0B99 C3 24 0F    JMP  FILNIB           FILNIB(REGSTR[0],HEXOF,REGSIZ)
4235                ;                               ( @C      , A    , B    )
4236                ;                               ( O       , I    , I    )
4237                ;                         DECLARE DEAD METER. BAD CRC
4238 0B9C 3E 00       MVI  A,BADCRC         A = CODE = BADCRC
4239 0B9E C3 85 10    JMP NVMDED            NVMDED(CODE,ERRFLG)
4240                ;                               ( A  ,PSW:Z )
4241                ;                               ( I  , O    )
4242                ;                       ENDIF
4243                ;                       RETURN
4244                ;-----------------------------------------------------
4245                ;-----------------------------------------------------
4246                ;-----------------------------------------------------
4249                ;PROERR(ERRFLG)(XMTBUF)
4250                ;      (BIT   )(BYTSTR)
4251                ;      ( O    )( O    )
4252                ;      (PSW:Z )( RAM  )
4253                ;      ( C    )( C    )
4254                ;
4255                ;REGISTERS DESTROYED
4256                ;PSW DESTROYED
4257                ;
4258                ;PROCESS PROCEDURAL ERROR
4259                ;
4260                PROERR;                 ****ENTRY POINT
4261 0BA1 CD F4 0A    CALL MTRSTS           PUT STATUS MESSAGE IN TRANSMIT BUFFER
4262 0BA4 11 53 74    LXI  D,XMTBUF/2+X+3
4263                ;                       DE =  ADDRESS, XMTBUF[3]
4264                ;                       DECLARE PROCEDURAL ERROR
4265 0BA7 1A          LDAX D                XMTBUF[3].PROERR = TRUE
4266 0BA8 F6 02       ORI  2
4267 0BAA 12          STAX D
4268 0BAB AF          XRA  A                PSW:Z = ERRFLG = TRUE
4269 0BAC C3 64 04    JMP  PERDSP           MAKE PROCEDURAL ERROR DISPLAY
4270                ;                       RETURN
4273                ;RDCYC(INCYC ,INCYC,ADRESS,MRSTS1)(DATA1 )
4274                ;     (BITSTR,BIT  ,ADRESS,BITSTR)(BITSTR)
4275                ;     ( O    , O   , O    , -    )( I    )
4276                ;     ( A    ,PSW:C, HL   , @HL  )( 6800 )
4277                ;     ( C    , C   , C    , NC   )( NC   )
4278                ;
4279                ;REGISTERS NOT CHANGED
4280                ;PSW DESTROYED
4281                ;
4282                ;RETURN STATUS OF METER CYCLE SWITCH
4283                ;
4284                RDCYC;                  ****ENTRY POINT
4285                ;                       DEFINE ADDRESS FOR CALLING ROUTINES
4286 0BAF 21 24 74    LXI  H,MRSTS1/2+X     HL = ADDRESS, MRSTS1
4287                ;                       READ CYCLE SWITCH
4288 0BB2 3A 00 68    LDA  DATA1            A = INCYC,INCYCN = DATA1.2,DATA1.3
4289 0BB5 E6 30       ANI  30H
4290 0BB7 C2 C2 0B    JNZ  RDCYC1           IF BOTH SIDES OF SWITCH CLOSED
4291                ;                         DECLARE DEAD METER; BAD CYCLE SWITCH
4292 0BBA 3E 04       MVI  A,BADCYC         A = BADCYC
4293 0BBC CD 85 10    CALL NVMDED           NVMDED(BADCYC,ERRFLG)
4294                ;                               ( A    ,PSW:Z )
4295                ;                               ( I    , O    )
4296 0BBF C3 B6 01    JMP PWRDN             ABORT
4297                RDCYC1;                 ELSE
4298 0BC2 17          RAL                     PSW:C = INCYC = DATA1.2
4299 0BC3 17          RAL
4300 0BC4 17          RAL
```

```
4301 0BC5 9F          SBB  A                A.0..7 = INCYC
4302 0BC6 C9          RET                   RETURN
4303                ;                     ENDIF
4306                ;RECEVE()(SID,SOD,SOE,RECBUF,NORFLG)
4307                ;        (BIT,BIT,BIT,BYTSTR,BITSTR)
4308                ;        ( I , O , O , O    , I    )
4309                ;        (RIM,SIM,SIM, RAM  , RAM  )
4310                ;        ( NC, C , C , C    , NC   )
4311                ;
4312                ;REGISTERS DESTROYED
4313                ;PSW DESTROYED
4314                ;
4315                ;RECEIVE INCOMING MESSAGE IF EXTERNAL RTS IS PRESENT.
4316                ;RECBUF[0], THE MESSAGE BYTE COUNT, IS CLEARED IF A
4317                ;REQUEST TO SEND IS DETECTED.
4318                ;
4319                RECEVE;               ****ENTRY POINT
4320 0BC7 3A 26 74    LDA  NORFLG/2+X     IF NORFLG.COMDSB .EQ. TRUE
4321 0BCA E6 04       ANI  4
4322                ;                       COMMUNICATIONS ARE DISABLED
4323 0BCC C0          RNZ                   RETURN
4324                ;                     END IF
4325 0BCD 20          RIM                 INPUT BIT
4326                ;                     A.0 = BIT = RIM.SID ;RTS OR IDLE
4327 0BCE B7          ORA A               IF RIM.SID .NE. RTS
4328                ;                       NO INCOMING REQUEST TO SEND PRESENT
4329 0BCF F0          RP                    RETURN
4330                ;                     ENDIF
4331                ;                     STOP TIMER
4332 0BD0 CD 34 01    CALL STPTMR         STPTMR(WASOFF)
4333                ;                           (PSW:Z )
4334                ;                           ( 0    )
4335 0BD3 21 27 0C    LXI  H,RECE06       SET TO REACH QUIT ROUTINE VIA RETURN
4336 0BD6 E5          PUSH H
4337 0BD7 21 48 74    LXI  H,RECBUF/2+X   HL = ADDRESS, RECBUF[N=0]
4338                ;                     (2 MVI VS 1 LXI FOR T3 = 100.012 USEC)
4339 0BDA 06 00       MVI  B,0            B = BYTCNT = 0
4340 0BDC 0E 80       MVI  C,80H          C = SIM*2 .AND. HEXFF, WHERE
4341                ;                         SIM.SOE = ENABLD = 1
4342 0BDE 70          MOV  M,B            RECBUF[0] = 0

4344                RECE01;               DO UNTIL BIT .EQ. EOM
4345 0BDF 3E C0       MVI  A,0C0H           SIM.SOD = ONEBIT=1 ;CTS,OR EOB ECHO
4346                ;                       SIM.SOE = ENABLD = 1
4347 0BE1 30          SIM                   OUTPUT ONEBIT
4348 0BE2 11 FB FE    LXI  D,-261           DE = COUNT ;FOR T13 = 3.494 MSEC
4349                RECE02;                 DO UNTIL (BIT .EQ. START) .OR.
4350                ;                         (COUNT .GE. 0)
4351 0BE5 20          RIM                     INPUT BIT
4352                ;                         A.0 = BIT = RIM.SID ;START,RTS,EOB
4353 0BE6 13          INX  D                  DE = COUNT = COUNT+1
4354 0BE7 A2          ANA  D                  A.0 = BIT .AND. COUNT.0
4355 0BE8 FA E5 0B    JM   RECE02
4356                ;                       ENDDO
4357                ;
4358 0BEB B2          ORA  D                IF COUNT .GE. 0
4359                ;                         T13 TIMEOUT OCCURRED
4360                ;                         START NOT RECEIVED AFTER RTS
4361 0BEC F0          RP                        QUIT
4362                ;                       ENDIF
4363                ;                       THE FIRST BYTE'S START BIT HAS BEEN
4364                ;                       READ. IT WILL BE READ AGAIN AND
4365                ;                       ECHOED LATER.
4366                ;                       POINT AT NEXT BYTE IN RECBUF.
4367 0BED 23          INX  H                HL = ADDRESS, RECBUF[N=N+1]
4368                ;                       CHECK FOR BUFFER OVERFLOW
4369 0BEE 04          INR  B                B = BYTCNT = BYTCNT+1
4370 0BEF 3E 07       MVI  A,7              IF 7 .LT. BYTCNT
4371 0BF1 B8          CMP  B
4372                ;                         TRYING TO RECEIVE 8TH BYTE
4373 0BF2 D8          RC                        QUIT
4374                ;                       ENDIF
```

```
                ;                       SET TO INPUT 10 BITS
                ;                       1 START, 8 DATA, AND 1 EOB OR EOM
0BF3 16 0A        MVI  D,10             D = BITCNT = 10

                RECE03;                 LOOP ;BREAK ON BITCNT .EQ. 0
0BF5 20           RIM                     INPUT BIT
                ;                         A.0 = BIT = RIM.SID
0BF6 17           RAL                     PSW:CY  = BIT
0BF7 79           MOV  A,C                PSW:CY,A = SIM*2
0BF8 1F           RAR                     A = SIM
                ;                         SIM.SOD = ECHO = BIT
                ;                         SIM.SOE = ENABLD = 1
0BF9 30           SIM                     OUTPUT 10 ECHO BITS
0BFA 15           DCR  D                  D = BITCNT = BITCNT-1
                ;                         IF BITCNT .EQ. 0
0BFB CA 0C 0C     JZ   RECE04               BREAK
                ;                         ENDIF
0BFE 17           RAL                     PSW:CY = BIT
                ;                         SHIFT 9 BITS INTO BUFFER
                ;                         1 START,(LOST); 8 DATA,(KEPT)
0BFF 7E           MOV  A,M                PSW:CY,A = RECBUF[N]*2
0C00 1F           RAR                     RECBUF[N] = (PSW:CY,A)/2
0C01 77           MOV  M,A
0C02 77           MOV  M,A                DELAY ;BIT PERIOD = 103.923 USEC
0C03 3E 07        MVI  A,7
0C05 3D           DCR  A
0C06 F2 05 0C     JP   $-1
0C09 C3 F5 0B     JMP  RECE03
                RECE04;                 ENDLOOP
0C0C B7           ORA  A                CHECK FOR EOM
0C0D FA DF 0B     JM   RECE01
                ;                       ENDDO
0C10 3E 21        MVI  A,33             DELAY ;T6 = 1264.965 USEC
0C12 3D           DCR  A
0C13 F2 12 0C     JP   $-1
                ;                       CHECK FOR NO-ERROR PULSE
0C16 20           RIM                   INPUT BIT
                ;                       A.0 = BIT = RIM.SID
0C17 B7           ORA  A                IF BIT .EQ. ACK
0C18 F2 1F 0C     JP   RECE05
                ;                         MESSAGE RECEIVED WITHOUT ERROR
                ;                         PUT NONZERO BYTE COUNT IN BUFFER
0C1B 78           MOV  A,B                RECBUF[0] = BYTCNT
0C1C 32 4B 74     STA  RECBUF/2+X
                RECE05;                 ENDIF
0C1F F1           POP  PSW              CLEAN UP STACK
0C20 16 22        MVI  D,34             DELAY ;T15 = 1560.533 USEC
0C22 15           DCR  D
0C23 F2 22 0C     JP   $-1
0C26 C9           RET                   RETURN
                ;
                RECE06;                 QUIT RECEIVE ROUTINE
0C27 3E 40        MVI  A,40H            SIM.SOD = IDLE = 0
                ;                       SIM.SOE = ENABLD = 1
0C29 30           SIM                   OUTPUT IDLE
0C2A 16 C2        MVI  D,194            DELAY ;T15 = 1558.298 USEC
0C2C 15           DCR  D
0C2D F2 2C 0C     JP   $-1
0C30 C9           RET                   RETURN
                ;REDSTS(TRPSW,PRVSW)(PORTA ,PORTC )
                ;      (BYTE ,BYTE )(BITSTR,BITSTR)
                ;      ( O   , O   )( I/O  , I    )
                ;      ( B   , A   )( 7001 , 7003 )
                ;      ( C   , C   )( C    , NC   )
                ;
                ;REGISTERS DESTROYED
                ;PSW DESTROYED
                ;
                ;RETURNS VALUES FOR TRIP SWITCH AND PRIVELEGED SWITCH
                ;OFF = HEX00
                ;ON  = HEXFF
                ;
```

```
4449                REDSTS;                 ****ENTRY POINT
4450                ;                       FETCH PORTA IMAGE
4451                ;                       SENSOR LEDS ASSUMED TO BE OFF
4452 0C31 21 01 70    LXI  H,PORTA          HL = ADDRESS, PORTA
4453 0C34 56          MOV  D,M              D = LEDOFF = PORTA
4454                ;                       TURN SENSOR LEDS ON
4455 0C35 7A          MOV  A,D              PORTA = PORTA .AND. HEXDF
4456 0C36 E6 DF       ANI  0DFH
4457 0C38 77          MOV  M,A
4458                ;                       READ SENSORS
4459 0C39 3A 03 70    LDA  PORTC
4460 0C3C 07          RLC
4461 0C3D 07          RLC
4462 0C3E 07          RLC                   PSW:CY = TRPBIT = PORTC.2
4463 0C3F 4F          MOV  C,A              C.0    = PRVBIT = PORTC.3
4464 0C40 9F          SBB  A                B = TRPSW = TRPBIT*HEXFF
4465 0C41 47          MOV  B,A
4466 0C42 79          MOV  A,C              A = PRVSW = (.NOT. PRVBIT)*HEXFF
4467 0C43 07          RLC
4468 0C44 3F          CMC
4469 0C45 9F          SBB  A
4470                ;                       TURN SENSOR LEDS OFF
4471 0C46 72          MOV  M,D              PORTA = LEDOFF
4472 0C47 C9          RET                   RETURN
4475                ;SELVAL(ERRFLG)(NORFLG,MRSTS1,POSREG)
4476                ;      (BIT   )(BITSTR,BITSTR,NIBSTR)
4477                ;      ( 0    )( 0    , I    , I    )
4478                ;      (PSW:Z )( RAM  , RAM  , RAM  )
4479                ;      ( C    )( C    , NC   , NC   )
4480                ;
4481                ;REGISTERS DESTROYED
4482                ;PSW DESTROYED
4483                ;
4484                ;PROCESS SELECTION VALUE REQUEST
4485                ;
4486                SELVAL;                 ****ENTRY POINT
4487 0C48 21 26 74    LXI  H,NORFLG/2+X     HL = ADDRESS, NORFLG
4488 0C4B 7E          MOV  A,M              NORFLG.QUEPOS = FALSE
4489 0C4C E6 BF       ANI  0BFH
4490 0C4E 77          MOV  M,A
4491 0C4F 3A 24 74    LDA  MRSTS1/2+X       IF MRSTS1.UNKSEL .EQ. TRUE
4492 0C52 B7          ORA  A
4493                ;                         SELECTION VALUE IS UNKNOWN
4494 0C53 FA A1 0B    JM  PROERR              PROERR(ERRFLG)
4495                ;                                (PSW:Z )
4496                ;                                ( 0    )
4497                ;                         RETURN
4498                ;                       ELSE
4499                ;                         FLAG VERIFICATION OF SELECTION VALUE
4500 0C56 7E          MOV  A,M                NORFLG.UNVSEL = FALSE
4501 0C57 E6 FD       ANI  0FDH
4502 0C59 77          MOV  M,A
4503 0C5A 11 60 0C    LXI  D,SELV01           DE = ADDRESS, SELV01
4504                ;                         PUT REPLY IN TRANSMIT BUFFER
4505 0C5D C3 5B 0D    JMP  VALREQ             VALREQ(POSREG,POSFMT,HPSET,ERRFLG)
4506                ;                                (@@DE+0,@DE+1 ,@DE+2,PSW:Z )
4507                ;                                ( I    , I    , I    , 0    )
4508                ;                         RETURN
4509                ;                       ENDIF
4510                SELV01;                 ARGUMENT LIST FOR VALREQ
4511 0C60 42 40 81    DB   POSREG,POSFMT,HPSET
4514                ;SEREOE(ERRFLG)(CMBBUF,LOWWRN,SETLIM,AMTBUF,WORK1 ,UNLOCK)
4515                ;      (BIT   )(NIBSTR,NIBSTR,NIBSTR,NIBSTR,NIBSTR,NIBSTR)
4516                ;      ( 0    )( I    , 0    , 0    , I    , I/O  , 0    )
4517                ;      (PSW:Z )( RAM  , RAM  , RAM  , RAM  , RAM  , RAM  )
4518                ;      ( C    )( C    , C    , C    , NC   , C    , C    )
4519                ;
4520                ;PSW DESTROYED
4521                ;REGISTERS DESTROYED
4522                ;
4523                ;PERFORM SERVICE FUNCTIONS WHICH ARE INITIATED BY THE
4524                ;ENTRY OF AN AMOUNT AND COMBINATION
4525                ;
```

```
4526                SEREOE;                 ****ENTRY POINT
4527                ;                       CHECK METER STATUS
4528 0C63 CD 4E 0F   CALL LSTATE            LSTATE(FATMOD,NORMOD,SERMOD,PRVMOD)
4529                ;                             (PSW:S ,PSW:Z ,PSW:P ,PSW:C )
4530                ;                             ( 0    , 0    , 0    , 0    )
4531                ;                       IF FATMOD .EQ. TRUE
4532                ;                         PROCESS ERROR
4533 0C66 FA A1 0B   JM   PROERR            PROERR(ERRFLG)
4534                ;                               (PSW:Z )
4535                ;                               ( 0    )
4536                ;                       ELSE
4537                ;                         CHECK FORMAT BYTE IN CMBBUF
4538 0C69 21 78 74   LXI  H,CMBBUF/2+X      HL = ADDRESS, CMBBUF[0..1]
4539 0C6C 7E         MOV  A,M               IF CMBBUF[0..1] .NE. HEX1F
4540 0C6D FE 1F      CPI  1FH
4541                ;                           BAD FORMAT, PROCEEDURAL ERROR
4542 0C6F C2 A1 0B   JNZ  PROERR                PROERR(ERRFLG)
4543                ;                                 (PSW:Z )
4544                ;                                 ( 0    )
4545                ;                         ELSE
4546                ;                         CHECK FOR OUT OF RANGE COMBINATION
4547 0C72 23         INX  H                 HL = ADDRESS, CMBBUF[2..3]
4548 0C73 7E         MOV  A,M               A = CMBBUF[2..3]
4549 0C74 FE 04      CPI  4                 IF CMBBUF[2..3] .GE. 4
4550                ;                           BAD COMBINATION, PROCEEDURAL ERROR
4551 0C76 D2 A1 0B   JNC  PROERR                PROERR(ERRFLG)
4552                ;                                 (PSW:Z )
4553                ;                                 ( 0    )
4554                ;                         ELSE
4555                ;                         --CASE (CMBBUF[2..3])
4556 0C79 11 1C 07   LXI  D,DSCSIZ*100H+LOWWRN
4557 0C7C FE 01      CPI  1                   **01:
4558                ;                             CHANGE LOW POSTAGE WARN LIMIT
4559 0C7E CA FB 0C   JZ   SRVCNV                 SRVCNV(LOWWRN,DSCSIZ,ERRFLG)
4560                ;                                   ( @E   , D    ,PSW:Z )
4561                ;                                   ( 0    , I    , 0    )
4562 0C81 11 1E 05   LXI  D,(NBANKS+1)*100H+SETLIM
4563 0C84 FE 02      CPI  2                   **02:
4564                ;                             CHANGE SETTING LIMIT
4565 0C86 CA FB 0C   JZ   SRVCNV                 SRVCNV(SETLIM,NBANKS+1,ERRFLG)
4566                ;                                   ( @E   , D      ,PSW:Z )
4567                ;                                   ( 0    , I      , 0    )
4568 0C89 06 E0      MVI  B,AMTBUF
4569                ;                         **03:
4570                ;                             CHANGE SERIAL NUMBER
4571 0C8B F2 38 0A   JP   MSERNO                 MSERNO(AMTBUF,ERRFLG)
4572                ;                                   ( @B   ,PSW:Z )
4573                ;                                   ( I    , 0    )
4574                ;                         **00:
4575 0C8E 15         DCR  D                     D = NBANKS
4576                ;                             CHANGE DOLLAR UNLOCK VALUE
4577 0C8F CD AA 0A   CALL MSG2MU                 MSG2MU(AMTBUF,NBANKS,ERRFLG)
4578                ;                                   ( @B   , D    ,PSW:Z )
4579                ;                                   ( I    , I    , 0    )
4580                ;                             IF ERRFLG .EQ. TRUE
4581                ;                               BAD AMOUNT, PROCEEDURAL ERROR
4582 0C92 CA A1 0B   JZ   PROERR                    PROERR(ERRFLG)
4583                ;                                     (PSW:Z )
4584                ;                                     ( 0    )
4585                ;                             ELSE
4586                ;                               REDEFINE $ UNLOCK VALUE
4587 0C95 3E 04      MVI  A,NBANKS                  A = NBANKS
4588 0C97 01 18 CC   LXI  B,(WORK1+16-NBANKS)*100H+UNLOCK
4589                ;                               B = OFFSET, WORK1[16-NBANKS]
4590                ;                               C = OFFSET, UNLOCK
4591 0C9A CD B3 0F   CALL MVLNIB                    MVLNIB(UNLOCK,WORK1[16-NBANKS],
4592                ;                                     ( @C   , @B             ,
4593                ;                                     ( 0    , I              ,
4594                ;
4595                ;                               NBANKS,NONBCD,ZERO )
4596                ;                                A    ,PSW:S ,PSW:Z)
4597                ;                                I    , 0    , 0   )
```

```
4598 0C9D 0C          INR  C                    PSW:Z = ERRFLG = FALSE
4599                ;                          ENDIF
4600                ;                       --ENDCASE
4601                ;                       ENDIF
4602                ;                     ENDIF
4603 0C9E C9          RET                   RETURN
4606                ;SETPOS(MSGBUF,ERRFLG)(SETLIM,WORK1 ,WORK2 ,MRSTS1,
4607                ;      (NIBSTR,BIT   )(NIBSTR,NIBSTR,NIBSTR,BITSTR,
4608                ;      ( I    , 0    )( I    , 0    , 0    , 0    ,
4609                ;      ( @B   ,PSW:Z )( RAM  , RAM  , RAM  , RAM  ,
4610                ;      ( NC   , C    )( NC   , C    , C    , C    ,
4611                ;
4612                ;      NORFLG,POSREG)
4613                ;      BITSTR,NIBSTR)
4614                ;       0    , 0    )
4615                ;       RAM  , RAM  )
4616                ;       C    , C    )
4617                ;
4618                ;REGISTERS DESTROYED
4619                ;PSW DESTROYED
4620                ;
4621                ;PROCESS SET POSTAGE COMMAND
4622                ;
4623                SETPOS;               ****ENTRY POINT
4624                ;                     SET TO REACH PROERR VIA RETURN
4625 0C9F 21 A1 0B    LXI  H,PROERR
4626 0CA2 E5          PUSH H
4627 0CA3 CD 4E 0F    CALL LSTATE         LSTATE(FATMOD,NORMOD,SERMOD,PRVMOD)
4628                ;                           (PSW:S ,PSW:Z ,PSW:P ,PSW:CY)
4629                ;                           ( 0    , 0    , 0    , 0    )
4630                ;                     IF NORMOD .EQ. FALSE
4631                ;                       METER NOT IN NORMAL MODE
4632 0CA6 C0          RNZ                   PROERR(ERRFLG)
4633                ;                     ELSE
4634                ;                       PUT NEW SETTING VALUE INTO WORK1
4635 0CA7 16 04       MVI  D,NBANKS         D = NIBCNT = NBANKS
4636 0CA9 CD AA 0A    CALL MSG2MU           MSG2MU(MSGBUF,NIBCNT,ERRFLG)
4637                ;                                ( @B   , D    ,PSW:Z )
4638                ;                                ( I    , I    , 0    )
4639 0CAC F5          PUSH PSW              SAVE A,PSW
4640 0CAD 21 24 74    LXI  H,MRSTS1/2+X     HL = ADDRESS, MRSTS1
4641 0CB0 7E          MOV  A,M              MRSTS1.ENABLD = FALSE
4642 0CB1 E6 FB       ANI  0FBH
4643 0CB3 77          MOV  M,A
4644 0CB4 F1          POP  PSW              RESTORE A,PSW
4645                ;                       IF ERRFLG .EQ. TRUE
4646                ;                         NEW SETTING VALUE IS IMPROPER
4647 0CB5 C8          RZ                      PROERR(ERRFLG)
4648                ;                       ELSE
4649                ;                         FETCH SETTING LIMIT EXPONENT
4650 0CB6 06 1F       MVI  B,SETLIM+1         B = OFFSET, SETLIM[1]
4651 0CB8 CD 35 0F    CALL GETNIB             GETNIB(EXPONT,ZROFLG,SETLIM[1])
4652                ;                                ( A    ,PSW:Z , @B      )
4653                ;                                ( 0    , 0    , I      )
4654                ;                         CALCULATE WORK2 INDEX FOR MANTISSA
4655 0CBB 2F          CMA                     A = -EXPONT-1
4656 0CBC C6 10       ADI  16                 C = I = 15-EXPONT
4657 0CBE 4F          MOV  C,A
4658                ;                         CLEAR WORK2
4659 0CBF 3E D0       MVI  A,WORK2            A = OFFSET, WORK2
4660 0CC1 CD 85 0E    CALL CLRBLK             CLRBLK(WORK2)
4661                ;                                ( @A   )
4662                ;                                ( 0    )
4663                ;                         PUT SET LIMIT MANTISSA INTO WORK2
4664 0CC4 81          ADD  C                  C = OFFSET, WORK2[I]
4665 0CC5 4F          MOV  C,A
4666 0CC6 05          DCR  B                  B = OFFSET, SETLIM[0]
4667 0CC7 CD 35 0F    CALL GETNIB             GETNIB(MANTIS,ZROFLG,SETLIM[0])
4668                ;                                ( A    ,PSW:Z , @B      )
4669                ;                                ( 0    , 0    , I      )
4670 0CCA CD EE 0F    CALL PUTNIB             PUTNIB(WORK2[I],MANTIS)
4671                ;                                ( @C     , A    )
```

```
4672                ;                                  ( O      , I    )
4673                ;                            COMPARE NEW SETTING VS SETTING LIM
4674 0CCD 11 DB CB    LXI  D,(WORK1+15-NBANKS)*100H+(WORK2+15-NBANKS)
4675                ;                            D = OFFSET, WORK1[N=15-NBANKS]
4676                ;                            E = OFFSET, WORK2[N]
4677 0CD0 3E 05       MVI  A,NBANKS+1            A = NIBCNT = NBANKS+1
4678 0CD2 CD 8E 0E    CALL CMPARE                CMPARE(WORK1[N],WORK2[N],NIBCNT,
4679                ;                                  ( @D     , @E     , A    ,
4680                ;                                  ( I      , I      , I    ;
4681                ;
4682                ;                                  NEGFLG,ZROFLG)
4683                ;                                  PSW:S ,PSW:Z )
4684                ;                                   O    , O    )
4685                ;                            IF NEGFLG .EQ. FALSE
4686                ;                              NEW SETTING EXCEEDS LIMIT
4687 0CD5 F0          RP                           PROERR(ERRFLG)
4688                ;                            ELSE
4689 0CD6 F1          POP  PSW                     CLEAN UP STACK
4690                ;                              SET POSTAGE
4691 0CD7 11 36 74    LXI  D,NORFLG/2+X            DE = ADDRESS, NORFLG
4692 0CDA 1A          LDAX D                       NORFLG.LATDSB = FALSE
4693 0CDB E6 FE       ANI  0FEH
4694 0CDD F6 02       ORI  2                       NORFLG.UNVSEL = TRUE
4695 0CDF 12          STAX D
4696 0CE0 7E          MOV  A,M                     MRSTS1.UNKSEL = TRUE
4697 0CE1 F6 80       ORI  80H
4698 0CE3 77          MOV  M,A
4699 0CE4 E5          PUSH H                       SAVE HL
4700 0CE5 CD 25 1A    CALL MVPOST                  MVPOST(ERROR)
4701                ;                                  ( A    )
4702                ;                                  ( O    )
4703 0CE8 E1          POP  H                       RESTORE HL
4704 0CE9 B7          ORA  A                       PSW:Z = NOERR = ERROR .EQ. 0
4705                ;                              IF NOERR .EQ. FALSE
4706                ;                                METER DID NOT SET
4707 0CEA C2 80 08    JNZ  FATERR                    FATERR(ERROR,ERRFLG)
4708                ;                                      ( A    ,PSW:Z )
4709                ;                                      ( I    , O    )
4710                ;                              ELSE
4711                ;                                REPORT SUCCESSFUL SETTING
4712 0CED 01 42 CC    LXI  B,(WORK1+16-NBANKS)*100H+POSREG
4713                ;                                B = OFFSET, WORK1[N]
4714                ;                                C = OFFSET, POSREG
4715 0CF0 3E 04       MVI  A,NBANKS                  A = NIBCNT = NBANKS
4716 0CF2 CD B3 0F    CALL MVLNIB                    MVLNIB(POSREG,WORK1[N],NBANKS,
4717                ;                                      ( @C    , @B     , A    ,
4718                ;                                      ( O     , I      , I    ,
4719                ;
4720                ;                                      NONBCD,ZROFLG)
4721                ;                                      PSW:S ,PSW:Z )
4722                ;                                       O    , O    )
4723 0CF5 7E          MOV  A,M                       MRSTS1.UNKSEL = FALSE
4724 0CF6 E6 7F       ANI  7FH
4725 0CF8 77          MOV  M,A
4726                ;                                CLEAR ERROR FLAG
4727 0CF9 0C          INR  C                         C = OFFSET, POSREG[1]
4728                ;                                PSW:Z = ERRFLG = C.EQ.0=FALSE
4729                ;                              ENDIF
4730                ;                            ENDIF
4731                ;                          ENDIF
4732                ;                        ENDIF
4733 0CFA C9          RET                      RETURN
4736                ;SRVCNV(SRVREG,MAXCNT,ERRFLG)(AMTBUF,DIEDCM)
4737                ;      (NIBSTR,BYTE  ,BIT   )(NIBSTR,BYTE  )
4738                ;      ( O    , I    , O    )( I    , I    )
4739                ;      ( @E   , D    ,PSW:Z )( RAM  , RAM  )
4740                ;      ( C    , C    , C    )( NC   , NC   )
4741                ;
4742                ;PSW DESTROYED
4743                ;REGISTERS DESTROYED
4744                ;
4745                ;CONVERT MESSAGE FORMATTED VALUE IN AMTBUF INTO A
```

```
4746                ;SPECIAL SERVICE REGISTER FORMAT IN THE FORM:
4747                ;MANTISSA*10**EXPONENT, IN WHICH
4748                ;SRVREG[0] = MANTISSA
4749                ;SRVREG[1] = EXPONENT
4750                ;
4751                SRVCNV;                 ****ENTRY POINT
4752                ;                       SET TO REACH PROERR VIA RETURN
4753 0CFB 21 A1 0B    LXI  H,PROERR
4754 0CFE E5          PUSH H
4755                ;                       FETCH VALUES FROM MESSAGE FORMAT
4756 0CFF 06 E1       MVI  B,AMTBUF+1       B = OFFSET, AMTBUF[1]
4757 0D01 CD 35 0F    CALL GETNIB           GETNIB(DECPOS,ZROFLG,AMTBUF[1])
4758                ;                             ( A    ,PSW:Z , @B      )
4759                ;                             ( D    , D    , I       )
4760 0D04 6F          MOV  L,A              L = DECPOS
4761 0D05 05          DCR  B                B = OFFSET, AMTBUF[0]
4762 0D06 CD 35 0F    CALL GETNIB           GETNIB(MSGCNT,ZROFLG,AMTBUF[0])
4763                ;                             ( A    ,PSW:Z , @B      )
4764                ;                             ( D    , D    , I       )
4765 0D09 67          MOV  H,A              H = MSGCNT
4766                ;                       IF ZROFLG .EQ. TRUE
4767                ;                         NO VALUE WAS ENTERED
4768 0D0A C8          RZ                      PROERR(ERRFLG)
4769                ;                       ELSE
4770                ;                       POINT TO RIGHT OF H/O MESSAGE DIGIT
4771 0D0B E6 01       ANI  1                B = OFFSET, AMTBUF[I=
4772                ;                                   (MSGCNT .AND. HEX01)+3]
4773 0D0D C6 E3       ADI AMTBUF+3
4774 0D0F 47          MOV  B,A
4775 0D10 4F          MOV  C,A              C = OFFSET, AMTBUF[I]
4776                ;                       SCAN DIGITS TO RIGHT OF H/O MSG DIGIT
4777 0D11 7C          MOV  A,H              A = NIBCNT = MSGCNT-1
4778 0D12 3D          DCR  A
4779 0D13 CD B3 0F    CALL MVLNIB           MVLNIB(AMTBUF[I],AMTBUF[I],NIBCNT,
4780                ;                             ( @C      , @B      , A    ,
4781                ;                             ( D       , I       , I    ,
4782                ;
4783                ;                             NONBCD,ZROFLG)
4784                ;                             PSW:S ,PSW:Z )
4785                ;                              D    , D    )
4786                ;                       IF ZROFLG .EQ. FALSE
4787                ;                         NOT ALL DIGITS SCANNED WERE ZEROES
4788 0D16 C0          RNZ                     PROERR(ERRFLG)
4789                ;                       ELSE
4790 0D17 3A 35 74    LDA  DIEDCM/2+X       A = DIEDCM-DECPOS
4791 0D1A 95          SUB  L
4792                ;                       IF (DIEDCM-DECPOS) .LT. 0
4793                ;                         BAD DECIMAL IN MESSAGE FORMAT
4794 0D1B D8          RC                      PROERR(ERRFLG)
4795                ;                       ELSE
4796                ;                       CALCULATE EXPONENT
4797 0D1C 84          ADD  H                L = EXPONT = MSGCNT-1+DIEDCM-DECPOS
4798 0D1D 3D          DCR  A
4799 0D1E 6F          MOV  L,A
4800 0D1F BA          CMP  D                IF EXPONT .GE. MAXCNT
4801                ;                         MESSAGE IS TOO LONG
4802 0D20 D0          RNC                     PROERR(ERRFLG)
4803                ;                       ELSE
4804                ;                       FETCH H/O MESSAGE DIGIT AS MANTISSA
4805 0D21 05          DCR  B                B = OFFSET, AMTBUF[I=I-1]
4806 0D22 CD 35 0F    CALL GETNIB           GETNIB(MANTIS,ZROFLG,AMTBUF[I])
4807                ;                             ( A    ,PSW:Z , @B      )
4808 0D25 FE 0A       CPI  10               IF MANTIS .GE. 10
4809                ;                         NON BCD CHAR IN MESSAGE
4810 0D27 D0          RNC                     PROERR(ERRFLG)
4811                ;                       ELSE
4812 0D28 C1          POP  B                  CLEAN UP STACK
4813                ;                         PUT MANTISSA IN SERVICE REGISTER
4814 0D29 4B          MOV  C,E                C = OFFSET, SRVREG[0]
4815 0D2A CD EE 0F    CALL PUTNIB             PUTNIB(SRVREG[0],MANTIS)
4816                ;                               ( @C      , A    )
4817                ;                               ( D       , I    )
```

```
4818                ;                          PUT EXPONENT IN SERVICE REGISTER
4819 0D2D 0C         INR  C                    C = OFFSET, SRVREG[1]
4820 0D2E 7D         MOV  A,L                  A = EXPONT
4821 0D2F CD EE 0F   CALL PUTNIB               PUTNIB(SRVREG[1],EXPONT)
4822                ;                                ( @C      , A    )
4823                ;                                ( 0       , I    )
4824 0D32 0C         INR  C                    PSW:Z = ERRFLG = FALSE
4825                ;                        ENDIF
4826 0D33 C9         RET                      RETURN
4829                ;SRVREQ(SRVVAL,SRVHDR,ERRFLG)(WORK1 ,WORK2 ,DIEDCM)
4830                ;      (NIBSTR,BYTE  ,BIT   )(NIBSTR,NIBSTR,BYTE  )
4831                ;      ( I    , I    , 0    )( 0    , 0    , I    )
4832                ;      ( @B   , C    ,PSW:Z )( RAM  , RAM  , RAM  )
4833                ;      ( NC   , C    , C    )( C    , C    , NC   )
4834                ;
4835                ;PSW DESTROYED
4836                ;REGISTERS DESTROYED
4837                ;
4838                ;EXPAND COMPRESSED SERVICE REGISTER TO WORK BUFFER.
4839                ;CALL VALREQ TO BUILD MESSAGE IN XMTBUF.
4840                ;
4841                SRVREQ;                  ****ENTRY POINT
4842                ;                        CLEAR WORK AREA
4843 0D34 3E C0      MVI A,WORK1             A = OFFSET, WORK1
4844 0D36 CD 85 0E   CALL CLRBLK             CLRBLK(WORK1)
4845                ;                              ( @A  )
4846                ;                              ( 0   )
4847 0D39 21 6A 74   LXI  H,(WORK2+4)/2+X
4848                ;                        HL = ADDRESS, WORK2[4..5]
4849 0D3C 71         MOV  M,C                WORK2[4..5] = SRVHDR
4850 0D3D 0E C4      MVI  C,WORK1+4          C = OFFSET, WORK1[4]
4851                ;                        MOVE MANTISSA INTO WORK AREA
4852 0D3F 3E 01      MVI  A,1                A = NIBCNT = 1
4853 0D41 CD B3 0F   CALL MVLNIB             MVLNIB(WORK1[4],SRVVAL[0],NIBCNT,PSW)
4854                ;                              ( @C     , @B      , A    ,PSW)
4855                ;                              ( 0      , I       , I    , 0 )
4856 0D44 04         INR  B                  B = OFFSET, SRVVAL[1]
4857                ;                        FETCH EXPONENT
4858 0D45 CD 35 0F   CALL GETNIB             GETNIB(EXPONT,PSW,SRVVAL[1])
4859                ;                              ( A    ,PSW, @B      )
4860                ;                              ( 0    , 0 , I       )
4861 0D48 3C         INR  A                  A = NIBCNT = EXPONT+1
4862 0D49 07         RLC                     B = FORMAT = HEX10*NIBCNT
4863 0D4A 07         RLC
4864 0D4B 07         RLC
4865 0D4C 07         RLC
4866 0D4D 47         MOV  B,A
4867 0D4E 3A 35 74   LDA  DIEDCM/2+X         A = FORMAT = FORMAT+DIEDCM
4868 0D51 80         ADD  B
4869 0D52 2B         DCX  H                  HL = ADDRESS, WORK2[2..3]
4870 0D53 77         MOV  M,A                WORK2[2..3] = FORMAT
4871 0D54 2B         DCX  H                  HL = ADDRESS, WORK2[0..1]
4872 0D55 36 C4      MVI  M,WORK1+4          WORK2[0..1] = OFFSET, WORK1[4]
4873 0D57 EB         XCHG                    DE = ADDRESS, WORK2[0..1]
4874                 ;                       PUT REPLY INTO TRANSMIT BUFFER
4875 0D58 C3 5B 0D   JMP  VALREQ             VALREQ(WORK1[4],WORK2[2],WORK2[4],
4876                ;                              (@@DE+0  ,@DE+1   ,@DE+2   ,
4877                ;                              ( I      ,  I      ,  I     ,
4878                ;
4879                ;                              ERRFLG)
4880                ;                              PSW:Z )
4881                ;                               0    )
4882                ;                        RETURN
4885                ;VALREQ(SOURCE,VALFMT,ANSHDR,ERRFLG)(DIEDCM,DEPDCM,XMTBUF)
4886                ;      (NIBSTR,BYTE  ,BYTE  ,BYTE  )(BYTE  ,BYTE  ,NIBSTR)
4887                ;      ( I    , I    , I    , 0    )( I    , I    , 0    )
4888                ;      (@@DE+0, @DE+1, @DE+2,PSW:Z )( RAM  , RAM  , RAM  )
4889                ;      ( NC   , NC   , NC   , C    )( NC   , NC   , C    )
4890                ;
4891                ;PSW DESTROYED
4892                ;ALL REGISTERS DESTROYED
4893                ;
```

```
4894                ;BUILD VALUE REPLY MESSAGE IN TRANSMIT BUFFER
4895                ;
4896                VALREQ;                 ****ENTRY POINT
4897                ;                       FETCH OFFSET OF SOURCE
4898 0D5B EB          XCHG                  HL = ADDRESS, (OFFSET, SOURCE[L=0])
4899 0D5C 46          MOV  B,M              B = OFFSET, SOURCE[L=0]
4900                ;                       FETCH FORMAT TEMPLATE FOR MESSAGE
4901 0D5D 23          INX  H                HL = ADDRESS, VALFMT
4902 0D5E 7E          MOV  A,M              E = DECPOS = VALFMT[1]
4903 0D5F E6 0F       ANI  0FH
4904 0D61 5F          MOV  E,A
4905 0D62 7E          MOV  A,M              D = NDIGIT = VALFMT[0]
4906 0D63 AB          XRA  E
4907 0D64 0F          RRC
4908 0D65 0F          RRC
4909 0D66 0F          RRC
4910 0D67 0F          RRC
4911 0D68 57          MOV  D,A
4912                ;                       FETCH HEADER FOR REPLY
4913 0D69 23          INX  H                HL = ADDRESS, ANSHDR
4914 0D6A 4E          MOV  C,M              C = ANSHDR
4915                ;                       SCAN FOR MOST SIGNIFICANT DIGIT
4916                VALR01;                 DO WHILE SOURCE[L] .EQ. 0
4917 0D6B CD 35 0F    CALL GETNIB             GETNIB(LDIGIT,ZROFLG,SOURCE[L])
4918                ;                               ( A    , PSW:Z, @B      )
4919                ;                               ( 0    , 0    , I       )
4920 0D6E C2 78 0D    JNZ  VALR02
4921 0D71 04          INR  B                  B = OFFSET, SOURCE[L=L+1]
4922 0D72 15          DCR  D                  D = NDIGIT = NDIGIT-1
4923 0D73 C2 6B 0D    JNZ  VALR01             IF NDIGIT .EQ. 0
4924 0D76 14          INR  D                    D = NDIGIT = 1
4925 0D77 05          DCR  B                    B = OFFSET, SOURCE[L=L-1]
4926                ;                           BREAK
4927                ;                         ENDIF
4928                VALR02;                 ENDDO
4929 0D78 1C          INR  E                  IF DECPOS .EQ. 0
4930 0D79 1D          DCR  E
4931 0D7A C2 9E 0D    JNZ  VALR05
4932                ;                         METER CHARACTERISTCS WILL
4933                ;                         DETERMINE FORMAT.
4934                ;                         ADJUST VALUES SO THAT AT LEAST ONE
4935                ;                         DIGIT WILL BE TO LEFT OF DECIMAL.
4936 0D7D 2A 35 74    LHLD DIEDCM/2+X         L = DIEDCM
4937                ;                         H = DEFDCM
4938 0D80 5D          MOV  E,L                E = DECPOS = DIEDCM
4939 0D81 7D          MOV  A,L                A = ADJUST = DIEDCM+1-NDIGIT
4940 0D82 3C          INR  A
4941 0D83 92          SUB  D
4942 0D84 FA 8D 0D    JM   VALR03             IF ADJUST .GE. 0
4943 0D87 6F          MOV  L,A                  L = ADJUST
4944 0D88 82          ADD  D                    D = NDIGIT = NDIGIT+ADJUST
4945 0D89 57          MOV  D,A
4946 0D8A 78          MOV  A,B                  B = OFFSET, SOURCE[L=L-ADJUST]
4947 0D8B 95          SUB  L
4948 0D8C 47          MOV  B,A
4949                VALR03;                 ENDIF
4950                ;                       SUPPRESS TRAILING ZERO IN THE
4951                ;                       EVENT DIEDCM .GT. DEFDCM
4952 0D8D C5          PUSH B                SAVE BC
4953 0D8E 78          MOV  A,B              B = OFFSET, SOURCE[R=L+NDIGIT-1]
4954 0D8F 82          ADD  D
4955 0D90 3D          DCR  A
4956 0D91 47          MOV  B,A
4957 0D92 CD 35 0F    CALL GETNIB           GETNIB(RDIGIT,ZROFLG,SOURCE[R])
4958                ;                               ( A    , PSW:Z, @B      )
4959                ;                               ( 0    , 0    , I       )
4960 0D95 C1          POP  B                B = SOURCE[L]
4961                ;                       C = ANSHDR
4962 0D96 C2 9E 0D    JNZ  VALR04           IF RDIGIT .EQ. 0
4963                ;                         TRAILING ZERO IS PRESENT
4964 0D99 7A          MOV  A,D                D = NDIGIT = NDIGIT+DEFDCM-DECPOS
4965 0D9A 93          SUB  E
```

```
0D9B 84          ADD H
0D9C 57          MOV  D,A
0D9D 5C          MOV  E,H              E = DECPOS = DEFDCM
                VALR04;                ENDIF
                VALR05;              ENDIF
                ;                    CLEAR TRANSMIT BUFFER
0D9E 3E A0       MVI  A,XMTBUF       A = OFFSET, XMTBUF
0DA0 CD 85 0E    CALL CLRBLK         CLRBLK(XMTBUF)
                ;                          ( @A   )
                ;                          ( 0    )
                ;                    BUILD MESSAGE IN TRANSMIT BUFFER
0DA3 7A          MOV  A,D            L = MSGSIZ = 2+(NDIGIT+1)/2
0DA4 B7          ORA  A
0DA5 1F          RAR
0DA6 CE 02       ACI  2
0DA8 6F          MOV  L,A
0DA9 61          MOV  H,C            H = ANSHDR
0DAA 22 50 74    SHLD XMTBUF/2+X     XMTBUF[0..1] = MSGSIZ
                ;                    XMTBUF[2..3] = ANSHDR
0DAD 0E A4       MVI  C,XMTBUF+4     C = OFFSET, XMTBUF[4]
0DAF 7A          MOV  A,D            A = NDIGIT
0DB0 CD EE 0F    CALL PUTNIB         PUTNIB(XMTBUF[4],NDIGIT)
                ;                          ( @C     , A    )
                ;                          ( 0      , I    )
0DB3 0C          INR  C              C = OFFSET, XMTBUF[5]
0DB4 7B          MOV  A,E            A = DECPOS
0DB5 CD EE 0F    CALL PUTNIB         PUTNIB(XMTBUF[5],DECPOS)
                ;                          ( @C     , A    )
                ;                          ( 0      , I    )
0DB8 0C          INR  C              C = OFFSET, XMTBUF[I=6+(NDIGIT.MOD.2)]
0DB9 7A          MOV  A,D
0DBA E6 01       ANI  1
0DBC 81          ADD  C
0DBD 4F          MOV  C,A
0DBE 7A          MOV  A,D            A = NDIGIT
0DBF CD B3 0F    CALL MVLNIB         MVLNIB(XMTBUF[I],SOURCE[L],NDIGIT,
                ;                          ( @C     , @B     , A    ,
                ;                          ( 0      , I      , I    ,
                ;
                ;                           NONBCD,ZROFLG)
                ;                           PSW:S ,PSW:Z )
                ;                            0    , 0    )
0DC2 FA A1 0B    JM   PROERR         IF NONBCD .EQ. TRUE
                ;                      PROCESS ERROR
                ;                      PROERR(ERRFLG)
                ;                            ( A    )
                ;                            ( 0    )
                ;                      RETURN
                ;                    ELSE
0DC5 0C          INR  C                PSW:Z = ERRFLG = FALSE
0DC6 C9          RET                   RETURN
                ;                    ENDIF
                ;XEQHDR(HEADER,ERRFLG)(DBUF  ,XMTBUF,NORFLG)
                ;      (BYTE  ,BIT   )(NIBSTR,NIBSTR,BITSTR)
                ;      ( I    , 0    )( I/O  , I    , 0    )
                ;      ( A    ,PSW:Z )( RAM  , RAM  , RAM  )
                ;      ( NC   , C    )( C    , NC   , C    )
                ;
                ;PSW = DESTROYED
                ;
                ;SUPERVISES THE EXECUTION OF INTERNALLY GENERATED HEADERS
                ;
                XEQHDR;              ****ENTRY POINT
0DC7 E5          PUSH H              SAVE HL
0DC8 D5          PUSH D              SAVE DE
0DC9 C5          PUSH B              SAVE BC
0DCA 47          MOV  B,A            B = HEADER
                ;                    STOP TIMER
0DCB CD 34 01    CALL STPTMR         STPTMR(WASOFF)
                ;                          (PSW:Z )
                ;                          ( 0    )
0DCE 3A 40 74    LDA  DBUF/2+X       A = DBUF[0..1]
```

```
0DD1 B7          ORA  A              PSW:Z = DBUF[0..1] .EQ. 0
0DD2 78          MOV  A,B            A = HEADER
0DD3 C2 E7 0D    JNZ  XEQH02         IF DBUF[0..1] .EQ. 0
                ;                      DISPLAY HAS KEYENTERED DATA
0DD6 FE C4       CPI  HSETDA           IF(HEADER .LT .0) .AND.
                ;                        (HEADER .NE. HSETDA)
0DD8 CA E7 0D    JZ   XEQH01
0DDB B7          ORA  A
0DDC F2 E7 0D    JP   XEQH01
                ;                        PROCESS HEADER WITH DATA IN DBUF
0DDF 06 82       MVI  B,DBUF+2          B = OFFSET, DBUF[2]
0DE1 CD 41 09    CALL HDRPLS            HDRPLS(HEADER,DBUF[2],ERRFLG)
                ;                              ( A    , @B    ,PSW:Z)
                ;                              ( I    , I     , O   )
0DE4 C3 EA 0D    JMP  XEQH03
                XEQH01;                ELSE
                ;                        PROCESS HEADER WITHOUT DATA
                ;                        HDRONY(HEADER,ERRFLG)
                ;                              ( A    ,PSW:Z)
                ;                              ( I    , O   )
                ;                      ENDIF
                XEQH02;              ELSE
                ;                      PROCESS HEADER WITHOUT DATA
0DE7 CD D5 08    CALL HDRONY           HDRONY(HEADER,ERRFLG)
                ;                            ( A    ,PSW:Z)
                ;                            ( I    , O   )
                XEQH03;              ENDIF
0DEA CA 11 0E    JZ   XEQH07         IF ERRFLG .EQ. FALSE
0DED F5          PUSH PSW              SAVE A, PSW
0DEE 3A 50 74    LDA  XMTBUF/2+X       A = BYTCNT = XMTBUF[0..1]
0DF1 B7          ORA  A                PSW:Z = BYTCNT .EQ. 0
                ;                      PSW:CY = 0
0DF2 CA 02 0E    JZ   XEQH04           IF BYTCNT .NE. 0
                ;                        CONVERT BYTE COUNT TO NIBBLE COUNT
0DF5 17          RAL                    A = NIBCNT = 2*BYTCNT
0DF6 01 80 A2    LXI  B,(XMTBUF+2)*100H+DBUF
                ;                        B = OFFSET, XMTBUF[2]
                ;                        C = OFFSET, DBUF[0]
                ;                        MOVE DATA INTO DBUF
0DF9 CD B3 0F    CALL MVLNIB            MVLNIB(DBUF[0],XMTBUF[2],NIBCNT)
                ;                              ( @C    , @B      , A    )
                ;                              ( O     , I       , I    )
0DFC CD 5A 05    CALL VALDSP            MOVE DBUF INTO DISPLAY
0DFF C3 10 0E    JMP  XEQH06
                XEQH04;              ELSE
                ;                        BYTCNT .EQ. 0
                ;                        COMMAND AFFECTED STATUS ONLY
0E02 3A 40 74    LDA  DBUF/2+X          IF DBUF[0..1] = HEX00
0E05 B7          ORA  A
0E06 C2 10 0E    JNZ  XEQH05
                ;                          KEYENTERED DISPLAY UNCHANGED
                ;                          QUE POSTAGE REQUEST
0E09 21 26 74    LXI  H,NORFLG/2+X          HL = ADDRESS, NORFLG
0E0C 7E          MOV  A,M                   NORFLG.QUEPOS = TRUE
0E0D F6 40       ORI  40H
0E0F 77          MOV  M,A
                XEQH05;                  ENDIF
                XEQH06;              ENDIF
0E10 F1          POP  PSW             A = HEADER
                ;                    PSW:Z = ERRFLG
                XEQH07;              ENDIF
0E11 C1          POP  B              RESTORE BC
0E12 D1          POP  D              RESTORE DE
0E13 E1          POP  H              RESTORE HL
0E14 C9          RET                 RETURN
                ;XMIT()(SID,SOD,SOE,XMTBUF,NORFLG)
                ;      (BIT,BIT,BIT,BYTSTR,BYTSTR)
                ;      ( I , O , O , I/O  , I    )
                ;      (RIM,SIM,SIM, RAM  , RAM  )
                ;      ( NC, C , C , C    , NC   )
                ;
                ;REGISTERS DESTROYED
```

```
5114                ;PSW DESTROYED
5115                ;
5116                ;ATTEMPT TO TRANSMIT MESSAGE IN XMTBUF.
5117                ;ONE ATTEMPT ONLY.  XMTBUF[0], THE MESSAGE BYTE COUNT,
5118                ;IS CLEARED WHETHER OR NOT THE MESSAGE IS ACTUALLY SENT.
5119                ;XMTBUF[0] IS ASSUMED .GT. 0, AND .LE. 7 ON ENTRY.
5120                ;
5121                XMIT;                  ****ENTRY POINT
5122                ;                      FETCH BYTE COUNT OF OUTBOUND MESSAGE
5123 0E15 21 50 74    LXI  H,XMTBUF/2+X    HL =  ADDRESS, XMTBUF[N=0]
5124 0E18 4E          MOV  C,M             C = BYTCNT = XMTBUF[N]
5125                ;                      CANCEL MSG BY CLEARING XMTBUF[0]
5126 0E19 36 00       MVI  M,0             XMTBUF[N] = 0
5127 0E1B 3A 26 74    LDA  NORFLG/2+X      IF NORFLG.COMDSB .EQ. TRUE
5128 0E1E E6 04       ANI  4
5129                ;                        COMMUNICATIONS ARE DISABLED
5130 0E20 C0          RNZ                      RETURN
5131                ;                      ENDIF
5132                ;                      STOP TIMER
5133 0E21 CD 34 01    CALL STPTMR          STPTMR(WASOFF)
5134                ;                            (PSW:Z )
5135                ;                            ( 0    )
5136 0E24 E5          PUSH H               SAVE HL
5137 0E25 C5          PUSH B               SAVE BC
5138 0E26 CD C7 0B    CALL RECEVE          IF INCOMING RTS IS PRESENT
5139                ;                        RECEIVE MESSAGE
5140                ;                      ENDIF
5141 0E29 3E C0       MVI  A,0C0H          SIM.SOD = RTS = 1
5142                ;                      SIM.SOE = ENABLD = 1
5143 0E2B 30          SIM                  OUTPUT RTS
5144 0E2C C1          POP  B               RESTORE BC
5145 0E2D E1          POP  H               RESTORE HL
5146 0E2E 16 D9       MVI  D,217           D = COUNT ;FOR T13 = 3.509 MSEC
5147                XMIT01;                DO UNTIL BIT .EQ. CTS
5148 0E30 15          DCR  D                 COUNT = COUNT-1
5149 0E31 CA 7B 0E    JZ   XMIT06            IF COUNT+1 .EQ. 0
5150                ; >>JUMP AHEAD<<           TIMEOUT HAS OCCURRED
5151                ;                          QUIT
5152                ;                        ENDIF
5153 0E34 20          RIM                    INPUT BIT
5154                ;                        A.0 = BIT = RIM.SID ;CTS OR IDLE
5155 0E35 B7          ORA  A                 CHECK BIT
5156 0E36 F2 30 0E    JP   XMIT01
5157                ;                      ENDDO

5159                XMIT03;                DO UNTIL BYTCNT .EQ. 0
5160                ;                        DEFINE STOP BIT
5161 0E39 3E 01       MVI  A,1               IF 1 .LT. BYTCNT
5162 0E3B B9          CMP  C
5163                ;                          THIS IS NOT LAST BYTE
5164                ;                          PSW:CY = STOP = EOB = 1
5165                ;                        ELSE
5166                ;                          THIS IS THE LAST BYTE
5167                ;                          PSW:CY = STOP = EOM = 0
5168                ;                        ENDIF
5169 0E3C 23          INX  H                 HL = ADDRESS, XMTBUF[N=N+1]
5170 0E3D 3E 12       MVI  A,18              DELAY ;FOR T4 = 178.234 USEC
5171 0E3F 3D          DCR  A
5172 0E40 F2 3F 0E    JP   $-1
5173                ;                        SET TO OUTPUT 9 BITS FROM LOOP
5174                ;                        8 DATA, AND 1 EOB OR EOM
5175 0E43 06 0A       MVI  B,9+1             BITCNT = 10 = 9+1
5176 0E45 3E 40       MVI  A,40H             SIM.SOD = START = 0
5177                ;                        SIM.SOE = ENABLD = 1
5178 0E47 57          MOV  D,A               D.0 = OUTBIT = START
5179 0E48 30          SIM                    OUTPUT = START
5180                ;                        LOAD 8 DATA BITS
5181 0E49 7E          MOV A,M                A = XMTBUF[N]
5182                ;                        SAVE 8 DATA BITS AND 1 STOP BIT
5183 0E4A F5          PUSH PSW

5185                XMIT04;                  LOOP ;BREAK IF BITCNT .EQ. 0
```

```
5186 0E4B 3E 06      MVI  A,6              DELAY ;BIT PERIOD = 103.923 USEC
5187 0E4D 3D         DCR  A
5188 0E4E F2 4D 0E   JP   $-1
5189 0E51 F0         RP
5190 0E52 F1         POP  PSW              GET NEXT BIT
5191 0E53 1F         RAR                   PSW.CY = OUTBIT
5192 0E54 F5         PUSH PSW
5193 0E55 3E 80      MVI  A,80H            PSW:CY,A = SIM*2
5194 0E57 1F         RAR                   A = SIM
5195               ;                       SIM.SOD = OUTBIT
5196               ;                       SIM.SOE = ENABLD = 1
5197 0E58 5A         MOV  E,D              E.0 = PRVBIT = OUTBIT
5198 0E59 57         MOV  D,A              D.0 = OUTBIT
5199 0E5A 05         DCR  B                BITCNT = BITCNT-1
5200               ;                       IF BITCNT .EQ. 0
5201 0E5B CA 68 0E   JZ   XMIT05             BREAK
5202               ;                       ENDIF
5203 0E5E 30         SIM                   OUTPUT OUTBIT
5204 0E5F 20         RIM                   READ ECHO
5205               ;                       A.0 = ECHO = RIM.SID
5206 0E60 AB         XRA  E                IF ECHO .NE. PRVBIT
5207 0E61 F2 4B 0E   JP   XMIT04
5208 0E64 F1         POP  PSW                CLEAN UP STACK
5209 0E65 C3 7B 0E   JMP  XMIT06             QUIT
5210               ; >>JUMP AHEAD<<
5211               ;                       ENDIF
5212               XMIT05;               ENDLOOP
5213 0E68 F1         POP  PSW            CLEAN UP STACK
5214 0E69 20         RIM                 READ ECHO
5215               ;                     A.0 = ECHO = RIM.SID
5216 0E6A AB         XRA  E              IF ECHO .NE. STOP
5217 0E6B FA 7B 0E   JM   XMIT06           QUIT
5218               ; >>JUMP AHEAD<<
5219               ;                     ENDIF
5220 0E6E 0D         DCR  C              C = BYTCNT = BYTCNT-1
5221 0E6F C2 39 0E   JNZ  XMIT03
5222               ;                   ENDDO

5224 0E72 3E C0      MVI  A,0C0H       SIM.SOD = ACK = 1
5225               ;                   SIM.SOE = ENABLD = 1
5226 0E74 30         SIM               OUTPUT ACK
5227 0E75 16 29      MVI  D,41         DELAY ;T7 = 336.914 USEC
5228 0E77 15         DCR  D
5229 0E78 F2 77 0E   JP   $-1
5230               XMIT06;             >>TARGET OF JUMP AHEAD<<
5231               ;                   QUIT XMIT ROUTINE
5232 0E7B 3E 40      MVI  A,40H        SIM.SOD = IDLE = 0
5233               ;                   SIM.SOE = ENABLD = 1
5234 0E7D 30         SIM               OUTPUT IDLE
5235 0E7E 16 C8      MVI  D,200        DELAY ;T14 = 1606.908 USEC
5236 0E80 15         DCR  D
5237 0E81 F2 80 0E   JP   $-1
5238 0E84 C9         RET               RETURN
5241               ;CLRBLK(BLOCK )
5242               ;      (NIBSTR)
5243               ;      ( D    )
5244               ;      ( @A   )
5245               ;      ( C    )
5246               ;
5247               ;PSW:S, Z, P, CY = NO CHANGE
5248               ;
5249               ;CLEAR A 16 NIBBLE BLOCK TO ZEROS
5250               ;BLOCK[0..15] = 0
5251               ;
5252               CLRBLK;             ****ENTRY POINT
5253 0E85 F5         PUSH PSW          SAVE A, PSW
5254 0E86 C5         PUSH B            SAVE BC
5255 0E87 4F         MOV  C,A          C = OFFSET, BLOCK
5256 0E88 AF         XRA  A            A = NIBVAL = 0
5257 0E89 06 10      MVI  B,16         B = NIBCNT = 16
5258 0E8B C3 26 0F   JMP  FILN01       FILNIB(BLOCK,NIBVAL,NIBCNT)
5259               ;                        ( @C  , A    , B    )
```

```
5260                ;                          ( O    , I    , I    )
5261                ;                    RESTORE BC
5262                ;                    RESTORE A, PSW
5263                ;                    RETURN
5266                ;CMPARE(MINUEN,SUBTRA,NNIB ,SGNFLG,ZROFLG)
5267                ;      (NIBSTR,NIBSTR,BYTE ,BIT   ,BIT   )
5268                ;      ( I    , I    , I   , O    , O    )
5269                ;      ( @D   , @E   , A   ,PSW:S ,PSW:Z )
5270                ;      ( NC   , NC   , NC  , C    , C    )
5271                ;
5272                ;PSW:CY = NO CHANGE
5273                ;PSW:S, Z, P CHANGED
5274                ;
5275                ;COMPARE EQUAL LENGTH BCD NIBBLE STRINGS
5276                ;
5277                CMPARE;              ****ENTRY POINT
5278 0E8E E5          PUSH H             SAVE HL
5279 0E8F F5          PUSH PSW           SAVE A, PSW
5280 0E90 C5          PUSH B             SAVE BC
5281 0E91 D5          PUSH D             SAVE DE
5282 0E92 67          MOV  H,A           H = COUNT = NNIB
5283                CMPAR1;              DO WHILE COUNT .GT. 0
5284 0E93 25          DCR  H               H = COUNT-1
5285 0E94 FA A9 0E    JM   CMPAR2
5286 0E97 43          MOV  B,E             B = OFFSET,
5287                ;                          SUBTRA[SINDEX = NNIB-COUNT]
5288 0E98 CD 35 0F    CALL GETNIB          GETNIB(SDIGIT,ZERO ,SUBTRA[SINDEX])
5289                ;                            ( A    ,PSW:Z, @B           )
5290                ;                            ( O    , O   , I            )
5291 0E9B 4F          MOV  C,A             C = SDIGIT
5292 0E9C 42          MOV  B,D             B = OFFSET,
5293                ;                          MINUEN[MINDEX = NNIB-COUNT]
5294 0E9D CD 35 0F    CALL GETNIB          GETNIB(MDIGIT,ZERO ,MINUEN[MINDEX])
5295                ;                            ( A    ,PSW:Z, @B           )
5296                ;                            ( O    , O   , I            )
5297 0EA0 91          SUB  C               A = DIFRNC = MDIGIT-SDIGIT
5298 0EA1 C2 A9 0E    JNZ  CMPAR2          IF DIFRNC .NE. 0
5299                ;                        BREAK
5300                ;                      ENDIF
5301 0EA4 1C          INR  E               E = OFFSET,
5302                ;                          SUBTRA[SINDEX = NNIB-(COUNT-1)]
5303 0EA5 14          INR  D               D = OFFSET,
5304                ;                          MINUEN[MINDEX = NNIB-(COUNT-1)]
5305                ;                      H = COUNT = COUNT-1
5306 0EA6 C3 93 0E    JMP  CMPAR1
5307                CMPAR2;              ENDDO
5308 0EA9 D1          POP  D             RESTORE DE
5309 0EAA C1          POP  B             RESTORE BC
5310                ;                    IF NNIB .EQ. 0
5311 0EAB 67          MOV  H,A             H = DIFRNC = NNIB = 0
5312                ;                    ELSE
5313                ;                      H = DIFRNC
5314                ;                    ENDIF
5315 0EAC F1          POP  PSW           RESTORE A, PSW:CY
5316                ;                    OUTPUT PSW:S = SGNFLG
5317                ;                    OUTPUT PSW:Z = ZROFLG
5318 0EAD 24          INR  H
5319 0EAE 25          DCR  H
5320 0EAF E1          POP  H             RESTORE HL
5321 0EB0 C9          RET                RETURN
5324                ;CRC(BLOCK ,NIBCNT,CRCVAL)
5325                ;   (NIBSTR,UBYTE ,UBYTE )
5326                ;   ( I    , I    , O    )
5327                ;   ( @C   , B    , D    )
5328                ;   ( NC   , NC   , C    )
5329                ;
5330                ;PSW = NO CHANGE
5331                ;
5332                ;COMPUTE CRC FOR BLOCK OF NIBCNT NIBBLES
5333                ;
5334                CRC;                 ****ENTRY POINT
5335 0EB1 C5          PUSH B             SAVE BC
```

```
5336 0EB2 F5          PUSH PSW          SAVE A, PSW
5337 0EB3 78          MOV  A,B          A = NIBCNT
5338 0EB4 41          MOV  B,C          B = OFFSET, BLOCKIN = O]
5339 0EB5 4F          MOV  C,A          C = NIBCNT
5340 0EB6 16 FF       MVI  D,0FFH       D = CRCVAL = HEXFF
5341                CRC1;               DO UNTIL NIBCNT = 0
5342 0EB8 CD 35 0F    CALL GETNIB         GETNIB(NIBVAL,ZERO ,BLOCKIN])
5343                ;                           ( A    ,PSW:Z, @B     )
5344                ;                           ( O    , O   , I      )
5345 0EBB CD C6 0E    CALL CRCNIB         CRCNIB(NIBVAL,CRCVAL)
5346                ;                           ( A    , D    )
5347                ;                           ( I    , I/O  )
5348 0EBE 04          INR  B              B = OFFSET, BLOCKIN = N+1]
5349 0EBF 0D          DCR  C              NIBCNT = NIBCNT-1
5350 0EC0 C2 B8 0E    JNZ  CRC1
5351                ;                   ENDDO
5352 0EC3 F1          POP  PSW          RESTORE A, PSW
5353 0EC4 C1          POP  B            RESTORE BC
5354 0EC5 C9          RET
5357                ;CRCNIB(NIBVAL,CRCVAL)
5358                ;      (BYTE  ,BYTE  )
5359                ;      ( I    , I/O  )
5360                ;      ( A    , D    )
5361                ;      ( NC   , C    )
5362                ;
5363                ;PSW DESTROYED
5364                ;
5365                ;INCLUDE NIBBLE INTO DEVELOPING VALUE OF CRC
5366                ;
5367                CRCNIB;             ****ENTRY POINT
5368 0EC6 C5          PUSH B            SAVE BC
5369 0EC7 06 04       MVI  B,4          B = BITCNT = 4
5370                ;                   SHIFT BITS TO HIGH ORDER OF NIBVAL
5371 0EC9 07          RLC               A = NIBVAL = NIBVAL*HEX10
5372 0ECA 07          RLC
5373 0ECB 07          RLC
5374 0ECC 07          RLC
5375                ;                   ROTATE NIBVAL ONE BIT AT A TIME
5376                ;                   BACK INTO ITS ORIGINAL FORM WHILE
5377                ;                   MODIFYING CRCVAL TO REFLECT
5378                ;                   THE BIT'S VALUE
5379                CRCNI1;             DO UNTIL BITCNT .EQ. 0
5380 0ECD 07          RLC                 CY = NIBBIT
5381                ;                     A = NIBVAL = ((NIBVAL*2) .AND.
5382                ;                         HEXFF)+NIBBIT
5383 0ECE 4F          MOV  C,A            C = NIBVAL
5384 0ECF 7A          MOV  A,D            A = CRCVAL
5385 0ED0 17          RAL                 CY = CRCBIT
5386                ;                     A = CRCVAL = ((CRCVAL*2) .AND.
5387                ;                                  HEXFF)+NIBBIT
5388 0ED1 D2 D6 0E    JNC  CRCNI2         IF CRCBIT = 1
5389 0ED4 EE 9B       XRI  9BH              A = CRCVAL = CRCVAL .XOR. HEX9B
5390                CRCNI2;               ENDIF
5391 0ED6 57          MOV  D,A            D = CRCVAL
5392 0ED7 79          MOV  A,C            A = NIBVAL
5393 0ED8 05          DCR  B              B = BITCNT = BITCNT-1
5394 0ED9 C2 CD 0E    JNZ  CRCNI1
5395                ;                   ENDDO
5396 0EDC C1          POP  B            RESTORE BC
5397 0EDD C9          RET               RETURN
5400                ;DBLANK()(PORTA )
5401                ;        (BITSTR)
5402                ;        ( I/O  )
5403                ;        ( 7001 )
5404                ;        ( C    )
5405                ;
5406                ;REGISTERS DESTROYED
5407                ;PSW DESTROYED
5408                ;
5409                ;DISPLAY BLANKING ROUTINE
5410                ;
5411                DBLANK;             ****ENTRY POINT
```

```
                ;                       PREVENT INTERRUPT DISPLAY REFRESH
0EDE CD 34 01     CALL STPTMR           STPTMR(WASOFF)
                ;                             (PSW:Z )
                ;                             ( 0    )
                ;                       FLUSH POSSIBLE NOISE OUT OF DISPLAY
0EE1 CD F6 0E     CALL DFLUSH           DFLUSH(ADDRESS,PORTA)
                ;                             ( HL    , @HL )
                ;                             ( 0       -   )
                ;                       (PORTA .AND HEX0F) .EQ. HEX0F, FOR
                ;                       3 DARK BITS AND IDLE DISPLAY CLOCK
0EE4 7E           MOV  A,M
0EE5 E6 F1        ANI  0F1H
0EE7 77           MOV  M,A              PORTA = PORTA .AND. HEXF1, FOR
                ;                       3 START BITS AND IDLE DISPLAY CLOCK
0EE8 35           DCR  M                PULSE DISPLAY CLOCK
0EE9 34           INR  M
                ;                       SET TO OUTPUT 35*3 DARK BITS
0EEA F6 0F        ORI  0FH
0EEC 77           MOV  M,A              PORTA = PORTA .OR. HEX0F, FOR
                ;                       3 DARK BITS AND IDLE DISPLAY CLOCK
0EEE 3E 22        MVI  A,34             A = COUNT = 34
                DBLAN1;                 ****ALTERNATE ENTRY POINT
                DBLAN2;                 DO UNTIL COUNT .LT. 0
0EEF 35           DCR  M                  PULSE DISPLAY CLOCK
0EF0 34           INR  M
0EF1 3D           DCR  A                  A = COUNT = COUNT-1
0EF2 F2 EF 0E     JP   DBLAN2
                ;                       ENDDO
0EF5 C9           RET
                ;DFLUSH(ADDRES)(PORTA )
                ;      (ADDRES)(BITSTR)
                ;      ( 0    )( I/O  )
                ;      ( HL   )( 7001 )
                ;      ( C    )( C    )
                ;
                ;REGISTERS DESTROYED
                ;PSW DESTROYED
                ;
                ;FLUSH POSSIBLE NOISE OUT OF DISPLAY SHIFT REGISTER
                ;
                DFLUSH;                 ****ENTRY POINT
0EF6 21 01 70     LXI  H,PORTA          HL = ADDRESS, PORTA
0EF9 7E           MOV  A,M
0EFA F6 0F        ORI  0FH
0EFC 77           MOV  M,A              PORTA = PORTA .OR. HEX0F, FOR
                ;                       3 DARK BITS AND IDLE DISPLAY CLOCK
                ;                       CLOCK 36*3 DARK BITS INTO DISPLAY
0EFD 3E 23        MVI  A,35             A = COUNT = 35
0EFF C3 EF 0E     JMP  DBLAN1
                ;                       RETURN
                ;DSBKBD()(KDCTRL,CHRBKT,CTLBKT)
                ;        (BITSTR,BYTE  ,BYTE  )
                ;        ( 0    , 0    , 0    )
                ;        ( RAM  , RAM  , RAM  )
                ;        ( C    , C    , C    )
                ;
                ;PSW:S, Z, P, CY = NO CHANGE
                ;
                ;DISABLE KEYBOARD
                ;
                DSBKBD;                 ****ENTRY POINT
0F02 F5           PUSH PSW              SAVE A, PSW
                ;                       PREVENT KDIO FROM SCANNING KEYBOARD
0F03 3A 27 74     LDA  KDCTRL/2+X       KDCTRL.KBDDSB = TRUE
0F06 F6 01        ORI  01H
0F08 32 27 74     STA  KDCTRL/2+X
                ;                       CLEAR OUTPUT OF DBOUNCE ROUTINE
0F0B AF           XRA  A                CHRBKT = HEX00
0F0C 32 2C 74     STA  CHRBKT/2+X
0F0F 32 2B 74     STA  CTLBKT/2+X       CTLBKT = HEX00
0F12 F1           POP  PSW              RESTORE A, PSW
0F13 C9           RET                   RETURN
```

```
5490                ;ENAKBD()(KEYBKT,KDCTRL)
5491                ;        (BYTE  ,BITSTR)
5492                ;        ( 0    , 0    )
5493                ;        ( RAM  , RAM  )
5494                ;        ( C    , C    )
5495                ;
5496                ;PSW:S, Z, P, CY = NO CHANGE
5497                ;
5498                ;ENABLE KEYBOARD
5499                ;
5500                ENAKBD;              ****ENTRY POINT
5501 0F14 F5          PUSH PSW           SAVE A, PSW
5502                ;                    FORCE KDIO TO RESYNC KEYBOARD SCAN
5503 0F15 3E 80       MVI  A,MULKEY      KEYBKT = MULKEY
5504 0F17 32 2A 74    STA  KEYBKT/2+X
5505                ;                    ALLOW KDIO TO SCAN KEYBOARD
5506 0F1A 3A 27 74    LDA  KDCTRL/2+X    KDCTRL.KDBDSB = FALSE
5507 0F1D E6 FE       ANI  0FEH
5508 0F1F 32 27 74    STA  KDCTRL/2+X
5509 0F22 F1          POP  PSW           RESTORE A, PSW
5510 0F23 C9          RET                RETURN
5513                ;FILNIB(DEST  ,NIBVAL,NIBCNT)
5514                ;      (NIBSTR,BYTE  ,UBYTE )
5515                ;      ( 0    , I    , I    )
5516                ;      ( @C   , A    , B    )
5517                ;      ( C    , NC   , NC   )
5518                ;
5519                ;PSW:S, Z, P, CY = NO CHANGE
5520                ;
5521                ;FILL A NIBBLE STRING WITH A VALUE
5522                ;DEST[0..NIBCNT-1] = NIBVAL
5523                ;
5524                FILNIB;              ****ENTRY POINT
5525 0F24 F5          PUSH PSW           SAVE A, PSW
5526 0F25 C5          PUSH B             SAVE BC
5527                FILN01;              ****SPECIAL JUMP ENTRY
5528                ;                    C = OFFSET, DEST[N = 0]
5529                ;                    FILL NIBCNT NIBBLES IN DEST WITH NIBVAL
5530 0F26 04          INR  B             CONDITION NIBCNT FOR DO WHILE
5531                FILN02;              DO WHILE NIBCNT .NE. 0
5532 0F27 05          DCR  B               B = NIBCNT-1
5533 0F28 CA 32 0F    JZ   FILN03
5534                ;                      PUT NIBVAL INTO DEST
5535 0F2B CD EE 0F    CALL PUTNIB            PUTNIB(DEST[N],NIBVAL)
5536                ;                            ( @C    , A    )
5537                ;                            ( 0     , I    )
5538                ;                      POINT AT NEXT NIBBLE TO RIGHT
5539 0F2E 0C          INR  C               C = OFFSET, DEST[N+1]
5540                ;                      B = NIBCNT = NIBCNT-1
5541 0F2F C3 27 0F    JMP  FILN02
5542                FILN03;              ENDDO
5543 0F32 C1          POP  B             RESTORE BC
5544 0F33 F1          POP  PSW           RESTORE A, PSW
5545 0F34 C9          RET                RETURN
5548                ;GETNIB(NIBVAL,ZERO ,SOURCE)
5549                ;      (BYTE  ,BIT  ,NIB   )
5550                ;      ( 0    , 0    , I    )
5551                ;      ( A    ,PSW:Z, @B    )
5552                ;      ( C    , C    , NC   )
5553                ;
5554                ;PSW:CY = NO CHANGE
5555                ;PSW:S, Z, P CHANGED; CORRESPOND TO VALUE OF NIBVAL
5556                ;
5557                ;FETCH HIGH ORDER 4 BIT VALUE FROM SOURCE[N=EVEN]
5558                ;OR LOW ORDER 4 BIT VALUE FROM SOURCE[N=ODD],
5559                ;AND PLACE IT IN LOW ORDER OF NIBVAL.
5560                ;CLEAR HIGH ORDER OF NIBVAL.
5561                ;NIBVAL = SOURCE[N],   ZERO = NIBVAL .EQ. 0
5562                ;
5563                GETNIB;              ****ENTRY POINT
5564 0F35 E5          PUSH H             SAVE HL
5565 0F36 F5          PUSH PSW           SAVE A, PSW
```

```
5566                ;                       FLAG WHETHER L/O NIBBLE OF BYTE WANTED
5567 0F37 AF          XRA  A                A = OFFSET, SOURCE[N]/2
5568 0F38 78          MOV  A,B
5569 0F39 1F          RAR
5570                ;                       PSW:CY = ODD = TRUE, IF N = ODD
5571                ;                       CALCULATE ADDRESS OF SOURCE
5572 0F3A 26 74       MVI  H,X/100H         HL = ADDRESS, SOURCE[N]
5573 0F3C 6F          MOV  L,A
5574                GETN01;                 ****SPECIAL JUMP ENTRY
5575                ;                       FETCH BYTE CONTAINING DESIRED NIBBLE
5576 0F3D 7E          MOV  A,M              A = SOURCE[N]
5577                ;                       CHECK WHETHER NIBBLE IN HIGH ORDER
5578 0F3E DA 45 0F    JC   GETN02           IF ODD .EQ. FALSE
5579                ;                         MOVE H/O NIBBLE TO L/O
5580 0F41 0F          RRC                     A = SOURCE[N] = SOURCE[N]/HEX10
5581 0F42 0F          RRC
5582 0F43 0F          RRC
5583 0F44 0F          RRC
5584                GETN02;                 ENDIF
5585                ;                       CLEAR HIGH ORDER NIBBLE
5586 0F45 E6 0F       ANI  0FH              H = NIBVAL = SOURCE[N] .AND. HEX0F
5587 0F47 67          MOV  H,A
5588 0F48 F1          POP  PSW              RESTORE PSW:CY
5589 0F49 7C          MOV  A,H              A = NIBVAL
5590                ;                       INDICATE NIBVAL STATUS
5591 0F4A 3C          INR  A                PSW:Z = ZERO = NIBVAL .EQ. 0
5592 0F4B 3D          DCR  A
5593 0F4C E1          POP  H                RESTORE HL
5594 0F4D C9          RET                   RETURN
5597                ;LSTATE(FATMOD,NORMOD,SERMOD,PRVMOD)(MRSTS1,MRSTS2)
5598                ;      (BIT   ,BIT   ,BIT   ,BIT   )(BITSTR,BITSTR)
5599                ;      ( 0    , 0    , 0    , 0    )( I    , I    )
5600                ;      (PSW:S ,PSW:Z ,PSW:P ,PSW:CY)(RAM   ,RAM   )
5601                ;      ( C    , C    , C    , C    )( NC   , NC   )
5602                ;
5603                ;PSW:S = MINUS STATUS IF FATAL MODE
5604                ;PSW:Z = ZERO STATUS IF NORMAL MODE
5605                ;PSW:P = EVEN PARITY STATUS IF SERVICE MODE
5606                ;PSW:CY= 1 IF PRIVILEGED MODE
5607                ;
5608                ;COPIES METER STATE FLAGS INTO PSW FOR EASY TESTING
5609                ;
5610                LSTATE;                 ****ENTRY POINT
5611 0F4E E5          PUSH H                SAVE HL
5612 0F4F F5          PUSH PSW              H = A, SAVED FOR RETURN
5613 0F50 E1          POP  H
5614 0F51 3A 25 74    LDA  MRSTS2/2+X       L = MRSTS2.FATMOD + MRSTS2.PRVMOD
5615 0F54 E6 81       ANI  81H                  (PSW:S POS  ) , (PSW:CY POS )
5616 0F56 6F          MOV  L,A
5617 0F57 3A 24 74    LDA  MRSTS1/2+X       A = MRSTS1.SERMOD
5618 0F5A E6 08       ANI  08H                  (           )
5619 0F5C 0F          RRC                       (PSW:P POS  )
5620 0F5D B5          ORA  L                A = FATMOD, PRVMOD, SERMOD
5621                ;                           (PSW:S, PSW:CY, PSW:P)
5622 0F5E C2 63 0F    JNZ  LSTAT1           IF NO STATUS BITS ARE SET
5623 0F61 3E 40       MVI  A,40H              A = NORMOD
5624                ;                             (PSW:Z)
5625                LSTAT1;                 ENDIF
5626 0F63 6F          MOV  L,A              L = A = STATUS
5627 0F64 E5          PUSH H                RESTORE A; PSW = STATUS
5628 0F65 F1          POP  PSW
5629 0F66 E1          POP  H                RESTORE HL
5630 0F67 C9          RET                   RETURN
5633                ;MOVBIT(SOURCE,SBIT ,DEST  ,DBIT ,VALUE)
5634                ;      (BITSTR,UBYTE,BITSTR,UBYTE,BIT  )
5635                ;      ( I    , I   , 0    , I   , 0   )
5636                ;      ( @H   , L   , @D   , E   ,PSW:Z)
5637                ;      ( NC   , NC  , C    , NC  , C   )
5638                ;
5639                ;PSW:CY = NO CHANGE
5640                ;PSW:S, Z, P CHANGED; CORRESPOND TO VALUE OF BIT
5641                ;
5642                ;MOVE BIT FROM BIT POSITION SBIT IN SOURCE TO BIT POSITION
```

```
                ;DBIT IN DEST.  VALUE INDICATES WHETHER BIT IS 0 OR 1.
                ;BIT 0 IS HIGH ORDER BIT OF STRING.
                ;DEST[DBIT] = SOURCE[SBIT]
                ;
                MOVBIT;                 ****ENTRY POINT
0F68 E5           PUSH H                SAVE HL
0F69 C5           PUSH B                SAVE BC
0F6A F5           PUSH PSW              SAVE A, PSW
0F6B D5           PUSH D                SAVE DE
                ;                       H = SRCOFS = OFFSET, SOURCE
                ;                       BUILD SOURCE ADDRESS AND MASK
0F6C CD 8A 0F     CALL MOVB01           MOVB01(SRCOFS,SBIT,SRCADR,SMASK)
                ;                             ( H    , L  , HL   , A   )
                ;                             ( I    , I  , O    , O   )
                ;                       HL = SRCADR = ADDRESS, SOURCE.SBIT
0F6F 47           MOV  B,A              B = SMASK
0F70 7E           MOV  A,M              PSW:CY = SOURCE.SBIT
0F71 A0           ANA  B
0F72 C6 FF        ADI  0FFH
                ;                       IF SOURCE.SBIT .NE. 0
0F74 9F           SBB  A                  B = SRCBIT = HEXFF
0F75 47           MOV  B,A
                ;                       ELSE
                ;                         B = SRCBIT = HEX00
                ;                       ENDIF
0F76 E1           POP  H                H = DSTOFS = OFFSET, DEST
                ;                       L = DBIT
0F77 E5           PUSH H                RESAVE HL
                ;                       BUILD DESTINATION ADDRESS AND MASK
0F78 CD 8A 0F     CALL MOVB01           MOVB01(DSTOFS,DBIT,DSTADR,DMASK)
                ;                             ( H    , L  , HL   , A   )
                ;                             ( I    , I  , O    , O   )
                ;                       HL = DSTADR = ADDRESS, DEST.DBIT
0F7B 4F           MOV  C,A              C = DMASK
0F7C A0           ANA  B                B = DSTBIT = DMASK .AND. SRCBIT
0F7D 47           MOV  B,A
0F7E 79           MOV  A,C              A = DEST.DBIT = 0
0F7F 2F           CMA
0F80 A6           ANA  M
0F81 B0           ORA  B                DEST.DBIT = DEST.DBIT .OR. DSTBIT
0F82 77           MOV  M,A
0F83 D1           POP  D                RESTORE DE
0F84 F1           POP  PSW              RESTORE A, PSW:CY
0F85 04           INR  B                PSW:Z = DSTBIT .EQ. 0
0F86 05           DCR  B
0F87 C1           POP  B                RESTORE BC
0F88 E1           POP  H                RESTORE HL
0F89 C9           RET                   RETURN
                ;MOVB01(NIBOFS,BITNO,BYTADR,MASK)
                ;      (OFFSET,UBYTE,ADDR  ,BYTE)
                ;      ( I    , I  , O    , O  )
                ;      ( H    , L  , HL   , A  )
                ;      ( C    , C  , C    , C  )
                ;
                ;PSW:S, Z, P, CY DESTROYED
                ;REGISTER DE DESTROYED
                ;
                ;CONVERT NIBBLE OFFSET AND BIT NUMBER INTO ADDRESS OF
                ;BYTE CONTAINING BIT.  A BIT SELECTION MASK IS ALSO
                ;PRODUCED
                ;
                MOVB01;                 ****ENTRY POINT FOR MOVBIT ONLY
0F8A 7D           MOV  A,L              E = ((BITNO/4)+NIBOFS)/2
0F8B 1F           RAR
0F8C 1F           RAR
0F8D E6 2F        ANI  2FH
0F8F 84           ADD  H
0F90 1F           RAR
0F91 5F           MOV  E,A
0F92 7C           MOV  A,H              PSW:CY = NIBOFS .MOD. 2
0F93 1F           RAR
0F94 7D           MOV  A,L              A = BITNO
```

```
0F95 D2 9A 0F   JNC  MOVB02        IF PSW:CY .EQ. 1
                ;                    NIBOFS NOT ON BYTE BOUNDARY
0F98 DE 04      SBI  4               MAKE CORRECTION TO BITNO
                MOVB02;            ENDIF
0F9A E6 07      ANI  07H           A = BITNUM, WITHIN BYTE
0F9C 16 00      MVI  D,0           DE = ((BITNO/4)+NIBOFS)/2
0F9E 21 00 74   LXI  H,X           HL = BYTADR
0FA1 19         DAD  D
0FA2 E5         PUSH H             SAVE BYTADR
0FA3 5F         MOV  E,A           DE = BITNUM
0FA4 21 AB 0F   LXI  H,MOVB03      HL = ADDRESS, MASK
0FA7 19         DAD  D
0FA8 7E         MOV  A,M           A = MASK
0FA9 E1         POP  H             HL = BYTADR
0FAA C9         RET                RETURN
                ;
                MOVB03;            MASK TABLE
0FAB 80         DB   80H           0 BIT MASK; HIGH ORDER
0FAC 40         DB   40H           1
0FAD 20         DB   20H           2
0FAE 10         DB   10H           3
0FAF 08         DB   08H           4
0FB0 04         DB   04H           5
0FB1 02         DB   02H           6
0FB2 01         DB   01H           7 BIT MASK; LOW ORDER
                ;MVLNIB(DEST  ,SOURCE,NIBCNT,NONBCD,ZERO  )
                ;      (NIBSTR,NIBSTR,BYTE  ,BIT   ,BIT   )
                ;      ( 0    , I    , I    , 0    , 0    )
                ;      ( @C   , @B   , A    ,PSW:S ,PSW:Z )
                ;      ( C    , NC   , NC   , C    , C    )
                ;
                ;PSW:CY = NO CHANGE
                ;PSW:S, Z, P CHANGED
                ;
                ;FOR A STRING ADDRESSED AT THE LEFT SIDE,
                ;FROM RIGHT TO LEFT MOVE NIBCNT NIBBLES FROM SOURCE TO
                ;DEST.  THE NONBCD AND ZERO FLAGS REFER TO THE LARGEST
                ;NIBBLE VALUE MOVED.
                ;DEST[0..NIBCNT-1] = SOURCE[0..NIBCNT-1]
                ;
                MVLNIB;            ****ENTRY POINT
0FB3 C5         PUSH B             SAVE  BC
                MVLN01;            ****SPECIAL JUMP ENTRY
0FB4 F5         PUSH PSW           SAVE A, PSW
0FB5 D5         PUSH D             SAVE DE
0FB6 3D         DCR  A             D = NIBCNT-1
0FB7 57         MOV  D,A
0FB8 80         ADD  B             B = OFFSET, SOURCE[N=NIBCNT-1]
0FB9 47         MOV  B,A
0FBA 7A         MOV  A,D           A = NIBCNT-1
0FBB 81         ADD  C             C = OFFSET, DEST[N=NIBCNT-1]
0FBC 4F         MOV  C,A
0FBD D1         POP  D             RESTORE DE
0FBE F1         POP  PSW           RESTORE A, PSW
0FBF C3 C3 0F   JMP  MVRN01        MVRNIB(DEST[N],SOURCE[N],NIBCNT,
                ;                        ( @C    , @B      , A    ,
                ;                        ( 0     , I       , I    ,
                ;
                ;                        NONBCD,ZERO )
                ;                        PSW:S ,PSW:Z)
                ;                         0    , 0   )
                ;                  RESTORE BC
                ;                  RETURN
                ;MVRNIB(DEST  ,SOURCE,NIBCNT,NONBCD,ZERO )
                ;      (NIBSTR,NIBSTR,BYTE  ,BIT   ,BIT  )
                ;      ( 0    , I    , I    , 0    , 0   )
                ;      ( @C   , @B   , A    ,PSW:S ,PSW:Z)
                ;      ( C    , NC   , NC   , C    , C   )
                ;
                ;PSW:CY = NO CHANGE
                ;PSW:S, Z, P CHANGED
                ;
```

```
5793                ;FOR A STRING ADDRESSED AT THE RIGHT SIDE,
5794                ;FROM RIGHT TO LEFT MOVE NIBCNT NIBBLES FROM SOURCE TO
5795                ;DEST.  THE NONBCD AND ZERO FLAGS REFER TO THE LARGEST
5796                ;NIBBLE VALUE MOVED.
5797                ;DEST[1-NIBCNT..0] = SOURCE[1-NIBCNT..0]
5798                ;
5799                MVRNIB;             ****ENTRY POINT
5800 0FC2 C5          PUSH B            SAVE BC
5801                MVRN01;             ****SPECIAL JUMP ENTRY
5802 0FC3 F5          PUSH PSW          SAVE A, PSW
5803 0FC4 E5          PUSH H            SAVE HL
5804 0FC5 67          MOV  H,A          H = NIBCNT
5805                ;                   B = OFFSET, SOURCE[N=0]
5806                ;                   C = OFFSET, DEST[N=0]
5807                ;                   SET FLAGS FOR RETURN IF NIBCNT .LE. 0
5808 0FC6 2E 00       MVI  L,0          L = FLAGV = 0; WHICH WILL PRODUCE:
5809                ;                   PSW:Z = ZERO = TRUE
5810                ;                   PSW:S = NONBCD = FALSE
5811                ;                   MOVE NIBCNT NIBBLES
5812                MVRN02;             DO WHILE NIBCNT .GT. 0
5813 0FC8 25          DCR  H              H = NIBCNT-1
5814 0FC9 FA E7 0F    JM   MVRN06
5815                ;                     MOVE ONE NIBBLE
5816 0FCC CD 35 0F    CALL GETNIB         GETNIB(NIBVAL,ZERO ,SOURCE[N])
5817                ;                           ( A    ,PSW:Z, @B      )
5818                ;                           ( D    , D   , I       )
5819 0FCF CD EE 0F    CALL PUTNIB         PUTNIB(DEST[N],NIBVAL)
5820                ;                           ( @C    , A    )
5821                ;                           ( D     , I    )
5822                ;                     CHECK FOR NONZERO NIBBLE
5823 0FD2 CA DB 0F    JZ   MVRN04         IF ZERO .EQ. FALSE
5824                ;                       CHECK FOR NO PREVIOUS FLAGS
5825 0FD5 2C          INR  L                IF FLAGV .EQ. 0
5826 0FD6 2D          DCR  L
5827 0FD7 C2 DB 0F    JNZ  MVRN03
5828 0FDA 2C          INR  L                  L = FLAGV = 1
5829                ;                         WHICH WILL PRODUCE:
5830                ;                         PSW:Z = ZERO = FALSE
5831                ;                         PSW:S = NONBCD = FALSE
5832                MVRN03;                 ENDIF
5833                MVRN04;               ENDIF
5834                ;                     CHECK FOR NONBCD NIBBLE
5835 0FDB FE 0A       CPI  10             IF NIBVAL .GE. 10
5836 0FDD DA E2 0F    JC   MVRN05
5837 0FE0 2E 80       MVI  L,80H            L = FLAGV = HEX80
5838                ;                       WHICH WILL PRODUCE:
5839                ;                       PSW:Z = ZERO = FALSE
5840                ;                       PSW:S = NONBCD = TRUE
5841                MVRN05;               ENDIF
5842                ;                     MOVE INDICES FROM RIGHT TO LEFT
5843 0FE2 05          DCR  B              B = OFFSET, SOURCE[N=N-1]
5844 0FE3 0D          DCR  C              C = OFFSET.DEST[N=N-1]
5845                ;                     H = NIBCNT = NIBCNT-1
5846 0FE4 C3 C8 0F    JMP  MVRN02
5847                MVRN06;             ENDDO
5848 0FE7 4D          MOV  C,L          C = FLAGV
5849 0FE8 E1          POP  H            RESTORE HL
5850 0FE9 F1          POP  PSW          RESTORE A, PSW:CY
5851 0FEA 0C          INR  C            PSW = STATUS, FLAGV
5852 0FEB 0D          DCR  C
5853 0FEC C1          POP  B            RESTORE BC
5854 0FED C9          RET               RETURN
5857                ;PUTNIB(DEST ,NIBVAL)
5858                ;      (NIBBLE,BYTE  )
5859                ;      ( D    , I    )
5860                ;      ( @C   , A    )
5861                ;      ( C    , NC   )
5862                ;
5863                ;PSW:S, Z, P, CY = NO CHANGE
5864                ;
5865                ;INSERT LOW ORDER 4 BITS OF NIBVAL INTO DEST
5866                ;DEST = NIBVAL .AND. HEX0F
```

```
                ;
                PUTNIB;             ****ENTRY POINT
0FEE E5           PUSH H            SAVE HL
0FEF C5           PUSH B            SAVE BC
0FF0 F5           PUSH PSW          SAVE A, PSW
                ;                   CLEAR H/O NIBBLE OF NIBVAL
0FF1 E6 0F        ANI  0FH          B = NIBVAL = NIBVAL .AND. HEX0F
0FF3 47           MOV  B,A
                ;                   FLAG WHETHER NIBBLE GOES INTO L/O
                ;                   OF BYTE CONTAINING DEST
0FF4 AF           XRA  A            PSW:CY = OFFSET, DEST .MOD. 2
0FF5 79           MOV  A,C
0FF6 1F           RAR
                ;                   A = (OFFSET, DEST)/2
0FF7 26 74        MVI  H,X/100H     HL = ADDRESS, DEST
0FF9 6F           MOV  L,A
                ;                   MAKE MASK TO CLEAR L/O OF BYTE
0FFA 0E F0        MVI  C,0F0H       C = MASK = HEXF0
                ;                   CHECK WHETHER NIBBLE GOES IN H/O
0FFC DA 07 10     JC   PUTN01       IF PSW:CY .EQ. 0
                ;                     MAKE MASK TO CLEAR H/O OF BYTE
0FFF 0E 0F        MVI  C,0FH          C = MASK = HEX0F
                ;                     SHIFT L/O NIBBLE OF NIBVAL TO H/O
1001 78           MOV  A,B            B = NIBVAL = NIBVAL * HEX10
1002 07           RLC
1003 07           RLC
1004 07           RLC
1005 07           RLC
1006 47           MOV  B,A
                PUTN01;             ENDIF
                ;                   FETCH BYTE CONTAINING DEST
1007 7E           MOV  A,M          A = DEST
                ;                   MAKE HOLE IN BYTE FOR NIBBLE
1008 A1           ANA  C            A = DEST = 0
                ;                   PUT NIBBLE IN HOLE
1009 B0           ORA  B            DEST = NIBVAL
100A 77           MOV  M,A
100B F1           POP  PSW          RESTORE A, PSW
100C C1           POP  B            RESTORE BC
100D E1           POP  H            RESTORE HL
100E C9           RET               RETURN
                ;RSCAN(SOURCE,NIBCNT,NONBCD,ZERO  )
                ;     (NIBSTR,BYTE  ,BIT   ,BIT   )
                ;     ( I    , I    , 0    , 0    )
                ;     ( @B   , A    ,PSW:S ,PSW:Z )
                ;     ( NC   , NC   , C    , C    )
                ;
                ;PSW:CY= NO CHANGE
                ;PSW:S, Z, P CHANGED
                ;
                ;FOR A STRING ADDRESSED AT THE RIGHT SIDE,
                ;FROM RIGHT TO LEFT SCAN NIBCNT NIBBLES.
                ;THE NONBCD AND ZERO FLAGS REFER TO THE LARGEST
                ;NIBBLE SCANNED.
                ;SCAN SOURCE[1-NIBCNT..0]
                ;
                RSCAN;              ****ENTRY POINT
100F C5           PUSH B            SAVE BC
                ;                   SCAN BY MOVING SOURCE INTO ITSELF
1010 48           MOV  C,B          C = OFFSET, SOURCE
1011 C3 C3 0F     JMP  MVRN01       MVRNIB(SOURCE,SOURCE,NIBCNT,
                ;                         ( @C   , @B   , A    ,
                ;                         ( 0    , I    , I    ,
                ;
                ;                         NONBCD,ZERO  )
                ;                         PSW:S ,PSW:Z )
                ;                          0    , 0    )
                ;                   RESTORE BC
                ;                   RETURN
                ;TDBITM(SOURCE,BITCNT,DEST  ,DBIT  ,SBIT  )
                ;     (BITSTR,UBYTE ,BITSTR,UBYTE ,BYTSTR)
                ;     ( I    , I    , 0    , I    , I    )
                ;     ( @H   , L    , @D   , E    , @BC  )
```

```
                ;      ( NC   , C    , C    , C    , NC   )
                ;
                ;REGISTERS DESTROYED
                ;PSW DESTROYED
                ;
                ;TABLE DRIVEN BIT MOVE ROUTINE.
                ;MOVES BITCNT BITS INTO DEST STARTING AT DEST.DBIT;
                ;THE SOURCE BITS ARE SOURCE.SBIT[0] THROUGH
                ;SOURCE.SBIT[BITCNT-1]
                ;
                TDBITM;                 ****ENTRY POINT
1014 7D           MOV  A,L              A = BITCNT = BITCNT+1
1015 3C           INR  A
                ;                       BC = ADDRESS, SBIT[N=0]
                TDBIT1;                 DO WHILE BITCNT .NE. 0
1016 3D           DCR  A                  A =  BITCNT = BITCNT-1
1017 C8           RZ
1018 F5           PUSH PSW                SAVE A, PSW
1019 0A           LDAX B                  L = SBIT[N]
101A 6F           MOV  L,A
                ;                         MOVE BIT
101B CD 68 0F     CALL MOVBIT             MOVBIT(SOURCE,SBIT[N],DEST,DBIT,VALUE)
                ;                               ( @H   , L    , @D , E  ,PSW:Z)
                ;                               ( I    , I    , O  , I  , O   )
101E F1           POP  PSW                A = BITCNT
101F 03           INX B                   BC = ADDRESS, SBIT[N=N+1]
1020 1C           INR  E                  E = DBIT = DBIT+1
1021 C3 16 10     JMP  TDBIT1
                ;                       ENDDO
                ;                       RETURN
                ;VCALL(RTNADR)
                ;     (ADDR  )
                ;     ( I    )
                ;     ( HL   )
                ;
                ;REGISTER AND STATUS CHANGES DEPEND ON ROUTINE @HL
                ;
                ;VECTOR CALL TO ROUTINE WHOSE ADDRESS IS IN HL
                ;
                VCALL;                  ****ENTRY POINT
1024 E9           PCHL                  GO TO ROUTINE @HL
                ;                       RETURN VIA RTS IN THAT ROUTINE
                ;VCALLS(RTNADR)
                ;      (ADDR  )
                ;      ( I    )
                ;      ( HL   )
                ;      ( NC   )
                ;
                ;PSW:S, Z, P, CY = NO CHANGE
                ;
                ;VECTOR CALL TO ROUTINE @HL
                ;
                VCALLS;                 ****ENTRY POINT
1025 C5           PUSH B                SAVE ALL REGISTERS
1026 D5           PUSH D
1027 E5           PUSH H
1028 F5           PUSH PSW
                ;                       VECTOR CALL TO ROUTINE @HL
1029 CD 24 10     CALL VCALL            VCALL(RTNADR)
                ;                            ( HL   )
                ;                            ( I    )
                ;                       RESTORE ALL REGISTERS
102C F1           POP  PSW
102D E1           POP  H
102E D1           POP  D
102F C1           POP  B
1030 C9           RET
                ;NVM30F()(PORTA )
                ;        (BITSTR)
                ;        ( I/O  )
                ;        ( 7001 )
                ;        ( C    )
```

```
6022                ;
6023                ;REGISTERS NOT CHANGED
6024                ;PSW NOT CHANGED
6025                ;
6026                ;REMOVE 30 VOLTS FROM NONVOLATILE MEMORY TO DISABLE
6027                ;WRITING AND ERASING.
6028                ;
6029                NVM30F;                 ****ENTRY POINT
6030 1031 F5          PUSH PSW              SAVE A,PSW
6031 1032 C5          PUSH B                SAVE BC
6032                ;                       REMOVE 30 VOLTS FROM NVM
6033 1033 3A 01 70    LDA  PORTA            PORTA = PORTA .OR. HEX40
6034 1036 F6 40       ORI  40H
6035 1038 32 01 70    STA  PORTA
6036                ;                       PAUSE FOR 10 MSEC TO ALLOW NVM
6037                ;                       VOLTAGE TO TRANSITION FROM
6038                ;                       -30 TO +5
6039 103B 01 64 00    LXI  B,100            BC = LOOPCT = 100
6040                NVM30G;                 DO UNTIL LOOPCT .EQ. 0
6041 103E CD 19 0B    CALL NPAUSE             NPAUSE(LOOPCT,ZROFLG)
6042                ;                               ( BC   ,PSW:Z )
6043                ;                               ( I/O  , 0    )
6044 1041 C2 3E 10    JNZ  NVM30G
6045                ;                       ENDDO
6046 1044 C1          POP  B                RESTORE BC
6047 1045 F1          POP  PSW              RESTORE A,PSW
6048 1046 C9          RET                   RETURN
6051                ;NVM30T()(PORTA )
6052                ;        (BITSTR)
6053                ;        ( I/O  )
6054                ;        ( 7001 )
6055                ;        ( C    )
6056                ;
6057                ;REGISTERS NOT CHANGED
6058                ;PSW NOT CHANGED
6059                ;
6060                ;APPLY 30 VOLTS TO NONVOLATILE MEMORY TO ENABLE
6061                ;WRITING AND ERASING.
6062                ;
6063                NVM30T;                 ****ENTRY POINT
6064 1047 F5          PUSH PSW              SAVE A,PSW
6065                ;                       SUPPLY 30 VOLTS TO NVM
6066 1048 3A 01 70    LDA  PORTA            PORTA = PORTA .AND. HEXBF
6067 104B E6 BF       ANI  0BFH
6068 104D 32 01 70    STA  PORTA
6069                ;                       DELAY ABOUT 100 USEC BEFORE RETURNING
6070 1050 3E 0B       MVI  A,11
6071 1052 3D          DCR  A
6072 1053 C2 52 10    JNZ  $-1
6073 1056 F1          POP  PSW              RESTORE A,PSW
6074 1057 C9          RET                   RETURN
6077                ;NVMBYT(ADRESS,NVMRED[J],BYTE)
6078                ;      (ADRESS,NIBSTR   ,BYTE)
6079                ;      ( I/O  , I       , 0  )
6080                ;      ( HL   , @HL     , A  )
6081                ;      ( C    , NC      , C  )
6082                ;
6083                ;PSW DESTROYED
6084                ;REGISTERS NOT CHANGED
6085                ;
6086                ;ASSEMBLE 2 NIBBLES FROM NVM INTO A SINGLE BYTE
6087                ;
6088                NVMBYT;                 ****ENTRY POINT
6089 1058 C5          PUSH B                SAVE BC
6090 1059 7E          MOV  A,M              B = HINIB = NVMRED[J]*HEX10
6091 105A 87          ADD  A
6092 105B 87          ADD  A
6093 105C 87          ADD  A
6094 105D 87          ADD  A
6095 105E 47          MOV  B,A
6096                ;                       POINT AT NEXT NIBBLE
6097 105F CD BB 11    CALL NVMNXT           NVMNXT(ADRESS,NVMRED[J=J+?])
6098                ;                             ( HL   , @HL         )
```

```
6099                ;                                  ( I/O  , -          )
6100 1062 7E          MOV  A,M            A = LOWNIB = NVMRED[J] .AND. HEXOF
6101 1063 E6 0F       ANI  0FH
6102 1065 B0          ORA  B              A = BYTE = LOWNIB .OR. HINIB
6103 1066 C1          POP  B              RESTORE BC
6104 1067 C9          RET                 RETURN
6107                ;NVMCHG()(NVMCTL)
6108                ;        (NIBSTR)
6109                ;        ( I    )
6110                ;        ( RAM  )
6111                ;        ( NC   )
6112                ;
6113                ;A,PSW DESTROYED
6114                ;REGISTERS DESTROYED
6115                ;
6116                ;PROVIDES NVM NORMAL BLOCK IF METER IN NORMAL MODE.
6117                ;PROVIDES NVM SERVICE BLOCK IF METER NOT IN NORMAL MODE.
6118                ;
6119                ;NVMCTL[0] = F IF NO BLOCK IS OPEN
6120                ;          = 0 IF NORMAL BLOCK IS OPEN
6121                ;          = 1 IF SERVICE BLOCK IS OPEN
6122                ;NVMCTL[1] = NUMBER OF OPEN BLOCK
6123                ;
6124                NVMCHG;               ****ENTRY POINT
6125                ;                     FETCH BLOCK TYPE
6126 1068 06 66       MVI  B,NVMCTL       B = OFFSET, NVMCTL[0]
6127 106A CD 35 0F    CALL GETNIB         GETNIB(BLKTYP,ZROFLG,NVMCTL[0])
6128                ;                           ( A    ,PSW:Z , @B      )
6129                ;                           ( 0    , 0    , I       )
6130 106D FE 02       CPI  2              IF BLKTYP .LT. 2
6131 106F D0          RNC
6132                ;                       A BLOCK IS OPEN
6133                ;                       DETERMINE METER STATUS
6134 1070 CD 4E 0F    CALL LSTATE           LSTATE(FATMOD,NORMOD,SERMOD,PRVMOD)
6135                ;                             (PSW:S ,PSW:Z ,PSW:P ,PSW:C )
6136                ;                             ( 0    , 0    , 0    , 0    )
6137 1073 CA 77 10    JZ   NVMCH1           IF NORMOD .EQ. FALSE
6138                ;                         A SERVICE BLOCK IS REQUIRED
6139 1076 3D          DCR  A                  A = DIFRNC = BLKTYP-(SRVTYP=1)
6140                NVMCH1;                 ELSE
6141                ;                         A NORMAL BLOCK IS REQUIRED
6142                ;                         A = DIFRNC = BLKTYP-(NORMDR=0)
6143                ;                       ENDIF
6144 1077 B7          ORA  A                IF DIFRNC .NE. 0
6145 1078 C8          RZ
6146                ;                         CURRENT BLOCK NOT REQUIRED
6147 1079 CD DE 0E    CALL DBLANK             STOP CLOCK. BLANK DISPLAY
6148                ;                         CLOSE CURRENT BLOCK
6149 107C F3          DI                      DISABLE INTERRUPTS
6150 107D CD 9E 12    CALL NVMWR              NVMWR(ERRFLG)
6151                ;                                (PSW:Z )
6152                ;                                ( 0    )
6153 1080 FB          EI                      ENABLE INTERRUPTS
6154                ;                         IF ERRFLG .EQ. FALSE
6155                ;                           OPEN REQUIRED BLOCK
6156 1081 C2 C4 11    JNZ  NVMOPN               NVMOPN(ERRFLG)
6157                ;                                      (PSW:Z )
6158                ;                                      ( 0    )
6159                ;                         ENDIF
6160                ;                       ENDIF
6161                ;                     ENDIF
6162 1084 C9          RET                 RETURN
6165                ;NVMDED(CODE,ERRFLG)(SERFLG,NVMRED)
6166                ;      (BYTE,BIT   )(BIT   ,NIBSTR)
6167                ;      ( I  , 0    )( 0    , I    )
6168                ;      ( A  ,PSW:Z )( RAM  , NVM  )
6169                ;      ( C  , C    )( C    , NC   )
6170                ;
6171                ;A,PSW DESTROYED
6172                ;REGISTERS DESTROYED
6173                ;
6174                ;FLAG METER DEAD AND INDICATE ERROR
6175                ;
```

```
6176                NVMDED;                 ****ENTRY POINT
6177 1085 47          MOV  B,A              B = CODE
6178                ;                       TEST SPECIAL NVM LOCATION
6179 1086 3A BE 46    LDA  NVMRED+KILCOD    IF NVMRED[KILCOD] .EQ. HEX0F
6180 1089 3C          INR  A
6181 108A E6 0F       ANI  0FH
6182 108C C2 A0 10    JNZ NVMDE2
6183                ;                         LOCATION STILL CLEAR
6184                ;                         WRITE ERROR CODE TO LOCATION
6185 108F 78          MOV  A,B                A[1] = CODE
6186 1090 21 BE 02    LXI  H,KILCOD           H = BASE = KILCOD
6187 1093 CD 47 10    CALL NVM30T             TURN ON -30 V TO NVM
6188 1096 CD 61 12    CALL NVMWN              NVMWN(CODE,BASE,ERRFLG)
6189                ;                              (A[1], HL ,PSW:Z )
6190                ;                              ( I  , I  , 0    )
6191                NVMDE1;                   ****ENTRY POINT
6192                ;                             NVMDE1(CODE,ERRFLG)
6193                ;                                   ( B  ,PSW:Z )
6194                ;                                   ( I  , 0    )
6195                ;                         FLAG METER DEAD
6196 1099 21 10 74    LXI  H,SERFLG/2+X       HL = ADDRESS, SERFLG
6197 109C 7E          MOV  A,M                SERFLG.DEAD = TRUE
6198 109D F6 80       ORI  80H
6199 109F 77          MOV  M,A
6200                NVMDE2;                 ENDIF
6201 10A0 CD 31 10    CALL NVM30F             TURN OFF -30 V TO NVM
6202                ;                         DECLARE FATAL ERROR
6203 10A3 78          MOV  A,B                A = DEDCOD = HEX20+CODE
6204 10A4 F6 20       ORI  20H
6205 10A6 C3 80 08    JMP  FATERR             FATERR(DEDCOD,ERRFLG)
6206                ;                               ( A    ,PSW:Z )
6207                ;                               ( I    , 0    )
6208                ;                         RETURN
6211                ;NVMDXB(ERRFLG,BLKCTL)
6212                ;      (BIT   ,NIBSTR)
6213                ;      ( 0    , I    )
6214                ;      (PSW:Z , B    )
6215                ;      ( C    , NC   )
6216                ;
6217                ;A,PSW DESTROYED
6218                ;REGISTERS DESTROYED
6219                ;
6220                ;DEACTIVATES NVM BLOCK
6221                ;
6222                NVMDXB;                 ****ENTRY POINT
6223                ;                       MOVE NVM CONTROL BYTE TO ACCUMULATOR
6224 10A9 78          MOV  A,B                A = BLKCTL
6225                ;                       FORM BASE VALUE FOR BLOCK
6226 10AA CD 91 11    CALL NVMMAP             NVMMAP(BLKCTL,BASE,BLKTYP)
6227                ;                               ( A    , HL , A[1] )
6228                ;                               ( I    , 0  , 0    )
6229                ;                       WRITE NUL HEADER TO DEACTIVATE BLOCK
6230 10AD AF          XRA  A                  A[1] = NULHDR = 0
6231 10AE C3 61 12    JMP  NVMWN              NVMWN(NULHDR,BASE,ERRFLG)
6232                ;                            ( A[1] , HL ,PSW:Z )
6233                ;                            ( I    , I  , 0    )
6234                ;                       RETURN
6237                ;NVMER(ERRFLG)(NVMCTL,NVMERS,NVMRED,SERFLG)
6238                ;     (BIT   )(NIBSTR,NIBSTR,NIBSTR,BITSTR)
6239                ;     ( 0    )( I    , 0    , I    , I    )
6240                ;     (PSW:Z )( RAM  , NVM  , NVM  , RAM  )
6241                ;     ( C    )( NC   , C    , NC   , C    )
6242                ;
6243                ;A,PSW DESTROYED
6244                ;REGISTERS DESTROYED
6245                ;
6246                ;ERASE A BLOCK OF NONVOLATILE MEMORY
6247                ;
6248                NVMER;                  ****ENTRY POINT
6249                ;                       GET CONTROL BYTE TO ERASE NEXT BLOCK
6250 10B1 CD 9F 11    CALL NVMNBK             NVMNBK(ERRFLG,OLDCTL,NXTCTL,
6251                ;                              (PSW:Z , B    , C    ,
```

```
6252                ;                          ( 0    , 0    , 0    ,
6253                ;
6254                ;                          ADRESS,NVMCTL)
6255                ;                           HL    , @HL   )
6256                ;                           0     , -     )
6257 10B4 C8          RZ                   IF ERRFLG .EQ. FALSE
6258                ;                        SET TO CHECK AND ERASE NEXT BLOCK
6259 10B5 79          MOV  A,C               NVMCTL = NXTCTL .OR. HEXF0
6260 10B6 F6 F0       ORI  0F0H
6261 10B8 77          MOV  M,A
6262                ;                        FETCH BLOCK LENGTH
6263 10B9 CD DF 11    CALL NVMPRP            NVMPRP(NIBCNT,OFFSET,RAM[I])
6264                ;                              ( B    , C    , @C   )
6265                ;                              ( 0    , 0    , -    )
6266 10BC C5          PUSH B                 SAVE BC
6267                ;                        FETCH BASE ADDRESS OF CURRENT BLOCK
6268 10BD 7E          MOV  A,M               A = NVMCTL
6269 10BE CD 91 11    CALL NVMMAP            NVMMAP(NVMCTL,BASE,BLKTYP)
6270                ;                              ( A    , HL , A[1] )
6271                ;                              ( I    , 0  , 0    )
6272 10C1 E5          PUSH H                 SAVE HL
6273                ;                        FORM NVM READ ADDRESS
6274 10C2 11 00 44    LXI  D,NVMRED          HL = ADDRESS, NVMRED[J=BASE]
6275 10C5 19          DAD  D
6276 10C6 E5          PUSH H                 SAVE HL
6277                ;                        INITIALIZE CRC VALUE
6278 10C7 16 FF       MVI  D,0FFH            D = CRCVAL = HEXFF
6279                ;                        CHECK BLOCK HEADER
6280 10C9 7E          MOV  A,M               A = BLKHDR[0] = NVMRED[J]
6281 10CA E6 0F       ANI  0FH               IF BLKHDR[0] .EQ. 0
6282 10CC C2 EB 10    JNZ  NVMER4
6283                ;                          BLOCK IS INACTIVE AND NOT ERASED
6284                ;                          POINT AT START OF BLOCK'S DATA
6285 10CF 23          INX  H                   HL = ADDRESS, NVMRED[J=J+2]
6286 10D0 23          INX  H
6287                ;                          CHECK BLOCK CHECKSUM
6288                NVMER1;                    LOOP - WITH 1 BREAK
6289 10D1 05          DCR  B                       B = NIBCNT = NIBCNT-1
6290 10D2 FA DF 10    JM   NVMER2                  IF NIBCNT .LT. 0
6291                ;                                BREAK
6292                ;                              ENDIF
6293                ;                              DEVELOP CRC
6294 10D5 7E          MOV  A,M                     A = DATA = NVMRED[J]
6295 10D6 CD C6 0E    CALL CRCNIB                  CRCNIB(DATA,CRCVAL)
6296                ;                                    ( A  , D    )
6297                ;                                    ( I  , 0    )
6298                ;                              POINT AT NEXT DATA
6299 10D9 CD BB 11    CALL NVMNXT                  NVMNXT(ADRESS,NVMRED[J=J+?])
6300                ;                                    ( HL   , @HL        )
6301                ;                                    ( I/O  , -          )
6302 10DC C3 D1 10    JMP  NVMER1
6303                NVMER2;                    ENDLOOP
6304                ;                          FETCH CRC FROM NVM
6305 10DF CD 58 10    CALL NVMBYT                NVMBYT(ADRESS,NVMRED[J],NVMCRC)
6306                ;                                ( HL   , @HL     , A    )
6307                ;                                ( I/O  , I       , 0    )
6308 10E2 BA          CMP  D                   IF NVMCRC .NE. CRCVAL
6309 10E3 CA EB 10    JZ   NVMER3
6310                ;                              DECLARE DEAD METER. WEAK NVM
6311 10E6 3E 02       MVI  A,NVMRET                A = NVMRET
6312 10E8 CD 85 10    CALL NVMDED                  NVMDED(NVMRET,ERRFLG)
6313                ;                                    ( A    ,PSW:Z )
6314                ;                                    ( I    , 0    )
6315                NVMER3;                      ENDIF
6316                NVMER4;                    ENDIF
6317 10EB D1          POP  D                   DE = ADDRESS, NVMRED[J=BASE]
6318 10EC E1          POP  H                   HL = BASE
6319 10ED 01 00 40    LXI  B,NVMERS            HL = ADDRESS, NVMERS[I=BASE]
6320 10F0 09          DAD  B
6321 10F1 F1          POP  PSW                 B = NIBCNT = NIBCNT+4
6322 10F2 C6 04       ADI  4
6323 10F4 47          MOV  B,A
```

```
10F5 3A 10 74   LDA  SERFLG/2+X      IF SERFLG.DEAD .EQ. TRUE
10F8 B7         ORA  A
10F9 F2 FE 10   JP   NVMER5
10FC AF         XRA  A                 PSW:Z = ERRFLG = TRUE
10FD C9         RET
                NVMER5;                ELSE
10FE CD 47 10   CALL NVM30T              SUPPLY 30 VOLTS TO NVM
                NVMER6;                  LOOP - WITH 2 BREAKS
1101 05         DCR  B                     B = NIBCNT = NIBCNT-1
                ;                          IF NIBCNT .LT. 0
                ;                            PSW:Z = ERRFLG = FALSE
1102 FA 31 10   JM  NVM30F                   REMOVE 30 VOLTS FROM NVM
                ;                            BREAK
                ;                          ENDIF
1105 F3         DI                         DISABLE INTERRUPTS
                ;                          START ERASE FUNCTION
1106 77         MOV  M,A                   NVMERS[J] = DUMMY
                ;                          PAUSE FOR 10 MSEC
1107 C5         PUSH B                     SAVE BC
1108 01 64 00   LXI  B,100                 BC = LOOPCT = 100
                NVMER7;                    DO UNTIL LOOPCT .EQ. 0
110B CD 19 0B   CALL NPAUSE                  NPAUSE(LOOPCT,ZROFLG)
                ;                                  ( BC   ,PSW:Z )
                ;                                  ( I/O  , O    )
110E C2 0B 11   JNZ  NVMER7
                ;                          ENDDO
1111 C1         POP  B                     RESTORE BC
                ;                          STOP ERASE FUNCTION
1112 1A         LDAX D                     A = GARBAGE = NVMRED[J]
1113 7B         MOV  A,E                   A=(ADDRESS,NVMRED[J]).AND.HEX3F
1114 E6 3F      ANI  3FH
1116 CA 1A 11   JZ   NVMER8                IF A .EQ. 0
                ;                            HEADER[0] NOT JUST ERASED
1119 FB         EI                           ENABLE INTERRUPTS
                NVMER8;                    ENDIF
                ;                          ADVANCE ERASE ADDRESS
111A CD BB 11   CALL NVMNXT                NVMNXT(ADRESS,NVMERS[I=I+?])
                ;                                ( HL   , @HL         )
                ;                                ( I/O  , -           )
                ;                          READ ERASED NIBBLE
111D 1A         LDAX D                     C = DATA = NVMRED[J] .AND. HEXF0
111E F6 F0      ORI  0F0H
1120 4F         MOV  C,A
                ;                          ADVANCE READ ADDRESS
1121 EB         XCHG
1122 CD BB 11   CALL NVMNXT                NVMNXT(ADRESS,NVMRED[J=J+?])
                ;                                ( HL   , @HL         )
                ;                                ( I/O  , -           )
1125 EB         XCHG
                ;                          CHECK FOR PROPER ERASURE
1126 0C         INR  C                     IF DATA+1 .NE. 0
1127 CA 01 11   JZ   NVMER6
                ;                            BAD ERASURE
                ;                            DECLARE DEAD METER. BAD NVM
112A 3E 01      MVI  A,NVMBAD              A = NVMBAD
112C C3 85 10   JMP  NVMDED                NVMDED(NVMBAD,ERRFLG)
                ;                                ( A    ,PSW:Z )
                ;                                ( I    , O    )
                ;                            BREAK
                ;                          ENDIF
                ;                        ENDLOOP
                ;                      ENDIF
                ;                    ENDIF
                ;                    RETURN
                ;NVMFND(ERRFLG)(NVMCTL,NVMRED)
                ;      (BIT   )(NIBSTR,NIBSTR)
                ;      ( O    )( I/O  , I    )
                ;      (PSW:Z )( RAM  , NVM  )
                ;      ( C    )( C    , NC   )
                ;
                ;A,PSW DESTROYED
                ;REGISTERS DESTROYED
```

```
6398                ;
6399                ;FIND CURRENT BLOCK CORRESPONDING TO METER MODE
6400                ;
6401                NVMFND;                 ****ENTRY POINT
6402 112F 11 33 74    LXI  D,NVMCTL/2+X     DE = ADDRESS, NVMCTL[0..1]
6403 1132 1A          LDAX D                PSW:CY = OPEN = NVMCTL[0] .LT. 2
6404 1133 FE 20       CPI  20H
6405 1135 3E 02       MVI  A,SFTWRE         A = SFTWRE
6406                ;                       IF OPEN .EQ. TRUE
6407                ;                         LOOKING FOR BLOCK IS INAPPROPRIATE
6408                ;                         DECLARE DEAD METER. SOFTWARE ERROR
6409 1137 DA 85 10    JC   NVMDED             NVMDED(SFTWRE,ERRFLG)
6410                ;                                ( A    ,PSW:Z )
6411                ;                                ( I    , 0    )
6412                ;                       ELSE
6413                ;                         SET TO LOCATE ACTIVE SERVICE HEADER
6414 113A 06 F1       MVI  B,0F1H             B = TEST = HEXF1
6415                ;                         SET TO INCREMENT TO BLOCK 0
6416 113C 1A          LDAX D                  NVMCTL[1] = HEX0F
6417 113D F6 0F       ORI  0FH
6418 113F 12          STAX D
6419                ;                         THERE ARE 2 SERVICE BLOCKS
6420 1140 0E 02       MVI  C,2                C = BLKCTR = 2
6421                ;                         DETERMINE METER MODE
6422 1142 CD 4E 0F    CALL LSTATE             LSTATE(FATMOD,NORMOD,SERMOD,PRVMOD)
6423                ;                                (PSW:S ,PSW:Z ,PSW:P ,PSW:C )
6424                ;                                ( 0    , 0    , 0    , 0    )
6425 1145 C2 4E 11    JNZ  NVMFN1             IF NORMOD .EQ. TRUE
6426                ;                           SET TO INCREMENT TO BLOCK 2
6427 1148 1A          LDAX D                    NVMCTL[1] = HEX01
6428 1149 A0          ANA  B
6429 114A 12          STAX D
6430                ;                           SET TO LOCATE ACTIVE NORMAL HEADER
6431 114B 05          DCR  B                    B = TEST = HEXF0
6432                ;                           THERE ARE 14 NORMAL BLOCKS
6433 114C 0E 0E       MVI  C,14                 C = BLKCTR = 14
6434                NVMFN1;                 ENDIF
6435                NVMFN2;                 LOOP - WITH 2 BREAKS
6436                ;                           INCREMENT BLOCK NUMBER
6437 114E 1A          LDAX D                    NVMCTL[1] = NVMCTL[1]+1
6438 114F 3C          INR  A
6439 1150 F6 F0       ORI  0F0H
6440 1152 12          STAX D
6441                ;                           FETCH CORRESPONDING BASE ADDRESS
6442 1153 CD 91 11    CALL NVMMAP               NVMMAP(NVMCTL,BASE,BLKTYP)
6443                ;                                ( A    , HL , A[1] )
6444                ;                                ( I    , O  , O    )
6445                ;                           CONVERT TO READ ADDRESS
6446 1156 C5          PUSH B                    SAVE BC
6447 1157 01 00 44    LXI  B,NVMRED             HL = ADDRESS, NVMRED[J=BASE]
6448 115A 09          DAD  B
6449 115B C1          POP  B                    RESTORE BC
6450 115C 0D          DCR  C                    C = BLKCTR = BLKCTR-1
6451                ;                           PSW:S = DONE = BLKCTR .LT. 0
6452 115D 3E 01       MVI  A,NVMBAD             A = NVMBAD
6453                ;                           IF DONE .EQ. TRUE
6454                ;                             DECLARE DEAD METER. BAD NVM
6455 115F FA 85 10    JM   NVMDED                 NVMDED(NVMBAD,ERRFLG)
6456                ;                                  ( A    ,PSW:Z )
6457                ;                                  ( I    , 0    )
6458                ;                             BREAK
6459                ;                           ENDIF
6460                ;                           FETCH BLOCK HEADER
6461 1162 CD 58 10    CALL NVMBYT               NVMBYT(ADRESS,NVMRED[J],HEADER)
6462                ;                                ( HL   , @HL     , A    )
6463                ;                                ( I/O  , I       , 0    )
6464 1165 B8          CMP  B                    IF HEADER .EQ. TEST
6465 1166 C2 4E 11    JNZ  NVMFN2
6466 1169 04          INR  B                      PSW:Z = ERRFLG = FALSE
6467 116A C9          RET                         BREAK
6468                ;                           ENDIF
6469                ;                         ENDLOOP
6470                ;                       ENDIF
6471                ;                       RETURN
```

```
                ;NVMLOD()(NORFLG,NVMCTL,MRSTS1)
                ;        (BITSTR,NIBSTR,BITSTR)
                ;        ( O    , O    , O    )
                ;        ( RAM  , RAM  , RAM  )
                ;        ( C    , C    , C    )
                ;
                ;A,PSW DESTROYED
                ;REGISTERS DESTROYED
                ;
                ;INITIALIZATION. LOAD NONVOLATILE MEMORY
                ;
                NVMLOD;                 ****ENTRY POINT
116B 21 26 74     LXI  H,NORFLG/2+X     HL = ADDRESS, NORFLG
                ;                       SENT STATUS AND POSTAGE AFTER POWERUP
116E 7E           MOV  A,M              NORFLG.QUESTS = NORFLG.QUEPOS = TRUE
116F F6 C0        ORI  0C0H
1171 77           MOV  M,A
                ;                       DECLARE THAT NO BLOCK IS OPEN
1172 3E F0        MVI  A,0F0H           NVMCTL = HEXF0
1174 32 33 74     STA  NVMCTL/2+X
                ;                       METER GUARANTEED TO BE IN NORMAL MODE
                ;                       SEARCH FOR NORMAL BLOCK
1177 CD 2F 11     CALL NVMFND           NVMFND(ERRFLG)
                ;                             (PSW:Z )
                ;                             ( O    )
                ;                       IF ERRFLG .EQ. FALSE
117A C4 EE 11     CNZ NVMRD               LOAD NORMAL BLOCK
                ;                       ENDIF
117D 21 24 74     LXI  H,MRSTS1/2+X     HL = ADDRESS, MRSTS1
                ;                       SET TO LOAD SERVICE BLOCK
                ;                       INITIALIZE CHECK DATE STATUS
1180 7E           MOV  A,M              MRSTS1.DATDOR = MRSTS1.SERMOD = TRUE
1181 F6 48        ORI  48H
1183 77           MOV  M,A
1184 E5           PUSH H                SAVE HL
                ;                       SEARCH FOR SERVICE BLOCK
1185 CD 2F 11     CALL NVMFND           NVMFND(ERRFLG)
                ;                             (PSW:Z )
                ;                             ( O    )
                ;                       IF ERRFLG .EQ. FALSE
1188 C4 EE 11     CNZ  NVMRD              LOAD SERVICE BLOCK
                ;                       ENDIF
118D E1           POP  H                RESTORE HL
                ;                       RETURN TO NORMAL MODE
                ;                       DISABLE METER
118C 7E           MOV  A,M              MRSTS1.SERMOD = MRSTS1.ENABLD = FALSE
118D E6 F3        ANI  0F3H
118F 77           MOV  M,A
1190 C9           RET                   RETURN
                ;NVMMAP(NVMCTL,BASE  ,BLKTYP)
                ;      (NIBSTR,ADRESS,NIBSTR)
                ;      ( I    , O    , O    )
                ;      ( A    , HL   , A[1] )
                ;      ( C    , C    , C    )
                ;
                ;PSW DESTROYED
                ;REGISTERS NOT CHANGED
                ;
                ;MAPS BLOCK NUMBER IN L/O NIBBLE OF ACCUMULATOR INTO
                ;CORRESPONDING NONVOLATILE MEMORY ADDRESS
                ;
                NVMMAP;                 ****ENTRY POINT
1191 0F           RRC                   A = NVMCTL[1]*HEX10+NVMCTL[0]
1192 0F           RRC
1193 0F           RRC
1194 0F           RRC
1195 F5           PUSH PSW              SAVE A,PSW
1196 E6 F0        ANI  0F0H             HL = BASE = NVMCTL[1]*HEX40
1198 6F           MOV  L,A
1199 26 00        MVI  H,0
119B 29           DAD  H
119C 29           DAD  H
```

```
6548 119D F1          POP  PSW            RESTORE A,PSW
6549                ;                     A[1] = BLKTYP = NVMCTL[0]
6550 119E C9          RET                 RETURN
6553                ;NVMNBK(ERRFLG,OLDCTL,NXTCTL,ADRESS,NVMCTL)(NVMCTL)
6554                ;      (BIT   ,NIBSTR,NIBSTR,ADRESS,NIBSTR)(NIBSTR)
6555                ;      ( 0    , 0    , 0    , 0    , -    )( I    )
6556                ;      (PSW:Z , B    , C    , HL   , @HL  )( RAM  )
6557                ;      ( C    , C    , C    , C    , -    )( NC   )
6558                ;
6559                ;A,PSW DESTROYED
6560                ;REGISTERS DESTROYED
6561                ;
6562                ;DEVELOP CONTROL BYTE VALUES FOR DEACTIVATING BLOCK OF
6563                ;CURRENT TYPE, AND FOR OPENING NEXT BLOCK.
6564                ;
6565                NVMNBK;               ****ENTRY POINT
6566                ;                     SET NVMCTL TO INDICATE ACTIVE CLOSED
6567                ;                     BLOCK CORRESPONDING TO CURRENT STATUS
6568 119F CD 2F 11    CALL NVMFND         NVMFND(ERRFLG)
6569                ;                           (PSW:Z )
6570                ;                           ( 0    )
6571 11A2 C8          RZ                  IF ERRFLG .EQ. FALSE
6572                ;                       NVMCTL[0] = HEXF, NO FILES OPEN
6573                ;                       NVMCTL[1] = ACTIVE BLOCK NUMBER
6574 11A3 21 33 74    LXI  H,NVMCTL/2+X     HL = ADDRESS, NVMCTL
6575 11A6 46          MOV  B,M              B = OLDCTL = NVMCTL
6576 11A7 0E 02       MVI  C,2              C = NVMCTL = HEX02
6577 11A9 78          MOV  A,B              A = OLDCTL+1
6578 11AA 3C          INR  A
6579 11AB CA B9 11    JZ   NVMNB1           IF OLDCTL+1 .EQ. 0
6580                ; >>JUMP AHEAD<<          OLD BLOCK WAS 15
6581                ;                         NEWCTL SET FOR BLOCK 2, NORMAL
6582                ;                         PSW:Z = ERRFLG = FALSE
6583                ;                       ELSE
6584                ;                         OLD BLOCK WAS NOT 15
6585 11AE E6 0F       ANI  0FH              A=OLDBLK+1=(OLDCTL+1).AND.HEX0F
6586 11B0 4F          MOV  C,A              C = OLDBLK+1
6587 11B1 DE 03       SBI  3                A = OLDBLK-2
6588 11B3 F2 B9 11    JP   NVMNB1           IF OLDBLK-2 .GE. 0
6589                ; >>JUMP AHEAD<<          OLD BLOCK WAS 2 TO 14
6590                ;                         NEWCTL SET FOR BLK 3 TO 15, NORM
6591                ;                         PSW:Z = ERRFLG = FALSE
6592                ;                       ELSE
6593                ;                         OLD BLOCK WAS 0 OR 1
6594                ;                         SET NEWCTL FOR BLK 0 OR 1, SERVC
6595 11B6 EE EF       XRI  0EFH             C=NEWCTL=(OLDBLK-2).XOR.HEXEF
6596 11B8 4F          MOV  C,A
6597                ;                       ENDIF
6598                ;                     ENDIF
6599                NVMNB1;               >>TARGET OF JUMP AHEAD<<
6600 11B9 B1          ORA  C                PSW:Z = ERRFLG = FALSE
6601 11BA C9          RET
6602                ;                     ENDIF
6603                ;                     RETURN
6606                ;NVMNXT(ADRESS)
6607                ;      (ADRESS)
6608                ;      ( I/O  )
6609                ;      ( HL   )
6610                ;      ( C    )
6611                ;
6612                ;A,PSW DESTROYED
6613                ;REGISTERS NOT CHANGED
6614                ;
6615                ;ADVANCE ADDRESS TO NEXT HIGHER LOCATION SKIPPING XXXF
6616                ;
6617                NVMNXT;               ****ENTRY POINT
6618 11BB 23          INX  H              HL = ADRESS = ADRESS+1
6619 11BC 7D          MOV  A,L            IF ADRESS[3] .EQ. HEX0F
6620 11BD E6 0F       ANI  0FH
6621 11BF FE 0F       CPI  0FH
6622 11C1 C0          RNZ
6623 11C2 23          INX  H                HL = ADRESS = ADRESS+1
```

```
6624                ;                       ENDIF
6625 11C3 C9          RET                   RETURN
6628                ;NVMOPN(ERRFLG)(NVMCTL,SERFLG)
6629                ;      (BIT   )(NIBSTR,BITSTR)
6630                ;      ( 0    )( 0    , I    )
6631                ;      (PSW:Z )( RAM  , RAM  )
6632                ;      ( C    )( C    , C    )
6633                ;
6634                ;A,PSW DESTROYED
6635                ;REGISTERS DESTROYED
6636                ;
6637                ;OPENS NVM BLOCK
6638                ;
6639                NVMOPN;                 ****ENTRY POINT
6640 11C4 3A 10 74    LDA  SERFLG/2+X       IF SERFLG.DEAD .EQ. TRUE
6641 11C7 F6 7F       ORI  7FH                PSW:Z = ERRFLG = TRUE
6642 11C9 2F          CMA
6643                ;                       ELSE
6644                ;                         PSW:Z = ERRFLG = FALSE
6645                ;                       ENDIF
6646 11CA C8          RZ                    IF ERRFLG .EQ. FALSE
6647                ;                         ERASE NEXT BLOCK
6648 11CB CD B1 10    CALL NVMER              NVMER(ERRFLG)
6649                ;                               (PSW:Z )
6650                ;                               ( 0    )
6651 11CE C8          RZ                      IF ERRFLG .EQ. FALSE
6652 11CF CD 47 10    CALL NVM30T               TURN ON -30V TO NVM
6653                ;                           DEVELOP CONTROL BYTES FOR OPENING
6654                ;                           NEXT BLOCK AND DEACTIVATING
6655                ;                           OLD BLOCK
6656 11D2 CD 9F 11    CALL NVMNBK               NVMNBK(ERRFLG,OLDCTL,NXTCTL,
6657                ;                                  (PSW:Z , B    , C    ,
6658                ;                                  ( 0    , 0    , 0    ,
6659                ;
6660                ;                                  ADRESS,NVMCTL)
6661                ;                                   HL   , @HL  )
6662                ;                                   0    , -    )
6663 11D5 F3          DI                        DISABLE INTERRUPTS
6664                ;                           OPEN NEXT BLOCK
6665 11D6 71          MOV  M,C                  NVMCTL = NXTCTL
6666                ;                           DEACTIVATE OLD BLOCK
6667 11D7 CD A9 10    CALL NVMDXB               NVMDXB(ERRFLG,OLDCTL)
6668                ;                                  (PSW:Z , B    )
6669                ;                                  ( 0    , I    )
6670 11DA FB          EI                        ENABLE INTERRUPTS
6671 11DB CD 31 10    CALL NVM30F               TURN OFF -30V TO NVM
6672                ;                         ENDIF
6673                ;                       ENDIF
6674 11DE C9          RET                   RETURN
6677                ;NVMPRP(NIBCNT,OFFSET,RAM[I])(NVMCTL)
6678                ;      (BYTE  ,OFFSET,NIBSTR)(NIBSTR)
6679                ;      ( 0    , 0    , -    )( I    )
6680                ;      ( B    , C    , @C   )( RAM  )
6681                ;      ( C    , C    , NC   )( NC   )
6682                ;
6683                ;A,PSW DESTROYED
6684                ;REGISTERS NOT CHANGED
6685                ;
6686                ;RETURN RAM PARAMETERS CORRESPONDING TO NVM BLOCK TYPE
6687                ;
6688                NVMPRP;                 ****ENTRY POINT
6689 11DF 06 22       MVI  B,NORSIZ         B = NIBCNT = NORSIZ
6690 11E1 0E 28       MVI  C,NORSTR         C = OFFSET = NORSTR
6691 11E3 3A 33 74    LDA  NVMCTL/2+X       IF NVMCTL[1] .LT. 2
6692 11E6 E6 0E       ANI  0EH
6693 11E8 C0          RNZ
6694 11E9 06 28       MVI  B,SRVSIZ           B = NIBCNT = SRVSIZ
6695 11EB 0E 00       MVI  C,SRVSTR           C = OFFSET = SRVSTR
6696                ;                       ENDIF
6697 11ED C9          RET                   RETURN
6700                ;NVMRD()(NVMCTL,RAM[I],NVMRED)
6701                ;       (NIBSTR,NIBSTR,NIBSTR)
6702                ;       ( I    , 0    , I    )
```

```
                ;       ( RAM  , RAM  , NVM  )
                ;       ( NC   , C    , NC   )
                ;
                ;A,PSW DESTROYED
                ;REGISTERS DESTROYED
                ;
                ;READ NONVOLATILE MEMORY INTO RAM
                ;
                NVMRD;                  ****ENTRY POINT
                ;                       GET RAM DESTINATION PARAMETERS
11EE CD DF 11     CALL NVMPRP           NVMPRP(NIBCNT,OFFSET,RAM[I])
                ;                               ( B    , C    , @C   )
                ;                               ( O    , O    , -    )
                ;                       DEFINE NVM SOURCE BASE
11F1 3A 33 74     LDA  NVMCTL/2+X       A = NVMCTL
11F4 CD 91 11     CALL NVMMAP           NVMMAP(NMVCTL,BASE,BLKTYP)
                ;                               ( A    , HL , A[1] )
                ;                               ( I    , O  , O    )
                ;                       FORM NVM READ ADDRESS OF SOURCE DATA
11F7 11 02 44     LXI  D,NVMRED+2       HL = ADDRESS, NVMRED[J=BASE+2]
11FA 19           DAD  D
                ;                       INITIALIZE CRC VALUE
11FB 16 FF        MVI  D,0FFH           D = CRCVAL = HEXFF
                NVMRD1;                 LOOP - WITH 1 BREAK
11FD 05           DCR  B                  B = NIBCNT = NIBCNT-1
11FE FA 0F 12     JM   NVMRD2             IF NIBCNT .LT. 0
                ;                           BREAK
                ;                         ENDIF
                ;                         COPY NVM TO RAM
1201 7E           MOV  A,M                A = NVMRED[J]
1202 CD EE 0F     CALL PUTNIB             PUTNIB(RAM[I],NVMRED[J])
                ;                                ( @C   , A       )
                ;                                ( O    , I       )
                ;                         UPDATE CRC
1205 CD C6 0E     CALL CRCNIB             CRCNIB(NVMRED[J],CRCVAL)
                ;                                ( A       , D    )
                ;                                ( I       , I/O  )
1208 0C           INR  C                  C = OFFSET, RAM[I=I+1]
                ;                         CALCULATE NEXT NVM SOURCE ADDRESS
1209 CD BB 11     CALL NVMNXT             NVMNXT(ADRESS,NVMRED[J=J+?])
                ;                                ( HL   , @HL         )
                ;                                ( I/O  , -           )
120C C3 FD 11     JMP  NVMRD1
                NVMRD2;                 ENDDO
                ;                       CHECK CRC VALUES
120F CD 58 10     CALL NVMBYT           NVMBYT(ADRESS,NVMRED[J],NVMCRC)
                ;                               ( HL   , @HL     , A    )
                ;                               ( I/O  , I       , O    )
1212 BA           CMP  D                IF NVMCRC .NE. CRCVAL
1213 C8           RZ
                ;                         DECLARE DEAD METER. BAD CRC
1214 3E 00        MVI  A,BADCRC           A = BADCRC
1216 C3 85 10     JMP  NVMDED             NVMDED(BADCRC,ERRFLG)
                ;                                ( A    ,PSW:Z )
                ;                                ( I    , O    )
                ;                       ENDIF
                ;                       RETURN
                ;NVMSTO(ERRFLG)(MRSTS1,MRSTS2,NVMCTL)
                ;       ( BIT  )(BITSTR,BITSTR,NIBSTR)
                ;       (  O   )( I/O  , I/O  , O    )
                ;       (PSW:Z )( RAM  , RAM  , RAM  )
                ;       (  C   )( C    , C    , C    )
                ;
                ;A,PSW DESTROYED
                ;REGISTERS DESTROYED
                ;
                ;STARTING WITH NO NVM BLOCKS OPEN:
                ;WRITE NEW ACTIVE NVM BLOCK NOT CORRESPONDING TO CURRENT
                ;METER MODE.
                ;OPEN AN ERASED BLOCK CORRESPONDING TO CURRENT METER MODE.
                ;
                NVMSTO;                 ****ENTRY POINT
1219 CD 4E 0F     CALL LSTATE           LSTATE(FATMOD,NORMOD,SERMOD,PRVMOD)
```

```
6778                ;                          (PSW:S ,PSW:Z ,PSW:P ,PSW:C )
6779                ;                          ( 0    , 0    , 0    , 0    )
6780 121C F2 21 12    JP   NVMST1        IF PATMOD .EQ. TRUE
6781 121F AF          XRA  A               ERRFLG = PSW:Z = TRUE
6782 1220 C9          RET
6783                NVMST1;              ELSE
6784                ;                      ERASE BLOCK FOR UNTOGGLED NORMOD
6785 1221 CD B1 10    CALL NVMER           NVMER(ERRFLG)
6786                ;                           (PSW:Z )
6787                ;                           ( 0    )
6788                ;                      IF ERRFLG .EQ. TRUE
6789 1224 CA B6 01    JZ   PWRDN             REINITIALIZE METER
6790                ;                      ELSE
6791                ;                        SET TO TOGGLE NORMOD INDIRECTLY BY
6792                ;                        TOGGLING THE SERVICE OR PRIVILEGED
6793                ;                        MODE FLAGS
6794 1227 21 24 74    LXI  H,MRSTS1/2+X      HL=ADDRESS,MRSTS?=ADDRESS,MRSTS1
6795 122A 1E 08       MVI  E,08H             E.M = E.SERMOD = TRUE
6796 122C EA 32 12    JPE  NVMST2            IF LSTATE(SERMOD) .EQ. FALSE
6797 122F 23          INX  H                   HL=ADDRESS,MRSTS?=ADDRESS,MRSTS2
6798 1230 1E 01       MVI  E,01H               E.M = E.PRVMOD = TRUE
6799                NVMST2;                  ENDIF
6800                ;                        TOGGLE NORMOD
6801 1232 7B          MOV  A,E               MRSTS?.M = MRSTS?.M .XOR. E.M
6802 1233 AE          XRA  M
6803 1234 77          MOV  M,A
6804 1235 E5          PUSH H                 SAVE HL
6805 1236 D5          PUSH D                 SAVE DE
6806                ;                        ERASE BLOCK FOR TOGGLED NORMOD
6807 1237 CD B1 10    CALL NVMER             NVMER(ERRFLG)
6808                ;                           (PSW:Z )
6809                ;                           ( 0    )
6810                ;                        IF ERRFLG .EQ. TRUE
6811 123A CA B6 01    JZ   PWRDN               REINITIALIZE METER
6812                ;                        ELSE
6813 123D F3          DI                       DISABLE INTERRUPTS
6814                ;                        SET TO STORE BLK FOR TOG NORMOD
6815 123E CD 9F 11    CALL NVMNBK              NVMNBK(ERRFLG,OLD,NXT,ADR,NVMCTL)
6816                ;                              (PSW:Z , B , C , HL, @HL  )
6817                ;                              ( 0    , 0 , 0 , 0 , -    )
6818                ;                        IF ERRFLG .EQ. TRUE
6819 1241 CA B6 01    JZ   PWRDN               REINITIALIZE METER
6820                ;                        ELSE
6821 1244 CD 47 10    CALL NVM30T              TURN ON -30 V TO NVM
6822 1247 E5          PUSH H                   SAVE HL
6823                ;                          DEACTIVATE BLK FOR TOG NORMOD
6824 1248 CD A9 10    CALL NVMDXB              NVMDXB(ERRFLG,OLD)
6825                ;                                (PSW:Z , B )
6826                ;                                ( 0    , I )
6827                ;                          OPEN BLK FOR TOG NORMOD
6828 124B E1          POP  H                   RESTORE HL
6829 124C 71          MOV  M,C                 NVMCTL = NXT
6830                ;                          STORE BLK FOR TOGLED NORMOD
6831 124D CD 9E 12    CALL NVMWR               NVMWR(ERRFLG)
6832                ;                                (PSW:Z )
6833                ;                                ( 0    )
6834                ;                          RETURN TO UNTOGGLED NORMOD
6835 1250 D1          POP  D                   RESTORE DE
6836 1251 E1          POP  H                   RESTORE HL
6837 1252 7B          MOV  A,E                 MRSTS?.M =
6838 1253 AE          XRA  M                          MRSTS?.M .XOR. E.M
6839 1254 77          MOV  M,A
6840                ;                          GET CONTROL BYTES
6841 1255 CD 9F 11    CALL NVMNBK              NVMNBK(ERRFLG,OLD,NXT,
6842                ;                                (PSW:Z , B , C ,
6843                ;                                ( 0    , 0 , 0 ,
6844                ;
6845                ;                                ADRESS,NVMCTL)
6846                ;                                 HL   , @HL  )
6847                ;                                 0    , -    )
6848                ;                          OPEN ERASED BLOCK
6849 1258 71          MOV  M,C                 NVMCTL = NXT
```

```
6850 1259 CD 47 10   CALL NVM30T                TURN ON -30 V TO NVM
6851               ;                            DEACTIVATE OLD BLOCK
6852 125C CD A9 10   CALL NVMDXB                NVMDXB(ERRFLG,OLD)
6853               ;                                  (PSW:Z , B )
6854               ;                                  ( 0    , I )
6855 125F FB         EI                         ENABLE INTERRUPTS
6856 1260 C9         RET
6857               ;                          ENDIF
6858               ;                        ENDIF
6859               ;                      ENDIF
6860               ;                    ENDIF
6861               ;                    RETURN
6864               ;NVMWN(DATA  ,BASE  ,ERRFLG)(NVMRED,NVMWRT)
6865               ;     (NIBBLE,ADRESS,BIT   )(NIBSTR,NIBSTR)
6866               ;     ( I    , I    , 0    )( I    , 0    )
6867               ;     ( A[1] , HL   ,PSW:Z )( NVM  , NVM  )
6868               ;     ( C    , NC   , C    )( NC   , C    )
6869               ;
6870               ;A,PSW DESTROYED
6871               ;REGISTERS NOT CHANGED
6872               ;
6873               ;WRITE NIBBLE TO NONVOLATILE MEMORY
6874               ;
6875               NVMWN;                 ****ENTRY POINT
6876 1261 C5         PUSH B               SAVE REGISTERS
6877 1262 D5         PUSH D
6878 1263 E5         PUSH H
6879 1264 E5         PUSH H
6880 1265 01 00 48   LXI  B,NVMWRT        DE = ADDRESS, NVMWRT[BASE]
6881 1268 09         DAD  B
6882 1269 EB         XCHG
6883 126A E1         POP  H               HL = ADDRESS, NVMRED[BASE]
6884 126B 01 00 44   LXI  B,NVMRED
6885 126E 09         DAD  B
6886 126F F5         PUSH PSW             SAVE A,PSW
6887               ;                      START WRITING DATA
6888 1270 12         STAX D               NVMWRT[BASE] = DATA
6889               ;                      DELAY FOR 1 MSEC
6890 1271 01 0A 00   LXI  B,10            BC = LOOPCT = 10
6891               NVMWN1;                DO UNTIL LOOPCT .EQ. 0
6892 1274 CD 19 0B   CALL NPAUSE            NPAUSE(LOOPCT,ZROFLG)
6893               ;                              ( BC   ,PSW:Z )
6894               ;                              ( I/O  , 0    )
6895 1277 C2 74 12   JNZ NVMWN1
6896               ;                      ENDDO
6897               ;                      STOP WRITE FUNCTION
6898 127A 7E         MOV  A,M             A = GARBAGE = NVMRED[BASE]
6899 127B C1         POP  B               B = DATA
6900               ;                      C = GARBAGE
6901 127C 7E         MOV  A,M             A = SAVDAT = NVMRED[BASE]
6902 127D 90         SUB  B               A = TEST = (SAVDAT-DATA) .AND. HEX0F
6903 127E E6 0F      ANI  0FH
6904 1280 C2 87 12   JNZ  NVMWN2          IF TEST .EQ. 0
6905               ;                        SAVDAT .EQ. DATA
6906 1283 3C         INR  A                 PSW:Z = ERRFLG = FALSE
6907 1284 C3 9A 12   JMP NVMWN4
6908               NVMWN2;                ELSE
6909               ;                        SAVDAT .NE. DATA
6910 1287 01 9A 12   LXI  B,NVMWN3          SET TO RETURN TO ENDIF
6911 128A C5         PUSH B
6912 128B 01 42 B9   LXI  B,-(NVMRED+KILCOD)
6913               ;                        BC = -(ADDRESS, NVMRED[KILCOD])
6914 128E 09         DAD  B                 HL = BASE-KILCOD
6915 128F 7C         MOV  A,H               PSW:Z = (BASE-KILCOD).EQ.0
6916 1290 B5         ORA  L
6917 1291 3E 01      MVI  A,NVMBAD          A = NVMBAD
6918 1293 47         MOV  B,A               B = NVMBAD
6919               ;                        IF (BASE-KILCOD).EQ.0
6920               ;                          DECLARE DEAD METER. BAD NVM
6921               ;                          DO NOT WRITE NVMBAD INTO NVM
6922 1294 CA 99 10   JZ   NVMDE1              NVMDE1(NVMBAD,ERRFLG)
6923               ;                                ( B    ,PSW:Z )
```

```
6924                ;                                  ( I    , O    )
6925                ;                        ELSE
6926                ;                          DECLARE DEAD METER. BAD NVM
6927                ;                          WRITE NVMBAD INTO NVM
6928 1297 C2 85 10    JNZ  NVMDED              NVMDED(NVMBAD,ERRFLG)
6929                ;                                  ( A    ,PSW:Z )
6930                ;                                  ( I    , O    )
6931                NVMWN3;                  ENDIF
6932                NVMWN4;                ENDIF
6933 129A E1          POP  H               RESTORE REGISTERS
6934 129B D1          POP  D
6935 129C C1          POP  B
6936 129D C9          RET
6939                ;NVMWR(ERRFLG)(NVMCTL,RAM[I],SERFLG)
6940                ;     (BIT   )(NIBSTR,NIBSTR,BITSTR)
6941                ;     ( O    )( I/O  , I    , I    )
6942                ;     (PSW:Z )( RAM  , RAM  , RAM  )
6943                ;     ( C    )( C    , NC   , NC   )
6944                ;
6945                ;A,PSW DESTROYED
6946                ;REGISTERS DESTROYED
6947                ;
6948                ;WRITE BLOCK FROM RAM TO NONVOLATILE MEMORY
6949                ;
6950                NVMWR;                 ****ENTRY POINT
6951                ;                      FETCH RAM SOURCE PARAMETERS
6952 129E CD DF 11    CALL NVMPRP          NVMPRP(NIBCNT,OFFSET,RAM[I])
6953                ;                            ( B    , C    , @C   )
6954                ;                            ( O    , O    , -    )
6955 12A1 79          MOV  A,C             C = NIBCNT
6956 12A2 48          MOV  C,B
6957 12A3 47          MOV  B,A             B = OFFSET, RAM[I]
6958                ;                      INITIALIZE CRC VALUE
6959 12A4 16 FF       MVI  D,0FFH          D = CRCVAL = HEXFF
6960 12A6 3A 33 74    LDA NVMCTL/2+X       A = NVMCTL
6961 12A9 FE 20       CPI  20H             IF NVMCTL[0] .LT. 2
6962 12AB D2 E6 12    JNC  NVMWR3
6963 12AE CD 47 10    CALL NVM30T            TURN ON -30 V TO NVM
6964                ;                        FETCH NVM DESTINATION BASE
6965 12B1 CD 91 11    CALL NVMMAP            NVMMAP(NVMCTL,BASE,BLKTYP)
6966                ;                              ( A    , HL   , A[1] )
6967                ;                              ( I    , O    , O    )
6968                ;                        STORE BLOCK TYPE IN NVM HEADER
6969 12B4 23          INX  H                 HL = BASE +1
6970 12B5 CD 61 12    CALL NVMWN             NVMWN(BLKTYP,BASE+1,ERRFLG)
6971                ;                              ( A[1] , HL   ,PSW:Z )
6972                ;                              ( I    , I    , O    )
6973                ;                        POINT AT START OF DATA IN NVM
6974 12B8 23          INX  H                 HL = BASE+2
6975                NVMWR1;                  LOOP - WITH 1 BREAK
6976 12B9 0D          DCR  C                   C = NIBCNT = NIBCNT-1
6977 12BA FA CD 12    JM   NVMWR2              IF NIBCNT .LT. 0
6978                ;                            BREAK
6979                ;                          ENDIF
6980                ;                          FETCH DATA FROM RAM
6981 12BD CD 35 0F    CALL GETNIB              GETNIB(DATA ,ZROFLG,RAM[I])
6982                ;                                ( A[1],PSW:Z , @B   )
6983                ;                                ( O    , O    , I    )
6984                ;                          UPDATE CRC VALUE
6985 12C0 CD C6 0E    CALL CRCNIB              CRCNIB(DATA ,CRCVAL)
6986                ;                                ( A[1], D    )
6987                ;                                ( I    , O    )
6988                ;                          WRITE DATA TO NVM
6989 12C3 CD 61 12    CALL NVMWN               NVMWN(DATA ,BASE+?,ERRFLG)
6990                ;                                ( A[1], HL   ,PSW:Z )
6991                ;                                ( I    , I    , O    )
6992                ;                          POINT AT NEXT DATA LOCATIONS
6993 12C6 04          INR  B                   B = OFFSET, RAM[I=I+1]
6994 12C7 CD BB 11    CALL NVMNXT              NVMNXT(ADRESS,BASE+?)
6995                ;                                ( HL   , @HL  )
6996                ;                                ( I/O  , -    )
6997 12CA C3 B9 12    JMP NVMWR1
```

```
6998                NVMWR2;                 ENDDO
6999                ;                       STORE CRC IN NVM
7000 12CD 7A          MOV  A,D              A[1] = CRCVAL[0]
7001 12CE 0F          RRC
7002 12CF 0F          RRC
7003 12D0 0F          RRC
7004 12D1 0F          RRC
7005 12D2 CD 61 12    CALL NVMWN            NVMWN(CRCVAL[0],BASE+?,ERRFLG)
7006                ;                            ( A[1]    , HL   ,PSW:Z )
7007                ;                            ( I       , I    , O    )
7008 12D5 CD BB 11    CALL NVMNXT           NVMNXT(ADRESS,BASE+?)
7009                ;                             ( HL    , @HL  )
7010                ;                             ( I/O   , -    )
7011 12D8 7A          MOV  A,D              A[1] = CRCVAL[1]
7012 12D9 CD 61 12    CALL NVMWN            NVMWN(CRCVAL[1],BASE+?,ERRFLG)
7013                ;                            ( A[1]    , HL   ,PSW:Z )
7014                ;                            ( I       , I    , O    )
7015                ;                       INDICATE BLOCK NOT OPEN
7016 12DC 21 33 74    LXI  H,NVMCTL/2+X     HL = ADDRESS, NVMCTL
7017 12DF 3E F0       MVI  A,0F0H           NVMCTL[0] = HEX0F
7018 12E1 B6          ORA  M
7019 12E2 77          MOV  M,A
7020 12E3 CD 31 10    CALL NVM30F           TURN OFF -30V TO NVM
7021                NVMWR3;               ENDIF
7022 12E6 3A 10 74    LDA  SERFLG/2+X       IF SERFLG.DEAD .EQ. TRUE
7023 12E9 E6 80       ANI  80H              PSW:Z = ERRFLG = TRUE
7024 12EB EE 80       XRI  80H
7025                ;                       ELSE
7026                ;                       PSW:Z = ERRFLG = FALSE
7027                ;                       ENDIF
7028 12ED C9          RET                   RETURN
7031                ;ACCODE(ERRFLG)(WORK1 ,DSCREG,RSTCNT,SERFLG)
7032                ;      (BIT   )(NIBCTR,NIBSTR,NIBBLE,BITSTR)
7033                ;      ( O    )( O    , I    , I    , I    )
7034                ;      (PSW:Z )( RAM  , RAM  , RAM  , RAM  )
7035                ;      ( C    )( C    , NC   , NC   , NC   )
7036                ;
7037                ;A,PSW DESTROYED
7038                ;REGISTERS DESTROYED
7039                ;
7040                ;BUILD ACCESS CODE MESSAGE IN TRANSMIT BUFFER
7041                ;
7042                ACCODE;               ****ENTRY POINT
7043                ;                     CLEAR WORK AREA
7044 12EE 3E C0       MVI  A,WORK1        A = OFFSET, WORK1
7045 12F0 CD 85 0E    CALL CLRBLK         CLRBLK(WORK1)
7046                ;                           ( @A   )
7047                ;                           ( O    )
7048                ;                     PUT 10 DGT CONTROL SUM IN WORK1[0..9]
7049 12F3 CD 3A 06    CALL CONSUM         CONSUM(ERRFLG)
7050                ;                           (PSW:Z )
7051                ;                           ( O    )
7052                ;                     IF ERRFLG .EQ. TRUE
7053                ;                       PROCESS ERROR
7054 12F6 CA A1 0B    JZ   PROERR           PROERR(ERRFLG)
7055                ;                             (PSW:Z )
7056                ;                             ( O    )
7057                ;                     ELSE
7058                ;                       MOVE CONTROL SUM TO WORK1[6..15]
7059 12F9 01 C6 C0    LXI  B,(WORK1+0)*100H+(WORK1+6)
7060                ;                       B = OFFSET, WORK1[0]
7061                ;                       C = OFFSET, WORK1[6]
7062 12FC 3E 0A       MVI  A,10             A = NIBCNT = 10
7063 12FE CD B3 0F    CALL MVLNIB           MVLNIB(WORK1[6],WORK1[0],NIBCNT,
7064                ;                             ( @C     , @B     , A    ,
7065                ;                             ( O      , I      , I    ,
7066                ;
7067                ;                             NONBCD,ZROFLG)
7068                ;                             PSW:S ,PSW:Z )
7069                ;                              O    , O    )
7070                ;                       PUT DESC REGISTER IN WORK1[0..4]
7071 1301 01 C0 2F    LXI  B,DSCREG*100H+WORK1
```

```
7072                ;                        B = OFFSET, DSCREG[0]
7073                ;                        C = OFFSET, WORK1[0]
7074 1304 3E 05       MVI  A,5               A = NIBCNT = 5
7075 1306 CD B3 0F    CALL MVLNIB            MVLNIB(WORK1[0],DSCREG[0],NIBCNT,
7076                ;                              ( @C     , @B      , A    ,
7077                ;                              ( O      , I       , I    .
7078                ;
7079                ;                              NONBCD,ZROFLG)
7080                ;                              PSW:S ,PSW:Z )
7081                ;                               O    , O    )
7082                ;                        PARSE RSTCNT INTO RESET NUMBER AND
7083                ;                        RESET BIT
7084 1309 01 C5 12    LXI  B,RSTCNT+100H+(WORK1+5)
7085                ;                        B = OFFSET, RSTCNT
7086                ;                        C = OFFSET, WORK1[5]
7087 130C CD 35 0F    CALL GETNIB            GETNIB(RSTCNT,ZROFLG,RSTCNT)
7088                ;                              ( A    ,PSW:Z , @B    )
7089                ;                              ( O    , O    , I    )
7090 130F 0F          RRC
7091 1310 57          MOV  D,A               D[1] = RSTCNT/2
7092                ;                        D[0].0 = RSTBIT = RSTCNT .MOD. 2
7093 1311 07          RLC                    A = RSTBIT
7094 1312 E6 01       ANI 01H
7095                ;                        PUT RSTBIT INTO WORK1[5]
7096 1314 CD EE 0F    CALL PUTNIB            PUTNIB(WORK1[5],RSTBIT)
7097                ;                              ( @C     , A    )
7098                ;                              ( O      , I    )
7099                ;                        EXTRACT RESET NUMBER FROM RIGHTMOST
7100                ;                        DIGIT OF WORK1[0..4] WHICH WILL NOT
7101                ;                        BE TRANSFORMED INTO A NON BCD DIGIT.
7102 1317 0D          DCR  C                 C = OFFSET, WORK1[I=4]
7103 1318 41          MOV  B,C               B = OFFSET, WORK1[I=4]
7104 1319 1E 05       MVI  E,5               E = NIBCNT = 5
7105               ACCOD1;                   DO UNTIL NIBCNT .EQ. 0; WITH 1 BREAK
7106 131B CD 35 0F    CALL GETNIB              GETNIB(BCDDGT,ZROFLG,WORK1[I])
7107                ;                                ( A    ,PSW:Z , @B     )
7108                ;                                ( O    , O    , I     )
7109 131E FE 08       CPI  8                   IF BCDDGT .LT. 8
7110 1320 D2 3A 13    JNC  ACCOD2
7111 1323 AA          XRA  D                     BCDDGT = BCDDGT .XOR. RSTNO
7112 1324 CD EE 0F    CALL PUTNIB                PUTNIB(WORK1[I],BCDDGT)
7113                ;                                  ( @C     , A    )
7114                ;                                  ( O      , I    )
7115 1327 C3 30 13    JMP  ACCOD3                BREAK
7116               ACCOD2;                   ENDIF
7117 132A 05          DCR  B                 B = OFFSET, WORK1[I=I-1]
7118 132B 0D          DCR  C                 C = OFFSET, WORK1[I=I-1]
7119 132C 1D          DCR  E                 E = NIBCNT = NIBCNT-1
7120 132D C2 1B 13    JNZ  ACCOD1
7121               ACCOD3;                   ENDDO
7122                ;                        CALCULATE CRC OF WORK AREA
7123 1330 01 C0 10    LXI  B,16*100H+WORK1
7124                ;                        B = NIBCNT = 16
7125                ;                        C = OFFSET, WORK1[0]
7126 1333 CD B1 0E    CALL CRC               CRC(WORK1[0],NIBCNT,CRCVAL)
7127                ;                           ( @C     , B    , D    )
7128                ;                           ( I      , I    , O    )
7129 1336 3A 10 74    LDA  SERFLG/2+X        PSW:Z=NVMOK=SERFLG.WEKNUM .EQ. FALSE
7130 1339 E6 20       ANI  20H
7131 133B 7A          MOV  A,D               A = CRCVAL
7132 133C CA 40 13    JZ   ACCOD4            IF NVMOK .EQ. FALSE
7133 133F 2F          CMA                      A = CRCVAL = .NOT. CRCVAL
7134               ACCOD4;                   ENDIF
7135                ;                        COMPLETE ACCESS CODE IN WORK[0..7]
7136                ;                        AS FOLLOWS:
7137                ;                        WORK1[4].0..3 = WORK1[4].0..3
7138                ;                        WORK1[5].1..2 = WORK1[5].1..2 .OR.
7139                ;                                        CRCVAL.0..1
7140                ;                        WORK1[6].0 = 0
7141                ;                        WORK1[6].1..3 = CRCVAL.2..4
7142                ;                        WORK1[7].0 = 0
7143                ;                        WORK1[7].1..3 = CRCVAL.5..7
7144 1340 57          MOV  D,A               D = CRCVAL
```

```
7145 1341 E6 F8      ANI  0F8H            D = FCRC2
7146 1343 82         ADD  D
7147 1344 57         MOV  D,A
7148 1345 17         RAL                  A = FCRC1
7149 1346 17         RAL
7150 1347 17         RAL
7151 1348 E6 06      ANI  6
7152 134A 21 62 74   LXI  H,(WORK1+4)/3+X HL = ADDRESS, WORK1[4..5]
7153 134D B6         ORA  M               WORK1[4..5] = WORK1[4..5] .OR. FCRC1
7154 134E 77         MOV  M,A
7155 134F 7A         MOV  A,D             A = FCRC3 = FCRC2 .AND. HEX77
7156 1350 E6 77      ANI  77H
7157 1352 23         INX  H               HL = ADDRESS, WORK1[6..7]
7158 1353 77         MOV  M,A             WORK1[6..7] = FCRC3
7159                ;                     BUILD ACCESS CODE MSG IN XMIT BUFFER
7160 1354 11 5A 13   LXI  D,ACCOD5        DE = ADDRESS, ACCOD5
7161 1357 C3 5B 0D   JMP  VALREQ          VALREQ(WORK1 ,ACCFMT,HACODE,ERRFLG)
7162                ;                           (@@DE+0,@DE+1 ,@DE+2 ,PSW:Z )
7163                ;                           ( I    , I    , I    , O    )
7164                ;                   ENDIF
7165                ;                   RETURN
7166                ACCOD5;             ARGUEMENTS FOR VALREQ
7167 135A C0 8F 90   DB   WORK1,ACCFMT,HACODE
7170                ;BINOCT(BINARY,OCTAL ,DIGCNT)
7171                ;      (BITSTR,NIBSTR,BYTE  )
7172                ;      ( I    , O    , I    )
7173                ;      ( @H   , @D   , B    )
7174                ;      ( NC   , C    , C    )
7175                ;
7176                ;A,PSW DESTROYED
7177                ;REGISTERS DESTROYED
7178                ;
7179                ;INSERT BITS FROM BIT STRING 3 AT A TIME INTO A PREVIOUSLY
7180                ;CLEARED NIBBLE STRING.
7181                ;DIGCNT ASSUMED .NE. 0.
7182                ;
7183                BINOCT;             ****ENTRY POINT
7184 135D 78         MOV  A,B           E = DBIT = DIGCNT*4-1
7185 135E 07         RLC
7186 135F 07         RLC
7187 1360 3D         DCR  A
7188 1361 5F         MOV  E,A
7189 1362 90         SUB  B             L = SBIT = DBIT-DIGCNT
7190 1363 6F         MOV  L,A
7191                BINOC1;             DO UNTIL DBIT .LT. 0
7192                ;                     SET TO MOVE 3 BITS INTO OCTAL NIBBLE
7193 1364 0E 03      MVI  C,3            C = BITCNT = 3
7194                BINOC2;               DO UNTIL BITCNT .EQ. 0
7195                ;                       MOVE 3 I/O BITS INTO NIBBLE
7196 1366 CD 68 0F   CALL MOVBIT           MOVBIT(BINARY,SBIT,OCTAL,DBIT,ZRO)
7197                ;                            ( @H   , L  , @D  , E  ,P:Z)
7198                ;                            ( I    , I  , O   , I  , O )
7199 1369 2D         DCR  L                 L = SBIT = SBIT-1
7200 136A 1D         DCR  E                 E = DBIT = DBIT-1
7201 136B 0D         DCR  C                 C = BITCNT = BITCNT-1
7202 136C C2 66 13   JNZ  BINOC2
7203                ;                     ENDDO
7204                ;                     SKIP OVER H/O BIT IN NIBBLE
7205 136F 1D         DCR  E               E = DBIT = DBIT-1
7206 1370 F2 64 13   JP   BINOC1
7207                ;                   ENDDO
7208 1373 C9         RET                RETURN
7211                ;VRCDR(ERRFLG)(DSCREG,DSCCRC)
7212                ;     (BIT   )(NIBSTR,BYTE  )
7213                ;     ( O    )( O    , O    )
7214                ;     (PSW:Z )( RAM  , RAM  )
7215                ;     ( C    )( C    , C    )
7216                ;
7217                ;A,PSW DESTROYED
7218                ;REGISTERS DESTROYED
7219                ;
7220                ;CLEAR VARIABLE RMRS DESCENDING REGISTER
```

```
7221                ;
7222                VRCDR;                  ****ENTRY POINT
7223                ;                       PERFORM RULE CHECKING AND REFORMATTING
7224 1374 CD 03 14    CALL VRPREP           VRPREP(ERRFLG)
7225                ;                             (PSW:Z )
7226                ;                             ( O    )
7227 1377 C8          RZ                    IF ERRFLG .EQ. FALSE
7228                ;                         CLEAR DESCENDING REGISTER
7229 1378 AF          XRA  A                  A = NIBVAL = 0
7230 1379 06 07       MVI  B,DSCSIZ           B = DSCSIZ
7231 137B 0E 2F       MVI  C,DSCREG           C = OFFSET, DSCREG
7232 137D CD 24 0F    CALL FILNIB             FILNIB(DSCREG,NIBVAL,DSCSIZ)
7233                ;                               ( @C   , A    , B    )
7234                ;                               ( O    , I    , I    )
7235                ;                         UPDATE DESCENDING REGISTER CRC
7236 1380 CD B1 0E    CALL CRC                CRC(DSCREG,DSCSIZ,CRCVAL)
7237                ;                            ( @C   , B    , D    )
7238                ;                            ( I    , I    , C    )
7239 1383 7A          MOV  A,D                DSCCRC = CRCVAL
7240 1384 32 1B 74    STA  DSCCRC/2+X
7241                ;                         CHECK METER STATUS
7242 1387 CD 4E 0F    CALL LSTATE             LSTATE(FATMOD,NORMOD,SERMOD,PRVMOD)
7243                ;                               (PSW:S ,PSW:Z ,PSW:P ,PSW:C )
7244                ;                               ( O    , O    , O    , O    )
7245                ;                         IF FATMOD .EQ. FALSE
7246                ;                           EXECUTE RESET
7247 138A F2 03 1A    JP   VRXEQ                VRXEQ(ERRFLG)
7248                ;                                (PSW:Z )
7249                ;                                ( O    )
7250                ;                         ELSE
7251                ;                           DECLARE DEAD METER. FATAL RESET
7252 138D 3E 03       MVI  A,FATRST             A = FATRST
7253 138F C3 85 10    JMP  NVMDED               NVMDED(FATRST,ERRFLG)
7254                ;                                  ( A    ,PSW:Z )
7255                ;                                  ( I    , O    )
7256                ;                         ENDIF
7257                ;                       ENDIF
7258                ;                       RETURN
7261                ;VRCLR(ERRFLG)(AMTBUF)
7262                ;     (BIT   )(NIBSTR)
7263                ;     ( O    )( I    )
7264                ;     (PSW:Z )( RAM  )
7265                ;     ( C    )( NC   )
7266                ;
7267                ;A,PSW DESTROYED
7268                ;REGISTERS DESTROYED
7269                ;
7270                ;SELECT VARIABLE RMRS CLEAR REGISTER FUNCTION
7271                ;
7272                VRCLR;                  ****ENTRY POINT
7273                ;                       SELECT FUNCTION VIA AMOUNT FORMAT
7274 1392 21 70 74    LXI  H,AMTBUF/2+X     HL = ADDRESS, AMTBUF[0..1]
7275 1395 7E          MOV  A,M              A = AMTBUF[0..1]
7276                ;                       CASE (AMTBUF[0..1])
7277 1396 FE 1F       CPI  1FH                **1F: CLEAR RESET ERROR COUNTER
7278 1398 CA A2 13    JZ   VRCREC                   VRCREC(ERRFLG,ADRESS,AMTBUF)
7279                ;                                   (PSW:Z , HL   , @HL  )
7280                ;                                   ( O    , I    , -   )
7281 139B FE 22       CPI  22H                **22: CLEAR DESCENDING REGISTER
7282 139D CA 74 13    JZ   VRCDR                    VRCDR(ERRFLG)
7283                ;                                  (PSW:Z )
7284                ;                                  ( O    )
7285                ;                         **ELSE:
7286                ;                               PROCESS ERROR
7287 13A0 C3 A1 0B    JMP  PROERR                   PROERR(ERRFLG)
7288                ;                                   (PSW:Z )
7289                ;                                   ( O    )
7290                ;                       ENDCASE
7291                ;                       RETURN
7294                ;VRCREC(ERRFLG,ADRESS,AMTBUF)(AMTBUF)
7295                ;     (BIT   ,ADRESS,NIBSTR)(NIBSTR)
7296                ;     ( O    , I    , -    )( O    )
```

```
7297                ;       (PSW:Z , HL    , @HL  )( RAM  )
7298                ;       ( C    , C     , -    )( C    )
7299                ;
7300                ;A,PSW DESTROYED
7301                ;REGISTERS DESTROYED
7302                ;
7303                ;CLEAR VARIABLE RMRS RESET ERROR COUNTER
7304                ;
7305                VRCREC;                 ****ENTRY POINT
7306                ;                       CHECK AMOUNT BUFFER
7307 13A3 23          INX  H                HL = ADDRESS, AMTBUF[2..3]
7308 13A4 7E          MOV  A,M              IF AMTBUF[2..3] .EQ. HEX00
7309 13A5 B7          ORA  A
7310                ;                         DON'T CLEAR DES REG BY MISTAKE
7311 13A6 CA A1 0B    JZ   PROERR             PROERR(ERRFLG)
7312                ;                                (PSW:Z )
7313                ;                                ( 0    )
7314                ;                       ELSE
7315                ;                         CHECK METER STATUS
7316 13A9 CD 4E 0F    CALL LSTATE             LSTATE(FATMOD,NORMOD,SERMOD,PRVMOD)
7317                ;                                (PSW:S ,PSW:Z ,PSW:P ,PSW:C )
7318                ;                                ( 0    , 0    , 0    , 0    )
7319                ;                         IF FATMOD .EQ. TRUE
7320                ;                           PROCESS ERROR
7321 13AC FA A1 0B    JM   PROERR               PROERR(ERRFLG)
7322                ;                                  (PSW:Z )
7323                ;                                  ( 0    )
7324                ;                         ELSE
7325                ;                           ALTER AMOUNT FORMAT
7326 13AF 3A 35 74    LDA  DIEDCM/2+X           A = DIEDCM
7327 13B2 0E B2       MVI  C,AMTBUF+1           C = OFFSET, AMTBUF[1]
7328 13B4 CD BE 0F    CALL PUTNIB               PUTNIB(AMTBUF[1],DIEDCM)
7329                ;                                  ( @C      , A    )
7330                ;                                  ( 0       , I    )
7331                ;                           PERFORM RULE CHECK AND REFORMATTING
7332 13B7 CD 03 14    CALL VRPRE1               VRPRE1(ERRFLG)
7333                ;                                  (PSW:Z )
7334                ;                                  ( 0    )
7335                ;                           IF ERRFLG .EQ. FALSE
7336                ;                             EXECUTE RESET
7337 13BA C2 03 14    JNZ  VRXEQ                  VRXEQ(ERRFLG)
7338                ;                                   (PSW:Z )
7339                ;                                   ( 0    )
7340                ;                           ENDIF
7341                ;                         ENDIF
7342                ;                       ENDIF
7343 13BD C9          RET                   RETURN
7346                ;VRMRS(ERRFLG)(CMBBUF)
7347                ;     (BIT   )(NIBSTR)
7348                ;     ( 0    )( I    )
7349                ;     (PSW:Z )( RAM  )
7350                ;     ( C    )( NC   )
7351                ;
7352                ;A,PSW DESTROYED
7353                ;REGISTERS DESTROYED
7354                ;
7355                ;SELECT VARIABLE RMRS FUNCTION
7356                ;
7357                VRMRS;                  ****ENTRY POINT
7358                ;                       SELECT FUNCTION VIA COMBINATION FORMAT
7359 13BE 3A 78 74    LDA  CMBBUF/2+X       A = CMBBUF[0..1]
7360                ;                       CASE (CMBBUF[0..1])
7361 13C1 FE 4F       CPI  4FH                **4F: CLEAR REGISTERS
7362 13C3 CA 92 13    JZ   VRCLR                    VRCLR(ERRFLG)
7363                ;                                     (PSW:Z )
7364                ;                                     ( 0    )
7365 13C6 FE 6F       CPI  6FH                **6F: RESET POSTAGE
7366 13C8 CA CE 13    JZ   VRSET                    VRSET(ERRFLG)
7367                ;                                     (PSW:Z )
7368                ;                                     ( 0    )
7369                ;                         **ELSE:
7370                ;                               PROCESS ERROR
```

```
7371 13CB C2 A1 0B   JMP  PROERR                PROERR(ERRFLG)
7372                ;                                (PSW:Z )
7373                ;                                ( 0    )
7374                ;                    ENDCASE
7375                ;                    RETURN
7378                ;VRSET(ERRFLG)(AMTBUF,DSCREG,DSCCRC)
7379                ;     (BIT   )(NIBSTR,NIBSTR,BYTE  )
7380                ;     ( 0    )( I    , 0    , 0    )
7381                ;     (PSW:Z )( RAM  , RAM  , RAM  )
7382                ;     ( C    )( NC   , C    , C    )
7383                ;
7384                ;A,PSW DESTROYED
7385                ;REGISTERS DESTROYED
7386                ;
7387                ;RESET VARIABLE RMRS DESCENDING REGISTER
7388                ;
7389                VRSET;               ****ENTRY POINT
7390                ;                    CHECK METER STATUS
7391 13CE CD 4E 0F   CALL LSTATE         LSTATE(FATMOD,NORMOD,SERMOD,PRVMOD)
7392                ;                          (PSW:S ,PSW:Z ,PSW:P ,PSW:C )
7393                ;                          ( 0    , 0    , 0    , 0    )
7394                ;                    IF NORMOD .EQ. FALSE
7395                ;                      PROCESS ERROR
7396 13D1 C2 A1 0B   JNZ  PROERR            PROERR(ERRFLG)
7397                ;                            (PSW:Z )
7398                ;                            ( 0    )
7399                ;                    ELSE
7400                ;                      CHECK AMOUNT FORMAT
7401 13D4 3A 70 74   LDA  AMTBUF/2+X        IF AMTBUF[1] .EQ. HEX0F
7402 13D7 E6 0F      ANI  0FH
7403 13D9 FE 0F      CPI  0FH
7404                ;                        PROCESS ERROR. NO DECIMAL ENTERED
7405 13DB CA A1 0B   JZ   PROERR              PROERR(ERRFLG)
7406                ;                              (PSW:Z )
7407                ;                              ( 0    )
7408                ;                      ELSE
7409                ;                        PERFORM RULE CHECK AND REFORMATTING
7410 13DE CD 03 14   CALL VRPREP              VRPREP(ERRFLG)
7411                ;                              (PSW:Z )
7412                ;                              ( 0    )
7413 13E1 C8         RZ                       IF ERRFLG .EQ. FALSE
7414                ;                          CALC NEW DESC REGISTER VALUE
7415 13E2 0E E7      MVI  C,AMTBUF+8-1         C = OFFSET, AMTBUF[7]
7416 13E4 06 E5      MVI  B,DSCREG+DSCSIZ-1    B = OFFSET, DSCREG[I=DSCSIZ-1]
7417 13E6 11 07 07   LXI  D,DSCSIZ*100H+DSCSIZ
7418                ;                          D = DSCSIZ
7419                ;                          E = DSCSIZ
7420 13E9 CD F8 06   CALL DECADD               DECADD(AMTBUF[7],DSCREG[I],
7421                ;                                ( @C      , @B      ,
7422                ;                                ( I/O     , I       ;
7423                ;
7424                ;                                DSCSIZ,DSCSIZ,OVRFLO)
7425                ;                                 D    , E    ,PSW:C )
7426                ;                                 I    , I    , 0    )
7427                ;                          IF OVRFLO .EQ. TRUE
7428                ;                            PROCESS ERROR. OVERFLOW
7429 13EC DA A1 0B   JC   PROERR              PROERR(ERRFLG)
7430                ;                                (PSW:Z )
7431                ;                                ( 0    )
7432                ;                          ELSE
7433                ;                            UPDATE DESCENDING REGISTER
7434 13EF 0E 2F      MVI  C,DSCREG             C = OFFSET, DSCREG
7435 13F1 06 E1      MVI  B,AMTBUF+8-DSCSIZ    B = OFFSET, AMTBUF[I=8-DSCSIZ]
7436 13F3 3E 07      MVI  A,DSCSIZ             A = DSCSIZ
7437 13F5 CD B3 0F   CALL MVLNIB               MVLNIB(DSCREG,AMTBUF[I],DSCSIZ,
7438                ;                                ( @C   , @B      , A    ,
7439                ;                                ( 0    , I       , I    ,
7440                ;
7441                ;                                NONBCD,NONZRO)
7442                ;                                PSW:S ,PSW:Z )
7443                ;                                 0    , 0    )
7444                ;                            UPDATE DESC REGISTER CRC
7445 13F8 47         MOV  B,A                  B = DSCSIZ
```

```
7446 13F9 CD B1 0E   CALL CRC                    CRC(DSCREG,DSCSIZ,CRCVAL)
7447                ;                               ( @C    , B     , D     )
7448                ;                               ( I     , I     , O     )
7449 13FC 7A         MOV  A,D                    DSCCRC = CRCVAL
7450 13FD 32 1B 74   STA  DSCCRC/2+X
7451                ;                            EXECUTE RESET
7452 1400 C3 03 14   JMP  VRXEQ                  VRXEQ(ERRFLG)
7453                ;                                (PSW:Z )
7454                ;                                ( O    )
7455                ;                            ENDIF
7456                ;                          ENDIF
7457                ;                        ENDIF
7458                ;                      ENDIF
7459                ;                      RETURN
7460                ;   Recharging programs have been deleted.
7461               VRPREP;
7462               VRPRE1; and
7463               VRXEQ;  are two (2) of the modules which have been removed for security
7464                ;   purposes.  One suitable system for the deleted set of modules
7465                ;   is disclosed in U. S. Patent No. 4,097,922 for REMOTE POSTAGE
7466                ;   METER CHARGING SYSTEM USING AN ADVANCED MICROCOMPUTERIZED
7467                ;   POSTAGE METER issued on June 27,1978 to Alton B. Eckert, Howell
7468                ;   A. Jones, Jr. and Frank T. Check, Jr.  This patent is hereby
7469                ;   incorporated by reference into the subject patent application.
7470                ; (*****************************************************************)
7471                ;
7472               ;THIS IS THE DEMO PROGRAM FOR 6 STEPS/DIGIT MECHANISM
7473                ;   USED FOR 45 DEG ENCODER  & 30 DEG SENSOR MOUNTING
7474               ;Objective
7475                ;   Position the stepper motor through specified number of steps.
7476                ;   Flag the errors if
7477                ;                      1. the move fails
7478                ;                      2. if the sensors are not in home position
7479                ;                         after the completion of a move
7480               ;Level:
7481                ;   Calls RENC , BKLASH routines
7482                ;   utilizes look up table setup for determining the step count
7483                ;   requirements for retries.
7484                ;   Exits with the power held on to both motors.  It is the duty of the
7485                ;   invoking routine to judiciously hold the appropriate home phase.
7486               ;Procedure MOVCLS(MOTOR,RETRIES,MCOUNT,SPEED:ERROR)
7487               ;ERROR := 0
7488               ;Input (PORT.SENSOR,SENSPTN)
7489               ;SENSPTN := SENSPTN and MSNMASK
7490               ;If SENSPTN = (BCDO or BCDC or BCDO or BCDC) then PASSFLAG := 0
7491                ;                                                  go to Loop1
7492                ;                                            else ERROR := 5
7493                ;                                                  End MOVCLS
7494               ;Loop1:     Do while (RETRIES > 0 and MCOUNT <> 0 and ERROR > 0 )
7495                ;           If PASSFLAG = 0 then  ECOUNT := MCOUNT * 2
7496                ;                                 MSTEP := MCOUNT * 6
7497                ;           Input (PORT.SENSOR,SENSPTN)
7498                ;           If MOTOR = BANK then
7499                ;                          SENSPTN := (SENSPTN / 4) and MASKDSENSR
7500                ;           If SENSPTN = 11 then MOTPTN := PHASE1    (....  11H..)
7501                ;                          else MOTPTN := PHASE2           44H
7502                ;           If MCOUNT > 0 then MOTPTN := MOTPTN * 4
7503                ;           Input (PORTB,MOTHPTN)
7504                ;           IF MOTOR = BANK then MOTPTN := MOTPTN and MASKMSN
7505                ;                                MOTHPTN := MOTHPTN and MASKLSN
7506                ;                                MOTHPTN := MOTHPTN or MOTPTN
7507                ;                          else MOTPTN := MOTPTN and MASKLSN
7508                ;                                MOTHPTN := MOTHPTN and MASKMSN
7509                ;                                MOTHPTN := MOTHPTN or MOTPTN
7510                ;           Output ( PORTB,MOTHPTN)
7511                ;           If MCOUNT > 0 then  MSTEP := MSTEP-1
7512                ;                               MOTPTN := MOTPTN * 2
7513                ;                          else  MSTEP := MSTEP + 1
7514                ;                               MOTPTN := MOTPTN / 2
7515                ;           For X = 1 to SPEED by 1
7516                ;                   Procedure RENC (MOTOR,SPEED,OLDPTN :ERROR,ADJCOUNT)
7517                ;           End For
```

```
7518                ;           If MSTEP <> 0 then
7519                ;                   If ERROR = 0 then Continue Do
7520                ;           else For Y =1 to 60 by 1
7521                ;                       Procedure RENC (MOTOR,OLDPTN: ERRORT,ADJCOUNT)
7522                ;               End For
7523                ;           MSTEP := MSTEP (look-up)
7524                ;           PASSFLAG := PASSFLAG + 1
7525                ;           Continue Do
7526                ;   End Do
7527                ;   If RETRIES = 0 or MCOUNT = 0 then
7528                ;                                   Procedure BKLASH
7529                ;If ERROR > 0 THEN End
7530                ;If BNKPAT = 01 then ERROR := 5; End
7531                ;            else if BNKPAT = 10 then ERROR :5; End
7532                ;                                   else if MCOUNT = 0 THEN    End
7533                ;                                                       else ERROR := 6;End
7534                ;If DGTPAT = 01 then ERROR := 5; End
7535                ;           else if DGTPAT = 10 then ERROR := 5 ; End
7536                ;                                 else if MCOUNT = 0 then End
7537                ;                                                       else ERROR := 6
7538                ;End movcls
7539                ;
7540                ;
7541                ; PARAM     (*C-REG*) COUNT : BYTE; (*- FOR CW, + FOR CCW*)
7542                ;   (*E-REG*) MOTOR : MOTORS; (*1 FOR BANK, 0 FOR DIGIT*)
7543                ;   (*H-REG*) SPEED : BYTE  ;Stepping speed of motor
7544                ;   (*L-REG*) TRIES : BYTE;
7545                ;
7546                ; VAR       (*B-REG*) ENC_COUNT : BYTE;
7547                ;   (*C-REG*) MOT_COUNT : BYTE;
7548                ;   (*D-REG*) PATTERN : BYTE;
7549                ;
7550 0000           BODO        EQU     0000B
7551 0003           BODC        EQU     0011B
7552 000C           BCDO        EQU     1100B
7553 000F           BCDC        EQU     1111B
7554 0000           PFLAGO      EQU     00
7555 0003           DGTMSK      EQU     03H
7556 000C           BNKMSK      EQU     0CH
7557 000F           LSNMSK      EQU     0FH
7558 00F0           MSNMSK      EQU     0F0H
7559 0011           PHASE1      EQU     11H
7560 0044           PHASE2      EQU     44H
7561 0003           SENSCL      EQU     03H
7562 0005           ERROR5      EQU     05H
7563 0006           ERROR6      EQU     06H
7565                MOVCLS:                                         ; BEGIN
7566 1403 AF            XRA     A       ; ERROR := NO_ERRORS;
7567 1404 32 38 74      STA     ERROR
7568                ;
7569                ;
7570 1407 3A 00 68  MOVC4:      LDA     PORT2A  ;Combination sensor check
7571 140A E6 0F         ANI     LSNMSK
7572 140C FE 00         CPI     BODO
7573 140E CA 23 14      JZ      MOVC7
7574 1411 FE 03         CPI     BODC
7575 1413 CA 23 14      JZ      MOVC7
7576 1416 FE 0C         CPI     BCDO
7577 1418 CA 23 14      JZ      MOVC7
7578 141B FE 0F         CPI     BCDC
7579 141D CA 23 14      JZ      MOVC7
7580 1420 C3 F9 14      JMP     MOVC60
7581                ;
7582                ;
7583 1423 3E 00     MOVC7:      MVI     A,PFLAGO  ;Passflag:=0
7584 1425 F5            PUSH    PSW
7585 1426 7D        MOVC05:     MOV     A,L     ; WHILE (TRIES > 0) AND (COUNT <> 0)
7586 1427 B7            ORA     A       ;       AND (ERROR = NO_ERRORS) DO
7587 1428 CA DB 14      JZ      MOVC50  ;branch here to movc70 for backlash correction
7588 142B 79            MOV     A,C
7589 142C B7            ORA     A
7590 142D CA DB 14      JZ      MOVC50  ;branch here to movc70 for backlash correction
```

```
1430 3A 38 74      LDA     ERROR
1433 B7            ORA     A
1434 C2 DB 14      JNZ     MOVC50
                                   ;     BEGIN
1437 F1            POP     PSW     ;Passflag check.
1438 B7            ORA     A
1439 F5            PUSH    PSW     ;
143A C2 56 14      JNZ     MOVC5
143D 79        MOVC1:      MOV     A,C             ;
143E 87            ADD     A
143F 47            MOV     B,A             ;ENC COUNT=2*COUNT
1440 87            ADD     A
1441 80            ADD     B               ;STEP = 6*COUNT
1442 4F            MOV     C,A
                 ;
                 ;
1447 7B            MOV     A,E
1444 B7            ORA     A
1445 3A 00 68      LDA     PORT2A
1448 CA 4D 14      JZ      MOVC6
                 ;
                 ;
144B 0F            RRC                     ;BANK MOTOR
144C 0F            RRC                     ;
                                   ;     CASE SIGN (MOT_COUNT) OF
144D E6 03     MOVC6:      ANI     DGTMSK          ;
144F 16 44         MVI     D,PHASE2                ;
1451 CA 56 14      JZ      MOVC8                   ;
1454 16 11         MVI     D,PHASE1
                 MOVC8:                    ;
1456 79            MOV     A,C                     ;
1457 B7            ORA     A                       ;
1458 7A            MOV     A,D                     ;
                                   ;
1459 FA 5F 14      JM      MOVC15          ;
145C 07            RLC
145D 07            RLC                                         ;
                                   ;                       AND PHASED AND PHASEA;
145E 57        MOVC10:     MOV     D,A     ;     END;
                 MOVC15:                   ;     REPEAT
145F 7B            MOV     A,E     ;         CASE MOTOR OF
1460 B7            ORA     A
1461 7A            MOV     A,D
1462 CA 73 14      JZ      MOVC20
1465 E6 F0         ANI     MSNMSK
1467 C5            PUSH    B
1468 47            MOV     B,A
1469 3A 02 70      LDA     PORTB
146C E6 0F         ANI     LSNMSK
146E B0            ORA     B
146F C1            POP     B
1470 C3 7E 14      JMP     MOVC25
1473 E6 0F     MOVC20:     ANI     LSNMSK  ;   DIGIT: PORTB := (PATTERN OR PHASESOFF R
1475 C5            PUSH    B
1476 47            MOV     B,A
1477 3A 02 70      LDA     PORTB                   ;
147A E6 F0         ANI     MSNMSK                  ;
147C B0            ORA     B                       ;
147D C1            POP     B                       ;
                                   ;               IS BEING MOVED
147E 32 02 70 MOVC25:      STA     PORTB   ;         END;
1481 79            MOV     A,C     ;         CASE SIGN (MOT_COUNT) OF
1482 B7            ORA     A
1483 7A            MOV     A,D
1484 FA 8C 14      JM      MOVC30
                                   ;             +1: BEGIN
1487 0D            DCR     C       ;                 MOT_COUNT := MOT_COUNT - 1;
1488 07            RLC             ;                 PATTERN := PATTERN ROL 1
1489 C3 8E 14      JMP     MOVC35  ;                 END;
                 MOVC30:                   ;             -1: BEGIN
148C 0C            INR     C       ;                 MOT_COUNT := MOT_COUNT - 1;
148D 0F            RRC             ;                 PATTERN := PATTERN ROR 1
```

```
                                        ;                END;
1488 57        MOVC35:     MOV     D,A     ;          END;
1489 C5            PUSH    B       ;         READ_ENCODERS (10, MOTOR, ENC_COUNT)
148A 48            MOV     C,B
148B D5            PUSH    D
148C E5            PUSH    H
148D 6C            MOV     L,H
148E CD 99 19      CALL    RENC
1491 E1            POP     H
1492 D1            POP     D
1493 79            MOV     A,C
1494 C1            POP     B
1495 47            MOV     B,A
1496 79            MOV     A,C     ;     UNTIL (MOT_COUNT = 0) OR (ERROR <> NO_ERRORS);
1497 B7            ORA     A
1498 CA A8 14      JZ      MOVC40
149B 3A 38 74      LDA     ERROR
149E B7            ORA     A
149F CA 5F 14      JZ      MOVC15
14A2 C5        MOVC40:     PUSH    B       ;     READ_ENCODERS (60, MOTOR, ENC_COUNT);
14A3 48            MOV     C,B
14A4 D5            PUSH    D
14A5 E5            PUSH    H
14A6 2E 3C         MVI     L,60.
14A8 CD 99 19      CALL    RENC
14AB E1            POP     H
14AC D1            POP     D
14AD 79            MOV     A,C
14AE C1            POP     B
14AF 47            MOV     B,A
14B0 B7            ORA     A       ;     COUNT := ENC_COUNT / 2;
14B1 F2 BC 14      JP      MOVC45
14B4 2F            CMA
14B5 3C            INR     A
14B6 E5        MOVC45:     PUSH    H
14B7 D5            PUSH    D
14B8 16 00         MVI     D,00H   ;Step error computation/lookup
14BA 5F            MOV     E,A
14BB 21 08 15      LXI     H,TABBASE
14BE 19            DAD     D
14BF 4E            MOV     C,M
14C0 78            MOV     A,B
14C1 B7            ORA     A
14C2 F2 CF 14      JP      MOVC42
14C5 79            MOV     A,C
14C6 2F            CMA
14C7 3C            INR     A
14C8 4F            MOV     C,A
14C9 D1        MOVC42:     POP     D
14CA E1            POP     H
14CB 2D            DCR     L
14CC F1            POP     PSW
14CD 3C            INR     A                       ;PASSFLAG:=PASSFLAG+1
14CE F5            PUSH    PSW
14CF C3 26 14      JMP     MOVC05
                ;
                ;
                ;
14D2 CD 1B 15 MOVC70:      CALL    BKLASH
14D5 F1       MOVC50:      POP     PSW             ;retrieve passflag;
14D6 3A 38 74      LDA     ERROR
14D9 B7            ORA     A
14DA C0            RNZ
                   ;
                ;
                ;
14DB 3A 39 74      LDA     BNKPAT  ; IF BANK_PAT NOT IN [00H, 03H]
14DE B7            ORA     A       ;    OR DIGIT_PAT NOT IN [00H,03H] THEN
14DF CA ED 14      JZ      MOVC55
14E2 FE 03         CPI     SENSOL
14E4 C2 F9 14      JNZ     MOVC60
14E7 3A 3A 74 MOVC55:      LDA     DGTPAT
14EA B7            ORA     A
```

```
14F1 CA FF 14      JZ      MOVC65
14F4 FE 03         CPI     SENSCL
14F6 CA FF 14      JZ      MOVC65
                                   ;     BEGIN
14F9 3E 05     MOVC60:     MVI     A,ERROR5        ;     ERROR := NOT_HOME;
14FB 32 38 74      STA     ERROR
14FE C9            RET             ;     RETURN
                                   ;     END;
14FF 79        MOVC65:     MOV     A,C     ; IF COUNT <> 0 THEN ERROR := MOVE_FAILED
1500 B7            ORA     A
1501 C8            RZ
1502 3E 06         MVI     A,ERROR6
1504 32 38 74      STA     ERROR
1507 C9            RET
                                   ; END;
                ;
                ;
1508 00         TABBASE:DB  0
1509 04            DB      4H
150A 06            DB      6D
150B 08            DB      8D
150C 0C            DB      12D
150D 10            DB      16D
150E 12            DB      18D
150F 14            DB      20D
1510 18            DB      24D
1511 1C            DB      28D
1512 1E            DB      30D
1513 22            DB      34D
1514 24            DB      36D
1515 28            DB      40D
1516 2A            DB      42D
1517 2C            DB      44D
1518 30            DB      48D
1519 34            DB      52D
151A 36            DB      54D
                ;
                ;
                ;BACKLASH CORRECTION ROUTINE
                ;This routine advances the digit stepper motor by one step
                ;beyond the expected settling point and then drives one
                ;step backwards  to the final settling point
                ;None of the registers are affected.
                ;This routine will be invoked only if all retries are exhausted or if al
                ;motor phases are applied.
                ;This routine will not be invoked in case of an error condition arises
                ;in RENC routine before the specified number of pulses are applied
                ;
151B F5         BKLASH:     PUSH    PSW
151C C5            PUSH    B
151D 7B            MOV     A,E             ;motor type check
151E B7            ORA     A
151F C2 3C 15      JNZ     BKL50
1522 3A 02 70      LDA     PORTD
1525 F5            PUSH    PSW
1526 E6 F0         ANI     MSNMSK
1528 F5            PUSH    PSW
1529 7A            MOV     A,D             ;D register has the next pattern output
152A E6 0F         ANI     LSNMSK
152C 47            MOV     B,A
152D F1            POP     PSW
152E B0            ORA     B
152F 32 02 70      STA     PORTB
1532 CD A9 17      CALL    DEL30M          ;forward pulse
1535 F1            POP     PSW
1536 32 02 70      STA     PORTB
1539 CD A9 17      CALL    DEL30M          ;backward pulse to final settling point
153C C1         BKL50:      POP     B
153D F1            POP     PSW
153E C9            RET
                ;
                ;
```

```
7811                ;   LEDON ROUTINE
7812                ;   TURNS ON THE STROBE FOR LEDS
7813                ;
7814                ;
7815 153F F5        LEDON:      PUSH    PSW             ;SAVE CONTENTS
7816 1540 3A 01 70      LDA     PORTA           ;LOADS THE CURRENT STATUS
7817 1543 E6 DF         ANI     0DFH            ;BIT RESET
7818 1545 32 01 70      STA     PORTA           ;PORT RESET
7819 1548 F1            POP     PSW
7820 1549 C9            RET                     ;
7821                ;
7822                ;
7823                ;   LEDOFF ROUTINE
7824                ;   TURNS THE STROBE OFF
7825                ;
7826                ;
7827 154A F5        LEDOFF:     PUSH    PSW                     ;
7828 154B 3A 01 70      LDA     PORTA                   ;
7829 154E F6 20         ORI     20H                     ;
7830 1550 32 01 70      STA     PORTA                   ;
7831 1553 F1            POP     PSW             ;
7832 1554 C9            RET                             ;
7833                ;
7834                ;
7835                ;
7836                ;
7837                ;
7839                ;
7840                ;   DELAY ROUTINES
7841                ;
7842                ;
7843 1555 00        DEL300:     NOP
7844 1556 00            NOP             ;ADJUST TIME
7845 1557 CD 64 15      CALL    DEL75   ;75 MICRO SECS
7846 155A CD 64 15      CALL    DEL75   ;
7847 155D CD 64 15      CALL    DEL75           ;
7848 1560 CD 64 15      CALL    DEL75           ;
7849 1563 C9            RET                     ;
7850                ;
7851                ;
7852                ;
7853 1564 F5        DEL75:      PUSH    PSW                     ;
7854 1565 3E 0A         MVI     A,0AH                   ;
7855 1567 3D        DEL1:       DCR     A                       ;
7856 1568 C2 67 15      JNZ     DEL1                    ;
7857 156B F1            POP     PSW                     ;
7858 156C C9            RET                             ;
7859                ;
7860                ;
7862                ;   SENSOR INITIALISATION ROUTINE
7863                ;
7864                ;
7865 156D           INITSM:
7866 156D CD 3F 15 SENSR:       CALL    LEDON                   ;LED STROBE ON
7867 1570 CD 64 15      CALL    DEL75                   ;SETTLING TIME
7868 1573 3A 00 68      LDA     PORT3AD
7869 1576 47            MOV     B,A                     ;
7870 1577 E6 03         ANI     DGTMSK
7871 1579 CA 9E 15      JZ      SENS35
7872 157C FE 03         CPI     DGTMSK
7873 157E C2 A3 15      JNZ     SENS40
7874 1581 3E 02         MVI     A,02H
7875 1583 32 02 70 SENS25:      STA     PORTB
7876 1586 CD A7 17      CALL    DEL30M
7877 1589 3A 00 68      LDA     PORT3AD
7878 158C 47            MOV     B,A
7879 158D E6 03         ANI     DGTMSK                  ;
7880 158F 32 CA 74      STA     DGTPAT                  ;DIGIT PATTERN
7881 1592 78            MOV     A,B                     ;
7882 1593 0F            RRC                             ;
7883 1594 0F            RRC                             ;
7884 1595 E6 03         ANI     DGTMSK                  ;
```

```
7885 1597 32 39 74      STA     BNKPAT                  ;BANK PATTERN
7886 159A CD 4A 15      CALL    LEDOFF
7887 159D C9            RET                             ;
7888                ;
7889                ;
7890 159E 3E 08     SENS35:     MVI     A,08H
7891 15A0 C3 83 15      JMP     SENS25
7892                ;
7893                ;
7894 15A3 3E 0F     SENS40:     MVI     A,15D
7895 15A5 32 38 74      STA     ERROR
7896 15A8 C3 9E 15      JMP     SENS35
7897                ;
7899                ; (*************************************************************)
7900                ;Objective: To compare present encoder status to previous encoder value
7901                ;           and determine the deviation as no change, clockwise movement
7902                ;           of one step, counterclockwise movement of one step or as an
7903                ;           error, which corresponds to a two step jump in the status.
7904                ;
7905                ;           Does not call any subroutines
7906                ;
7907                ;
7908                ; FUNCTION (*A-REG*) ENCODER_MOVE : BYTE;
7909                ;
7910                ; PARAM     (*C-REG*) PATTERN : ENCODER_PATTERNS;
7911                ;   (*E-REG*) NEW_PATTERN : ENCODER_PATTERNS;
7912                ;
7913                ENCMOV:                     ; BEGIN
7914 15AB 79            MOV     A,C     ; CASE PATTERN ROL 2 OR NEW_PATTERN OF
7915 15AC 07            RLC
7916 15AD 07            RLC
7917 15AE B3            ORA     E
7918 15AF 5F            MOV     E,A
7919 15B0 AF            XRA     A
7920 15B1 57            MOV     D,A
7921 15B2 21 B8 15      LXI     H,ENCT
7922 15B5 19            DAD     D
7923 15B6 7E            MOV     A,M
7924 15B7 C9            RET
7925 15B8 00        ENCT:       DB      0       ;     00H: ENCODER_MOVE := 0;
7926 15B9 01            DB       1      ;     01H: ENCODER_MOVE := +1;
7927 15BA FF            DB      -1      ;     02H: ENCODER_MOVE := -1;
7928 15BB 02            DB      +2      ;     03H: ENCODER_MOVE := +2;
7929 15BC FF            DB      -1      ;     04H: ENCODER-MOVE := -1;
7930 15BD 00            DB      0       ;     05H: ENCODER_MOVE := 0;
7931 15BE 02            DB      +2      ;     06H: ENCODER_MOVE := +2;
7932 15BF 01            DB      +1      ;     07H: ENCODER_MOVE := +1;
7933 15C0 01            DB      +1      ;     08H: ENCODER_MOVE := +1;
7934 15C1 02            DB      +2      ;     09H: ENCODER_MOVE := +2;
7935 15C2 00            DB      0       ;     0AH: ENCODER_MOVE := 0;
7936 15C3 FF            DB      -1      ;     0BH: ENCODER_MOVE := -1;
7937 15C4 02            DB      +2      ;     0CH: ENCODER_MOVE := +2;
7938 15C5 FF            DB      -1      ;     0DH: ENCODER_MOVE := -1;
7939 15C6 01            DB      +1      ;     0EH: ENCODER_MOVE := +1;
7940 15C7 00            DB      0       ;     0FH: ENCODER_MOVE := 0;
7941                                    ; END
7942                                    ; END;
7944                ; (*************************************************************)
7945                ;THIS SEGMENT IS USED TO MOVE THE BANK & DIGIT IN TO HOME
7946                ;POSITION UPON DETECTION OF AN ERROR IN ATTEMPT TO
7947                ;POSITION THE RACKS TO 00.00
7948                ;
7949                ; PROCEDURE ENDMOV_CLOSED;
7950                ;
7951                ; PARAM     (*C-REG*) COUNT : BYTE; (*- FOR CW, + FOR CCW*)
7952                ;   (*E-REG*) MOTOR : MOTORS; (*1 FOR BANK, 0 FOR DIGIT*)
7953                ;
7954                ; VAR       (*B-REG*) ENC_COUNT : BYTE;
7955                ;   (*C-REG*) MOT_COUNT : BYTE;
7956                ;   (*D-REG*) PATTERN : BYTE;
7957                ;
7958                ;
```

```
                    ;
00F0                MSNMASK     EQU     0F0H
000F                LSNMASK     EQU     0FH
0014                NUMRD1      EQU     20D
003C                SETLTIM     EQU     60D
                    ;
                    ;
                    ;
                    ;
                    ;
15C8 AF             ENDMOV:     XRA     A                       ;     REPEAT
15C9 32 38 74           STA     ERROR
15CC 7B             ENDM05:     MOV     A,E     ;         CASE MOTOR OF
15CD B7                 ORA     A
15CE 7A                 MOV     A,D
15CF CA E0 15           JZ      ENDM20          ;MOTOR(BANK,DIGIT)
                    ;
                    ;
15D2 E6 F0              ANI     MSNMASK
15D4 C5                 PUSH    B
15D5 47                 MOV     B,A
15D6 3A 02 70           LDA     PORTB
15D9 E6 0F              ANI     LSNMASK
15DB B0                 ORA     B
15DC C1                 POP     B
15DD C3 E9 15           JMP     ENDM25
                    ;
                    ;
15E0 E6 0F          ENDM20:     ANI     LSNMASK     ;   DIGIT: PORTB :=
                                                                PATTERN OR PHASESOFF ROL 4)
15E2 C5                 PUSH    B
15E3 47                 MOV     B,A
15E4 3A 02 70           LDA     PORTB                   ;
15E7 E6 F0              ANI     MSNMASK                 ;
15E9 B0                 ORA     B                       ;
15EA C1                 POP     B                       ;
                                        ;               IS BEING MOVED
15EB 32 02 70 ENDM25:   STA     PORTB   ;         END;
15EE 79                 MOV     A,C     ;         CASE SIGN (MOT_COUNT) OF
15EF B7                 ORA     A
15F0 7A                 MOV     A,D
15F1 FA F9 15           JM      ENDM30
                                        ;             +1: BEGIN
15F4 0D                 DCR     C       ;                 MOT_COUNT := MOT_COUNT - 1;
15F5 07                 RLC             ;                 PATTERN := PATTERN ROL 1
15F6 C3 FB 15           JMP     ENDM35  ;                 END;
                    ;
                    ;
                    ENDM30:                     ;             -1: BEGIN
15F9 0C                 INR     C       ;                 MOT_COUNT := MOT_COUNT - 1;
15FA 0F                 RRC             ;                 PATTERN := PATTERN ROR 1
                                        ;                 END;
15FB 57             ENDM35:     MOV     D,A     ;         END;
15FC C5                 PUSH    B       ;         READ_ENCODERS (10, MOTOR, ENC_COUNT)
15FD 48                 MOV     C,B
15FE D5                 PUSH    D
15FF E5                 PUSH    H
1600 2E 14              MVI     L,NUMRD1
1602 CD 99 19           CALL    RENC
1605 E1                 POP     H
1606 D1                 POP     D
1607 79                 MOV     A,C
1608 C1                 POP     B
1609 47                 MOV     B,A
160A 79                 MOV     A,C     ;     UNTIL (MOT_COUNT = 0) OR (ERROR <> NO_ERRORS);
160B B7                 ORA     A
160C C2 CC 15           JNZ     ENDM05
                    ;
                    ;
160F C5             ENDM40:     PUSH    B       ;     READ_ENCODERS (60, MOTOR, ENC_COUNT);
1610 48                 MOV     C,B
1611 D5                 PUSH    D
```

```
1612 E5          PUSH    H
1613 2E 3C       MVI     L,SETLTIM
1615 CD 99 19    CALL    RENC
1618 E1          POP     H
1619 D1          POP     D
161A 79          MOV     A,C
161B C1          POP     B
161C 47          MOV     B,A
161D B7          ORA     A       ;     COUNT := ENC_COUNT / 2;
161E 3E 07       MVI     A,07H                   ;ERROR 7
1620 C8          RZ                              ;NORMAL EXIT
                 ;
                 ;
1621 32 39 74    STA     ERROR
1624 C9          RET                             ;ERROR EXIT
                 ;
0044             HPHAM1      EQU     044H
0088             HPHASE      EQU     88H
0000             SENS00      EQU     00H
0001             SENS01      EQU     01H
0002             SENS02      EQU     02H
0003             SENS03      EQU     03H
0004             SENS04      EQU     04H
0005             SENS05      EQU     05H
0006             SENS06      EQU     06H
0007             SENS07      EQU     07H
0008             SENS08      EQU     08H
0009             SENS09      EQU     09H
000A             SENS10      EQU     0AH
000B             SENS11      EQU     0BH
000C             SENS12      EQU     0CH
000D             SENS13      EQU     0DH
000E             SENS14      EQU     0EH
000F             SENS15      EQU     0FH
0003             SENMSK      EQU     03H
                 ;
                 ;
1625 CD 6D 15    SEKPOS:     CALL    SENSR
1628 CD 3F 15        CALL    LEDON
162B CD 3B 16        CALL    HDSEEK
162E CD 4A 15        CALL    LEDOFF
1631 CD BC 18        CALL    MODLN
1634 CD B0 18        CALL    ERRHDR
1637 C4 B5 18        CNZ     EXTERR
163A C9              RET
                 ;
                 ;
                 ;
                 ;
                 ;
                 ;Procedure HDSEEK
                 ;Objective
                 ;    This segment initialises the print wheels to 00.00 position.
                 ;    Prior to the movement of the racks this segment aligns the
                 ;    bank and digit motors to legitimate home positions. The 00.00
                 ;    location is attained by hitting against the mechanical blocks.
                 ;    Three retries will be provided before coming to the conclusion
                 ;    that an error in movement is detected.
                 ;Level
                 ;;
                 ;
                 ;   RCOUNTERB := 4
                 ;   RCOUNTERC := 8                  ;RETRY COUNTERS
                 ;SEKP00:RCOUNTERB:= RCOUNTERB-1
                 ;   If RCOUNTERB = 0 then ERROR := 12 ;     End.
                 ;   MOTPATN := HOMEPHASE-1
                 ;   Output(PORTB,MOTPATN)
                 ;   Procedure TIMEDELAY(30msec)
                 ;   MOTPATN := HOMEPHASE
                 ;   Output (PORTB,MOTPATN)
                 ;   Procedure TIMEDELAY(30msec)
                 ;   RCOUNTERC := RCOUNTERC - 1
                 ;   If RCOUNTERC = 0 then ERROR := 12 ;             End.
```

```
8104          ;   Input (PORT.SENSOR,SENSRPTN)
8105          ;   SENSRPTN := SENSRPTN.LSNMASK
8106          ;   Case SENSRPTN   00,03,12,15     SEKP85
8107          ;                   01,02,13,14     SEKP01
8108          ;                   04,07,08,11     SEKP02
8109          ;                   05,06,09,10     SEKP03
8110          ;
8111          ;   SEKP01: Procedure DALIGN(,TYPE 2 ERROR)
8112          ;           If TYPE2ERROR = FALSE then go to STEP0
8113          ;           else MOTPTN:= NOPHASEON
8114          ;                Output (PORTB,MOTPTN)
8115          ;                Procedure TIMEDELAY (30msec)
8116          ;                Go to SEEKP00
8117          ;   SEKP02: Procedure BALIGN(TYPE2ERROR)
8118          ;           If TYPE2ERROR = FALSE then go to STEP0
8119          ;           else MOTPTN := NOPHASEON
8120          ;                Procedure TIMEDELAY(30msec)
8121          ;                Go to SEEKP00
8122          ;   SEKP03: Procedure DALIGN(TYPE2 ERROR)
8123          ;           If TYPE2ERROR = FALSE then go to STEP0
8124          ;           else  Procedure BALIGN(TYPE2ERROR)
8125          ;           If TYPE2ERROR = FALSE then go to STEP0
8126          ;           else Input (PORTB,MOTPTN)
8127          ;                MOTPTN := MOTPTN.LSNMSK
8128          ;                Output (PORTB,MOTPTN)
8129          ;                Procedure TIMEDELAY(30msec)
8130          ;                Procedure DALIGN(TYPE2ERROR)
8131          ;                If TYPE2ERROR = TRUE then Input (PORTB,MOTPTN)
8132          ;                                          MOTPTN := NOPHASEON
8133          ;                                          Output(PORTB,MOTPTN)
8134          ;                                          Procedure TIMEDELAY(30msec)
8135          ;                                          Go to SEEKP00
8136          ;                else        Input (PORTB,MOTPTN)
8137          ;                            MOTPTN:=(( MOTPTN.LSNMSK)+HOMEPHASEBANK))
8138          ;                            Output (PORTB,MOTPTN)
8139          ;                            Procedure TIMEDELAY(30msec)
8140          ;                            Go to STEP0
8141          ;   SEKP85:
8142          ;           Procedure PTNCHK(DIGIT:PTNFLAG)
8143          ;           If PTNFLAG <> 0 then go to SEKP00
8144          ;           Procedure PTNCHK(BANK,PTNFLAG)
8145          ;           If PTNFLAG <> 0 then go to SEKP00
8146          ;end case
8147          ;
8148          ;   SEKP05: Procedure MOVE(DIGIT,CCW,1,SPD8:ERROR)
8149          ;           Do while ERROR = 0
8150          ;                   Procedure MOVE(DIGIT,CCW,1,SPD8:ERROR)
8151          ;           End do.
8152          ;           Procedure SELDRN(:DRN)
8153          ;           Procedure POHOME(DRN:ERROR)
8154          ;           If ERROR <>0 then End hdseek.
8155          ;
8156          ;           Procedure MOVE(BANK,CCW,1,SPD8:ERROR)
8157          ;           Do while ERROR = 0
8158          ;                   Procedure MOVE (BANK,CCW,1,SPD8:ERROR)
8159          ;           end do.
8160          ;           If BNKPAT = 01 then DRN:=CW else DRN:=CCW
8161          ;           Procedure POHOME(DRN,ERROR)
8162          ;           If ERROR <> 0 then End Hdseek.
8163          ;           Procedure MOVE(BANK,CW,4,SPD8:ERROR)
8164          ;           If ERROR <> 0 then End Hdseek.
8165          ;           For BANK:=0 TO 4 by 1 Do
8166          ;                   Procedure MOVE(DIGIT,CCW,1,SPD8:ERROR)
8167          ;                   Do while ERROR =FALSE
8168          ;                           Procedure MOVE(DIGIT,CCW,1,SPD8:ERROR)
8169          ;                   end do
8170          ;                   Procedure SELDRN(:DRN)
8171          ;                   Procedure POHOME(DRN:ERROR)
8172          ;                   If ERROR = TRUE then End hdseek.
8173          ;                   Procedure MOVE(DIGIT,CW,9,SPD8:ERROR)
8174          ;                   If ERROR = TRUE then End Hdseek.
8175          ;                   BANK:= BANK+1
```

```
8176                ;                   If BANK = 2 then
8177                ;                           Procedure MOVE(BANK,CCW,1,SPD8:ERROR)
8178                ;                           If ERROR = TRUE then end Hdseek.
8179                ;                   end do
8180                ;           end for.
8181                ;           Procedure MOVE (BANK,CW,2,SPD8:ERROR)
8182                ;           If ERROR = TRUE then end hdseek.
8183                ;           Procedure MOVE (DIGIT,CW,2,SPD8:ERROR)
8184                ;           If ERROR = TRUE then end hdseek.
8185                ;           Input (PORTB.MOTPTN)
8186                ;           MOTPTN:=MOTPTN.MSNMSK
8187                ;           Output(PORTB,MOTPTN)
8188               ;END.
8189               ;
8190               ;
8191 163B 01 08 04 HDSEEK:     LXI     B,408H                  ;RETRY COUNT
8192 163E C5           PUSH    B
8193 163F C1       SEKP00:     POP     B
8194 1640 05           DCR     B
8195 1641 CA 5A 16     JZ      EREXIT
8196               ;
8197               ;
8198 1644 C5           PUSH    B
8199 1645 3E 44        MVI     A,HPHAM1
8200 1647 32 02 70     STA     PORTB
8201 164A CD A9 17     CALL    DEL30M
8202 164D 3E 88        MVI     A,HPHASE
8203 164F 32 02 70     STA     PORTB
8204 1652 CD A9 17     CALL    DEL30M
8205 1655 C1       STEP0:      POP     B
8206 1656 0D           DCR     C
8207 1657 C2 60 16     JNZ     CSTEP0
8208 165A 3E 0C    EREXIT:     MVI     A,12D
8209 165C 32 38 74     STA     ERROR
8210 165F C9           RET
8211               ;
8212               ;
8213 1660 C5       CSTEP0:     PUSH    B
8214 1661 3A 00 68     LDA     PORT2A                  ;
8215 1664 E6 0F        ANI     LSNMSK
8216               ;
8217               ;
8218 1666 21 73 16     LXI     H,BASE5
8219 1669 16 00        MVI     D,00H
8220 166B 87           ADD     A
8221 166C 5F           MOV     E,A
8222 166D 19           DAD     D
8223 166E 5E           MOV     E,M
8224 166F 23           INX     H
8225 1670 56           MOV     D,M
8226 1671 EB           XCHG
8227 1672 E9           PCHL
8228               ;
8229               ;
8230               ;
8231 1673 D2 16    BASE5:      DW      SEKP85
8232 1675 93 16        DW      SEKP01
8233 1677 93 16        DW      SEKP01
8234 1679 D2 16        DW      SEKP85
8235 167B A5 16        DW      SEKP02
8236 167D AF 16        DW      SEKP03
8237 167F AF 16        DW      SEKP03
8238 1681 A5 16        DW      SEKP02
8239 1683 A5 16        DW      SEKP02
8240 1685 AF 16        DW      SEKP03
8241 1687 AF 16        DW      SEKP03
8242 1689 A5 16        DW      SEKP02
8243 168B D2 16        DW      SEKP85
8244 168D 93 16        DW      SEKP01
8245 168F 93 16        DW      SEKP01
8246 1691 D2 16        DW      SEKP85
8248               ;
8249               ;
8250               ;   JZ      SEKP90
```

```
8251                ;                       ;CHECKING DIGIT POSITION
8252                ;   CPI     SENS01
8253                ;   JZ      SEKP01
8254                ;
8255                ;   CPI     SENS02
8256                ;   JZ      SEKP01
8257                ;;
8258                ;   CPI     SENS13
8259                ;   JZ      SEKP01
8260                ;;
8261                ;   CPI     SENS14
8262                ;   JZ      SEKP01
8263                ;;
8264                ;   CPI     SENS04
8265                ;   JZ      SEKP02
8266                ;;
8267                ;   CPI     SENS07
8268                ;   JZ      SEKP02
8269                ;;
8270                ;   CPI     SENS08
8271                ;;  JZ      SEKP02
8272                ;;
8273                ;   CPI     SENS11
8274                ;   JZ      SEKP02
8275                ;;;
8276                ;   CPI     SENS05
8277                ;   JZ      SEKP03
8278                ;;
8279                ;   CPI     SENS06
8280                ;   JZ      SEKP03
8281                ;;
8282                ;   CPI     SENS09
8283                ;   JZ      SEKP03
8284                ;;
8285                ;   CPI     SENS10
8286                ;   JZ      SEKP03
8287                ;;
8288                ;   CPI     SENS03
8289                ;   JZ      SEKP90
8290                ;;
8291                ;   JMP     SEKP05
8292                ;
8294                ;
8295                ;                       DIGIT NOT IN HOME
8296 1693 CD E7 17 SEKP01:      CALL    DALIGN
8297 1696 B7            ORA     A
8298 1697 CA 55 16      JZ      STEP0           ;No Error condition
8299                                            ;Digit aligned and phased
8300                                            ;Bank aligned and phased
8301 169A
8302                                            ;Type 1 error
8303                                            ;Digit aligned and phased
8304                                            ;Bank not aligned and/or phased
8305                                            ;
8306 169A 3E 00    SEKP04:      MVI     A,00H           ;Type 2 error
8307                                            ;Digit not aligned and/or phased
8308                                            ;Bank don't care
8309 169C 32 02 70 SEP11:       STA     PORTB
8310 169F CD A9 17      CALL    DEL30M
8311 16A2 C3 3F 16      JMP     SEKP00
8312 16A5 CD 12 18 SEKP02:      CALL    BALIGN
8313 16A8 B7            ORA     A
8314 16A9 CA 55 16      JZ      STEP0           ;No Error condition
8315                                            ;Digit aligned and phased
8316                                            ;Bank aligned and phased
8317                                            ;
8318                                            ;Type 1 Error
8319                                            ;Bank aligned and phased
8320                                            ;Digit not aligned and/or phased
8321 16AC C3 9A 16      JMP     SEKP04
8322 16AF CD E7 17 SEKP03:      CALL    DALIGN
8323 16B2 B7            ORA     A
```

```
16B3 CA 55 16      JZ      STEP0          ;NO error condition
                 ;
                 ;
16B6
                                          ;Type 2 error
16B6 CD 12 18      CALL    BALIGN
16B9 B7            ORA     A
16BA CA 55 16      JZ      STEP0          ;No error condition
                 ;
                 ;
                                          ;Type 1 Error condition
                 ;
                 ;
16BD 3A 02 70      LDA     PORTB
16C0 E6 0F         ANI     LSNMSK
16C2 32 02 70      STA     PORTB
16C5 CD A9 17      CALL    DEL30M
                 ;
                 ;
                 ;
                 ;
16C8 CD E7 17      CALL    DALIGN
16CB B7            ORA     A
16CC C2 9A 16      JNZ     SEKP04
                 ;
                 ;
                 ;
                 ;   LDA     PORTB
                 ;   ANI     LSNMSK
                 ;   ORI     80H
                 ;   STA     PORTB
                 ;   CALL    DEL30M
16CF C3 55 16      JMP     STEP0
                 ;;
                 ;
                 ;
                 ;
16D2 1E 00       SEKP05:   MVI     E,00
16D4 CD 2A 19      CALL    PINCHK
16D7 C2 3F 16      JNZ     SEKP00
16DA 1C            INR     E
16DB CD 2A 19      CALL    PINCHK
16DE C2 3F 16      JNZ     SEKP00
                 ;;
                 ;
16E1 C1          SEKP05:   POP     B
16E2 3A 3A 74    SEKP06:   LDA     DGTPAT
16E5 F5            PUSH    PSW
16E6 0E 01         MVI     C,1                ;
16E8 1E 00         MVI     E,00               ;DIGIT MOTOR
16EA 21 03 08      LXI     H,803H             ;RE TRIES
16ED CD 03 14      CALL    MOVCLS             ;EXIT FROM LOCK TRY
16F0 3A 38 74      LDA     ERROR              ;
16F3 B7            ORA     A                  ;
16F4 C2 FB 16      JNZ     SEKP07
16F7 F1            POP     PSW
16F8 C3 E2 16      JMP     SEKP06             ;
                 ;
                 ;
                 ;
16FB F1          SEKP07:   POP     PSW
16FC CD 40 18      CALL    SELDRN
                 ;
16FF CD C5 18    SEKP19:   CALL    POHOME
                 ;
1702 C0            RNZ
1703             SEKP10:
1703 0E 01         MVI     C,01               ;CLOCKWISE 1STEP
1705 1E 01         MVI     E,01
1707 21 03 09      LXI     H,903H             ;BANK MOTOR
170A CD 03 14      CALL    MOVCLS             ;BANK POSITION IDENTIFICATION
170D 3A 38 74      LDA     ERROR              ;
```

```
1710 B7          ORA     A                       ;
1711 CA 03 17    JZ      SEKP10                  ;
                 ;
                 ;
1714 3A 39 74    LDA     BNKPAT
1717 2E 00       MVI     L,00H
1719 FE 01       CPI     01
171B CA 1F 17    JZ      SEKP12
171E 2C          INR     L
                 ;
                 ;
171F CD C5 18 SEKP12:    CALL    POHOME
1722 C0          RNZ
                 ;
                 ;
                 ;
1723 1E 01       MVI     E,01                    ;
1725 0E FC       MVI     C,-4H                   ;
1727 21 03 08    LXI     H,803H                  ;BANK IS BEING POSITIONED TO EXTREME
172A CD 03 14    CALL    MOVCLS                  ;
172D CD B0 18    CALL    ERRHDR                  ;
1730 C0          RNZ                             ;EXITS ON FATAL ERROR
                 ;
                 ;
1731 0E 05       MVI     C,5H                    ;
1733 C5       SEKP15:    PUSH    B                       ;INDEX STORAGE
1734 3A 3A 74 SEKP20:    LDA     DGTPAT
1737 F5          PUSH    PSW
1738 0E 01       MVI     C,1                     ;CLOCKWISE 1 STEP
173A 1E 00       MVI     E,00                    ;DIGIT MOTOR
173C 21 03 08    LXI     H,803H                  ;RETRIES
173F CD 03 14    CALL    MOVCLS                  ;MOVE DIGIT TO EXTREME..9
1742 3A 38 74    LDA     ERROR                   ;
1745 B7          ORA     A                       ;
1746 C2 4D 17    JNZ     SEKP21                  ;
1749 F1          POP     PSW
174A C3 34 17    JMP     SEKP20
                 ;
                 ;
                 ;
174D F1       SEKP21:    POP     PSW
174E CD 40 18    CALL    SELDRN
1751 CD C5 18 SEKP23:    CALL    POHOME                  ;
                 ;
1754 C2 B3 17    JNZ     SEEK26
1757 0E F7       MVI     C,-9H                   ;CLOCKWISE 9STEPS
1759 1E 00       MVI     E,00                    ;
175B 21 03 08    LXI     H,803H                  ;RE TRIES
175E CD 03 14    CALL    MOVCLS                  ;POSITION TO 0
1761 CD B0 18    CALL    ERRHDR                  ;
1764 C1          POP     B                       ;RESTORE STACK
1765 C0          RNZ                             ;FATAL ERROR  EXIT
1766 00          NOP
1767 00          NOP
1768 00          NOP
1769 00          NOP
                 ;
                 ;
                 ;
                 ;
176A 0D       SEKP22:    DCR     C                       ;
176B CA 87 17    JZ      SEKP30                  ;
176E C5       SEKP25:    PUSH    B                       ;INDEX RESTORE
176F 0E 01       MVI     C,1                     ;CLOCWISE 1 STEP
1771 1E 01       MVI     E,01                    ;BANK MOTOR
1773 21 03 08    LXI     H,803H                  ;RETRIES
1776 CD 03 14    CALL    MOVCLS                  ;GO  TO NEXT BANK
1779 CD B0 18    CALL    ERRHDR                  ;
177C C1          POP     B                       ;
177D C0          RNZ                             ;FATAL ERROR EXIT
                 ;
177E 79          MOV     A,C                     ;
177F FE 03       CPI     03                      ;HOME?
```

```
8470 1781 C2 33 17      JNZ     SEKP15                  ;
8471 1784 C3 6A 17      JMP     SEKP22                  ;
8472                ;
8473                ;
8474                ;
8475 1787 0E FE     SEKP30:     MVI     C,-2H                   ;COUNTER CLOCKWISE 2 STEPS
8476 1789 1E 01         MVI     E,01                    ;BANK MOTOR
8477 178B 21 03 08      LXI     H,803H                  ;
8478 178E CD 03 14      CALL    MOVCLS                  ;MOVE BANK TO HOME
8479 1791 CD B0 18      CALL    ERRHDR                  ;
8480 1794 C0            RNZ                             ;FATAL ERROR EXIT
8481                ;
8482                ;
8483 1795 0E FE         MVI     C,-2H                   ;COUNTER CLOCKWISE 1 STEP
8484 1797 1E 00         MVI     E,00                    ;DIGIT MOTOR
8485 1799 21 03 08      LXI     H,803H                  ;
8486 179C CD 03 14      CALL    MOVCLS                  ;SET DIGIT IN TO LOCK
8487 179F CD B0 18      CALL    ERRHDR                  ;
8488 17A2 C9            RET
8489                ;
8490                    ;
8492 17A3 C5        DEL6M:      PUSH    B
8493 17A4 06 14         MVI     B,20D
8494 17A6 C3 AC 17      JMP     DELM1
8495                ;
8496                ;
8497                ;
8498 17A9 C5        DEL30M:     PUSH    B
8499 17AA 06 64         MVI     B,100D
8500 17AC CD 55 15 DELM1:       CALL    DEL300
8501 17AF 05            DCR     B
8502 17B0 C2 AC 17      JNZ     DELM1
8503 17B3 C1        SEEK26:     POP     B
8504 17B4 C9            RET
8505                ;
8506                ;
8507                ;
8509                ;
8510 17B5 01 DC 17 DPTSP:       LXI     B,BASEAD
8511 17B8 21 02 70      LXI     H,PORTB
8512 17BB 7B            MOV     A,E
8513 17BC B7            ORA     A
8514 17BD 7E            MOV     A,M
8515 17BE CA D4 17      JZ      DPTS05
8516                ;
8517                ;
8518 17C1 7E            MOV     A,M
8519 17C2 E6 E0         ANI     0E0H
8520 17C4 07            RLC
8521 17C5 07            RLC
8522 17C6 07            RLC
8523 17C7 E5        DPTS10:     PUSH    H
8524 17C8 26 00         MVI     H,00H
8525 17CA 6F            MOV     L,A
8526 17CB 09            DAD     B
8527 17CC 7E            MOV     A,M
8528 17CD E1            POP     H
8529 17CE A6            ANA     M
8530 17CF 77            MOV     M,A
8531                ;   STA     PORTB
8532 17D0 CD A9 17      CALL    DEL30M
8533 17D3 C9            RET
8534                ;
8535                ;
8536                ;
8537 17D4 E6 02     DPTS05:     ANI     02H
8538 17D6 0F            RRC
8539 17D7 C6 04         ADI     04
8540 17D9 C3 C7 17      JMP     DPTS10
8541                ;
8542                ;
8543                ;
```

```
                    ;
                    ;
17DC FF             BASEAD:     DB      0FFH
17DD DF                 DB      0DFH
17DE FF                 DB      0FFH
17DF BF                 DB      0BFH
17E0 EF                 DB      0EFH
17E1 FD                 DB      0FDH
17E2 7F                 DB      7FH
17E3 FB                 DB      0FBH
17E4 FE                 DB      0FEH
17E5 FF                 DB      0FFH
17E6 F7                 DB      0F7H
                    ;
                    ;
                    ;
                    ;Procedure DALIGN
                    ;Objective:   this segment makes an attempt to align the digit motors to
                    ;           a legitimate home position.
                    ;
                    ;Level.
                    ;
                    ;DALIGN:
                    ;   MOTOR := DIGIT
                    ;   PHASE := DPHASE1
                    ;   DIRECTION := CW
                    ;   Procedure DPHOME(:ERROR)
                    ;   If ERROR = TRUE then
                    ;                       MOTOR := DIGIT
                    ;                       PHASE := DPHASE1
                    ;                       DIRECTION := CCW
                    ;                       Procedure DPHOME(:ERROR)
                    ;                       If ERROR <>0 then ERROR := TYPE2ERROR
                    ;                                         Procedure DPTSP(DIGIT)
                    ;                                         end.
                    ;                       else MOTOR := BANK
                    ;                            Procedure PTNCHK(:ERROR)
                    ;                            Procedure DPTSP(DIGIT)
                    ;                            If ERROR <> 0 then ERROR := TYPE2ERROR
                    ;                            end
                    ;End.
                    ;
                    ;
                    ;
17E7 2E 00          DALIGN:     MVI     L,00
17E9 16 33              MVI     D,33H
17EB 1E 00              MVI     E,00H
17ED CD 86 19           CALL    DPHOME
17F0 CA FF 17           JZ      SEKP11
                    ;
                    ;
                    ;
                    ;
                    ;
17F3 2E 01          SEKP09:     MVI     L,01
17F5 16 33              MVI     D,33H
17F7 1E 00              MVI     E,00H
17F9 CD 86 19           CALL    DPHOME
17FC C2 0C 18           JNZ     ERSET
                    ;
                    ;
17FF 1E 01          SEKP11:     MVI     E,01H
1801 CD 2A 19           CALL    PTNCHK
1804 F5                 PUSH    PSW
1805 1E 00              MVI     E,00
1807 CD B5 17           CALL    DPTSP
180A F1                 POP     PSW
180B C8                 RZ                      ;No Error condition
                    ;   MVI     A,01
                    ;   RET                     ;Type 1 Error set
180C CD B5 17 ERSET:    CALL    DPTSP
180F 3E 02              MVI     A,02            ;Type 2 error set
```

```
1811 C9            RET
                ;
                ;
                ;;
                ;Procedure BALIGN
                ;Objective:   this segment makes an attempt to align the bank motors to
                ;           a legitimate home position.
                ;
                ;Level.
                ;
                ;BALIGN:
                ;   MOTOR := BANK
                ;   PHASE := DPHASE1
                ;   DIRECTION := CW
                ;   Procedure DPHOME(:ERROR)
                ;   If ERROR = TRUE then
                ;                       MOTOR := BANK
                ;                       PHASE := DPHASE1
                ;                       DIRECTION := CCW
                ;                       Procedure DPHOME(:ERROR)
                ;                       If ERROR <>0 then ERROR := TYPE2ERROR
                ;                                         Procedure DPTSP(BANK)
                ;                                         end.
                ;                       else MOTOR := DIGIT
                ;                            Procedure PINCHK(:ERROR)
                ;                            Procedure DPTSP(BANK)
                ;                            If ERROR <> 0 then ERROR := TYPE2ERROR
                ;                            end
                ;End.
                ;
                ;
                ;
                ;
1812            BALIGN:
1812 2E 00         MVI     L,00
1814 16 33      SEKP17:    MVI     D,33H
1816 1E 01         MVI     E,01H
1818 CD 86 19      CALL    DPHOME
181B C2 31 18      JNZ     SEKP14
181E 1E 00      SEKP13:    MVI     E,00
1820 CD 2A 19      CALL    PINCHK
1823 F5            PUSH    PSW
1824 1E 01         MVI     E,01
1826 CD B5 17      CALL    DPTSP
1829 F1            POP     PSW
182A C8            RZ                      ;No error condition
                ;  MVI     A,01
                ;  RET                     ;Type 1 error set
                ;
                ;
182B CD B5 17 BERSET:      CALL    DPTSP
182E 3E 02         MVI     A,02            ;       type 2 error set
1830 C9            RET
                ;
                ;
                ;
                ;
1831 2E 01      SEKP14:    MVI     L,01
1833 16 33         MVI     D,33H
1835 1E 01         MVI     E,01H
1837 CD 86 19      CALL    DPHOME
183A C2 2B 18      JNZ     BERSET
                ;
                ;
183D C3 1E 18      JMP     SEKP13
                ;
                ;
                ;
                ;
                ;
                ;
                ;
```

```
                    ; Accumulator contains the last sucessfully attained
                    ;digit sensor readings
                    ;this sensor reading is compared with the new sensor readings to
                    ;determine the direction of POHOME
                    ;drive
                    ;
                    ;
1840 47             SELDRN:     MOV     B,A
1841 3A 00 68           LDA     PORT2A
1844 E6 03              ANI     DGTMSK
1846 2E 00              MVI     L,00
1848 A8                 XRA     B               ;CLEARS CARRY
1849 1F                 RAR
184A D2 4E 18           JNC     SEKP08
184D 2C                 INR     L
184E C9             SEKP08:     RET
                    ;
184F 16 88          MOPEN:      MVI     D,088H
1851 79             MOP05:      MOV     A,C
1852 B7                 ORA     A
1853 7A                 MOV     A,D
1854 FA 68 18           JM      MOP01
1857 07                 RLC
1858 0D                 DCR     C
1859 CA 6D 18           JZ      MOP10
185C 57             MOP02:      MOV     D,A
185D E6 0F              ANI     0FH
185F 32 02 70           STA     PORTB
1862 CD A3 17           CALL    DEL6M
1865 C3 51 18           JMP     MOP05
1868 0F             MOP01:      RRC
1869 0C                 INR     C
186A C2 5C 18           JNZ     MOP02
186D CD A9 17       MOP10:      CALL    DEL30M
1870 C9                 RET
                    ;
                    ;
                    ;
                    ;
1871 0E F4          SEKTRP:     MVI     C,-12D
1873 CD 4F 18           CALL    MOPEN
1876 0E 0C              MVI     C,12D
1878 CD 4F 18           CALL    MOPEN
187B C9                 RET
                    ;
187C
                    ;           THIS SEGMENT CONTAINS THE PROCEDURES USED IN STEPPER MOTOR
                    ;           CONTROL OF THE SELECTION AND TRIP MECHANISMS.
                    ;
                    ;
                    ;           PROCEDURE MVTRIP
                    ;
                    ;
                    ;           THIS PROCEDURE MOVES THE DIGIT MOTOR FROM THE LOCKED POSITION
                    ;           TO THE TRIP POSITION OF THE TRIP SHAFT.
                    ;           ON DETECTION OF AN ERROR IN THE PROCEDURE, A FATAL ERROR
                    ;           ROUTINE IS INVOKED . UPON EXIT  FROM THE FATAL ERROR ROUTINE
                    ;           THE ZERO FLAG OF THE PROCESSOR STATUS WORD IS RESET TO ZERO
                    ;           IF A FATAL ERROR HAS OCCURED.THE ACCUMULATOR WILL HAVE THE ERRO;
                    ;
                    ;
187C CD 3F 15       MVTRIP:     CALL    LEDON
187F 21 03 10       MVTR05:     LXI     H,1003H                 ;# OF RE TRIES
1882 1E 00              MVI     E,00                    ;DIGIT MOTOR SELECTED
1884 0E FE              MVI     C,-2                    ;COUNTER CLOCKWISE 2 STEPS
1886 CD 03 14           CALL    MOVCLS
1889 CD 4A 15           CALL    LEDOFF                  ;
188C CD BC 18           CALL    MODLN                   ;
188F CD B0 18           CALL    ERRHDR
1892 C4 B5 18           CNZ     EXTERR
1895 C9                 RET                             ;
                    ;
                    ;
```

```
8767                ;
8768                ;
8769                ;*****************************************************************
8770                ;
8771                ;
8772                ;   PROCEDURE MVLOCK
8773                ;
8774                ;
8775                ;   THIS PROCEDURE MOVES THE DIGIT MOTOR FROM THE TRIP POSITION TO THE
8776                ;   LOCK POSITION OF THE TRIP SHAFT. ON DETECTION OF AN ERROR ,THE FATAL E
8777                ;
8778 1896 CD 3F 15 MVLOCK:     CALL    LEDON
8779 1899 21 03 08 MVLO05:     LXI     H,803H                  ;RE TRIES
8780 189C 1E 00        MVI     E,00                    ;DIGIT MOTOR
8781 189E 0E 02        MVI     C,2H                    ;CLOCKWISE 2 STEP
8782 18A0 CD 03 14     CALL    MOVCLS                  ;
8783 18A3 CD 4A 15     CALL    LEDOFF
8784 18A6 CD BC 18     CALL    MODLN                   ;
8785 18A9 CD B0 18     CALL    ERRHDR
8786 18AC C4 B5 18     CNZ     EXTERR                  ;
8787 18AF C9           RET
8788                                   ;
8789                ;
8790                ;
8791                ;
8792                ;*****************************************************************
8793                ;
8794                                                   ;THIS PROCEDURE ASSUMES THAT THE
8795                ;
8796                ;
8797                ;
8798                ;*****************************************************************
8799                ;
8800                ;
8801                ;           ERRHDR  ROUTINE
8802                ;           THIS ROUTINE IS CALLED ON DETECTION OF AN ERROR IN
8803                ;           THE MOTOR MOVE ROUTINES.THE ZERO FLAG AND THE
8804                ;           ACCUMULATOR RETURN THE FLAG INDICATION AND ERROR CODE
8805                ;
8806                ;
8807 18B0           ERRHDR:
8808 18B0 3A 38 74 ERRHO5:     LDA     ERROR                   ;
8809 18B3 B7           ORA     A                       ;SETTING FLAGS
8810 18B4 C9           RET                             ;
8811                ;
8812                ;
8813                ;*****************************************************************
8814                ;
8815                ;
8816                ;EXTERR ROUTINE
8817                ;   This segment creates  a BCD coded error code from the
8818                ;   error storage location .  Before converting to the BCD pattern
8819                ;   30D is added to the error value from motor move routines.
8820                ;   this routine is called upon only when an Error is detected by
8821                ;   the errhdr routine.
8822 18B5           EXTERR:
8823 18B5 3A 38 74     LDA     ERROR   ;
8824 18B8 C6 1E        ADI     30D
8825 18BA 27           DAA             ;
8826 18BB C9           RET             ;
8827                ;
8828                ;
8829                ;*****************************************************************
8830                ;MODLN routine
8831                ;
8832                ;
8833                ;   This routine masks off the bank home position hold and provides
8834                ;the digit motor hold pattern to the interface for modulation purpose.
8835                ;
8836 18BC           MODLN:
8837 18BC 3A 02 70     LDA     PORTB
```

```
8839 18BF E6 0F        ANI     0FH
8840 18C1 32 02 70     STA     PORTB
8841 18C4 C9           RET
8842                ;
8843                ;
8844                ;
8845                ;
8846                ;THIS ROUTINE PLACES THE MOTOR IN TO THE APPROPRIATE HOME
8847                ;POSITION WHEN AN ERROR OCCURS ON SEEK
8848                ;THIS ROUTINE MOVES THE MOTORS TWO STEPS AT A TIME
8849                ;DEPENDING ON THE SENSOR READINGS THE MOTOR MOVEMENT DIRECTION IS DETERM
8850                ;THIS ROUTINE TRANSFORMS THE THE LAST PATTERN OUTPUT FROM DMOVE ROUTINE
8851                ;BREGISTER WILL BE LOADED BY THE EXPECTED ENCODER COUNT
8852                ;C REGISTER WILL BE LOADED BY THE MOTOR STEP COUNT
8853                ;MOTOR STEP COUNT WILL BE DETERMINED BY THE ENCODER READINGS
8854                ;BEFORE REACHING THE ERROR CONDITION THE MOTOR WAS BEING DRIVEN IN
8855                ;THE CW DIRECTION
8856                ;
8857                ;
8858 18C5           POHOME:
8859 18C5 CD 79 19 PLHOME:     CALL    SENSIN
8860 18C8 CA D4 18     JZ      PLH12           ;SENSOR (00)
8861 18CB FE 03        CPI     03H
8862 18CD CA D9 18     JZ      PLH14           ;SENSOR (00,11)
8863 18D0 CD FD 18     CALL    PH0110          ;SENSOR (01,10)
8864 18D3 C9           RET
8865                ;
8866                ;
8867 18D4 16 11     PLH12:     MVI     D,11H
8868 18D6 C3 DB 18     JMP     PLH10           ;check phases/
8869                ;
8870 18D9 16 44     PLH14:     MVI     D,44H
8871 18DB CD DF 18 PLH10:      CALL    PH0011          ;
8872 18DE C9           RET                     ;
8873                ;
8874                ;
8875                ;Procedure PH0011
8876                ;Objective: This segments positions the motors to a legitimate home posi
8877                ;           when the sensor patterns are , to start with , at 00 or 11, (the
8878                ;           sensors are either both pen or closed)
8879                ;PH0011:DIRECTION := CW
8880                ;   MSTEP:=-4
8881                ;   ECOUNT := -1
8882                ;   Procedure ENDMOV(NEXTPTN,MOTOR,DIRECTION,MSTEP,ECOUNT:ERROR)
8883                ;   If ERROR <> 0  then NEXTPTN := RRC(NEXTPTN)
8884                ;                       NEXTPTN := RRC(NEXTPTN)
8885                ;                       DIRECTION := CCW
8886                ;                       MSTEP       :=2
8887                ;                       ECOUNT:=    1
8888                ;                       Procedure ENDMOV(NEXTPTN,MOTOR,DIRECTION,MSTEP,ECOUNT:ERROR)
8889                ;   Procedure PINCHK(MOTOR:ERROR)
8890                ;   end
8891                ;End.
8892                ;
8893                ;
8894                ;
8895 18DF           PH0011:
8896 18DF 0E FC        MVI     C,-4H           ;4STEPS CW
8897 18E1 06 FF        MVI     B,-1H
8898 18E3 CD C8 15     CALL    ENDMOV          ;POSITION TO 2STEPS BEFORE HOME
8899                                           ;1ENCODER STEP AWAY FROM HOME
8900 18E6 3A 38 74     LDA     ERROR
8901 18E9 FE 07        CPI     07H
8902 18EB CA F9 18     JZ      PH05            ;EXIT 1. ERROR FROM TRYING TO MOVE
8903                                           ;TO MOVE CW (TOWARDS LOCK FROM A
8904                                           ;SENSOR (00,11) AFTER IDENTIFYING
8905                                           ;A BLOCK
8906 18EE 7A           MOV     A,D
8907 18EF 0F           RRC
8908 18F0 0F           RRC                     ;MOTOR PATTERN FOR
8909 18F1 57           MOV     D,A
8910 18F2 0E 02        MVI     C,02H
```

```
8911 18F4 06 01        MVI     B,01
8912 18F6 CD C8 15     CALL    ENDMOV
8913                                          ;TWO MSTEPS TOWARDS SENSORS (00,11)
8914                                          ;IN CCW DIRECTION
8915 18F9 CD 2A 19 PH05:       CALL    PTNCHK
8916 18FC C9           RET
8917                ;
8918                ;
8919                ;
8920                ;Procedure PH0110
8921                ;Objective :        This segment positions the motors to a legitimate home
8922                ;           position wherein there is agreement between the phase applied
8923                ;           to the motor and the sensor readings observed.  Four single
8924                ;           step attempts will be made to position the motor to the
8925                ;           home position.  If a home position is reached before all
8926                ;           four attempts are completed, an exit will be done from this
8927                ;           segment.  The error will be flagged by the pattern check segment.
8928                ;
8929                ;PH0110:    If DIRECTION = CW then
8930                ;                                NEXTPTN := RLC (NEXTPTN)
8931                ;                                NEXTPTN := RLC (NEXTPTN)
8932                ;                                MSTEP:= -1
8933                ;                                ECOUNT := -1
8934                ;           else MSTEP:= 1
8935                ;                ECOUNT := 1
8936                ;           For TRIES = 4 to 0 by 1 do
8937                ;                   Procedure ENDMOV(NEXTPTN,MOTOR,DIRECTION,MSTEP,ECOUNT:ERROR)
8938                ;                   Procedure PTNCHK(MOTOR:ERROR)
8939                ;                   If ERROR = TRUE then TRIES:= TRIES-1
8940                ;                   else end
8941                ;           End
8942                ;End.
8943                ;
8944                ;
8945                ;
8946                ;
8947 18FD           PH0110:
8948                ;
8949                ;
8950 18FD 7D           MOV     A,L             ;SENSOR (01)
8951 18FE FE 01        CPI     01H
8952 1900 C2 0D 19     JNZ     PLH57           ;DIRECTION(CW,CCW)
8953                ;
8954                ;
8955 1903 7A        PLH52:     MOV     A,D             ;DIGIT SEEKING 00----------
8956 1904 07           RLC
8957 1905 07           RLC
8958 1906 0E FF        MVI     C,-1H
8959 1908 06 FF        MVI     B,-1H
8960 190A C3 12 19     JMP     PLH65
8961                ;
8962                ;
8963 190D 7A        PLH57:     MOV     A,D
8964 190E 0E 01        MVI     C,01H
8965 1910 06 01        MVI     B,01H
8966 1912 57        PLH65:     MOV     D,A             ;PATTERN IN D REGISTER
8967 1913 2E 04        MVI     L,04H
8968 1915 C5        PLH66:     PUSH    B
8969 1916 CD C8 15 PLH67:      CALL    ENDMOV
8970 1919 C1        PLH68:     POP     B
8971 191A CD 2A 19     CALL    PTNCHK
8972 191D C8           RZ                      ;EXIT 4 .NORMAL EXIT
8973                                           ;STILL ERRORS COULD EXIST
8974                                           ;DUE TO PTNCHK RESULTS
8975 191E 7A        PLH70:     MOV     A,D
8976 191F 2D           DCR     L
8977 1920 C2 15 19     JNZ     PLH66           ;2 + 2 MSTEPS OVER?
8978                                           ;AGAINST A STOP
8979 1923 3E 09     PLH83:     MVI     A,09H
8980 1925 32 38 74     STA     ERROR
8981 1928 B7           ORA     A
8982 1929 C9           RET                     ;EXIT 6. THERE IS NO 00/11
```

```
8983                                        ; IN THIE DIRECTION OF MOVEMENT
8984                ;
8985                ;
8986                ;
8987                ;
8988                ;
8989                ;
8990                ;
8991                ;
8992                ;*********************************************************************
8993                ;
8994                ;
8995                ;
8996                ;PROCEDURE  PTNCHK( MOTOR:ERROR)
8997                ;
8998                ;Input (PORTB,MOTPTN)
8999                ;   IF MOTOR = BANK then MOTPTN:=MOTPTN.MSNMSK
9000                ;                        MOTPTN:= 4*RRC(MOTPTN)
9001                ;
9002                ;                           IF BNKPAT =( 01,02) THEN ERROR:=8; END.
9003                ;                        IF BNKPAT = 00 AND MOTPTN = (08,05) THEN ERROR :=0
9004                ;                                                                    END.
9005                ;                        IF MOTPTN (02,06) THEN ERROR := 0
9006                ;                                        ELSE ERROR:=8
9007                ;                                            END.
9008                ;
9009                ;
9010                ;                        ENDIF
9011                ;       ELSE        MOTPTN:= MOTPTN.LSNMSK
9012                ;               IF DGTPAT =(01,02)THEN ERROR:=8;    END.
9013                ;           IF DGTPAT = 0 AND MOTPTN = (08,09) THEN ERROR := 0
9014                ;                                                   END.
9015                ;           IF MOTPATN =(02,06) THEN ERROR:=0       ;END.
9016                ;END                                                  ELSE ERROR := 8
9017                ;                                                   END
9018                ;;
9019                ;
9020                ;
9021                ;   E REGISTER  ......      MOTOR(BANK,DIGIT)
9022                ;   ERROR   CODE.....       8       FAILURE TO  ARRIVE AT HOME
9023                ;
9024 192A 7B        PTNCHK:     MOV     A,E                     ;MOTOR (BANK,DIGIT)
9025 192B B7            ORA     A                               ;MOTOR
9026 192C 3A 02 70      LDA     PORTB
9027 192F CA 68 19      JZ      PTNC10
9028                ;
9029                ;
9030 1932 E6 F0         ANI     0F0H
9031 1934 0F            RRC
9032 1935 0F            RRC
9033 1936 0F            RRC
9034 1937 0F            RRC
9035 1938 F5            PUSH    PSW
9036 1939 3A 39 74      LDA     BNKPAT
9037 193C FE 01     PTNC15:     CPI     01
9038 193E CA 71 19      JZ      PTNC20
9039                ;
9040                ;
9041                ;
9042 1941 FE 02         CPI     02H
9043 1943 CA 71 19      JZ      PTNC20
9044 1946 B7            ORA     A
9045 1947 CA 5A 19      JZ      PTNC30
9046                ;
9047                ;
9048                ;
9049 194A F1            POP     PSW
9050 194B FE 02         CPI     02H
9051 194D CA 55 19      JZ      PTNC40
9052 1950 FE 06         CPI     06H
9053 1952 C2 73 19      JNZ     PTNC25
9054                ;
```

```
9055                ;
9056                ;
9057 1955 AF        PTNC40:     XRA     A
9058 1956 32 38 74      STA     ERROR
9059 1959 C9            RET
9060                ;
9061                ;
9062                ;
9063 195A F1        PTNC30:     POP     PSW
9064 195B FE 08         CPI     08H
9065 195D CA 55 19      JZ      PTNC40
9066 1960 FE 09         CPI     09H
9067 1962 CA 55 19      JZ      PTNC40
9068 1965 C3 72 19      JMP     PTNC25
9069                ;
9070                ;
9071                ;
9072 1968 E6 0F     PTNC10:     ANI     0FH
9073 196A F5            PUSH    PSW
9074 196B 3A 3A 74      LDA     DGTPAT
9075 196E C3 3C 19      JMP     PTNC15
9076                ;
9077                ;
9078 1971 F1        PTNC20:     POP     PSW
9079 1972 3E 08     PTNC25:     MVI     A,08H                   ;ERROR :=8
9080 1974 32 38 74      STA     ERROR
9081 1977 B7            ORA     A                       ;NOT HOME ERROR
9082 1978 C9            RET                             ;EXIT
9084                ;;
9085                ;
9086                ;
9087 1979           SENSIN:
9088 1979 7B            MOV     A,E             ;CHECK MOTOR BANK/DIGIT
9089 197A B7            ORA     A
9090 197B 3A 00 68      LDA     PORT2A
9091 197E CA 83 19      JZ      PLH05           ;MOTOR (BANK,DIGIT)
9092 1981 0F            RRC
9093 1982 0F            RRC
9094 1983 E6 03     PLH05:      ANI     DGTMSK
9095 1985 C9            RET
9096                ;
9097                ;
9098                ;
9099 1986 CD 79 19 DPHOME:      CALL    SENSIN
9100 1989 CA 91 19      JZ      DPH1
9101 198C FE 03         CPI     03H
9102 198E C2 95 19      JNZ     DPH5
9103 1991 CD DF 18 DPH1:        CALL    PH0011
9104 1994 C9            RET
9105                ;
9106                ;
9107                ;
9108 1995 CD FD 18 DPH5:        CALL    PH0110
9109 1998 C9            RET
9110                ;
9112                ; (*************************************************************)
9113                ;
9114                ; PROCEDURE READ_ENCODERS;
9115                ;
9116                ;Objective: Read the encoder status and store the information in ram
9117                ;           storage and update the terminal count.  Flag errors of
9118                ;           1.  digit motor moved on a bank motor move
9119                ;           2.  digit motor moved too fast
9120                ;           3.  bank motor moved on a digit motor move
9121                ;           4.  bank motor moved too fast
9122                ;
9123                ;Initialisation requirements:
9124                ;           Initial patterns of bank and digit sensors be stored in the
9125                ;           respective locations before this module is invoked, during
9126                ;           power up activities.
9127                ;Level:
9128                ;           Calls ENCMOV, DEL300 and DEL75 modules.
```

```
9129                ;           Delay routines are used for adjusting the stepper motor rate.
9130                ;
9131                ;
9132                ;Procedure READENC(DGTPAT,BNKPAT,NUMREAD,MOTOR,ENCCOUNT: ENCCOUNT,ERROR)
9133                ;Do While (NUMREAD greater than 0 and ERROR  equal to 0
9134                ;   NUMREAD := NUMREAD - 1
9135                ;   Input (PORT.SENSOR,SENSPTN)
9136                ;   SENSPTN1 := SENSPTN
9137                ;   SENSPTN := SENSPTN.DSNSRMASK
9138                ;   SENSPTN1 := (SENSPTN.BSNSRMASK)/4
9139                ;   Case MOTOR = BANK
9140                ;           If SENSPTN = (DGTPAT) then
9141                ;                           Procedure ENCMOV(BNKPAT,SENSPTN1:COUNTINC)
9142                ;                           If COUNTINC = 2 then
9143                ;                                       ERROR:= 3
9144                ;                                       End Case
9145                ;                           If ENCCOUNT greater than 0 then
9146                ;                                       ENCCOUNT:= ENCCOUNT-COUNTINC
9147                ;                           else        ENCCOUNT:= ENCCOUNT+COUNTINC
9148                ;           else            ERROR:= 1       ;DIGIT ON BANK
9149                ;           End If
9150                ;
9151                ;       MOTOR = DIGIT
9152                ;           If SENSPTN1 = BNKPAT then
9153                ;                           Procedure ENCMOV(DGTPAT,SENSPTN:COUNTINC)
9154                ;                           If COUNTINC = 2 then
9155                ;                                       ERROR = 4
9156                ;                                       End Case
9157                ;                           If ENCCOUNT greater than 0 then
9158                ;                                       ENCCOUNT=ENCCOUNT-COUNTINC
9159                ;                           else        ENCCOUNT=ENCCOUNT+COUNTINC
9160                ;           else            ERROR:= 2
9161                ;           End If
9162                ;       End Case
9163                ;End Do
9164                ;BNKPAT := SENSPTN1
9165                ;DGTPAT := SENSPTN
9166                ;End RENC.
9167                ;
9168                ;
9169                ;
9170                ; PARAM VAR (*C-REG*) COUNT : BYTE;
9171                ;   (*E-REG*) MOTOR : MOTORS;
9172                ;   (*L-REG*) NUM_READS : BYTE;
9173                ;
9174                ; VAR       (*A-REG*) COUNT_INC : BYTE;
9175                ;   (*B-REG*) NEW_BANK_PAT : ENCODER_PATTERNS;
9176                ;   (*D-REG*) NEW_DIGIT_PAT : ENCODER_PATTERNS;
9177                ;
9178 0001          ERRR1       EQU     01H
9179 0002          ERROR2      EQU     02H
9180 0003          ERROR3      EQU     03H
9181 0004          ERROR4      EQU     04H
9182               RENC:                       ; BEGIN
9183 1999
9184 1999 7D       RENC05:     MOV     A,L     ; WHILE (NUM_READS > 0) AND (ERROR = NO_ERRORS) DO
9185 199A B7           ORA     A
9186 199B C8           RZ
9187 199C 3A 38 74     LDA     ERROR
9188 199F B7           ORA     A
9189 19A0 C0           RNZ
9190                                   ;     BEGIN
9191 19A1 2D           DCR     L       ;     NUM_READS := NUM_READS - 1;
9192 19A2 3A 00 68     LDA     PORT2AD ;     NEW_BANK_PAT := (PORTA AND 0CH) ROR 2;
9193 19A5 E6 0C        ANI     BNKMSK
9194 19A7 0F           RRC
9195 19A8 0F           RRC
9196 19A9 47           MOV     B,A
9197 19AA 3A 00 68     LDA     PORT2AD ;     NEW_DIGIT_PAT := PORTA AND 03H;
9198 19AD E6 03        ANI     DGTMSK
9199 19AF 57           MOV     D,A
9200 19B0 7B           MOV     A,E     ;     CASE MOTOR OF
```

```
9201 19B1 B7            ORA     A
9202 19B2 CA E6 19      JZ      RENC20
9203 19B5 3A 3A 74      LDA     DGTPAT  ;         BANK:  IF NEW_DIGIT_PAT <> DIGIT_PAT THEN
9204 19B8 BA            CMP     D
9205 19B9 CA C4 19      JZ      RENC10
9206 19BC 3E 01         MVI     A,ERRR1 ;                    ERROR := DIG_ON_BANK
9207 19BE 32 38 74      STA     ERROR
9208 19C1 C3 14 1A      JMP     RENC35
9210                RENC10:                     ;                ELSE
9211                                    ;                    BEGIN
9212 19C4 C5            PUSH    B       ;                    COUNT_INC := ENCODER_
9213 19C5 3A 39 74      LDA     BNKPAT  ;                        MOVE (NEW_BANK_PAT, BANK_PAT);
9214 19C8 4F            MOV     C,A
9215 19C9 D5            PUSH    D
9216 19CA 58            MOV     E,B
9217 19CB E5            PUSH    H
9218 19CC CD AB 15      CALL    ENCMOV
9219 19CF E1            POP     H
9220 19D0 D1            POP     D
9221 19D1 C1            POP     B
9222 19D2 FE 02         CPI     2.      ;                    IF COUNT_INC = 2 THEN
9223 19D4 C2 DF 19      JNZ     RENC15
9224 19D7 3E 03         MVI     A,ERROR3        ;                    ERROR := BANK_TOO_FAST
9225 19D9 32 38 74      STA     ERROR
9226 19DC C3 14 1A      JMP     RENC35
9227 19DF 2F        RENC15:     CMA             ;                ELSE COUNT := COUNT - COUNT_INC
9228 19E0 3C            INR     A
9229 19E1 81            ADD     C
9230 19E2 4F            MOV     C,A
9231 19E3 C3 14 1A      JMP     RENC35
9232                                    ;                    END;
9233 19E6 3A 39 74 RENC20:      LDA     BNKPAT  ;        DIGIT: IF NEW_BANK_PAT <> BANK_PAT THEN
9234 19E9 B8            CMP     B
9235 19EA CA F5 19      JZ      RENC25
9236 19ED 3E 02         MVI     A,ERROR2        ;                ERROR := BANK_ON_DIG
9237                                            ;NOTE .ERROR CODE MASKED FOR DEMO.........
9238 19EF 32 38 74      STA     ERROR
9239 19F2 C3 14 1A      JMP     RENC35
9241                RENC25:                     ;                ELSE
9242                                    ;                    BEGIN
9243 19F5 C5            PUSH    B       ;                    COUNT_INC := ENCODER_
9244 19F6 3A 3A 74      LDA     DGTPAT  ;                        MOVE (NEW_DIGIT_PAT, DIGIT_PAT);
9245 19F9 4F            MOV     C,A
9246 19FA D5            PUSH    D
9247 19FB 5A            MOV     E,D
9248 19FC E5            PUSH    H
9249 19FD CD AB 15      CALL    ENCMOV
9250 1A00 E1            POP     H
9251 1A01 D1            POP     D
9252 1A02 C1            POP     B
9253 1A03 FE 02         CPI     2.      ;                    IF COUNT_INC = 2 THEN
9254 1A05 C2 10 1A      JNZ     RENC30
9255 1A08 3E 04         MVI     A,ERROR4;                        ERROR := DIG_TOO_FAST
9256 1A0A 32 38 74      STA     ERROR
9257 1A0D C3 14 1A      JMP     RENC35
9258 1A10 2F        RENC30:     CMA             ;                ELSE COUNT := COUNT - COUNT_INC
9259 1A11 3C            INR     A
9260 1A12 81            ADD     C
9261 1A13 4F            MOV     C,A
9262                                    ;                    END;
9263                RENC35:                     ;     END;
9264 1A14 78            MOV     A,B     ;     BANK_PAT := NEW_BANK_PAT;
9265 1A15 32 39 74      STA     BNKPAT
9266 1A18 7A            MOV     A,D     ;     DIGIT_PAT := NEW_DIGIT_PAT;
9267 1A19 32 3A 74      STA     DGTPAT
9268 1A1C CD 55 15      CALL    DEL300  ;     DELAY (375)
9269 1A1F CD 64 15      CALL    DEL75
9270 1A22 C3 99 19      JMP     RENC05  ;     END
9271                                    ; END;
9273                ;
9274                ; (*************************************************************)
9275                ;
9276                ; PROCEDURE SET_CLOSED;
```

```
9277                ;
9278                ;
9279                ; VAR       (*C-REG*) CUR_BANK_VAL : BYTE;
9280                ;   (*E-REG*) INDEX : PRINT_BANKS;
9281                ;
9282 1A25           MVPOST:
9283 1A25 CD 3F 15 SETCLS:     CALL    LEDON
9284 1A28 CD 38 1A     CALL    CHPOST
9285 1A2B CD 4A 15     CALL    LEDOFF
9286 1A2E CD BC 18     CALL    MODLN
9287 1A31 CD B0 18     CALL    ERRHDR
9288 1A34 C4 B5 18     CNZ     EXTERR
9289 1A37 C9           RET
9290                ;
9291                ;
9292                ;Procedure MOVPOST
9293                ;Objective
9294                ;    sets the print wheels to a new postage value upon execution.
9295                ;    updates the postage value upon a sucessfull completion of a
9296                ;    new setting.
9297                ;Level
9298                ;   Calls GNIB, MOVCLS, ERRHDR
9299                ;Note:      What action is to be taken up on detection of an error is
9300                ;   determined solely by the invoking routine.
9301                ;
9302                ;INDEX1 := 0
9303                ;Do while INDEX1 <> 4
9304                ;   VALUE1 := GNIB(POSVAL,INDEX1:VALUE)
9305                ;   VALUE2 := GNIB(POSREQ,INDEX1:VALUE)
9306                ;   If VALUE1 = VALUE2 then INDEX1 := INDEX1+1; Continue Do
9307                ;   MOTOR := DIGIT
9308                ;   DIRECTION := CCW
9309                ;   RETRIES := 3
9310                ;   MCOUNT := 2
9311                ;   SPEED := 8 ..................... CORRESPONDING TO 160 STEPS/SEC
9312                ;   Procedure MOVCLS( MOTOR,DIRECTION,MCOUNT,RETRIES,SPEED: ERROR)
9313                ;   Procedure ERRHDR( ERRORFLAG )
9314                ;   If ERRORFLAG = 0 then CURBNKVAL := 0
9315                ;                         BNKVAL(HOM) := 0
9316                ;                         INDEX := 0
9317                ;                         Do while INDEX <> 4
9318                ;                                  DELTA :=(GNIB (POSREQ,INDEX:VALUE)-
9319                ;                                          GNIB (POSVAL,INDEX:VALUE))
9320                ;                                  If DELTA <> 0 then
9321                ;                                       If INDEX >= 2 then
9322                ;                                           INDEX2:= INDEX - 1
9323                ;                                       else INDEX2:= INDEX-2
9324                ;                                       INDEX2 := COMPLMNT(INDEX2)
9325                ;                                       BNKVALINDEX := INDEX2 + 1
9326                ;                                       MOTOR := BANK
9327                ;                                       MCOUNT := BNKVALINDEX - CURBNKVAL
9328                ;                                       RETRIES := 3
9329                ;                                       SPEED := 08
9330                ;                                       Procedure MOVCLS(MOTOR,MCOUNT,-
9331                ;                                                  -RETRIES,SPEED:ERROR)
9332                ;                                       Procedure ERRHDR(ERRFLAG)
9333                ;                                       If ERRFLAG = 0 then
9334                ;                                                 MOTOR := DIGIT
9335                ;                                                 RETRIES := 3
9336                ;                                                 MCOUNT := DELTA
9337                ;                                                 SPEED := 08
9338                ;                                                 Procedure MOVCLS
9339                ;                                                         (MOTOR,RETRIES,
9340                ;                                                         MCOUNT,SPEED:ERROR)
9341                ;                                                 ProcedureERRHDR(ERRFLAG))
9342                ;                                                 If ERRFLAG<>0 then End
9343                ;                                                 end if
9344                ;                                       end if
9345                ;                                  else INDEX := INDEX + 1
9346                ;
9347                ;                              End do
9348                ;                              MOTOR := BANK
```

```
9349                ;                                   RETRIES := 3
9350                ;                                   SPEED := 08
9351                ;                                   MCOUNT := BNKVALHOM - CURMBNKVAL
9352                ;                                   Procedure MOVCLS (MOTOR,SPEED,RETRIES,
9353                ;                                                     MCOUNT:ERROR)
9354                ;                                   Procedure ERRHDR(ERRFLAG)
9355                ;                                   If ERRFLAG = 0 then
9356                ;                                               RETRIES := 3
9357                ;                                               MOTOR := DIGIT
9358                ;                                               MCOUNT := 2
9359                ;                                               SPEED := 08
9360                ;                                               Procedure MOVCLS(
9361                ;                                                  MOTOR,MCOUNT,
9362                ;                                                  SPEED,RETRIES:ERROR)
9363                ;                                               Procedure ERRHDR(EFLAG)
9364                ;                                               If ERRFLAG = 0 then
9365                ;                                                         For Z=1 to 4 by 1
9366                ;                                                             POSTVAL(Z)
9367                ;                                                               := POSREQ(Z)
9368                ;                                                             Z:= Z + 1
9369                ;                                                         end for
9370                ;                                               end if
9371                ;                                   end
9372                ;   end
9373                ;End movpost
9374 7421           PREG        EQU     7421H           ;POSTACE VALUE LOCATION
9375 7460           TWORK1      EQU     7460H           ;
9376 7466           POSREQ      EQU     7466H           ;WORK1+((16-NBANKS)/2))
9377 7421           POSVAL      EQU     PREG
9378                ;
9379                ;
9380                ;
9381                ;
9382                            ;
9383 1A38 1E 00     CHPOST:     MVI     E,00.   ; IF POST_REQ = POST_VAL THEN RETURN;
9384 1A3A 21 21 74  SETC05:     LXI     H,POSVAL
9385 1A3D CD DB 1A      CALL    GNIB                    ;
9386 1A40 47            MOV     B,A                     ;
9387 1A41 21 66 74      LXI     H,POSREQ                ;
9388 1A44 CD DB 1A      CALL    GNIB                            ;
9389 1A47 90            SUB     B                       ;
9390 1A48 C2 54 1A      JNZ     SETC10                  ;
9391 1A4B 7B            MOV     A,E                     ;
9392 1A4C 3C            INR     A                       ;
9393 1A4D FE 04         CPI     04                      ;ALL BANKS CHECKED?
9394 1A4F C8            RZ                              ;EXIT
9395 1A50 5F            MOV     E,A                     ;
9396 1A51 C3 3A 1A      JMP     SETC05                  ;
9397                ;
9398                ;
9400 1A54 0E 02     SETC10:     MVI     C,+2    ; MOVE_CLOSED (DIGIT_TRIES, DIGIT,
9401 1A56 1E 00         MVI     E,00H   ;               DIGIT_VALUE (SET) - DIGIT_VALUE (LOCK));
9402 1A58 21 03 08      LXI     H,803H
9403 1A5B CD 03 14      CALL    MOVCLS
9404 1A5E CD B0 18      CALL    ERRHDR          ;ERROR PROCESSING
9405 1A61 C0            RNZ                     ;FATAL ERROR EXIT
9406 1A62 4F            MOV     C,A     ; CUR_BANK_VAL := BANK_VALUE (HOME);
9407 1A63 57            MOV     D,A     ; FOR INDEX := PENNIES TO TEN_DOLLARS DO
9408 1A64 5F        SETC15:     MOV     E,A
9409 1A65 21 21 74      LXI     H,POSVAL;       IF POST_REQ [INDEX] <> POST_VAL [INDEX] THEN
9410 1A68 CD DB 1A      CALL    GNIB
9411 1A6B 47            MOV     B,A
9412 1A6C 21 66 74      LXI     H,POSREQ                        ;
9413 1A6F CD DB 1A      CALL    GNIB                                    ;
9414 1A72 90            SUB     B
9415 1A73 CA A5 1A      JZ      SETC25
9416 1A76 F5            PUSH    PSW     ;           BEGIN
9417 1A77 7B            MOV     A,E     ;           MOVE_CLOSED (BANK_TRIES, BANK,
9418 1A78 FE 02         CPI     02H     ;                       BANK_VALUE (INDEX) - CUR_BANK_VAL;
9419 1A7A D2 7E 1A      JNC     SETC20
9420 1A7D 3D            DCR     A
9421 1A7E 3D        SETC20:     DCR     A
```

```
9422                ;   CMA
9423                ;   INR     A
9424 1A7F F5            PUSH    PSW
9425 1A80 91            SUB     C
9426 1A81 4F            MOV     C,A
9427 1A82 D5            PUSH    D
9428 1A83 1E 01         MVI     E,01H
9429 1A85 21 03 08      LXI     H,803H
9430 1A89 CD 03 14      CALL    MOVCLS
9431 1A8B D1            POP     D
9432 1A8C F1            POP     PSW     ;         CUR_BANK_VAL := BANK_VALUE (INDEX);
9433 1A8D 4F            MOV     C,A
9434 1A8E F1            POP     PSW
9435 1A8F 6F            MOV     L,A
9436 1A90 CD B0 18      CALL    ERRHDR          ;
9437 1A93 C0            RNZ                     ;FATAL ERROR EXIT
9438 1A94 C5            PUSH    B       ;         MOVE_CLOSED (DIGIT_TRIES, DIGIT,
9439 1A95 4D            MOV     C,L     ;                     POST_REQ [INDEX] - POST_VAL [INDEX];
9440 1A96 D5            PUSH    D
9441 1A97 1E 00         MVI     E,00H
9442 1A99 21 03 08      LXI     H,803H
9443 1A9C CD 03 14      CALL    MOVCLS
9444 1A9F D1            POP     D
9445 1AA0 C1            POP     B
9446 1AA1 CD B0 18      CALL    ERRHDR          ;
9447 1AA4 C0            RNZ                     ;FATAL ERROR EXIT
9448                            ;         END;
9449 1AA5 7B        SETC25:     MOV     A,E
9450 1AA6 3C            INR     A
9451 1AA7 FE 04         CPI     04H
9452 1AA9 DA 64 1A      JC      SETC15
9453 1AAC 79            MOV     A,C     ; MOVE_CLOSED (BANK_TRIES, BANK, BANK_VALUE (HOME)
9454 1AAD 2F            CMA             ;             - CUR_BANK_VAL;
9455 1AAE 3C            INR     A
9456 1AAF 4F            MOV     C,A
9457 1AB0 1E 01         MVI     E,01
9458 1AB2 21 03 08      LXI     H,803H
9459 1AB5 CD 03 14      CALL    MOVCLS
9460 1AB8 CD B0 18      CALL    ERRHDR                          ;
9461 1ABB C0            RNZ                                     ;FATAL ERROR EXIT
9462 1ABC 0E FE         MVI     C,-2.   ; MOVE_CLOSED (DIGIT_TRIES, DIGIT, DIGIT_VALUE (LOCK)
9463 1ABE 1E 00         MVI     E,00H   ;             - DIGIT_VALUE (SET));
9464 1AC0 21 03 08      LXI     H,803H
9465 1AC3 CD 03 14      CALL    MOVCLS
9466 1AC6 CD B0 18      CALL    ERRHDR                  ;
9467 1AC9 C0            RNZ                     ;FATAL ERROR
9468 1ACA 0E 02         MVI     C,2.    ; FOR INDEX := PENNIES TO TEN_DOLLARS DO
9469 1ACC 11 66 74      LXI     D,POSREQ;     POST_VAL [INDEX] := POST_REQ [INDEX]
9470 1ACF 21 21 74      LXI     H,POSVAL
9471 1AD2 1A        SETC30:     LDAX    D
9472 1AD3 77            MOV     M,A
9473 1AD4 13            INX     D
9474 1AD5 23            INX     H
9475 1AD6 0D            DCR     C
9476 1AD7 C2 D2 1A      JNZ     SETC30
9477 1ADA C9            RET             ; END;
9478                ;
9479                ;
9480                ;
9481                ;
9482                ;
9483                ;GETNIB ROUTINE
9484                ;HLREGISTER HAS THE BASE ADDRESS:E REGISTER HAS THE BANK INDEX
9485                ;RETURNS THE INDEXED NIBBLE IN ACCUMULATOR
9486                ;
9487                ;
9488 1ADB D5        GNIB:       PUSH    D               ;SAVE REGISTER DE
9489 1ADC AF            XRA     A               ;SET CY = 0
9490 1ADD 57            MOV     D,A                     ;SETTING FOR DAD OPERATION
9491 1ADE 7B            MOV     A,E                     ;
9492 1ADF 1F            RAR                             ;DIVIDE BY 2
9493 1AE0 5F            MOV     E,A                     ;
```

```
9494 1AE1 19          DAD     D                    ;ADDRESS GENERATION
9495 1AE2 D1          POP     D                    ;
9496 1AE3 7B          MOV     A,E                  ;MSB/LSB SELECTION
9497 1AE4 E6 01       ANI     01H                  ;00,02,04ETC  &01,03,05....
9498 1AE6 3E 0F       MVI     A,0FH                ;MASK FOR LSB
9499 1AE8 C2 F3 1A    JNZ     GNI10                ;
9500              ;
9501              ;
9502 1AEB 3E F0       MVI     A,0F0H               ;MASK FOR MSB SELECTION
9503 1AED A6          ANA     M                    ;
9504 1AEE 0F          RRC                          ;
9505 1AEF 0F          RRC                          ;
9506 1AF0 0F          RRC                          ;
9507 1AF1 0F          RRC                          ;
9508 1AF2 C9          RET                          ;
9509              ;
9510              ;
9511 1AF3 A6      GNI10:      ANA     M                    ;
9512 1AF4 C9          RET                          ;
9513              ;
9514              ;
9515              ;
9516 1AF5
9517              ;
9518 1AF5             END
M85 assembly errors =    0
```

CROSS REFERENCE

| LABEL | VALUE | REFERENCE | | | | | | | |
|---|---|---|---|---|---|---|---|---|---|
| ACCFMT | 008F | -375 | 7167 | | | | | | |
| ACCOD1 | 131B | -7105 | 7120 | | | | | | |
| ACCOD2 | 132A | 7110 | -7116 | | | | | | |
| ACCOD3 | 1330 | 7115 | -7121 | | | | | | |
| ACCOD4 | 1340 | 7132 | -7134 | | | | | | |
| ACCOD5 | 135A | 7160 | -7166 | | | | | | |
| ACCODE | 12EE | 3374 | -7042 | | | | | | |
| AMTBUF | 00E0 | -254 | 3107 | 4568 | 4756 | 4773 | 7274 | 7327 | 7401 |
| | | 7415 | 7435 | | | | | | |
| ASCCRC | 0040 | -101 | 2796 | 3845 | 4146 | | | | |
| ASCFMT | 0080 | -376 | 2605 | | | | | | |
| ASCREG | 0038 | -96 | 2451 | 2605 | 2778 | 2789 | 3839 | 4143 | |
| ASCSIZ | 0008 | -360 | 2451 | 2454 | 2473 | 2484 | 2484 | 2607 | 2775 |
| | | 2778 | 2789 | 3822 | 3839 | 4143 | | | |
| BADCRC | 0000 | -410 | 2427 | 4238 | 6754 | | | | |
| BADCYC | 0004 | -414 | 2881 | 2927 | 4292 | | | | |
| BADRAM | 000A | -421 | 1111 | | | | | | |
| BADSW | 0011 | -397 | | | | | | | |
| BALIGN | 1812 | 8312 | 8329 | -8651 | | | | | |
| BARF | 0017 | -399 | 3240 | | | | | | |
| BASE5 | 1673 | 8218 | -8231 | | | | | | |
| BASEAD | 17DC | 8510 | -8547 | | | | | | |
| BCDC | 000F | -7553 | 7578 | | | | | | |
| BCDG | 000C | -7552 | 7576 | | | | | | |
| BERSET | 182B | -8668 | 8679 | | | | | | |
| BINOC1 | 1364 | -7191 | 7206 | | | | | | |
| BINOC2 | 1366 | -7194 | 7202 | | | | | | |
| BINOCT | 135D | -7183 | | | | | | | |
| BKL50 | 153C | 7790 | -7805 | | | | | | |
| BKLASH | 151B | 7721 | -7786 | | | | | | |
| BLKTMR | 0050 | -136 | 699 | | | | | | |
| BNKMSK | 000C | -7556 | 9193 | | | | | | |
| BNKPAT | 7439 | -210 | 7729 | 7885 | 8401 | 9036 | 9213 | 9233 | 9265 |
| BODC | 0003 | -7551 | 7574 | | | | | | |
| BODG | 0000 | -7550 | 7572 | | | | | | |
| BUFOVR | 0012 | -398 | 3685 | | | | | | |
| CDBUF | 0316 | -1435 | 1781 | 1839 | | | | | |
| CDBUF1 | 0320 | 1414 | -1443 | | | | | | |
| CDBUFC | 0306 | -1409 | 1777 | 1799 | 1870 | | | | |
| CDBUFD | 030F | -1424 | | | | | | | |
| CHPOST | 1A38 | 9284 | -9303 | | | | | | |

| | | | | | | | | | |
|---|---|---|---|---|---|---|---|---|---|
| CHRBKT | 0058 | -156 | 573 | 1553 | 5484 | | | | |
| CLKD01 | 0046 | 531 | -539 | | | | | | |
| CLKD02 | 0049 | 538 | -543 | | | | | | |
| CLKDEC | 0040 | -530 | 654 | | | | | | |
| CLKDGT | 0043 | -537 | 634 | | | | | | |
| CLRBLK | 0E85 | 1234 | 3381 | 4081 | 4120 | 4660 | 4844 | 4973 | -5252 |
| | | 7045 | | | | | | | |
| CMDBUF | 00F0 | -259 | 3113 | 4538 | 7359 | | | | |
| CMDDSB | 05CD | -2272 | 3358 | | | | | | |
| CMDENB | 05F3 | -2317 | 3356 | | | | | | |
| CMPAR1 | 0E93 | -5283 | 5306 | | | | | | |
| CMPAR2 | 0EA9 | 5285 | 5298 | -5307 | | | | | |
| CMPARE | 0E8E | 3799 | 4189 | 4210 | 4678 | -5277 | | | |
| CONFIG | 062C | -2383 | 2583 | | | | | | |
| CONSU1 | 0647 | 2415 | -2425 | | | | | | |
| CONSU2 | 064C | 2424 | -2431 | | | | | | |
| CONSUM | 063A | -2410 | 2565 | 4164 | 7049 | | | | |
| CRC | 0EB1 | 1282 | 2487 | 2792 | 2815 | 3842 | 3850 | 4227 | -5334 |
| | | 7126 | 7236 | 7446 | | | | | |
| CRC1 | 0EB8 | -5341 | 5350 | | | | | | |
| CRCNI1 | 0ECD | -5379 | 5394 | | | | | | |
| CRCNI2 | 0ED6 | 5388 | -5390 | | | | | | |
| CRCNIB | 0EC6 | 5345 | -5367 | 6295 | 6737 | 6985 | | | |
| CSMPMT | 0080 | -377 | 2607 | | | | | | |
| CSTEP0 | 1660 | 8207 | -8213 | | | | | | |
| CTLBKT | 0056 | -151 | 574 | 1503 | 3543 | 5485 | | | |
| CTLCRC | 0010 | -31 | 2422 | 3837 | | | | | |
| CTLREG | 7000 | -324 | 899 | 961 | 1087 | | | | |
| CTLSU1 | 065B | 2462 | -2465 | | | | | | |
| CTLSUM | 064E | 2412 | -2449 | 3833 | | | | | |
| CURBKT | 005A | -161 | 1550 | 1967 | | | | | |
| DALIGN | 17E7 | 8296 | 8322 | 8345 | -8590 | | | | |
| DATA1 | 6800 | -325 | 330 | 4288 | | | | | |
| DBCTR | 005C | -166 | 565 | 1190 | | | | | |
| DBLAN1 | 0EEF | -5433 | 5462 | | | | | | |
| DBLAN2 | 0EEF | -5434 | 5438 | | | | | | |
| DBLANK | 0EDE | 1063 | 1494 | 1962 | 2922 | -5411 | 6147 | | |
| DBLH01 | 068D | -2531 | 3386 | | | | | | |
| DBLH02 | 06A6 | 2518 | -2551 | | | | | | |
| DBLH03 | 06C5 | 2564 | -2576 | | | | | | |
| DBLH04 | 06E2 | 2516 | -2598 | | | | | | |
| DBLH05 | 06EE | 2521 | 2532 | 2537 | 2554 | 2559 | 2568 | 2578 | -2601 |
| DBLHDR | 0671 | -2512 | 3390 | | | | | | |
| DBOUN1 | 005D | 568 | -575 | | | | | | |
| DBOUNC | 004C | -562 | 733 | | | | | | |
| DBUF | 0080 | -219 | 1412 | 1439 | 1442 | 1653 | 1719 | 1803 | 1803 |
| | | 1879 | 1904 | 1910 | 1933 | 2050 | 2056 | 2168 | 2182 |
| | | 2184 | 2217 | 3642 | 5039 | 5050 | 5075 | 5087 | |
| DBVAL | 0002 | -342 | 580 | | | | | | |
| DECAD1 | 06FE | -2633 | 2654 | | | | | | |
| DECADD | 06F8 | 2476 | -2624 | 2781 | 2829 | 7430 | | | |
| DECCOM | 070C | 2636 | -2675 | 2736 | | | | | |
| DECERR | 0720 | 2629 | -2704 | 2729 | | | | | |
| DECSU1 | 0731 | -2733 | 2757 | | | | | | |
| DECSUB | 072B | -2724 | 2804 | | | | | | |
| DEFDCM | 006C | -201 | 1164 | 3906 | | | | | |
| DEL1 | 1567 | -7855 | 7856 | | | | | | |
| DEL300 | 1555 | -7843 | 8500 | 9268 | | | | | |
| DEL30M | 17A9 | 7801 | 7804 | 7876 | 8201 | 8204 | 8310 | 8340 | -8499 |
| | | 8532 | 8726 | | | | | | |
| DEL6M | 17A3 | -8492 | 8721 | | | | | | |
| DEL75 | 1564 | 7845 | 7846 | 7847 | 7848 | -7853 | 7867 | 9269 | |
| DELM1 | 17AC | 8494 | -8500 | 8502 | | | | | |
| DFLUSH | 0EF6 | 737 | 5417 | -5454 | | | | | |
| DGTMSK | 0003 | -7555 | 7616 | 7870 | 7872 | 7879 | 7884 | 8700 | 9094 |
| | | 9198 | | | | | | | |
| DGTPAT | 743A | -211 | 7734 | 7880 | 8371 | 8423 | 9074 | 9203 | 9244 |
| | | 9267 | | | | | | | |
| DIAPMT | 005F | -378 | 2604 | | | | | | |
| DIEDCM | 006A | -196 | 1161 | 3910 | 4790 | 4867 | 4936 | 7326 | |
| DIMAGE | 0000 | -265 | 776 | 1462 | 1633 | 1649 | 1688 | 1847 | 1849 |
| | | 1850 | 2179 | 2243 | | | | | |

| | | | | | | | | | |
|---|---|---|---|---|---|---|---|---|---|
| DISAB1 | 05D5 | 2276 | -2282 | | | | | | |
| DISAB2 | 05EF | 2292 | -2300 | | | | | | |
| DISABL | 05D3 | -2278 | 4182 | | | | | | |
| DISP01 | 0072 | 607 | -609 | | | | | | |
| DISP02 | 0072 | 605 | -610 | | | | | | |
| DISP03 | 007D | -620 | 658 | | | | | | |
| DISP04 | 007F | -623 | 642 | | | | | | |
| DISPLY | 0062 | -596 | 738 | | | | | | |
| DOACCT | 0744 | 1018 | -2773 | 2964 | | | | | |
| DOSTAT | 0778 | -2850 | 3509 | | | | | | |
| DOTR01 | 07D9 | -2973 | 2983 | | | | | | |
| DOTR02 | 07ED | 2978 | -2994 | | | | | | |
| DOTR03 | 07F7 | -3008 | 3018 | | | | | | |
| DOTR04 | 080D | 3013 | -3030 | | | | | | |
| DOTR05 | 080F | 3026 | -3036 | | | | | | |
| DOTR06 | 0811 | -3040 | 3310 | | | | | | |
| DOTRIP | 07A5 | -2921 | 3220 | 3584 | | | | | |
| DPH1 | 1991 | 9100 | -9103 | | | | | | |
| DPH5 | 1995 | 9102 | -9108 | | | | | | |
| DPHOME | 1986 | 8593 | 8603 | 8655 | 8678 | -9099 | | | |
| DPTS05 | 17D4 | 8515 | -8537 | | | | | | |
| DPTS10 | 17C7 | -8523 | 8540 | | | | | | |
| DPTSP | 17B5 | -8510 | 8611 | 8616 | 8661 | 8668 | | | |
| DSBKBD | 0F02 | 3370 | -5476 | | | | | | |
| DSCCRC | 0036 | -91 | 1286 | 2819 | 3854 | 4156 | 7240 | 7450 | |
| DSCFMT | 0070 | -379 | 2606 | | | | | | |
| DSCRDG | 003T | -86 | 1274 | 2466 | 2471 | 2606 | 2801 | 2812 | 3847 |
| | | 4153 | 4206 | 7071 | 7231 | 7416 | 7434 | | |
| DSCSIZ | 0007 | -321 | 1274 | 2471 | 2473 | 2798 | 2801 | 2812 | 3822 |
| | | 3847 | 4089 | 4123 | 4153 | 4209 | 4556 | 7230 | 7416 |
| | | 7417 | 7417 | 7435 | 7436 | | | | |
| DSPCHR | 0008 | -349 | 1884 | 1891 | 2239 | | | | |
| DSPTMR | 0052 | -141 | 704 | 1515 | 1544 | 1853 | 2254 | | |
| DSPVAL | 0007 | -343 | 1543 | 1852 | 2253 | | | | |
| EJEC | 0000 | -473 | | | | | | | |
| ENABL1 | 05FC | 2321 | -2327 | | | | | | |
| ENABL2 | 0627 | 2355 | -2362 | | | | | | |
| ENABL3 | 0627 | 2342 | -2363 | | | | | | |
| ENABL4 | 0627 | 2337 | -2364 | | | | | | |
| ENABLE | 05F9 | -2323 | 4196 | | | | | | |
| ENAKBD | 0F14 | 3368 | -5500 | | | | | | |
| ENCMDV | 15AB | -7913 | 9218 | 9249 | | | | | |
| ENCT | 15B8 | 7921 | -7925 | | | | | | |
| ENDENT | 0819 | -3062 | 3378 | | | | | | |
| ENDM05 | 15CC | -7971 | 8024 | | | | | | |
| ENDM20 | 15E0 | 7974 | -7987 | | | | | | |
| ENDM25 | 15EB | 7984 | -7995 | | | | | | |
| ENDM30 | 15F9 | 7999 | -8006 | | | | | | |
| ENDM35 | 15FB | 8003 | -8010 | | | | | | |
| ENDM40 | 160F | -8027 | | | | | | | |
| ENDMOV | 15C8 | -7969 | 8898 | 8912 | 8969 | | | | |
| ENTAMT | 082E | -3106 | 3464 | | | | | | |
| ENTCM1 | 0839 | 3110 | -3116 | | | | | | |
| ENTCMB | 0835 | -3112 | 3468 | | | | | | |
| ENTSER | 0848 | -3146 | 3360 | | | | | | |
| EREXIT | 165A | 8195 | -8208 | | | | | | |
| ERRCNT | 0016 | -51 | 3254 | 3831 | | | | | |
| ERRCOD | 0014 | -46 | 3246 | 3829 | | | | | |
| ERRH05 | 18B0 | -8808 | | | | | | | |
| ERRHDR | 18B0 | 8072 | 8417 | 8446 | 8464 | 8479 | 8487 | 8762 | 8785 |
| | | -8807 | 9287 | 9404 | 9436 | 9446 | 9460 | 9466 | |
| ERROR | 7438 | -209 | 7567 | 7591 | 7679 | 7723 | 7741 | 7748 | 7895 |
| | | 7970 | 8043 | 8209 | 8377 | 8396 | 8429 | 8808 | 8823 |
| | | 8900 | 8980 | 9058 | 9080 | 9187 | 9207 | 9225 | 9238 |
| | | 9256 | | | | | | | |
| ERROR2 | 0002 | -9179 | 9236 | | | | | | |
| ERROR3 | 0003 | -9180 | 9224 | | | | | | |
| ERROR4 | 0004 | -9181 | 9255 | | | | | | |
| ERROR5 | 0005 | -7562 | 7740 | | | | | | |
| ERROR6 | 0006 | -7563 | 7747 | | | | | | |
| ERRR1 | 0001 | -9178 | 9206 | | | | | | |
| ERRST | 0013 | -41 | 2604 | | | | | | |

| | | | | | | | | | |
|---|---|---|---|---|---|---|---|---|---|
| ERSET | 180C | 8604 | -8616 | | | | | | |
| EXTERR | 1885 | 8073 | 8763 | 8786 | -8822 | 9288 | | | |
| EXTSER | 0852 | -3166 | 3362 | | | | | | |
| EXTTRP | 0860 | -3190 | 3364 | | | | | | |
| FATE01 | 089E | 3245 | -3260 | | | | | | |
| FATERR | 0880 | 1041 | 1220 | 1242 | 2706 | 2953 | 2988 | 3002 | -3241 |
| | | 3330 | 3603 | 3688 | 4707 | 6205 | | | |
| FATINT | 087E | 502 | 506 | -3237 | | | | | |
| FATRST | 0003 | -413 | 1270 | 7252 | | | | | |
| FILDI1 | 0327 | -1464 | 1468 | | | | | | |
| FILDIM | 0322 | 1145 | -1459 | 1672 | 1842 | 2159 | | | |
| FILN01 | 0F26 | 5258 | -5527 | | | | | | |
| FILN02 | 0F27 | -5531 | 5541 | | | | | | |
| FILN03 | 0F32 | 5533 | -5542 | | | | | | |
| FILNIB | 0F24 | 1140 | 1212 | 1229 | 1278 | 1326 | 3825 | 4234 | -5524 |
| | | 7232 | | | | | | | |
| FINTR1 | 08AA | -3287 | 3291 | | | | | | |
| FINTR2 | 08BC | -3295 | 3306 | | | | | | |
| FINTR3 | 08BF | 3301 | -3309 | | | | | | |
| FINTR4 | 08D0 | 3022 | -3327 | | | | | | |
| FINTRP | 08A0 | 1026 | 2991 | -3276 | | | | | |
| FIXSED | 0000 | -21 | 351 | 1136 | 1136 | | | | |
| GETN01 | 0F3D | -5574 | | | | | | | |
| GETN02 | 0F45 | 5578 | -5584 | | | | | | |
| GETNIB | 0F35 | 1654 | 1806 | 1905 | 2169 | 2174 | 2223 | 2679 | 2689 |
| | | 3122 | 3661 | 3890 | 3899 | 4085 | 4651 | 4667 | 4757 |
| | | 4762 | 4806 | 4858 | 4917 | 4957 | 5288 | 5294 | 5342 |
| | | -5563 | 5816 | 6127 | 6931 | 7087 | 7106 | | |
| GNI10 | 1AF3 | 9499 | -9511 | | | | | | |
| GNIB | 1ADB | 9385 | 9388 | 9410 | 9413 | -9488 | | | |
| HACODE | 0090 | -486 | 7167 | | | | | | |
| HAREG | 0082 | -477 | 2605 | | | | | | |
| HCLRSV | 0047 | -436 | 3361 | | | | | | |
| HCONFG | 00AB | -487 | 2389 | | | | | | |
| HCSUM | 0084 | -479 | 2607 | | | | | | |
| HDIAGS | 003D | -484 | 2604 | | | | | | |
| HDISAB | 0042 | -433 | 1427 | 3357 | 3410 | | | | |
| HDISKB | 0063 | -439 | 3369 | | | | | | |
| HDLOCK | 008A | -481 | 2602 | | | | | | |
| HDREG | 0083 | -478 | 2606 | | | | | | |
| HDR001 | 091C | 3371 | -3393 | | | | | | |
| HDR002 | 091F | 3352 | -3398 | | | | | | |
| HDR003 | 092D | 3402 | -3407 | | | | | | |
| HDR004 | 093F | 3414 | -3420 | | | | | | |
| HDR005 | 093F | 3411 | -3421 | | | | | | |
| HDRONY | 08D5 | -3349 | 3635 | 5063 | | | | | |
| HDRP01 | 0954 | 3447 | -3452 | | | | | | |
| HDRP02 | 0954 | 3445 | -3453 | | | | | | |
| HDRP03 | 0979 | 3471 | -3485 | | | | | | |
| HDRP04 | 097C | 3460 | -3489 | | | | | | |
| HDRPLS | 0941 | -3439 | 3672 | 5051 | | | | | |
| HDSEEK | 163B | 8069 | -8191 | | | | | | |
| HENABL | 0041 | -432 | 2078 | 3355 | | | | | |
| HENAKB | 0062 | -438 | 3367 | | | | | | |
| HENDEN | 0043 | -434 | 1496 | 3377 | | | | | |
| HENIAM | 00C5 | -444 | 2018 | 3444 | 3463 | | | | |
| HENICC | 00C6 | -445 | 2017 | 3446 | 3467 | | | | |
| HEXTRP | 004E | -437 | 3363 | | | | | | |
| HHSLIM | 008E | -485 | 2542 | | | | | | |
| HLOPCS | 008B | -482 | 2526 | | | | | | |
| HMTRNS | 008C | -483 | 2603 | | | | | | |
| HPCNT | 0085 | -480 | 2608 | | | | | | |
| HPHAM1 | 0044 | -8046 | 8199 | | | | | | |
| HPHASE | 0083 | -8047 | 8202 | | | | | | |
| HPSET | 0081 | -476 | 2077 | 2198 | 4511 | | | | |
| HREQAC | 0040 | -453 | 1723 | 3373 | | | | | |
| HREQAR | 0052 | -456 | 2032 | 2553 | 3546 | | | | |
| HREQCF | 005B | -460 | 2582 | | | | | | |
| HREQCS | 0054 | -458 | 2563 | | | | | | |
| HREQDL | 0052 | -467 | 2520 | | | | | | |
| HREQDR | 0053 | -457 | 2028 | 2558 | 3555 | | | | |
| HREQDS | 0055 | -470 | 2536 | | | | | | |

| | | | | | | | | | |
|---|---|---|---|---|---|---|---|---|---|
| HREQLP | 0053 | -468 | 2525 | | | | | | |
| HREQMN | 0054 | -469 | 2530 | | | | | | |
| HREQPC | 0055 | -459 | 2024 | 2577 | 3564 | | | | |
| HREQPO | 0051 | -455 | 1532 | 3381 | 3525 | 3639 | | | |
| HREQSL | 0056 | -471 | 2541 | | | | | | |
| HREQSN | 005D | -461 | 3385 | | | | | | |
| HREQSI | 0050 | -454 | 3365 | | | | | | |
| HSETDA | 00C4 | -443 | 2016 | 2586 | 5044 | | | | |
| HSETMN | 00C0 | -441 | 3473 | | | | | | |
| HSETPO | 00C1 | -442 | 2064 | 3477 | | | | | |
| HSETSV | 0046 | -435 | 1757 | 3359 | | | | | |
| HSTAT | 0080 | -475 | 3991 | | | | | | |
| IDLE | 097E | 1191 | -3503 | 3506 | | | | | |
| IDLE01 | 09A4 | 3523 | -3529 | | | | | | |
| IDLE02 | 09D1 | 3538 | -3572 | | | | | | |
| IDLE03 | 09D1 | 3534 | -3573 | | | | | | |
| IDLE04 | 09E6 | 3580 | -3587 | | | | | | |
| INITSM | 156D | 1134 | -7865 | | | | | | |
| INT75 | 009D | 514 | -673 | | | | | | |
| KDCTRL | 004E | -131 | 598 | 723 | 1487 | 1510 | 1588 | 1621 | 1834 |
| | | 1838 | 2163 | 2210 | 3194 | 3581 | 4018 | 5479 | 5481 |
| | | 5506 | 5508 | | | | | | |
| KDIO | 00A7 | -697 | 1564 | | | | | | |
| KDIO01 | 00B7 | 706 | -708 | | | | | | |
| KDIO02 | 00B7 | 702 | -709 | | | | | | |
| KDIO03 | 00D0 | 721 | -731 | | | | | | |
| KDSKIP | 0002 | -344 | 1565 | | | | | | |
| KEYB01 | 034A | 1489 | 1493 | -1501 | | | | | |
| KEYB02 | 0370 | 1524 | -1530 | | | | | | |
| KEYB03 | 0375 | 1529 | -1536 | | | | | | |
| KEYB04 | 0375 | 1517 | -1537 | | | | | | |
| KEYB05 | 0375 | 1513 | -1538 | | | | | | |
| KEYB06 | 0378 | 1508 | -1540 | | | | | | |
| KEYB07 | 038C | 1547 | -1555 | | | | | | |
| KEYB08 | 038C | 1539 | -1556 | | | | | | |
| KEYB09 | 038C | 1500 | -1557 | | | | | | |
| KEYBKT | 0054 | -146 | 563 | 736 | 851 | 5504 | | | |
| KEYBRD | 032E | -1486 | 3588 | | | | | | |
| KEYINT | 4C96 | -345 | 1566 | | | | | | |
| KILCOD | 02BE | -326 | 1126 | 1168 | 6179 | 6186 | 6912 | | |
| LEDOFF | 154A | -7827 | 7886 | 8070 | 8760 | 8783 | 9285 | | |
| LEDON | 153F | -7815 | 7866 | 8068 | 8755 | 8778 | 9283 | | |
| LOKFMT | 0040 | -380 | 2602 | | | | | | |
| LOWWRN | 001C | -61 | 2526 | 4084 | 4556 | | | | |
| LSNMAS | 000F | -7961 | 7981 | 7987 | | | | | |
| LSNMSK | 000F | -7557 | 7571 | 7639 | 7643 | 7796 | 8215 | 8238 | |
| LSTAT1 | 0F63 | 5622 | -5625 | | | | | | |
| LSTATE | 0F4E | 1030 | 1153 | 1180 | 1315 | 1521 | 1627 | 1679 | 2339 |
| | | 2513 | 2873 | 3072 | 3531 | 3728 | 4529 | 4627 | -5610 |
| | | 6174 | 6422 | 6777 | 7242 | 7316 | 7391 | | |
| MANRST | 09E9 | 3083 | -3600 | | | | | | |
| MAXINT | 7FA1 | -346 | | | | | | | |
| MEMORY | M 0000 | 0 | | | | | | | |
| MESAG1 | 0A17 | 3640 | -3655 | | | | | | |
| MESAG2 | 0A17 | 3638 | -3656 | | | | | | |
| MESAG3 | 0A1A | 3632 | -3658 | | | | | | |
| MESAG4 | 0A2E | 3669 | -3676 | | | | | | |
| MESAG5 | 0A31 | 3675 | -3681 | | | | | | |
| MESAG6 | 0A31 | 3657 | -3682 | | | | | | |
| MESAGE | 09EE | 3576 | -3620 | | | | | | |
| MODD01 | 03AD | 1593 | -1599 | | | | | | |
| MODD02 | 03D8 | 1637 | -1639 | | | | | | |
| MODD03 | 03E3 | 1645 | -1647 | | | | | | |
| MODD04 | 03F5 | 1630 | -1664 | | | | | | |
| MODD05 | 03FC | 1668 | -1671 | | | | | | |
| MODD06 | 03FF | 1663 | -1675 | | | | | | |
| MODD07 | 03FF | 1598 | -1676 | | | | | | |
| MODD08 | 0408 | 1682 | -1684 | | | | | | |
| MODD09 | 040E | -1690 | 1702 | | | | | | |
| MODD10 | 0419 | 1693 | -1699 | | | | | | |
| MODDSP | 03A0 | 1562 | -1586 | | | | | | |
| MODLN | 18BC | 8071 | 8761 | 8784 | -8837 | 9286 | | | |
| MOP01 | 1868 | 8714 | -8723 | | | | | | |

```
MOP02    185C    -8718  8725
MOP05    1851    -8711  8722
MOP10    186D     8717 -8726
MOPEN    184F    -8710  8734  8736
MOVB01   0F8A     5654  5672 -5705
MOVB02   0F9A     5716 -5719
MOVB03   0FAB     5726 -5732
MOVBIT   0F68    -5647  5965  7196
MOVC05   1426    -7585  7717
MOVC1    143D    -7599
MOVC10   145E    -7629
MOVC15   145F     7625 -7630  7681
MOVC20   1473     7634 -7643
MOVC25   147E     7642 -7651
MOVC30   148C     7655 -7660
MOVC35   148E     7659 -7664
MOVC4    1407    -7570
MOVC40   14A8     7678 -7682
MOVC42   14CF     7706 -7711
MOVC45   14BC     7694 -7697
MOVC50   14DB     7587  7590  7593 -7722
MOVC55   14ED     7731 -7734
MOVC6    144D     7610 -7616
MOVC60   14F9     7580  7733 -7740
MOVC65   14FF     7736  7738 -7744
MOVC7    1423     7573  7575  7577  7579 -7583
MOVC70   14D8    -7721
MOVC8    1456     7598  7618 -7620
MOVCLS   1403    -7565  8376  8395  8416  8428  8445  8463  8478
                  8486  8759  8782  9403  9430  9443  9459  9465
MRGTS1   0048     -116  1009  1020  1204  1307  1330  1602  2289
                  2343  2588  2966  3147  3167  3200  3535  3998
                  4102  4169  4286  4491  4640  5617  6502  6794
MRGTS2   004A     -121   354  2862  3243  5614
MSERN1   0A6D     3766 -3794
MSERN0   0A38     3474 -3713  4571
MSG2M1   0AC4     3904 -3907
MSG2M2   0AF2     3966 -3971
MSG2M3   0AF2     3939 -3972
MSG2M4   0AF2     3921 -3973
MSG2M5   0AF2     3912 -3974
MSG2MU   0AAA    -3878  4577  4636
MSNPMT   007F     -381  2603
MSNMAS   00F0    -7960  7977  7991
MSNMSK   00F0    -7558  7625  7647  7793
MTRCH3   0046     -111  1136  1159  2394
MTRSTS   0AF4     3520 -3990  4261
MULKEY   0080     -347   855  5503
MVDD01   00F0     -779   803
MVDD02   00FA      783  -791
MVDBAT   00DE      626   646  -760
MVLN01   0FB4    -5761
MVLNIB   0FBC     1913  3129  3447  3770  3783  4093  4127  4591
                  4716  4779  4853  5001  5079 -5759  7063  7075
                  7437
MVLO05   1899    -8779
MVLOCK   1896     2997 -8778
MVPOST   1A25     1215  1237  4700 -9282
MVRN01   0FC3     5773 -5801  5929
MVRN02   0FC8    -5812  5846
MVRN03   0FDB     5827 -5832
MVRN04   0FDB     5823 -5833
MVRN05   0FE2     5836 -5841
MVRN06   0FE7     5814 -5847
MVRNIB   0FC2     1938  2455  3930 -5799
MVTR05   187F    -8756
MVTRIP   187C     2948 -8755
NARG     0000        0
NBANKS   0004     -342   383  1208  1208  1225  1322  2775  2778
                  2798  2801  4123  4126  4188  4562  4587  4588
                  4635  4674  4674  4677  4712  4715
NDISP    0002     -348   349   773  1461  1462  1649  1687  1688
```

| | | | | | | | | | |
|---|---|---|---|---|---|---|---|---|---|
| | | 2179 | 2243 | | | | | | |
| NINCYC | 0018 | -400 | 2987 | | | | | | |
| NORFLG | 004C | -126 | 1490 | 1558 | 1761 | 2089 | 2285 | 2331 | 3063 |
| | | 3117 | 3399 | 3442 | 3516 | 4320 | 4487 | 4691 | 5092 |
| | | 5127 | 6486 | | | | | | |
| NORSIZ | 0022 | -354 | 6689 | | | | | | |
| NORSTR | 0028 | -352 | 353 | 354 | 6690 | | | | |
| NPAUS1 | 0B1B | -4045 | 4047 | | | | | | |
| NPAUSE | 0B19 | 1367 | 2980 | 3015 | 3288 | 3303 | -4042 | 6041 | 6345 |
| | | 6892 | | | | | | | |
| NUMRD1 | 0014 | -7962 | 8015 | | | | | | |
| NVM30F | 1031 | 1391 | -6029 | 6201 | 6335 | 6671 | 7020 | | |
| NVM30G | 103E | -6040 | 6044 | | | | | | |
| NVMZOT | 1047 | 1361 | -6063 | 6187 | 6330 | 6652 | 6821 | 6850 | 6963 |
| NVMBAD | 0001 | -411 | 1378 | 6378 | 6452 | 6917 | | | |
| NVMBYT | 1058 | -6088 | 6305 | 6461 | 6748 | | | | |
| NVMCH1 | 1077 | 6137 | -6140 | | | | | | |
| NVMCHG | 1068 | 2707 | 3511 | -6124 | | | | | |
| NVMCTL | 0066 | -186 | 2335 | 6126 | 6402 | 6493 | 6574 | 6691 | 6717 |
| | | 6960 | 7016 | | | | | | |
| NVMDE1 | 1099 | 1266 | -6191 | 6922 | | | | | |
| NVMDE2 | 10A0 | 6182 | -6200 | | | | | | |
| NVMDED | 1085 | 1117 | 1381 | 2428 | 2885 | 2931 | 4239 | 4293 | -6176 |
| | | 6312 | 6379 | 6409 | 6455 | 6755 | 6928 | 7253 | |
| NVMDXB | 10A9 | -6222 | 6667 | 6824 | 6852 | | | | |
| NVMER | 10B1 | -6243 | 6648 | 6785 | 6807 | | | | |
| NVMER1 | 10D1 | -6288 | 6302 | | | | | | |
| NVMER2 | 10DF | 6290 | -6303 | | | | | | |
| NVMER3 | 10EB | 6309 | -6315 | | | | | | |
| NVMER4 | 10EB | 6282 | -6316 | | | | | | |
| NVMER5 | 10FE | 6326 | -6329 | | | | | | |
| NVMER6 | 1101 | -6331 | 6375 | | | | | | |
| NVMER7 | 110B | -6344 | 6348 | | | | | | |
| NVMER8 | 111A | 6355 | -6358 | | | | | | |
| NVMERS | 4000 | -329 | 1363 | 6319 | | | | | |
| NVMFN1 | 114E | 6425 | -6434 | | | | | | |
| NVMFN2 | 114E | -6435 | 6465 | | | | | | |
| NVMFND | 112F | -6401 | 6496 | 6510 | 6568 | | | | |
| NVMLOD | 116B | 1151 | -6485 | | | | | | |
| NVMMAP | 1191 | 6226 | 6269 | 6442 | -6537 | 6718 | 6965 | | |
| NVMNB1 | 11B9 | 6579 | 6588 | -6599 | | | | | |
| NVMNBK | 119F | 6250 | -6565 | 6656 | 6815 | 6841 | | | |
| NVMNXT | 11BB | 6097 | 6299 | 6360 | 6369 | -6617 | 6742 | 6994 | 7008 |
| NVMOPN | 11C4 | 1300 | 6156 | -6639 | | | | | |
| NVMPRF | 11DF | 6263 | -6688 | 6713 | 6952 | | | | |
| NVMRD | 11EE | 6500 | 6514 | -6711 | | | | | |
| NVMRD1 | 11FD | -6726 | 6745 | | | | | | |
| NVMRD2 | 120F | 6728 | -6746 | | | | | | |
| NVMRED | 4400 | -328 | 1126 | 1168 | 1336 | 1372 | 1375 | 6179 | 6274 |
| | | 6447 | 6722 | 6884 | 6912 | | | | |
| NVMRET | 0002 | -412 | 6311 | | | | | | |
| NVMST1 | 1221 | 6780 | -6783 | | | | | | |
| NVMST2 | 1232 | 6796 | -6799 | | | | | | |
| NVMSTO | 1219 | 1356 | 3858 | -6776 | | | | | |
| NVMWN | 1261 | 1388 | 6188 | 6231 | -6875 | 6970 | 6989 | 7005 | 7012 |
| NVMWN1 | 1274 | -6891 | 6895 | | | | | | |
| NVMWN2 | 1287 | 6904 | -6908 | | | | | | |
| NVMWN3 | 129A | 6910 | -6931 | | | | | | |
| NVMWN4 | 129A | 6907 | -6932 | | | | | | |
| NVMWR | 129E | 1065 | 1351 | 3810 | 6150 | 6831 | -6950 | | |
| NVMWR1 | 12B9 | -6975 | 6997 | | | | | | |
| NVMWR2 | 12CD | 6977 | -6998 | | | | | | |
| NVMWR3 | 12E6 | 6962 | -7021 | | | | | | |
| NVMWRI | 4800 | -327 | 6880 | | | | | | |
| OLDSWT | 0068 | -191 | | | | | | | |
| PAUTHK | 041F | -1717 | 2002 | | | | | | |
| PCEFMT | 007F | -382 | 2608 | | | | | | |
| PCEREG | 0028 | -81 | 352 | 2608 | 2826 | 3822 | | | |
| PCESIZ | 0007 | -363 | 2823 | 2826 | 3822 | | | | |
| PCLRK | 0447 | -1776 | 1993 | | | | | | |
| PDCMK | 0450 | -1796 | 1996 | | | | | | |
| PDCMK1 | 0461 | 1810 | -1816 | | | | | | |

| | | | | | | | | | |
|---|---|---|---|---|---|---|---|---|---|
| PERDSP | 0464 | -1831 | 3259 | 4289 | | | | | |
| PFLAG0 | 0000 | -7554 | 7583 | | | | | | |
| PH0011 | 18DF | 8871 | -8895 | 9103 | | | | | |
| PH0110 | 18FD | 8863 | -8947 | 9108 | | | | | |
| PH05 | 18F9 | 8902 | -8915 | | | | | | |
| PHASE1 | 0011 | -7559 | 7619 | | | | | | |
| PHASE2 | 0044 | -7560 | 7617 | | | | | | |
| PLH05 | 1983 | 9091 | -9094 | | | | | | |
| PLH10 | 18DB | 8868 | -8871 | | | | | | |
| PLH12 | 18D4 | 8860 | -8867 | | | | | | |
| PLH14 | 18D9 | 8862 | -8870 | | | | | | |
| PLH52 | 1903 | -8955 | | | | | | | |
| PLH57 | 190D | 8953 | -8963 | | | | | | |
| PLH65 | 1912 | 8960 | -8966 | | | | | | |
| PLH66 | 1915 | -8968 | 8977 | | | | | | |
| PLH67 | 1916 | -8969 | | | | | | | |
| PLH68 | 1919 | -8970 | | | | | | | |
| PLH70 | 191E | -8975 | | | | | | | |
| PLH83 | 1923 | -8979 | | | | | | | |
| PLHOME | 18C5 | -8859 | | | | | | | |
| PNUMK | 048A | -1868 | 1988 | | | | | | |
| PNUMK1 | 04A5 | 1895 | -1899 | | | | | | |
| POHOME | 18C5 | 8388 | 8408 | 8439 | -8858 | | | | |
| PORT2A | 6800 | -330 | 7570 | 7609 | 7868 | 7877 | 8214 | 8699 | 9090 |
| | | 9192 | 9197 | | | | | | |
| PORTA | 7001 | -331 | 612 | 840 | 1062 | 1092 | 1186 | 2959 | 3042 |
| | | 3278 | 4452 | 5455 | 6033 | 6035 | 6066 | 6068 | 7816 |
| | | 7818 | 7828 | 7830 | | | | | |
| PORTB | 7002 | -332 | 712 | 908 | 963 | 1060 | 7638 | 7646 | 7651 |
| | | 7791 | 7800 | 7803 | 7875 | 7980 | 7990 | 7995 | 8200 |
| | | 8203 | 8309 | 8337 | 8339 | 8511 | 8720 | 8838 | 8840 |
| | | 9026 | | | | | | | |
| PORTBI | 006E | -206 | 209 | 210 | 211 | 711 | 907 | 964 | |
| PORTC | 7003 | -333 | 847 | 4459 | | | | | |
| POSFMT | 0040 | -383 | 4511 | | | | | | |
| POSREG | 0042 | -106 | 1225 | 1322 | 2778 | 2801 | 4123 | 4185 | 4511 |
| | | 4712 | | | | | | | |
| POSREQ | 7466 | -9376 | 9387 | 9412 | 9469 | | | | |
| POSUP1 | 0B85 | 4111 | 4138 | -4205 | | | | | |
| POSUP2 | 0B92 | 4147 | 4157 | -4226 | | | | | |
| POSUPD | 0B23 | 3510 | -4074 | | | | | | |
| POSVAL | 7421 | -9377 | 9384 | 9409 | 9470 | | | | |
| PREE | 7421 | -9374 | 9377 | | | | | | |
| PROERR | 0BA1 | 494 | 496 | 498 | 500 | 504 | 508 | 512 | 1736 |
| | | 1745 | 2547 | 2587 | 3068 | 3192 | 3482 | 3678 | 3715 |
| | | -4260 | 4494 | 4533 | 4542 | 4551 | 4562 | 4625 | 4753 |
| | | 5008 | 7054 | 7287 | 7311 | 7321 | 7371 | 7396 | 7405 |
| | | 7429 | | | | | | | |
| PROKE1 | 04DB | -1974 | 1978 | | | | | | |
| PROKE2 | 04E3 | 1976 | -1979 | | | | | | |
| PROKE3 | 0502 | 1982 | -2012 | | | | | | |
| PROKEY | 04CE | 1554 | -1961 | | | | | | |
| PSETK | 0516 | 1999 | -2048 | | | | | | |
| PSETK1 | 052F | 2052 | -2075 | | | | | | |
| PSETK2 | 0536 | 2054 | -2087 | | | | | | |
| PTNC10 | 1968 | 9027 | -9072 | | | | | | |
| PTNC15 | 1970 | -9037 | 9075 | | | | | | |
| PTNC20 | 1971 | 9032 | 9043 | -9078 | | | | | |
| PTNC25 | 1972 | 9053 | 9060 | -9079 | | | | | |
| PTNC30 | 195A | 9045 | -9063 | | | | | | |
| PTNC40 | 1955 | 9051 | -9057 | 9065 | 9067 | | | | |
| PTNCHK | 192A | 8362 | 8365 | 8600 | 8658 | 8915 | 8971 | -9024 | |
| PTR | 0010 | -18 | 21 | -23 | 23 | 26 | -28 | 28 | 31 |
| | | -33 | 33 | 36 | -38 | 38 | 41 | -43 | 43 |
| | | 46 | -48 | 48 | 51 | -53 | 53 | 56 | -58 |
| | | 58 | 61 | -63 | 63 | 66 | -68 | 68 | 71 |
| | | -73 | 73 | 76 | -78 | 78 | 81 | -83 | 83 |
| | | 86 | -88 | 88 | 91 | -93 | 93 | 96 | -98 |
| | | 98 | 101 | -103 | 103 | 106 | -108 | 108 | 111 |
| | | -113 | 113 | 116 | -118 | 118 | 121 | -123 | 123 |
| | | 126 | -128 | 128 | 131 | -133 | 133 | 136 | -138 |
| | | 138 | 141 | -143 | 143 | 146 | -148 | 148 | 151 |

| | | | | | | | | |
|---|---|---|---|---|---|---|---|---|
| | | -153 | 153 | 156 | -158 | 158 | 161 | -163 | 163 |
| | | 166 | -168 | 168 | 171 | -173 | 173 | 176 | -178 |
| | | 178 | 181 | -183 | 183 | 186 | -188 | 188 | 191 |
| | | -193 | 193 | 196 | -198 | 198 | 201 | -203 | 203 |
| | | 206 | -208 | 208 | 214 | -216 | 216 | 216 | 219 |
| | | -221 | 221 | 224 | -226 | 226 | 229 | -231 | 231 |
| | | 234 | -236 | 236 | 239 | -241 | 241 | 241 | 244 |
| | | -246 | 246 | 249 | -251 | 251 | 254 | -256 | 256 |
| | | 259 | -261 | 261 | -262 | 265 | -267 | 267 | |
| PUTN01 | 1007 | 5886 | -5896 | | | | | | |
| PUTNIB | 0FEE | 1813 | 1928 | 2650 | 2753 | 4670 | 4815 | 4821 | 4987 |
| | | 4992 | 5535 | 5819 | -5868 | 6733 | 7096 | 7112 | 7328 |
| PWRAB1 | 01A7 | 1014 | -1025 | | | | | | |

What is claimed is:

1. An electronically controlled mailing machine comprising: a housing having a slot into which an envelope may be inserted, a platen movably mounted within the housing, a print head movably mounted within the housing and overhanging said platen, a single revolution clutch coupled to said platen and to said print head for movement of said platen and said print head toward each other for urging an envelope inserted into the slot into imprinting engagement with said print head, a motor coupled to said clutch for actuation thereof, computer means for controlling said motor to actuate said clutch, said computer means including a microprocessor and a system bus, said computer means including a ROM connected to said microprocessor through said system bus, said ROM including a program stored therein for controlling said microprocessor, switch means including a member movably mounted within said housing and extending into said slot for movement by an envelope inserted thereinto, said switch means including optical sensing means mounted within the housing, said optical sensing means including an LED and a photosensor spaced apart from each other to permit movement of said member therebetween, said optical sensing means electrically connected to said computer means, said computer means including strobe means electrically connected to said microprocessor and to said optical sensing means, said microprocessor causing said strobe means under the control of said program to intermittently energize said LED whereby said photosensor is normally caused to intermittently signal said microprocessor said photosensor responsive to movement of said member between said LED and said photosensor for interrupting said intermittent signal, and said microprocessor operating under the control of said program for responding to the interruption of said signal for causing said motor to actuate said clutch, whereby when an envelope is inserted into said slot said print head and said platen move toward each other for urging an inserted envelope into printing engagement with said print head.

2. The mailing machine according to claim 1, wherein said switch means includes a spring connected to said housing and to said member for urging said member into a first position wherein said member extends into said slot for movement by an envelope, said member having a second position wherein said member is sensed by said photosensor and said member adapted for movement from said first position to said second position against the urging of said spring by an envelope inserted into said slot.

3. The mailing machine according to claim 2, wherein said computer means includes an integrated circuit, the microprocessor and integrated circuit electrically connected to each other through the system bus, said platen moving means including said motor electrically connected to said integrated circuit, said platen and said print head moving when said motor is energized, and said optical sensing means electrically connected to said integrated circuit and responsive to the positioning of said member in said second position for causing said microprocessor to energize said motor for moving said platen and said print head.

4. The mailing machine according to claim 1, wherein said member is a lever pivotably attached to said base, said lever having a first portion adapted to protrude into said slot for engagement by an envelope inserted thereinto, and said lever having a second portion adapted for sensing by said optical sensing means.

5. The mailing machine according to claim 2, wherein said spring is a torsion spring having one end secured to said base and the other end secured to said member.

6. The mailing machine according to claim 1, wherein said optical sensing means includes a two legged structure, said LED included in one of the legs and said photosensor in the other of the legs, and said optical sensing means responsive to the insertion of the member between said legs for preventing light from the LED from impinging on the photosensor, whereby said photosensor responds to the interruption of said intermittent signal to said LED by signalling said microprocessor that an envelope has been inserted for imprintation.

* * * * *